US007815552B2

(12) United States Patent
Dibble et al.

(10) Patent No.: US 7,815,552 B2
(45) Date of Patent: Oct. 19, 2010

(54) EXERCISE DEVICE

(75) Inventors: Ryan R. Dibble, Denver, CO (US); Patrick A. Warner, Boulder, CO (US); Eric D. Golesh, Arvada, CO (US); Brent Christopher, Denver, CO (US)

(73) Assignee: Nautilus, Inc., Vancouver, WA (US)

( * ) Notice: Subject to any disclaimer, the term of this patent is extended or adjusted under 35 U.S.C. 154(b) by 1303 days.

(21) Appl. No.: 11/249,119

(22) Filed: Oct. 11, 2005

(65) Prior Publication Data

US 2006/0100069 A1 May 11, 2006

Related U.S. Application Data

(60) Provisional application No. 60/618,131, filed on Oct. 12, 2004, provisional application No. 60/644,110, filed on Jan. 14, 2005, provisional application No. 60/662,808, filed on Mar. 15, 2005.

(51) Int. Cl.
*A63B 21/00* (2006.01)
*A63B 21/045* (2006.01)

(52) U.S. Cl. ..... 482/92; 482/103; 482/127; 482/129; 482/138

(58) Field of Classification Search ..... 482/92, 482/103, 121, 129, 130, 138, 908, 127; 403/322.3, 403/55, 99, 103; 248/124.1, 124.2, 276.1, 248/288.31, 288.51, 921
See application file for complete search history.

(56) References Cited

U.S. PATENT DOCUMENTS 1,205,426 A 11/1916 Barnhill
2,632,645 A 3/1953 Barkschat
3,394,934 A 7/1968 Elia et al.
3,596,907 A 8/1971 Brighton et al.

(Continued)

FOREIGN PATENT DOCUMENTS

EP 0 862 931 A2 9/1998

(Continued)

OTHER PUBLICATIONS

Taiwan Official Letter (Preliminary Examination Report) and Search Report and English translation thereof for corresponding Taiwan Patent Application No. 094135468 dated May 1, 2008 (6 pages).

(Continued)

*Primary Examiner*—Loan Thanh
*Assistant Examiner*—Victor K Hwang
(74) *Attorney, Agent, or Firm*—Dorsey & Whitney LLP

(57) ABSTRACT

Aspects of the present invention involve an exercise device configurable to allow a user to perform various exercises. The exercise devices include an adjustable bench assembly connected with a frame supporting adjustable arm and cable-pulley assemblies providing a user interface with a resistance system. In some embodiments of the invention, the adjustable bench assembly includes a bench seat and a pivotal back support supported on an adjustable bench frame. The exercise devices also utilize various configurations of adjustable arm assemblies that are selectively positionable for numerous exercises and to suit a user's particular body size and shape. Other embodiments of the exercise devices include a resistance system with a transmission supporting a plurality of resistance packs. The transmission allows a user to conveniently engage any number of resistance packs to change the resistance level for a particular exercise.

34 Claims, 124 Drawing Sheets

U.S. PATENT DOCUMENTS

| | | | | |
|---|---|---|---|---|
| 4,369,966 | A | 1/1983 | Silberman et al. | |
| 4,382,596 | A | 5/1983 | Silberman | |
| 4,415,063 | A * | 11/1983 | Hutchison | 482/75 |
| 4,478,411 | A | 10/1984 | Baldwin | |
| 4,511,137 | A | 4/1985 | Jones | |
| 4,556,216 | A * | 12/1985 | Pitkanen | 482/131 |
| 4,603,855 | A | 8/1986 | Sebelle | |
| 4,634,127 | A | 1/1987 | Rockwell | |
| 4,643,420 | A | 2/1987 | Riley et al. | |
| 4,666,149 | A | 5/1987 | Olschansky et al. | |
| 4,709,918 | A * | 12/1987 | Grinblat | 482/70 |
| 4,898,381 | A * | 2/1990 | Gordon | 482/103 |
| 4,902,007 | A | 2/1990 | Ferrari | |
| 4,944,511 | A | 7/1990 | Francis | |
| 5,039,089 | A | 8/1991 | Lapcevic | |
| 5,039,092 | A | 8/1991 | Olschansky et al. | |
| 5,056,779 | A | 10/1991 | Webb | |
| 5,074,551 | A | 12/1991 | Olschansky et al. | |
| 5,106,081 | A | 4/1992 | Webb | |
| 5,145,479 | A | 9/1992 | Olschansky et al. | |
| D335,511 | S | 5/1993 | Engel et al. | |
| 5,209,461 | A | 5/1993 | Whightsil, Sr. | |
| 5,226,867 | A | 7/1993 | Beal | |
| 5,269,512 | A | 12/1993 | Crowson et al. | |
| 5,348,524 | A | 9/1994 | Grant | |
| 5,356,360 | A | 10/1994 | Johns | |
| 5,382,212 | A | 1/1995 | Davenport et al. | |
| 5,456,644 | A | 10/1995 | Hecox et al. | |
| 5,505,681 | A | 4/1996 | Bruggemann | |
| 5,518,479 | A | 5/1996 | Young et al. | |
| 5,586,962 | A | 12/1996 | Hallmark | |
| 5,588,938 | A * | 12/1996 | Schneider et al. | 482/4 |
| 5,597,147 | A * | 1/1997 | Hashi | 248/280.11 |
| 5,733,231 | A | 3/1998 | Corn et al. | |
| 6,045,491 | A | 4/2000 | McNergney et al. | |
| 6,126,580 | A | 10/2000 | Francis et al. | |
| 6,186,961 | B1 * | 2/2001 | Hanoun | 482/6 |
| 6,217,493 | B1 | 4/2001 | Spletzer | |
| 6,238,323 | B1 | 5/2001 | Simonson | |
| 6,319,178 | B1 | 11/2001 | Webber | |
| D455,803 | S | 4/2002 | Webber | |
| 6,371,896 | B1 | 4/2002 | Kettler | |
| 6,440,044 | B1 | 8/2002 | Francis et al. | |
| 6,443,877 | B1 * | 9/2002 | Hoecht et al. | 482/103 |
| 6,447,430 | B1 | 9/2002 | Webb et al. | |
| 6,471,624 | B1 | 10/2002 | Voris | |
| 6,488,612 | B2 | 12/2002 | Sechrest et al. | |
| 6,491,610 | B1 | 12/2002 | Henn | |
| 6,561,960 | B2 | 5/2003 | Webber | |
| 6,579,213 | B1 | 6/2003 | Webber et al. | |
| 6,595,905 | B2 | 7/2003 | McBride | |
| 6,652,426 | B2 | 11/2003 | Carter et al. | |
| 6,685,601 | B1 | 2/2004 | Knapp | |
| 6,685,602 | B2 | 2/2004 | Colosky et al. | |
| 6,685,607 | B1 | 2/2004 | Olson | |
| 6,705,976 | B1 * | 3/2004 | Piane, Jr. | 482/103 |
| 6,770,015 | B2 | 8/2004 | Simonson | |
| 6,793,610 | B2 | 9/2004 | Deola | |
| 6,929,589 | B1 | 8/2005 | Bruggemann et al. | |
| D521,087 | S | 5/2006 | Francis | |
| 7,083,554 | B1 | 8/2006 | Lo Presti | |
| 7,090,623 | B2 * | 8/2006 | Stewart et al. | 482/100 |
| 7,189,190 | B2 | 3/2007 | Lamar et al. | |
| 7,229,391 | B2 | 6/2007 | Francis | |
| 7,235,039 | B2 * | 6/2007 | Anders | 482/51 |
| 7,250,022 | B2 | 7/2007 | Dalebout et al. | |
| 7,255,665 | B2 * | 8/2007 | Ish, III | 482/102 |
| 2002/0077230 | A1 | 6/2002 | Lull et al. | |
| 2003/0017918 | A1 * | 1/2003 | Webb et al. | 482/94 |
| 2003/0092540 | A1 | 5/2003 | Gillen | |
| 2003/0100413 | A1 * | 5/2003 | Huang | 482/100 |
| 2003/0232707 | A1 | 12/2003 | Dalebout et al. | |
| 2004/0009856 | A1 | 1/2004 | Hammer | |
| 2005/0049121 | A1 | 3/2005 | Dalebout et al. | |
| 2005/0143228 | A1 | 6/2005 | Lee | |
| 2005/0143230 | A1 | 6/2005 | Dalebout et al. | |
| 2006/0063650 | A1 | 3/2006 | Francis | |
| 2006/0116249 | A1 | 6/2006 | Dibble et al. | |
| 2007/0135277 | A1 * | 6/2007 | Alessandri et al. | 482/121 |
| 2007/0184944 | A1 * | 8/2007 | Huang | 482/94 |
| 2009/0036277 | A1 * | 2/2009 | Ish et al. | 482/94 |

FOREIGN PATENT DOCUMENTS

| | | | |
|---|---|---|---|
| SU | 1743620 | | 6/1992 |
| TW | 510233 | Y | 11/2002 |
| TW | 518970 | Y | 1/2003 |
| TW | 535599 | Y | 6/2003 |
| TW | 557221 | B | 10/2003 |

OTHER PUBLICATIONS

"Bowflex Fitness", Bowflex, Inc., catalog, 8 pages (1998).
"Cross Bow by Weider," manual, ICON Health & Fitness, Inc., 22 pages (undated).
"Cross Bow by Weider How Does the Crossbow Stack up Against the Competition", ICON Health and Fitness located at http://www.iconfitness.com/crossbow/cb_vs_bf.html, 2 pages (retrieved Oct. 22, 2002).
"Nautilus Home Health & Fitness Catalog," Nautilus, Inc., pp. 1-56 (2004).
Schwinn Iron Classic Strength Training System by Bowflex® Owner's Manual, 55 pages (1993).
Non-Final Office Action and PTO-892, U.S. Appl. No. 09/502,339, Oct. 2, 2001, 7 pages.
Amendment, U.S. Appl. No. 09/502,339, Jan. 2, 2002, 17 pages.
Notice of Allowance and Fee(s) Due and Notice of Allowability, U.S. Appl. No. 09/502,339, Apr. 19, 2002, 2 pages.
Non-Final Office Action and PTO-892, U.S. Appl. No. 10/161,766, Mar. 31, 2005, 10 pages.
Amendment and Response to Official Action Dated Mar. 31, 2005 and replacement drawing sheets 1/10 and 10/10, U.S. Appl. No. 10/161,766, Sep. 29, 2005, 14 pages.
Final Office Action, U.S. Appl. No. 10/161,766, Dec. 28, 2005, 8 pages.
Non-Final Office Action, U.S. Appl. No. 11/262,260, Dec. 26, 2008, 6 pages.
Amendment and Response to Restriction Requirement, U.S. Appl. No. 11/262,260, Jan. 26, 2009, 6 pages.
Non-Final Office Action, U.S. Appl. No. 11/262,260, Apr. 27, 2009, 7 pages.
Amendment and Response to Restriction Requirement, U.S. Appl. No. 11/262,260, May 27, 2009, 5 pages.
Non-Final Office Action and PTO-892, U.S. Appl. No. 11/262,260, Jun. 11, 2009, 9 pages.

* cited by examiner

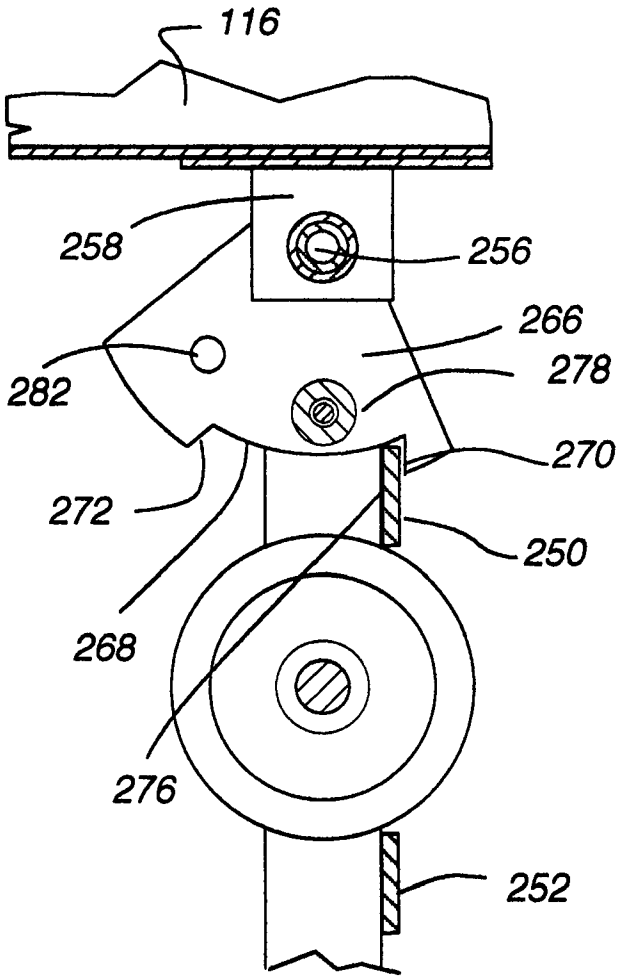
Fig. 5AA1
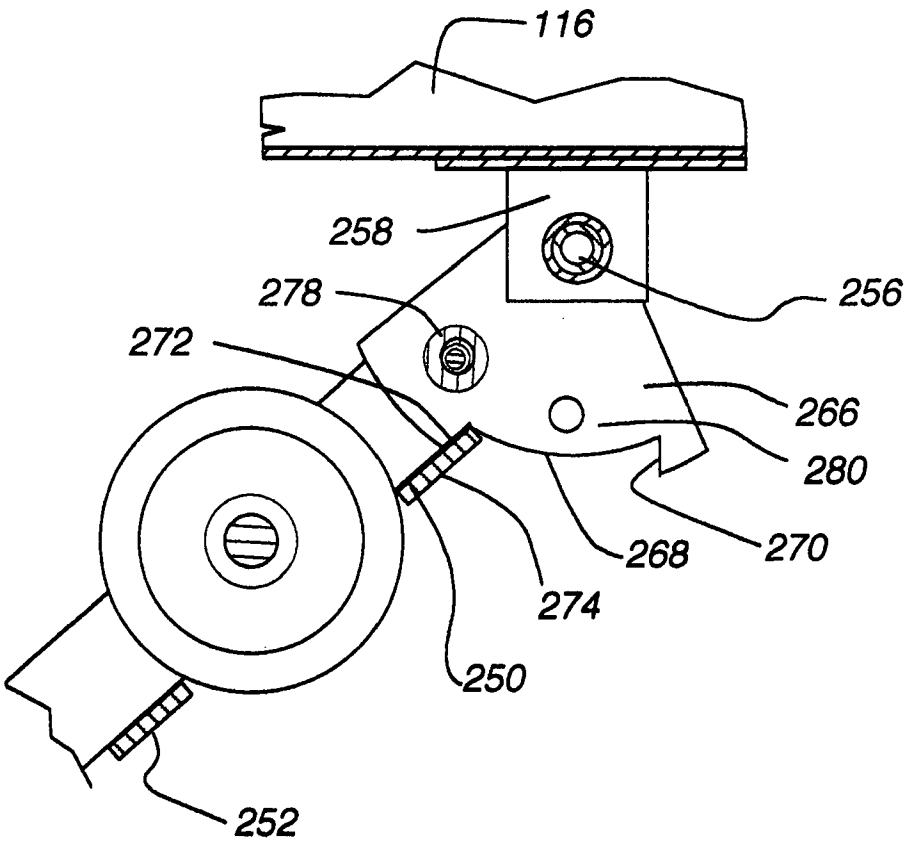
Fig. 5AA2

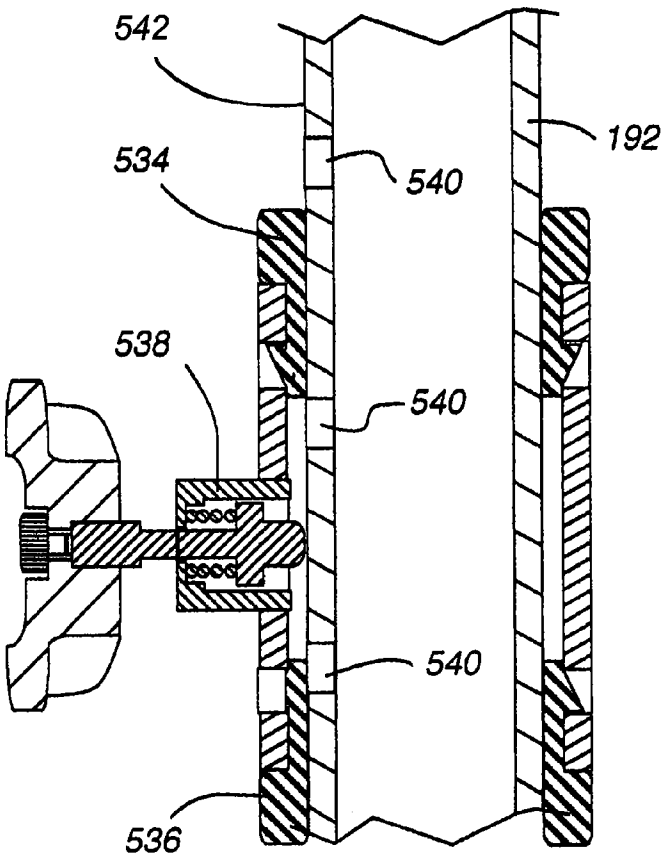
Fig. 10A2
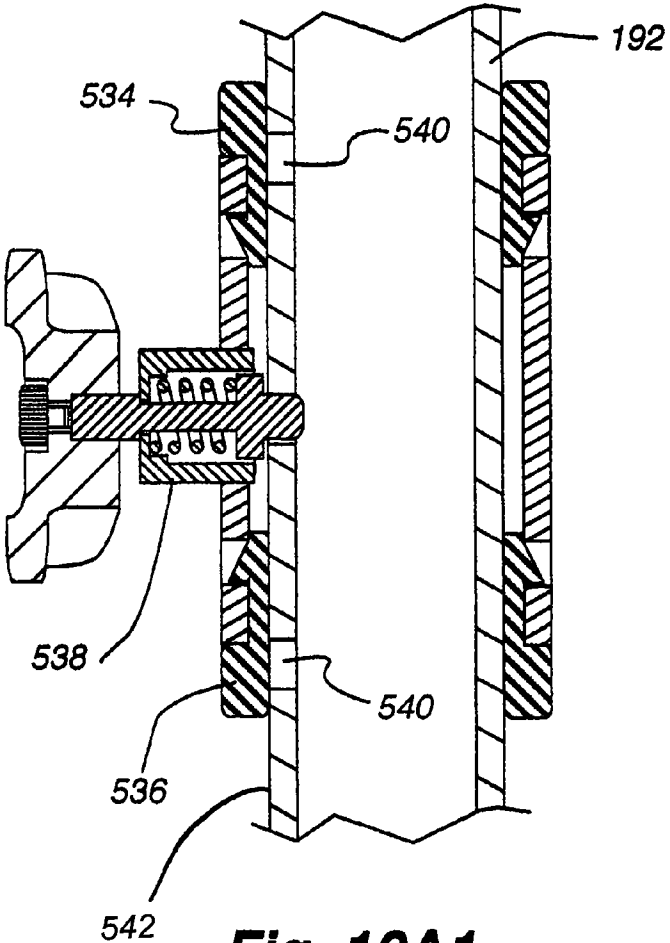
Fig. 10A1

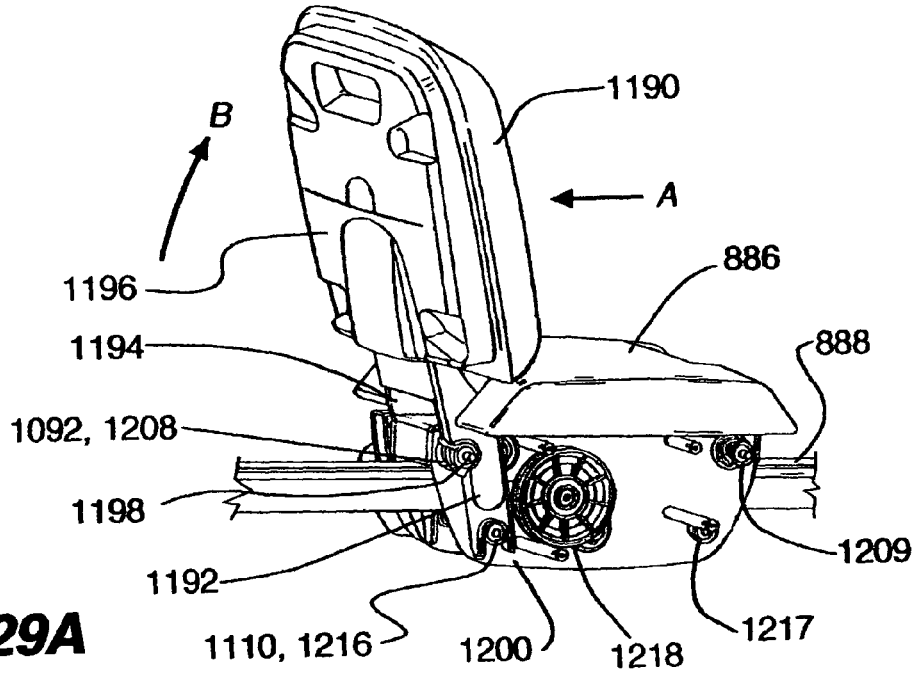
Fig. 29A
Fig. 29B
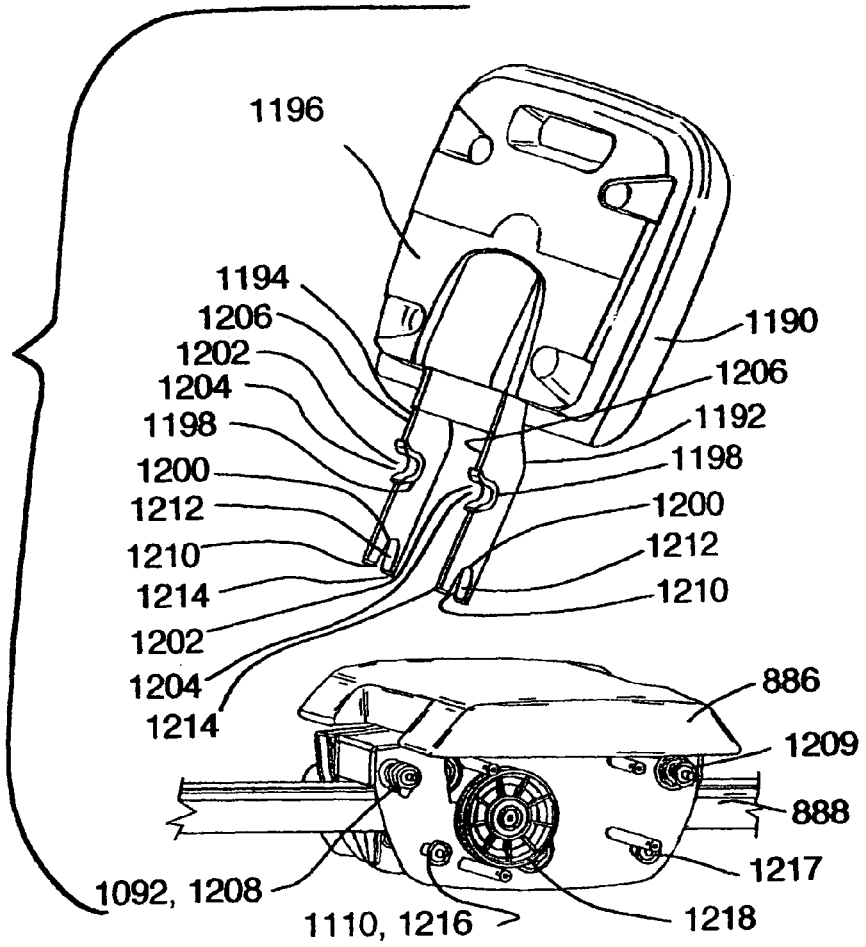

EXERCISE DEVICE

CROSS-REFERENCE TO RELATED APPLICATIONS

This application claims the benefit of U.S. Provisional Application No. 60/618,131, filed Oct. 12, 2004; U.S. Provisional Application No. 60/644,110, filed Jan. 14, 2005; and U.S. Provisional Application No. 60/662,808, filed on Mar. 15, 2005, all of which are hereby incorporated by reference herein.

U.S. patent application Ser. No. 29/225,514, titled "Exercise Device," filed on Mar. 15, 2005; U.S. Pat. No. 4,944,511, titled "Adjustable Resilient Reel Exerciser," filed on Jan. 23, 1989; U.S. Pat. No. 5,209,461, titled "Elastomeric Torsional Spring Having Tangential Spokes With Varying Elastic Response," filed on Jun. 12, 1992; U.S. Pat. No. 6,126,580, titled "Resistance Exercise Machine With Series Connected Resistance Packs," filed on Aug. 7, 1998; and U.S. Pat. No. 6,440,044, titled "Resistance Mechanism With Series Connected Resistance Packs," filed on Aug. 1, 2000, are all hereby incorporated by reference herein.

BACKGROUND OF THE INVENTION a. Field of the Invention

Aspects of this invention relate to exercise devices, some more particular aspects involve exercise devices utilizing an adjustable bench, a user interface with adjustable arms including a multi-axis release locking mechanism, a resistance system employing one or more non-linear force curves, a resistance system transmission, and a cable-pulley assembly.

b. Background Art

A variety of exercise devices provide a user with the ability to perform various different exercises in different positions. Some of these exercise devices include a bench and a resistance system connected with a frame. With some exercise devices, the user exercises by applying force to the resistance system through a cable and pulley system. The bench and resistance system may be adjustable to permit the user to sit in different positions and allow the user to select different levels of resistance. Portions of the frame as well as the cable and pulley system may also be adjustable to allow the user to adjust the exercise device to better conform with the user's size.

However, on some of these exercise devices, the range of positions for the frame, bench, and cable and pulley system may be limited. Thus, these exercise devices confine the range of positions available for performing various exercises. In addition, many of the exercise devices may require the user to perform numerous steps in order to reposition the adjustable components. Further, these exercise devices only provide the user with the ability to change the level of resistance and do not allow a user to vary the force curve.

BRIEF SUMMARY OF THE INVENTION

Aspects of the present invention involve an exercise device configurable to allow a user to perform various exercises. The exercise devices described and depicted herein include an adjustable bench assembly connected with a frame supporting adjustable arm and cable-pulley assemblies providing a user interface with a resistance system. The exercise devices can include various types of resistance systems and/or resistance packs. Some embodiments of the exercise devices also include a resistance system with a transmission supporting a plurality of resistance packs. The transmission allows a user to conveniently engage any number of resistance packs to change the resistance level for a particular exercise. In addition to being able to select the level of resistance, some embodiments of the exercise devices allow a user to select from a plurality of force curves. The exercise devices can also utilize various configurations of adjustable arm assemblies that are selectively positionable for numerous exercises and to suit a user's particular body size and shape. One embodiment includes a releasable locking mechanism that allows the user to simultaneously maneuver an adjustable arm assembly in more than one range of motion.

In one aspect of the present invention, an exercise device includes: a frame; an arm bi-directionally coupled with the frame through a first axle and a second axle; a first securing mechanism adapted to secure the arm in a first position relative to the first axle; a second securing mechanism adapted to secure the arm in a second position relative to the second axle; and a release mechanism operably coupled with the first and second securing mechanisms and adapted to simultaneously activate the securing mechanisms to move the arm about the first and second axles.

In another form of the present invention, an exercise device includes: a frame; a resistance system supported on the frame; a first arm assembly operably coupled with the resistance system and rotatably supported by the frame, the first arm selectively positionable about a first axis of rotation; and a second arm assembly operably coupled with the resistance system and rotatably supported by the frame, the second arm selectively positionable about a second axis of rotation.

In yet another form of the present invention, an exercise device includes: a frame; a resistance system supported by the frame; an actuation device operably coupled with the resistance system; a first cam operably coupled with the resistance system; a second cam operably coupled with the resistance system; and a selector mechanism operably coupled with the first and second cams, the selector mechanism configured to operably couple the first and second cams with the actuation device to change the resistance forces from the resistance system exerted on the actuation device as the actuation device is displaced.

In still another form of the present invention, an exercise device includes: a frame; a resistance structure including a plurality of resistance packs; and a selector mechanism including a plate supporting a plurality of pins, the pins operable to selectively connect at least one of the plurality of resistance packs with the selector mechanism.

In still another form of the present invention, an exercise device includes: a resistance system; an actuation device; a first pulley rotatably; a first cable operably coupling the actuation device with the first pulley; a second pulley; a second cable operably coupling the resistance system with the second pulley; and a locking member connected with the second pulley and operable to selectively connect the second pulley with the first pulley for simultaneous rotation of the first and second pulleys and to selectively disconnect the second pulley from the first pulley for independent rotation of the first and second pulleys.

In still another form of the present invention, an exercise device includes: a frame; a rail extending from the frame; a seat movably supported on the rail; at least one pulley rotatably connected with the seat; a resistance system supported on the frame; at least one cable defining a first end portion adapted to connect with the frame and a second end portion operably coupled with the resistance system; wherein the at least one cable extends from the first end portion, around the at least one pulley, and to the second end portion.

In still another form of the present invention, an exercise device includes: a frame; a rail extending from the frame; and a seat movably connected with the rail such that the seat can move along the length of the rail and pivot relative to the rail.

In still another form of the present invention, an exercise device includes: a frame; a rail defining a first end portion and a second end portion, the first end portion pivotally connected with the frame; a seat supported by the rail; a support assembly pivotally connected with the second end portion of the rail and adapted to support the second end portion of the rail at least at a first height and a second height relative to a support surface.

In still another form of the present invention, an exercise device includes: a frame; a first rail defining a first end portion and a second end portion, the first end portion pivotally connected with the frame; a seat supported by the first rail; a second rail defining a first end portion and a second end portion, the first end portion of the second rail pivotally connected with the frame below the first end portion of the first rail; a support assembly pivotally connected with the second end portion of the first rail and pivotally connected with second end portion of the second rail, the support assembly adapted to support the first end portion of the first rail above a support surface; and wherein when the first rail is pivoted upward from a first position to a second position toward the frame, the relative motion between the second end portion of the second rail and the second end portion of the first rail causes the support assembly to pivot toward the second rail.

In still another form of the present invention, an exercise device includes: a frame; a leg exercise assembly pivotally coupled with the frame through an axle; the leg exercise assembly including: a resistance arm pivotally connected with the axle, the resistance arm including an arm portion extending from an arcuate pivot portion, the pivot portion including a plurality of apertures; a first member pivotally connected with the axle adjacent a first side of the resistance arm; a second member pivotally connected with the axle adjacent a second side of the resistance arm; a pop-pin supported between the first member and the second member and adapted to selectively engage at least one of the plurality of apertures to connected the first and second members with the resistance arm; and a housing slidingly connected with the first member and second member and adapted to selectively disengage the pop-pin from the at least one of the plurality of apertures to disconnect the first and second members from the resistance arm.

In still another form of the present invention, an exercise device includes: a frame including at least one upright member; at least one hook connected with the at least one upright member; and a selectively removable foot plate assembly having a main body defining a channel adapted to receive a portion of the at least one upright member and including a handle bar adapted to support the foot plate assembly from the at least one hook.

In still another form of the present invention, an exercise device includes: a frame; a rail extending from the frame; a seat movably supported on the rail, the seat including a plurality of studs; and a removable seat back adapted to connect with the seat, the removable seat back including two rails each having at least two hooks adapted to connect with the plurality of studs on the seat.

In still another form of the present invention, an exercise device includes: a frame; a resistance structure including an axle supported on the frame; a transmission assembly coupled with the resistance structure; and a plurality of resistance packs adapted to receive the axle, each one of the plurality of resistance packs including a housing adapted to connect with the transmission assembly and another one of the plurality of resistance packs.

The features, utilities, and advantages of various embodiments of the invention will be apparent from the following more particular description of embodiments of the invention as illustrated in the accompanying drawings and defined in the appended claims.

BRIEF DESCRIPTION OF THE DRAWINGS

FIG. 5AA1 is a cross-sectional view of the forward bench support depicted in FIG. 5A, taken along line 5AA-5AA showing the forward bench support in an upright position.

FIG. 5AA2 is a cross-sectional view of the forward bench support depicted in FIG. 5A, taken along line 5AA-5AA showing the forward bench support in a rear pivot position.

FIG. 5BB is a cross-sectional view of the seat rail and wheel car assembly depicted in FIG. 5B, taken along line 5BB-5BB.

FIG. 5EE is a cross-sectional view of the leg developer assembly depicted in FIG. 5E, taken along line 5EE-5EE.

FIG. 10A1 is a cross-sectional view of the right arm assembly depicted in FIG. 10, taken along line 10A-10A showing a slider pop-pin engaged with an upright member.

FIG. 10A2 is a cross-sectional view of the bench assembly depicted in FIG. 10, taken along line 10A-10A showing the slider pop-pin disengaged from the upright member.

FIG. 29G is a detailed view of a cable adjustment mechanism.

FIG. 30A is an exploded view of a leg developer assembly.

FIG. 30B is a detailed exploded view of a leg developer pop-pin.

FIG. 30C is a cross sectional view of the leg developer pop-pin engaged with the resistance member.

FIG. 30D is a cross sectional view of the leg developer pop-pin disengaged from the resistance member.

FIG. 30E is a left side view of the leg developer assembly configured for leg extension exercises.

FIG. 30F is a left side view of the leg developer assembly configured for leg curl exercises.

FIG. 31A is a detailed view of right and left arm assemblies.

FIG. 31B is a detailed view of pop-pin connections for right and left arm assemblies.

FIG. 31C is a detailed view of gas springs connected with the right and left arm assemblies.

FIG. 31D is a right side view of an upper end portion of an arm support member.

FIG. 31E is a front detailed view of the upper end portion of the arm support member.

Figure 31A:
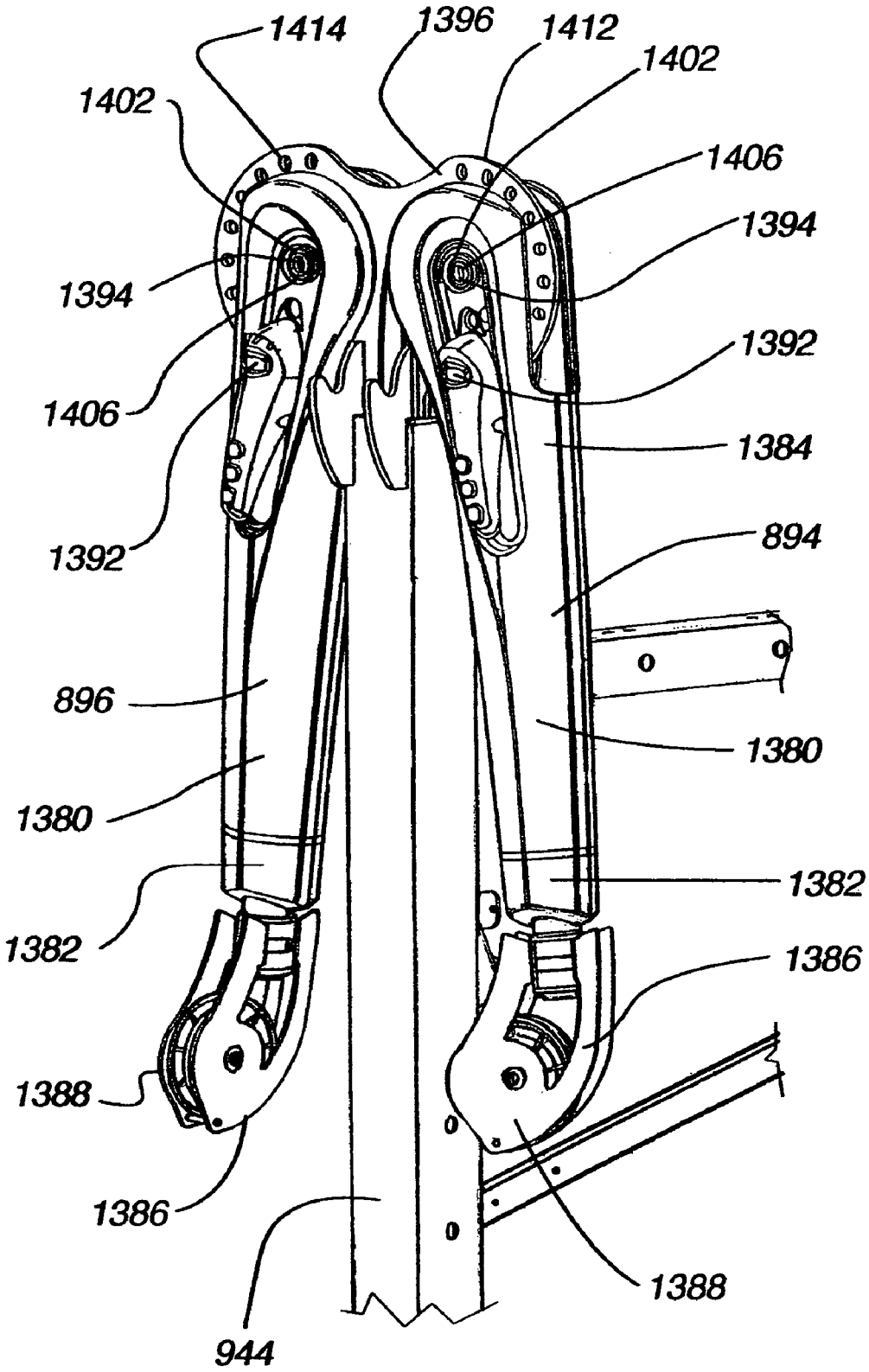
Figure 31B:
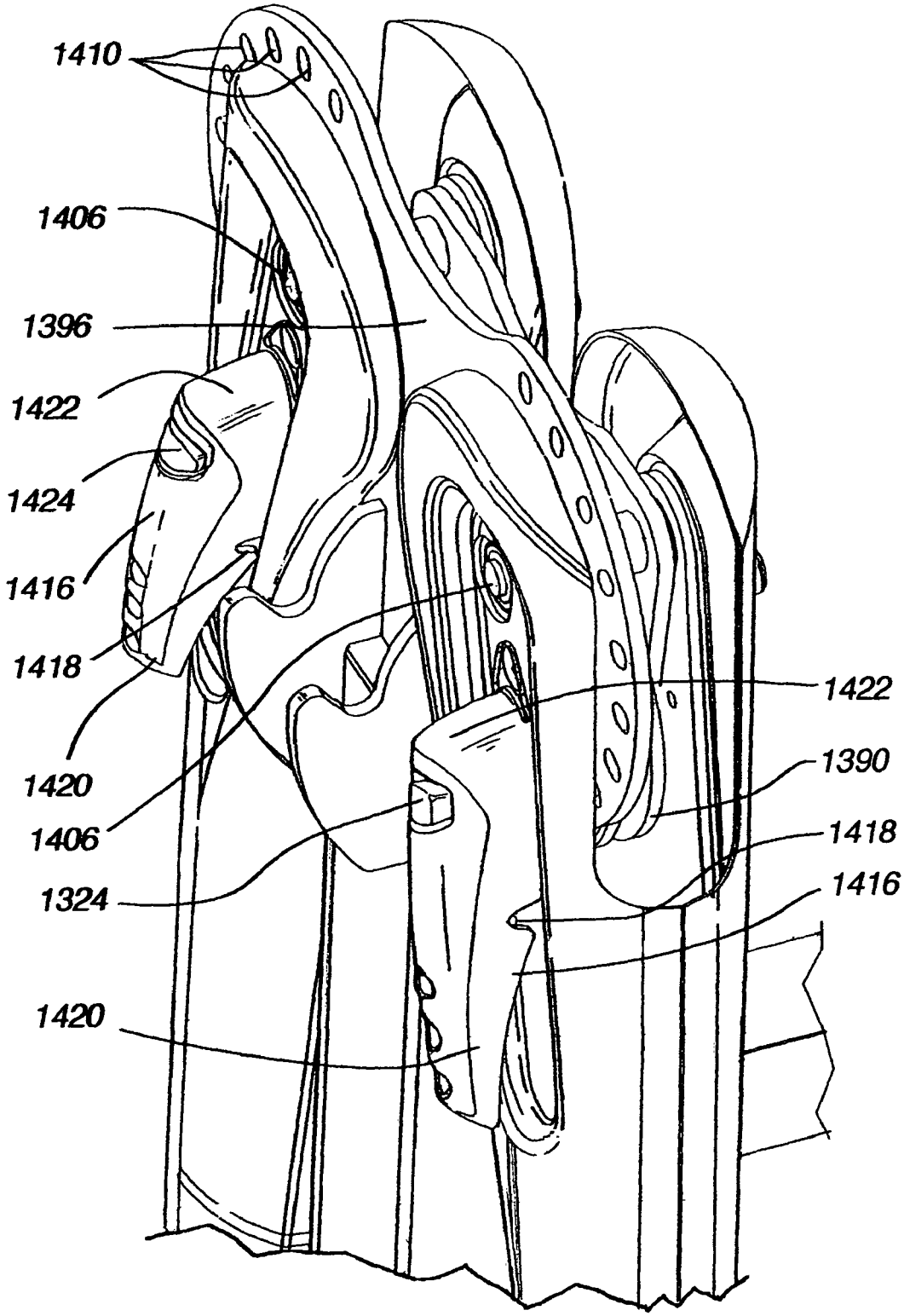
Figure 31C:
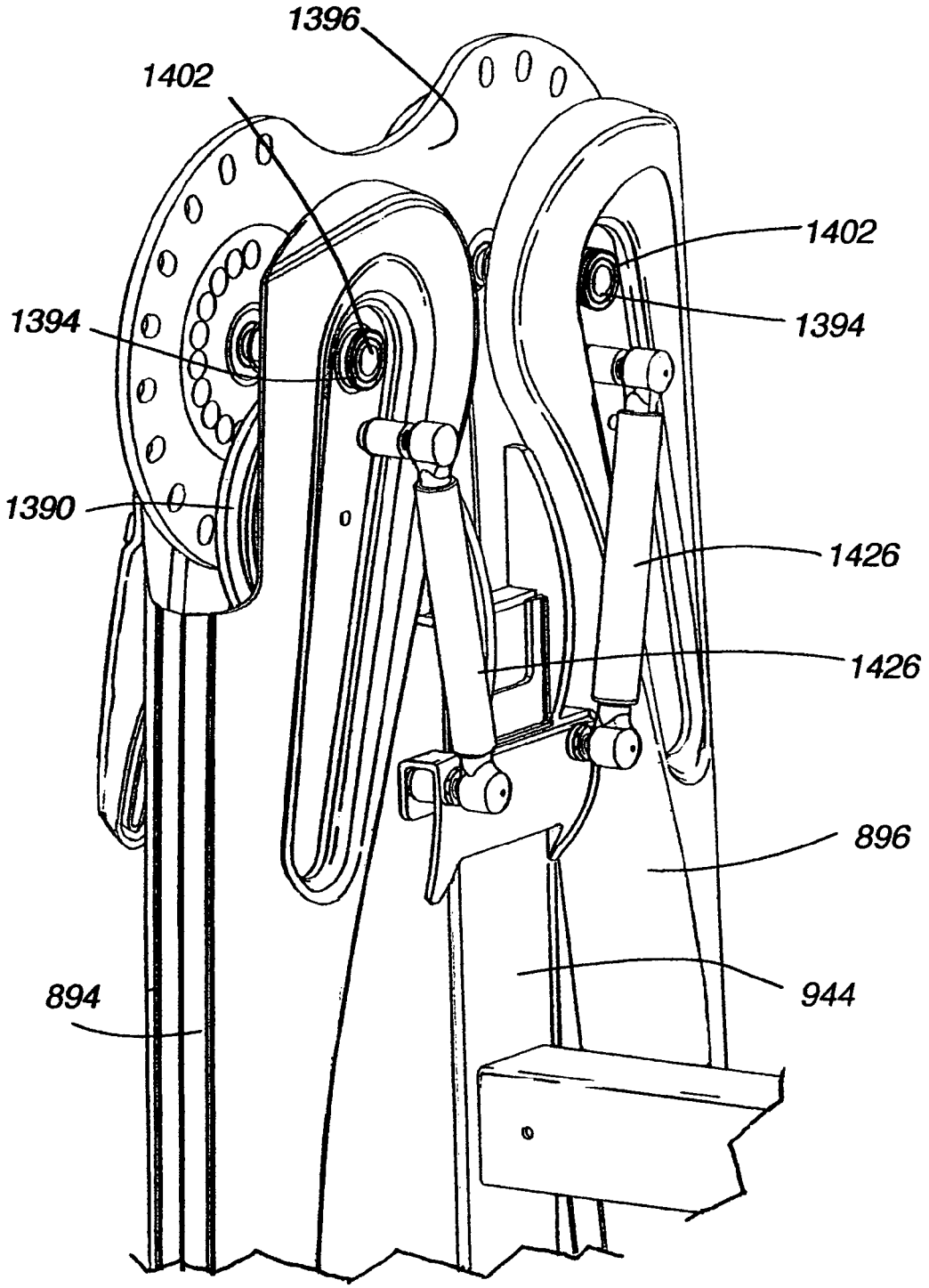
Figure 31D:
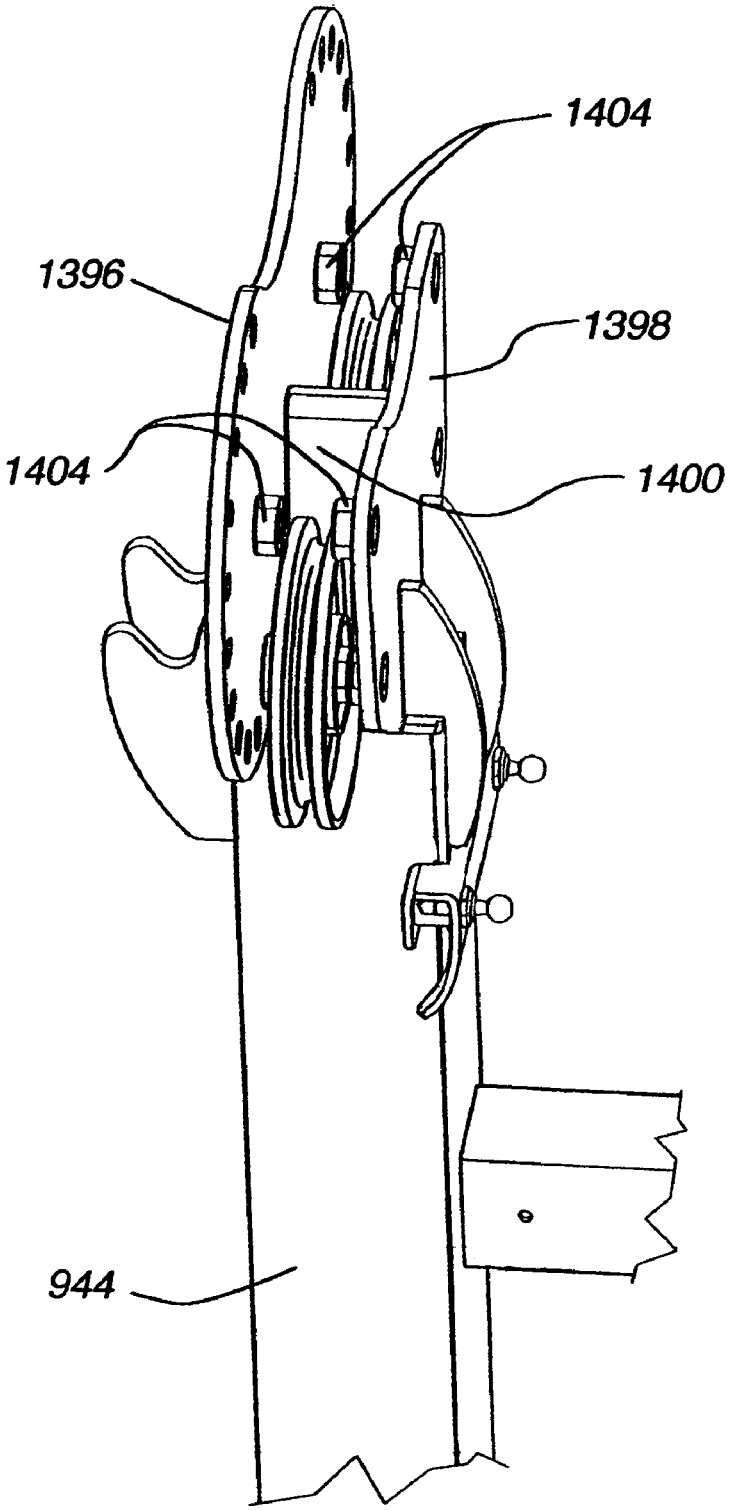
Figure 31E:
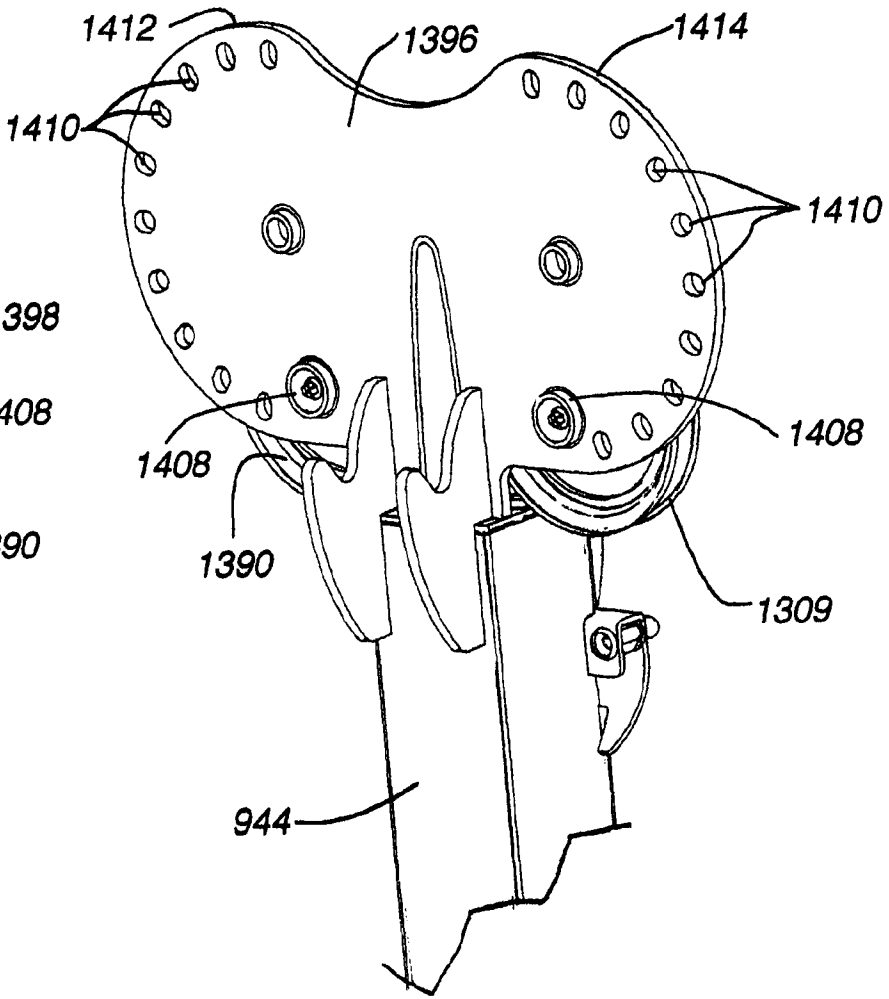
Figure 31F:
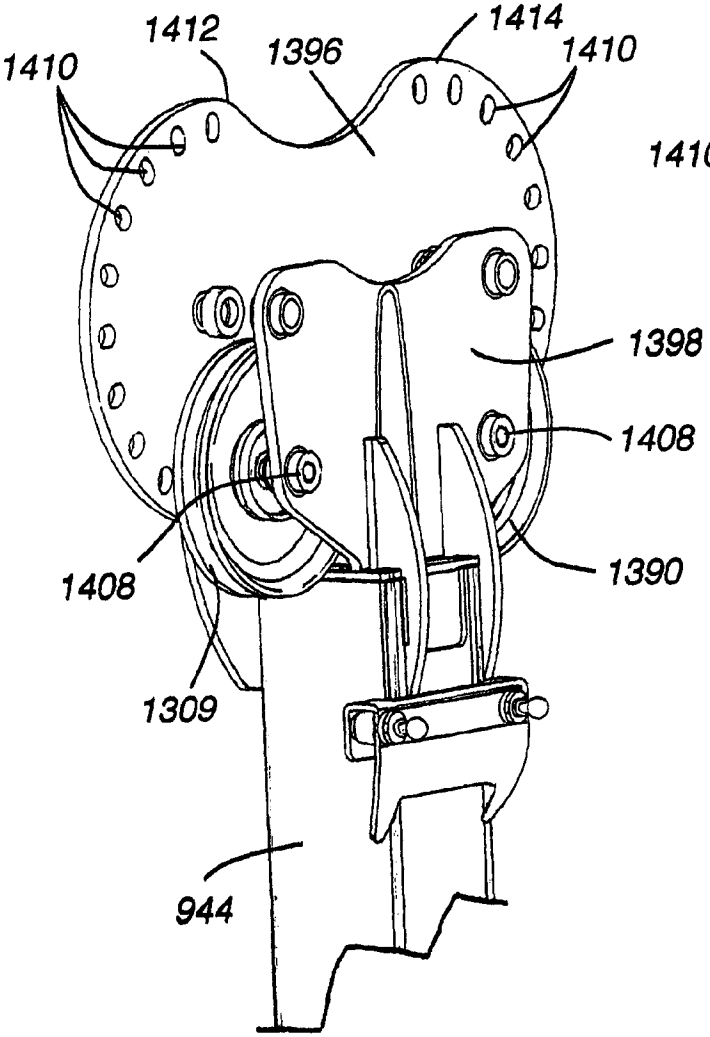

FIG. 31F is a rear detailed view of the upper end portion of the arm support member.

Figure 32A:
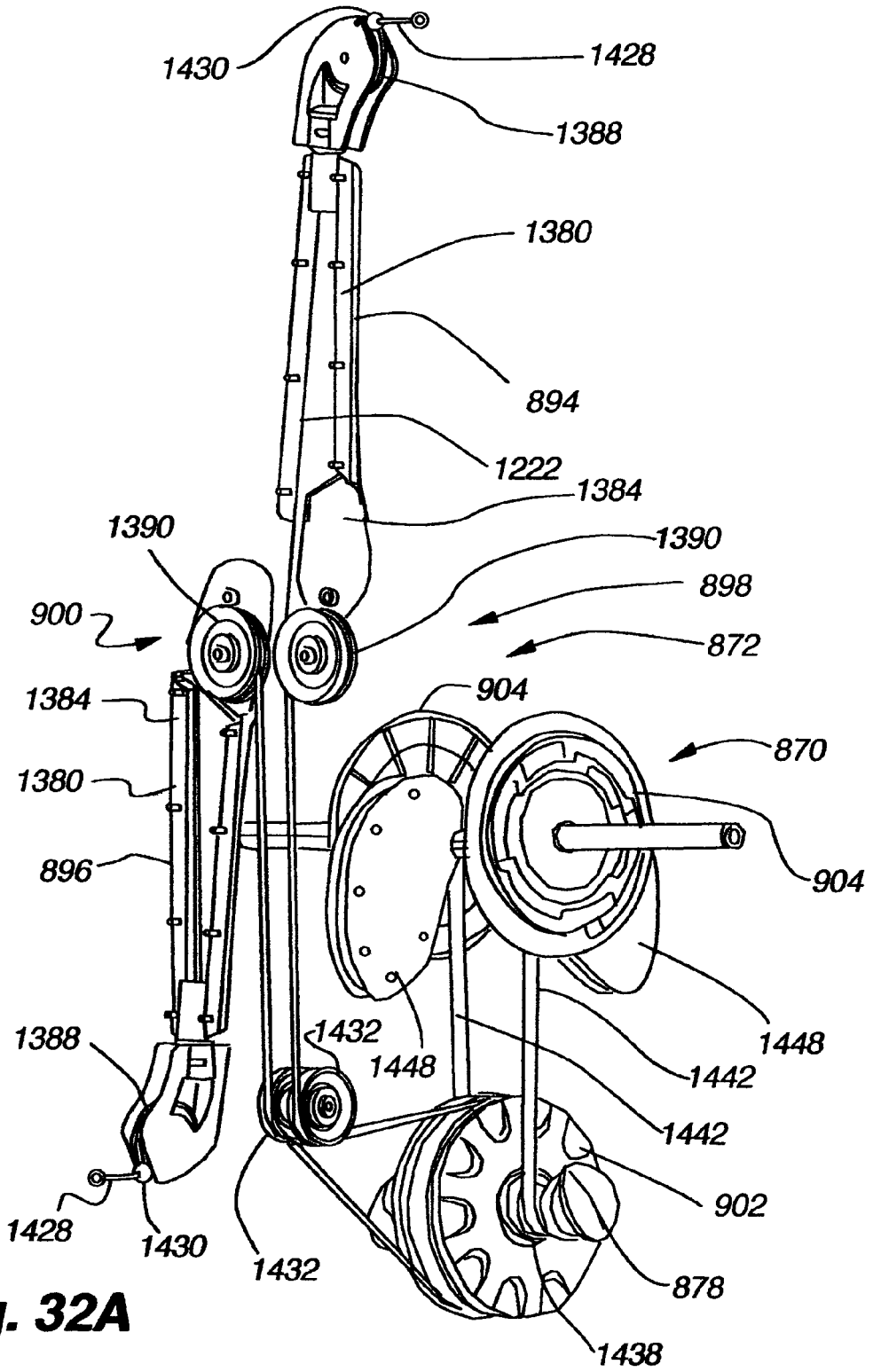

FIG. 32A is a right isometric detailed view of right and left cable-pulley assemblies.

Figure 32B:
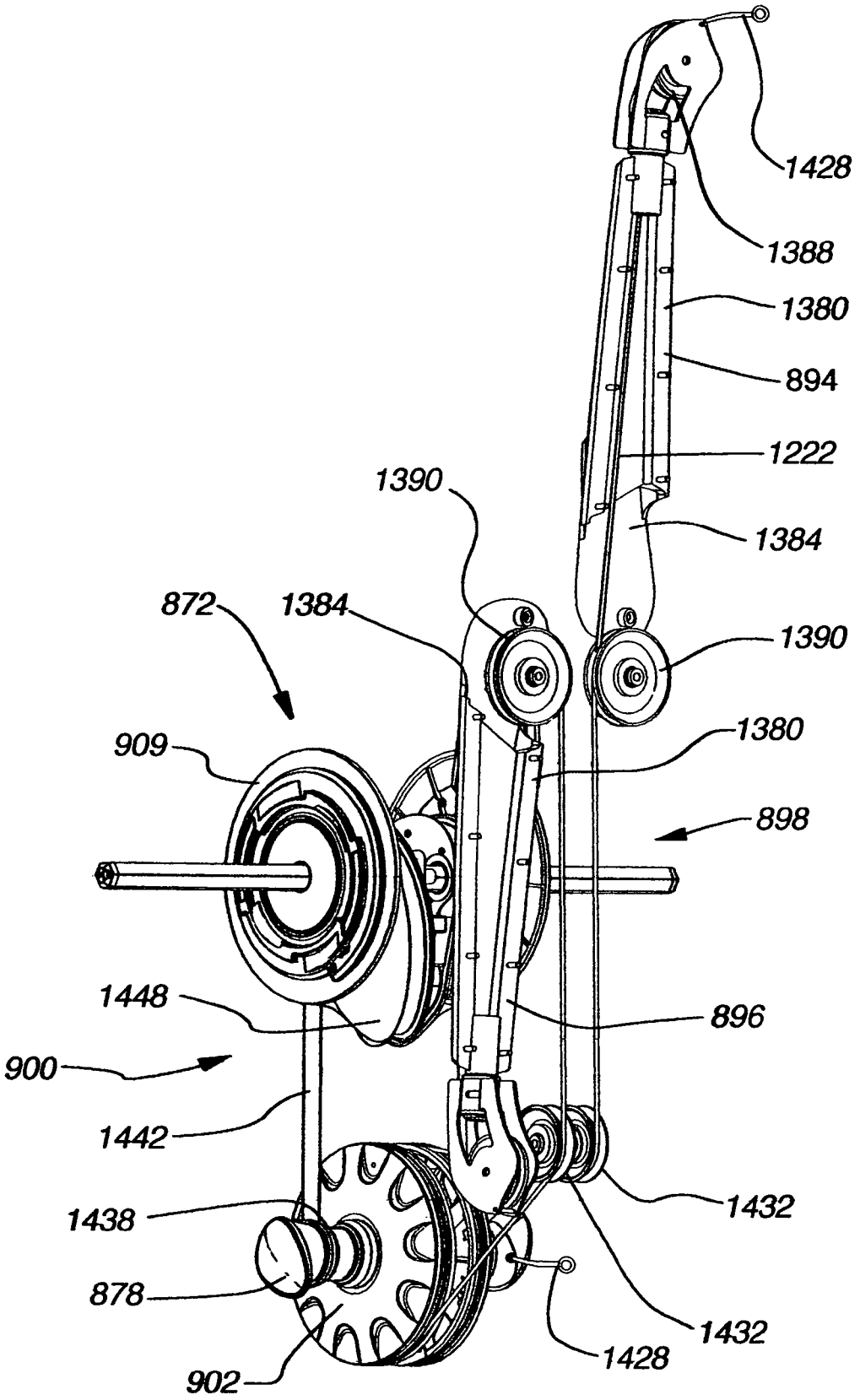

FIG. 32B is a left isometric detailed view of right and left cable-pulley assemblies.

Figure 32C:
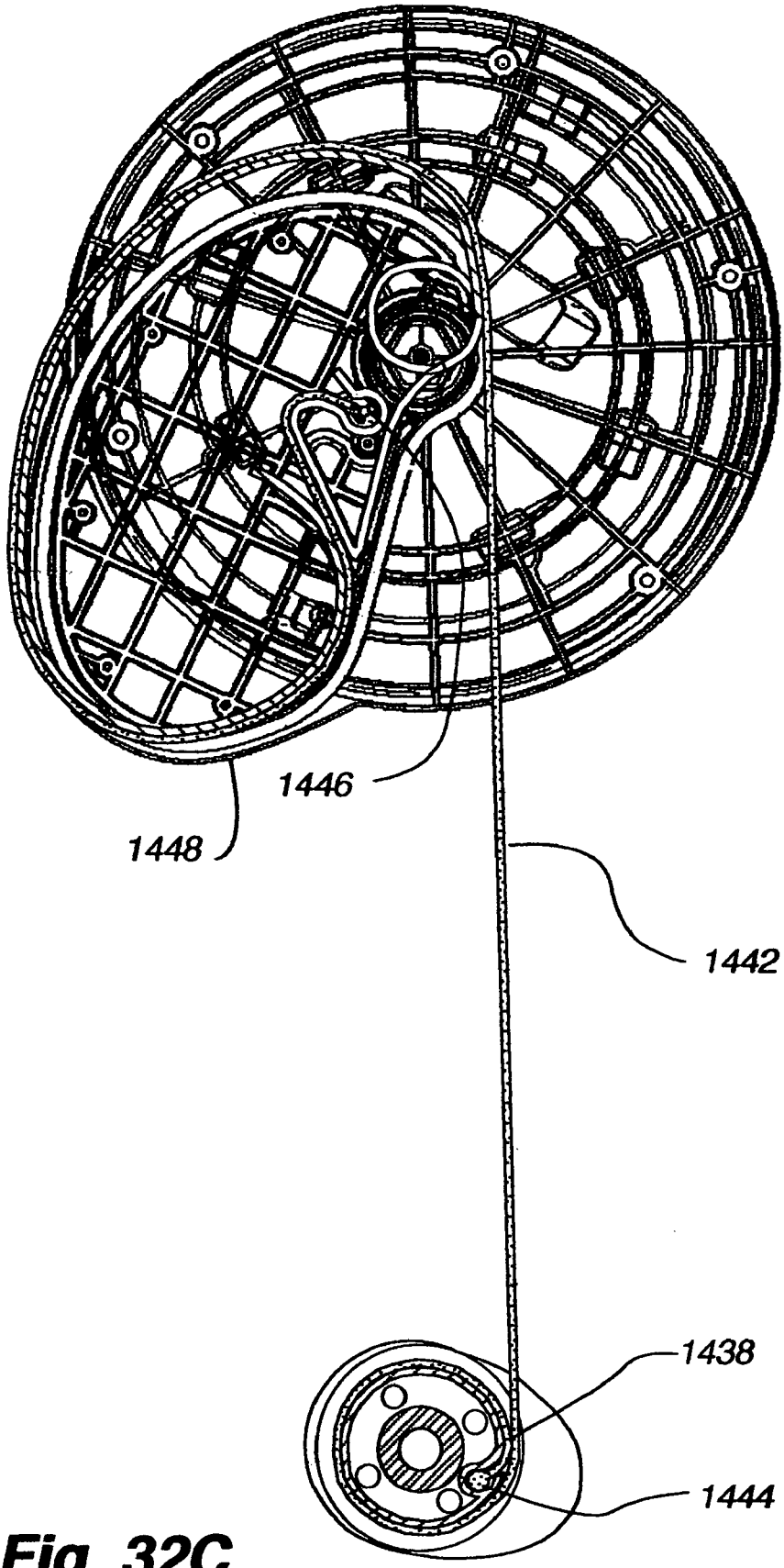

FIG. 32C is a cross sectional view of a linearizing cam and belt pulley connected with a resistance belt.

Figure 33A:
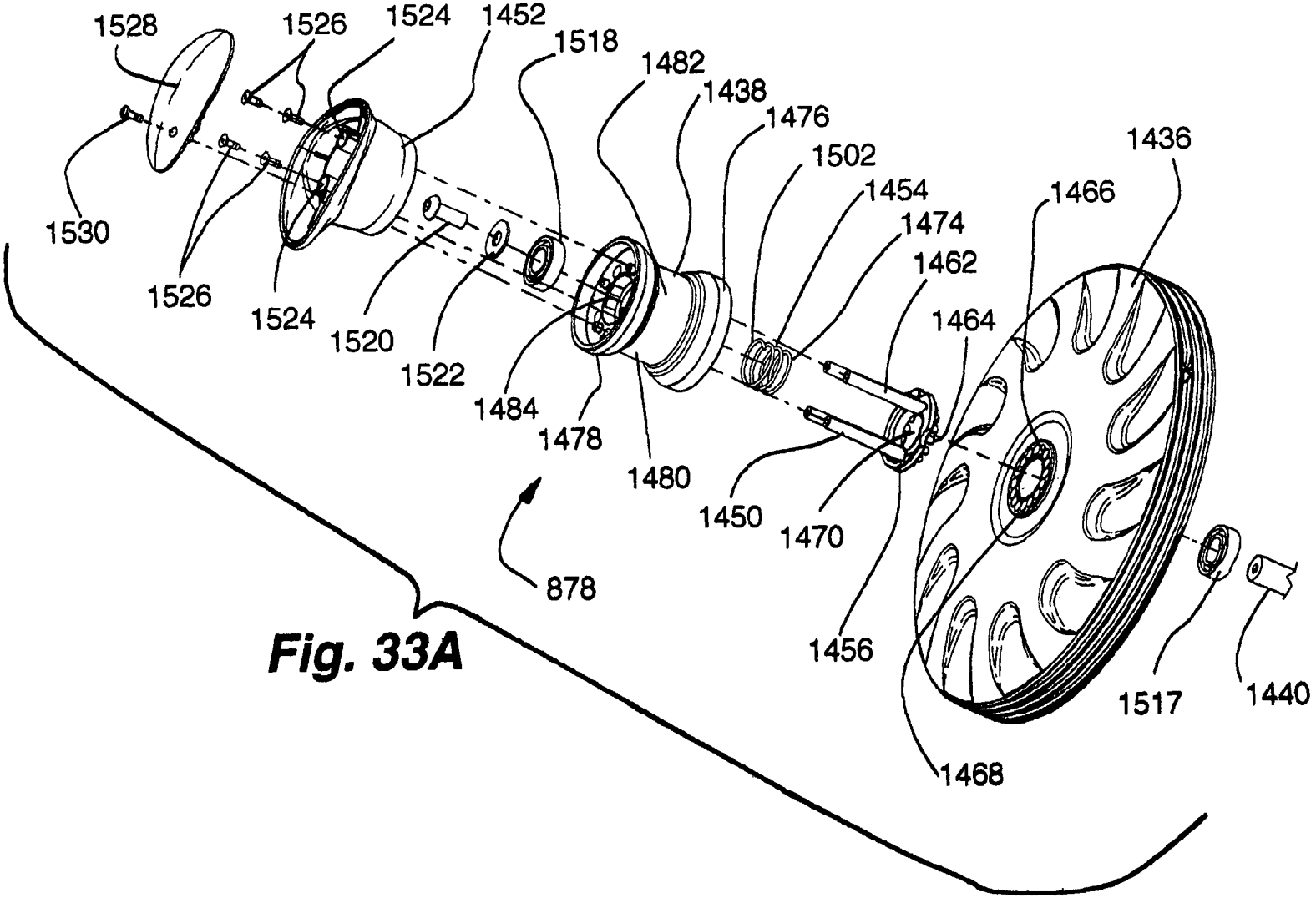

FIG. 33A is an exploded view of tensioning mechanism.

Figure 33C:
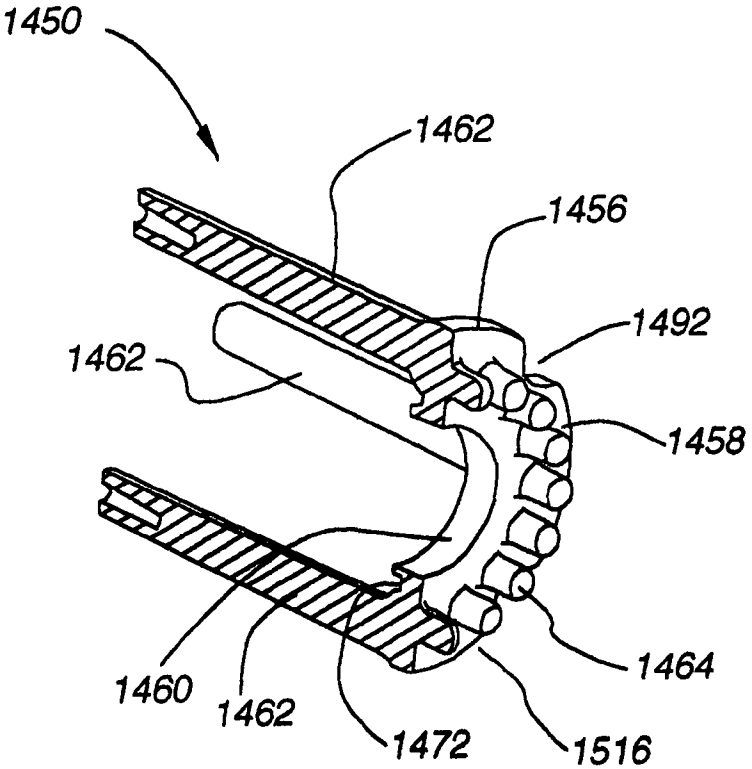
Figure 33B:
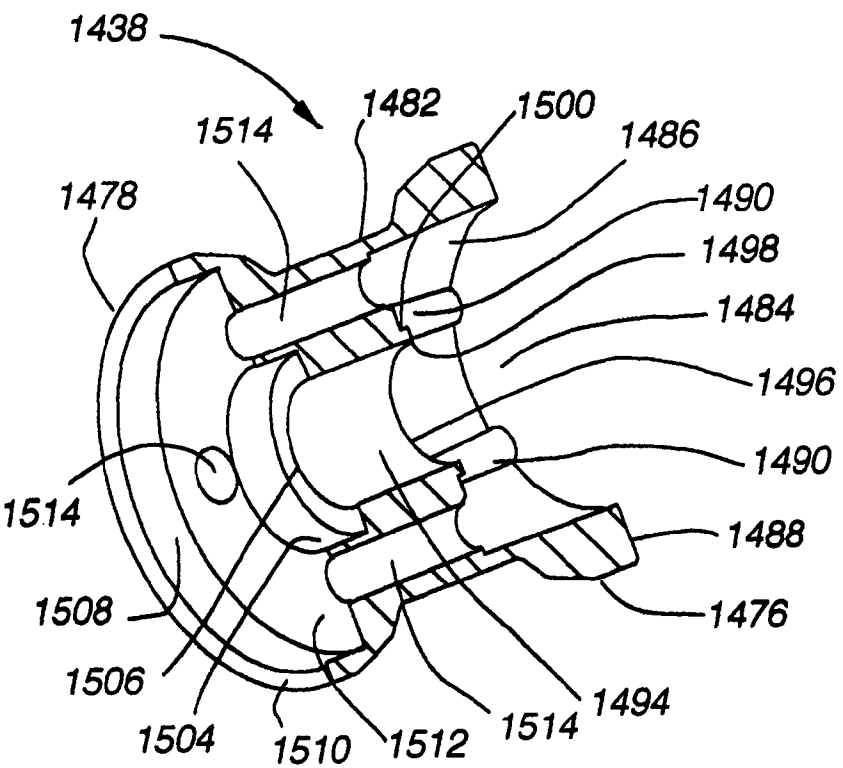

FIG. 33B is a cross sectional view of a belt pulley.

FIG. 33C is a cross sectional view of a locking member.

Figure 33D:
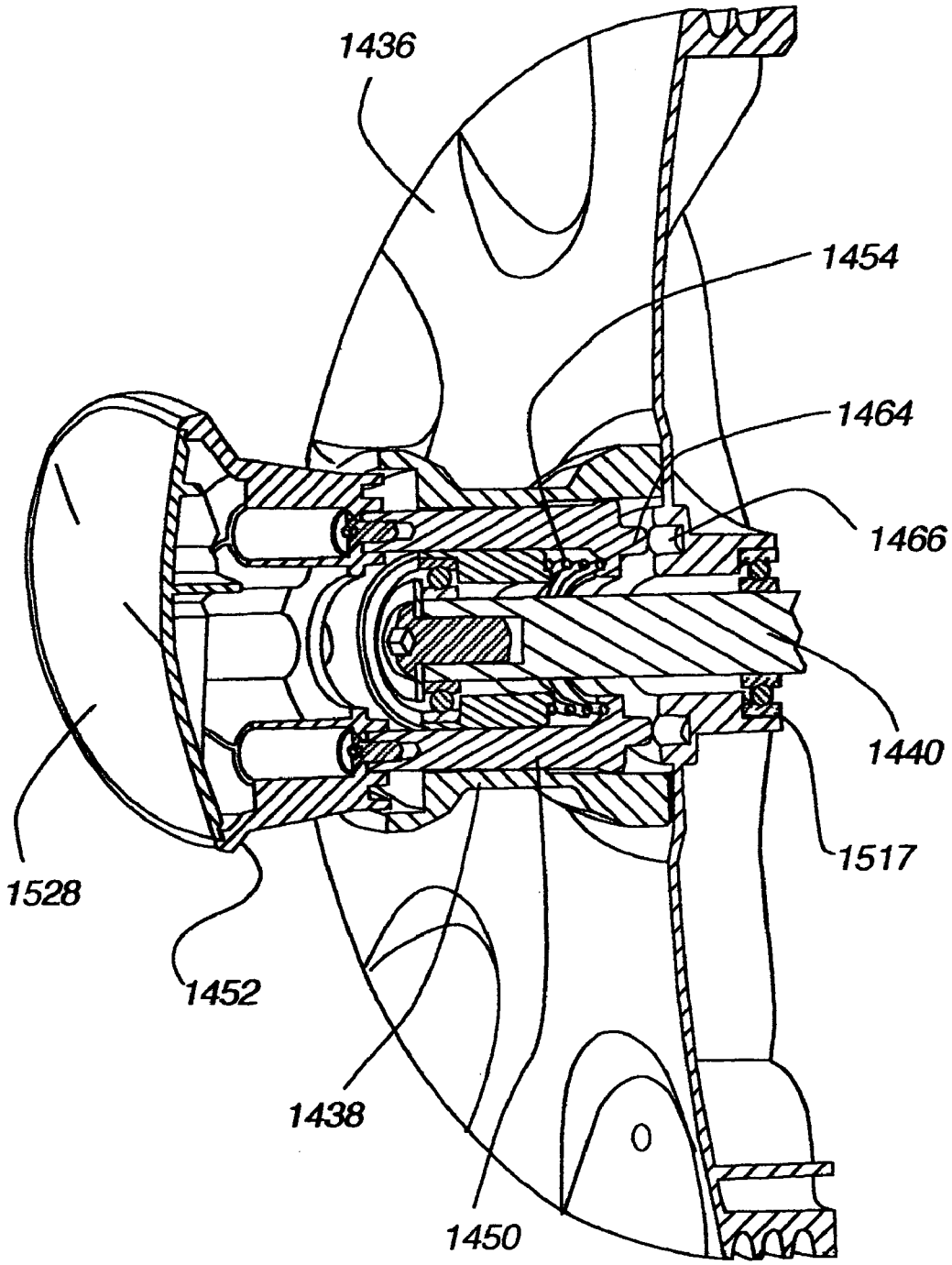

FIG. 33D is a cross sectional view of the tensioning mechanism showing the locking member disengaged from the belt pulley.

Figure 33E:
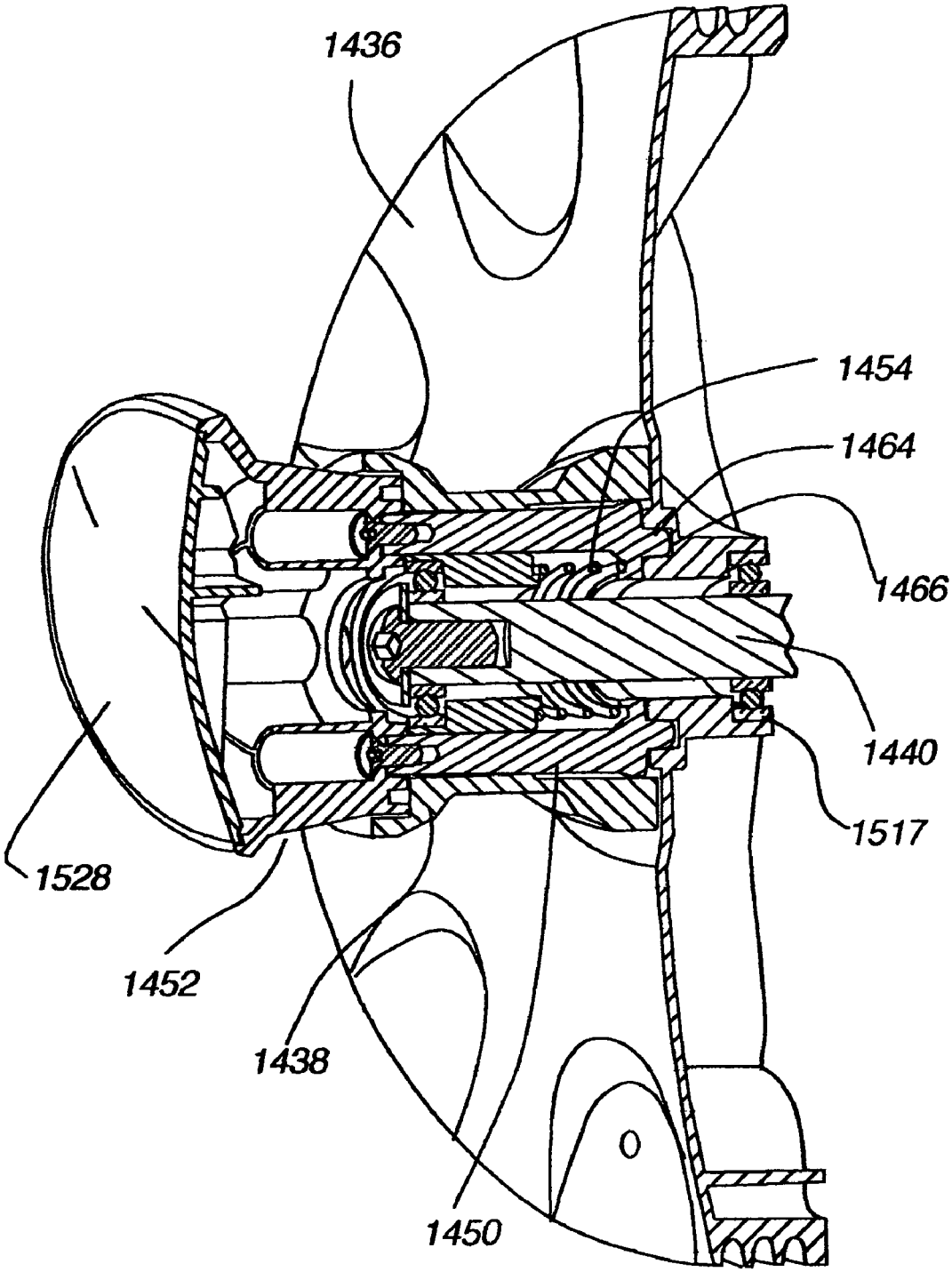

FIG. 33E is a cross sectional view of the tensioning mechanism showing the locking member engaged with the belt pulley.

Figure 34A:
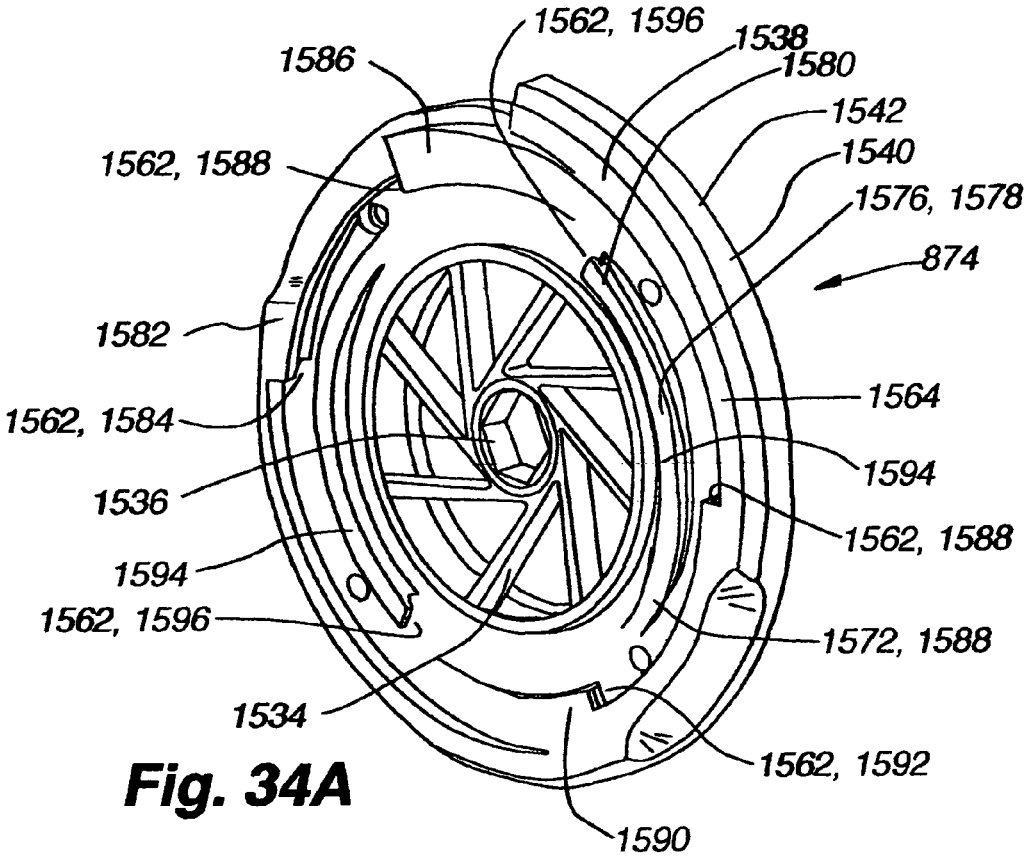

FIG. 34A is an isometric view of resistance pack showing a first side.

Figure 34B:
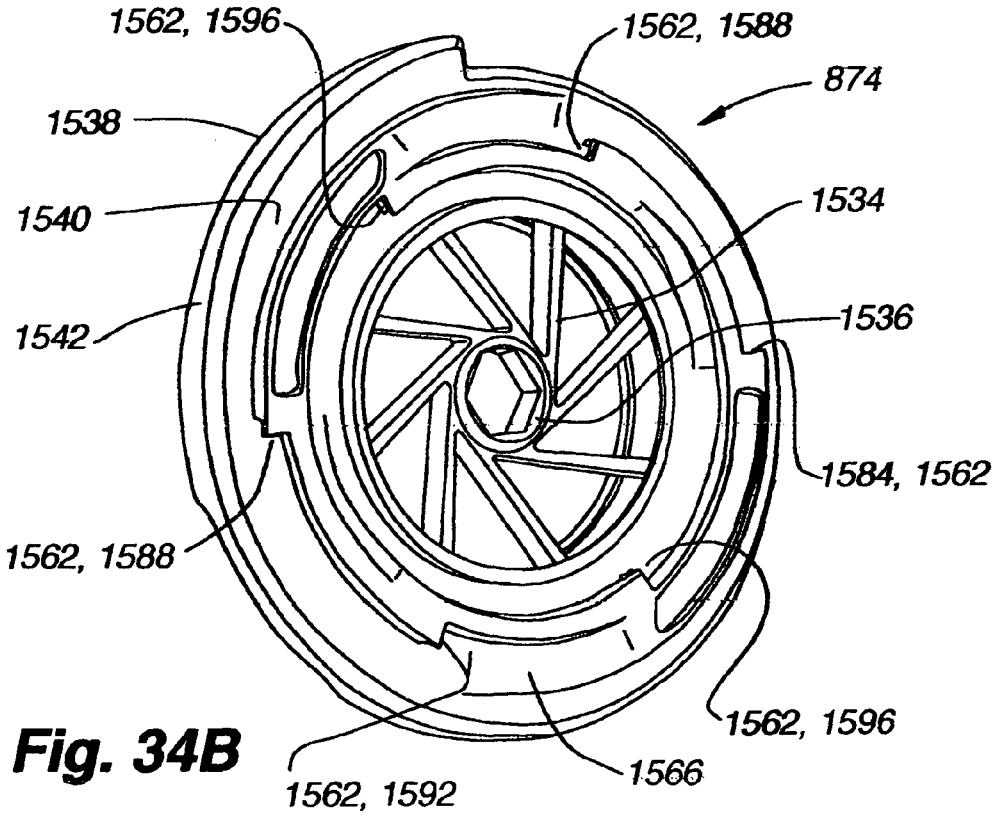

FIG. 34B is an isometric view of the resistance pack showing a second side.

Figure 34C:
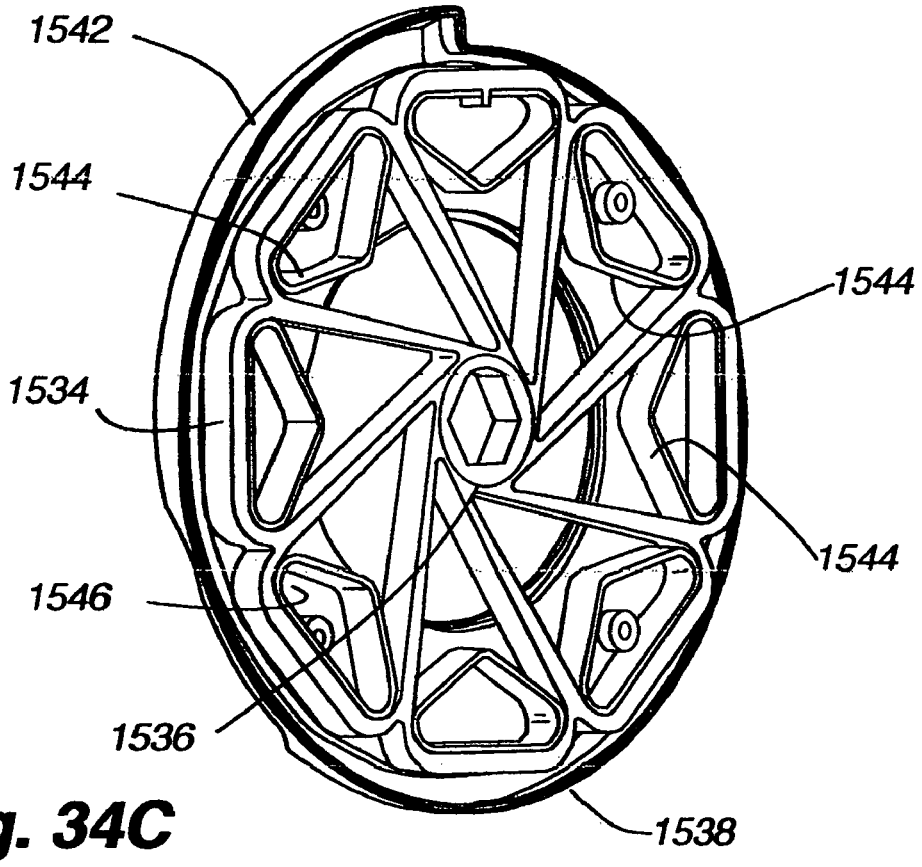

FIG. 34C is an isometric view of the first side of the resistance pack shown in a resistance element.

Figure 34D:
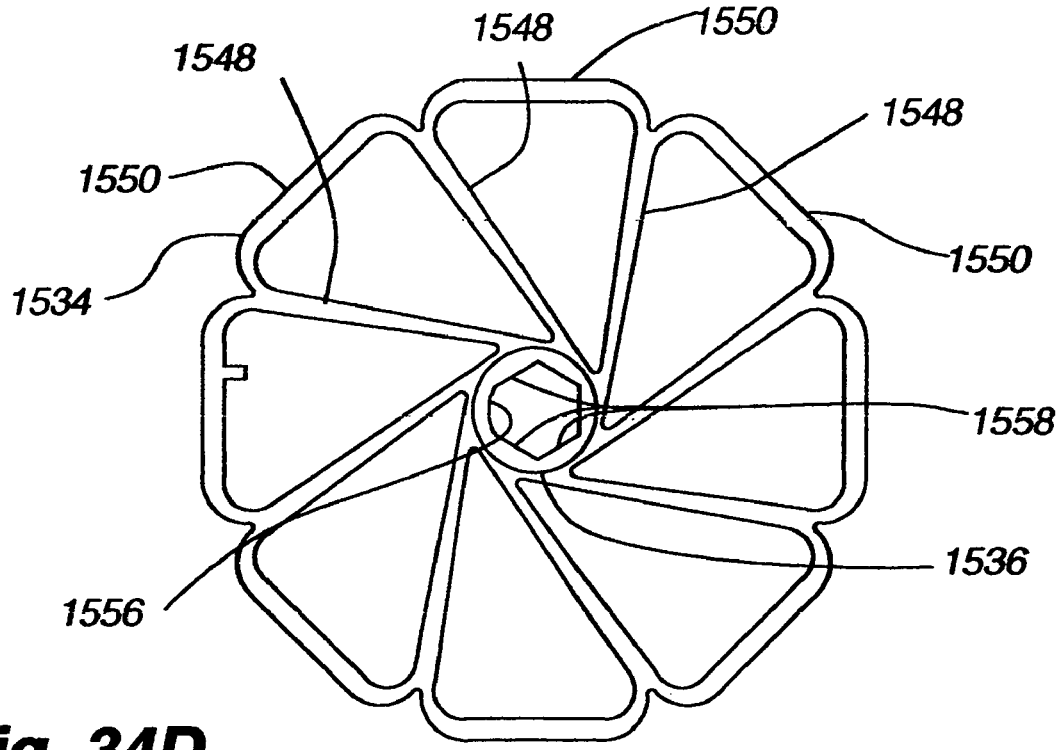

FIG. 34D is a side view of the resistance element.

Figure 34E:
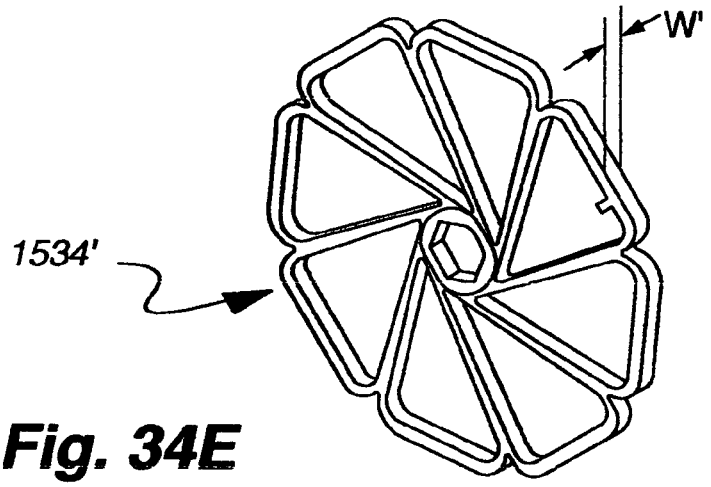

FIG. 34E is an isometric view of a resistance element having a first width.

Figure 34F:
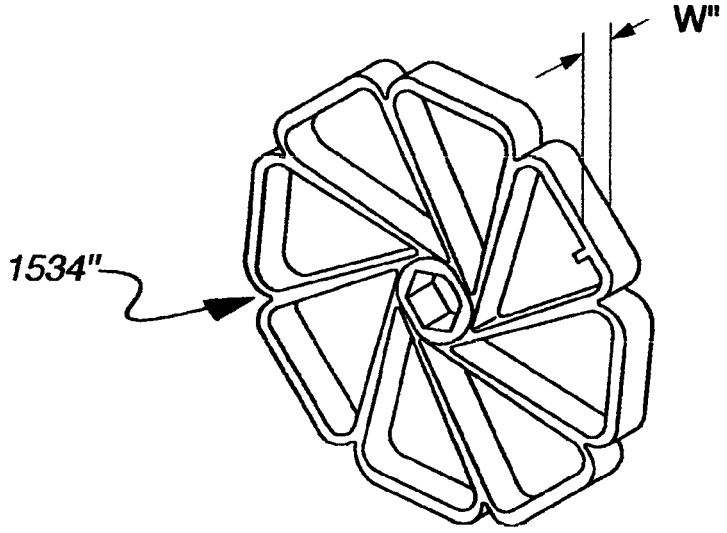

FIG. 34F is an isometric view of a resistance element having a second width.

Figure 34G:
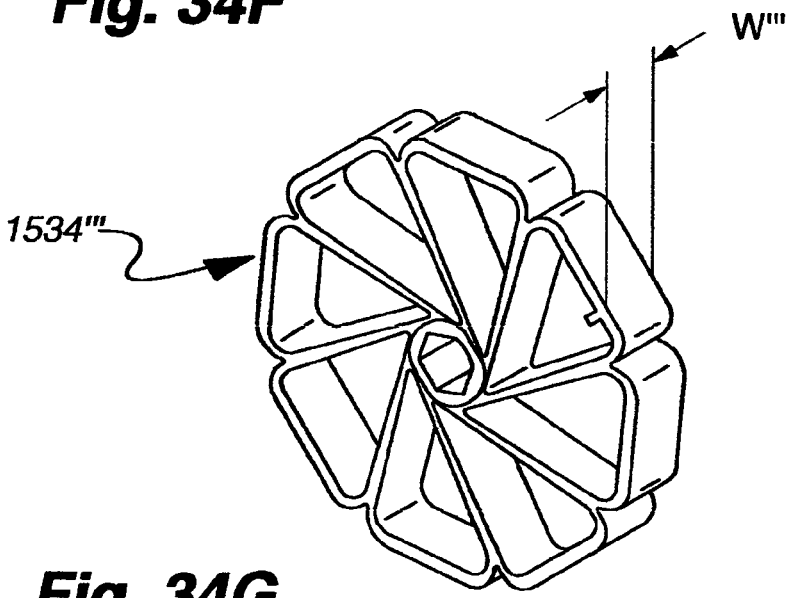

FIG. 34G is an isometric view of a resistance element having a third width.

Figure 35A:
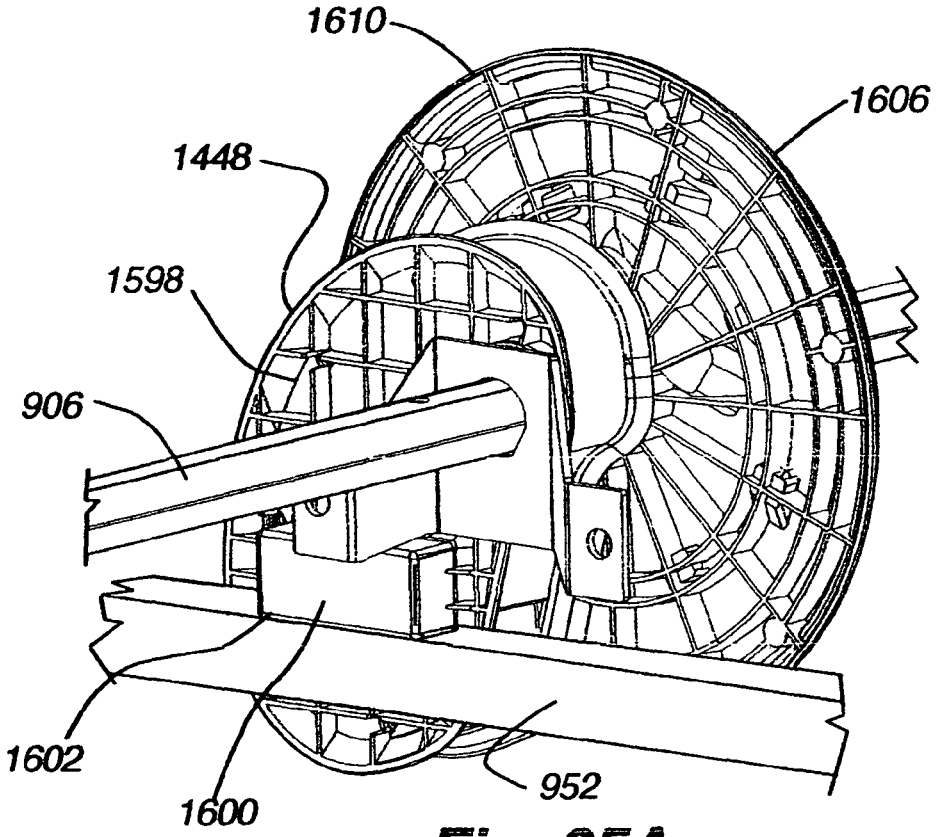

FIG. 35A is a detailed view of a linearizing cam and resistance axle.

Figure 35C:
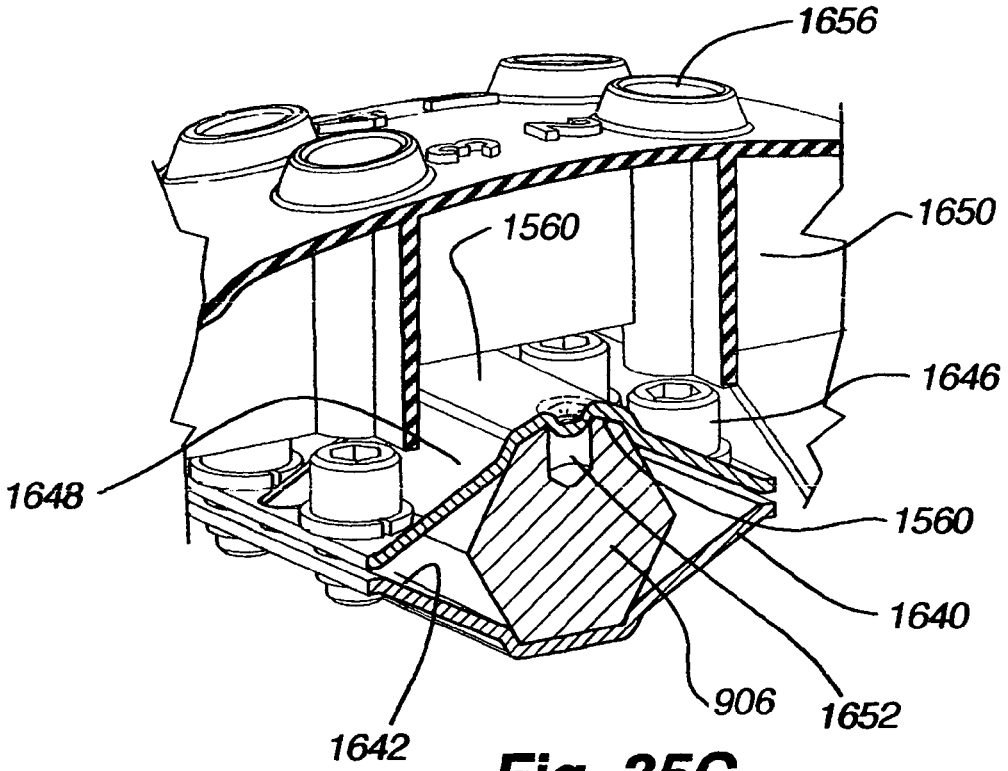
Figure 35B:
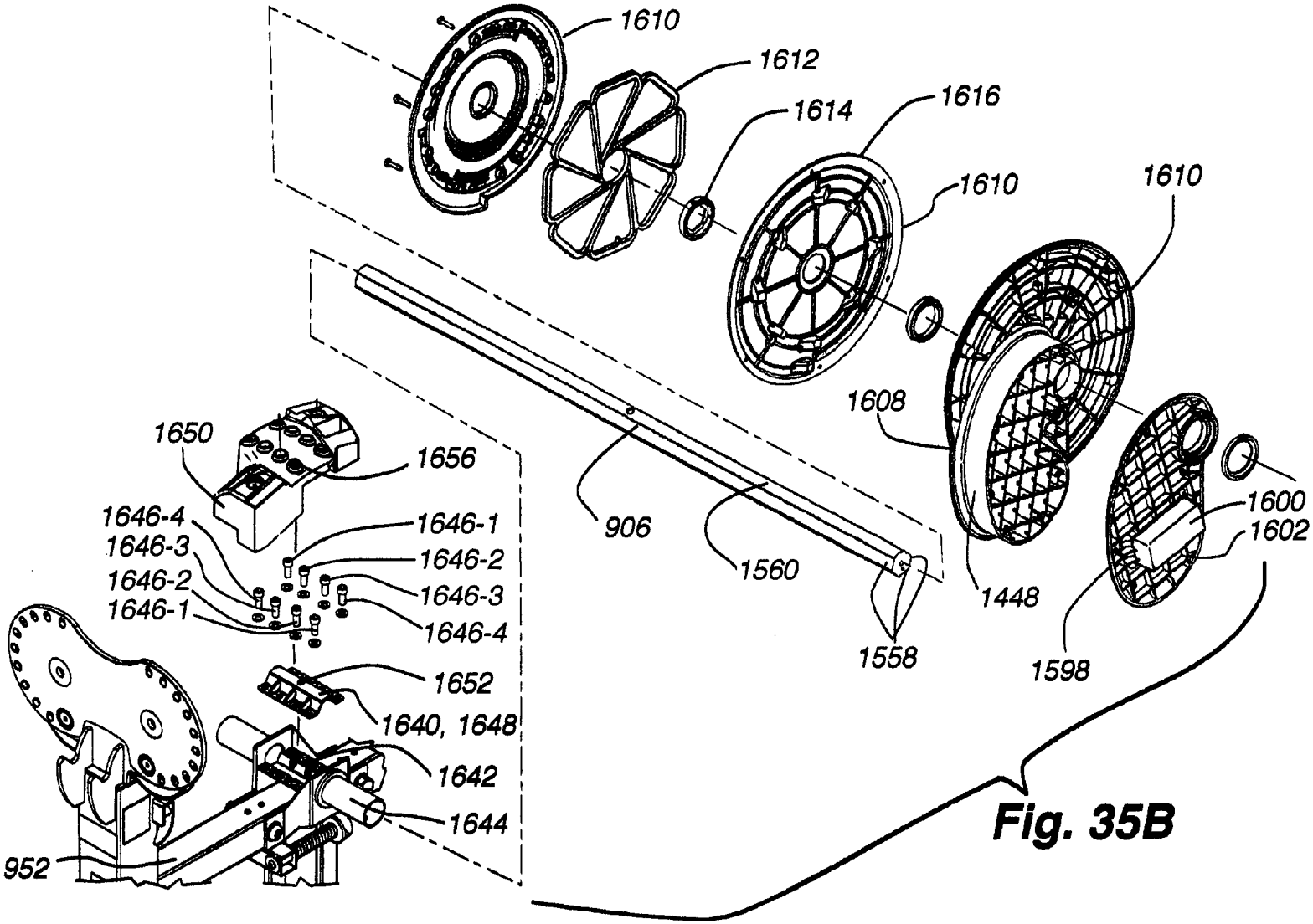

FIG. 35B is an exploded view of a linearizing cam, first resistance pack, a clam shell clamp, and resistance axle.

FIG. 35C is a cross sectional view of the clam shell claim and resistance axle.

Figure 36A:
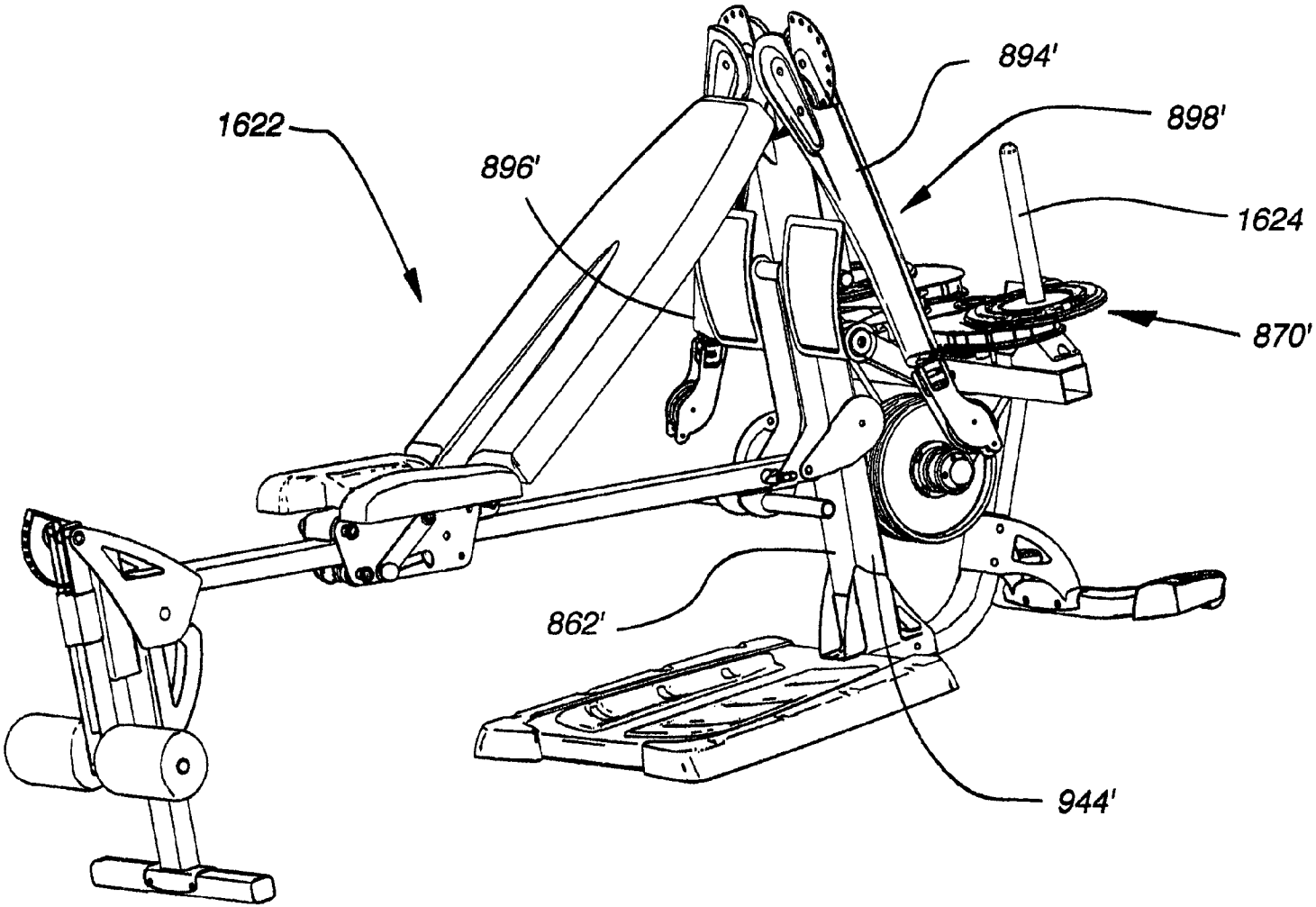

FIG. 36A is a right side isometric view of a second alternative exercise device.

Figure 36B:
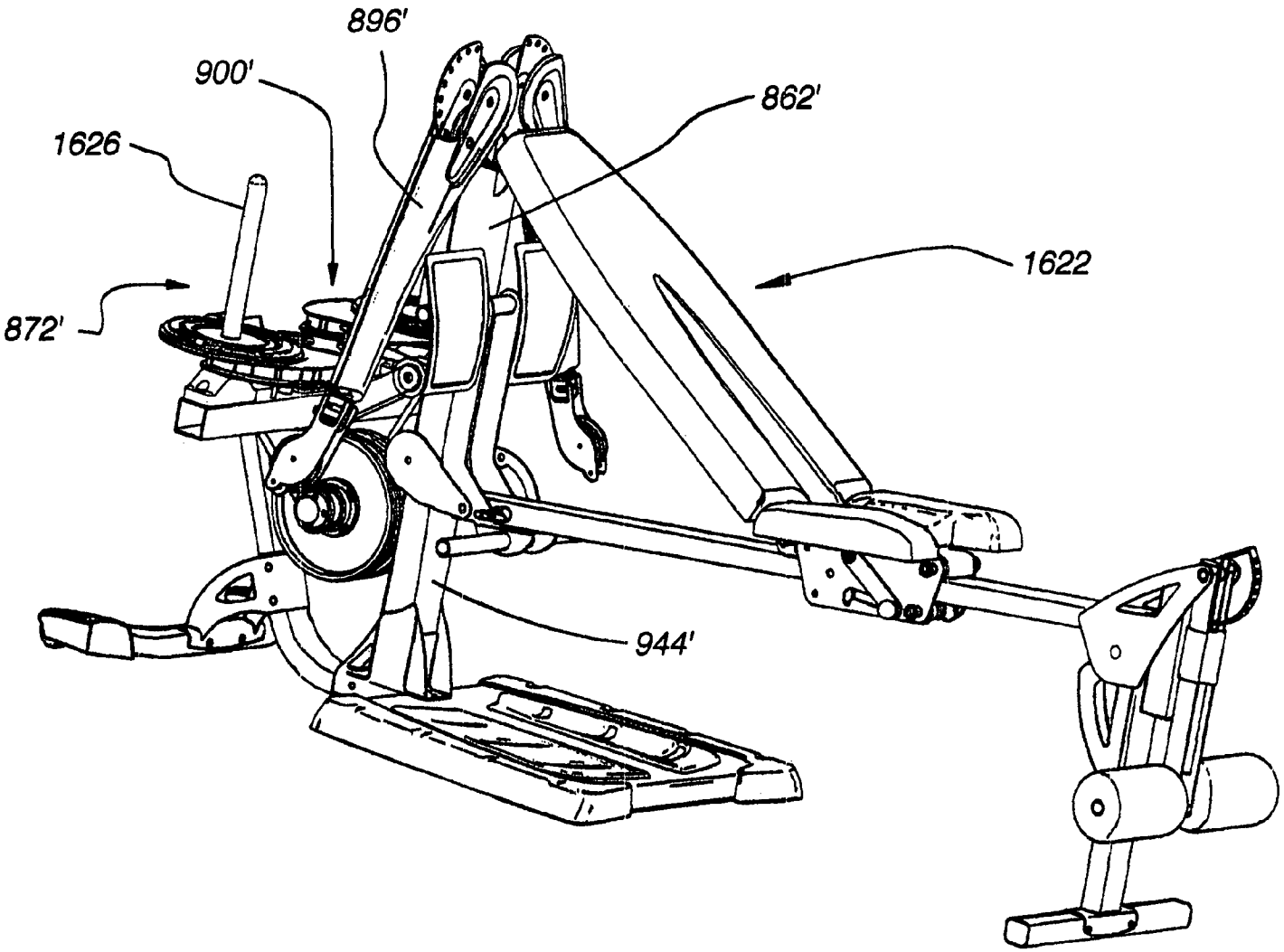

FIG. 36B is a left side isometric view of a second alternative exercise device.

Figure 36C:
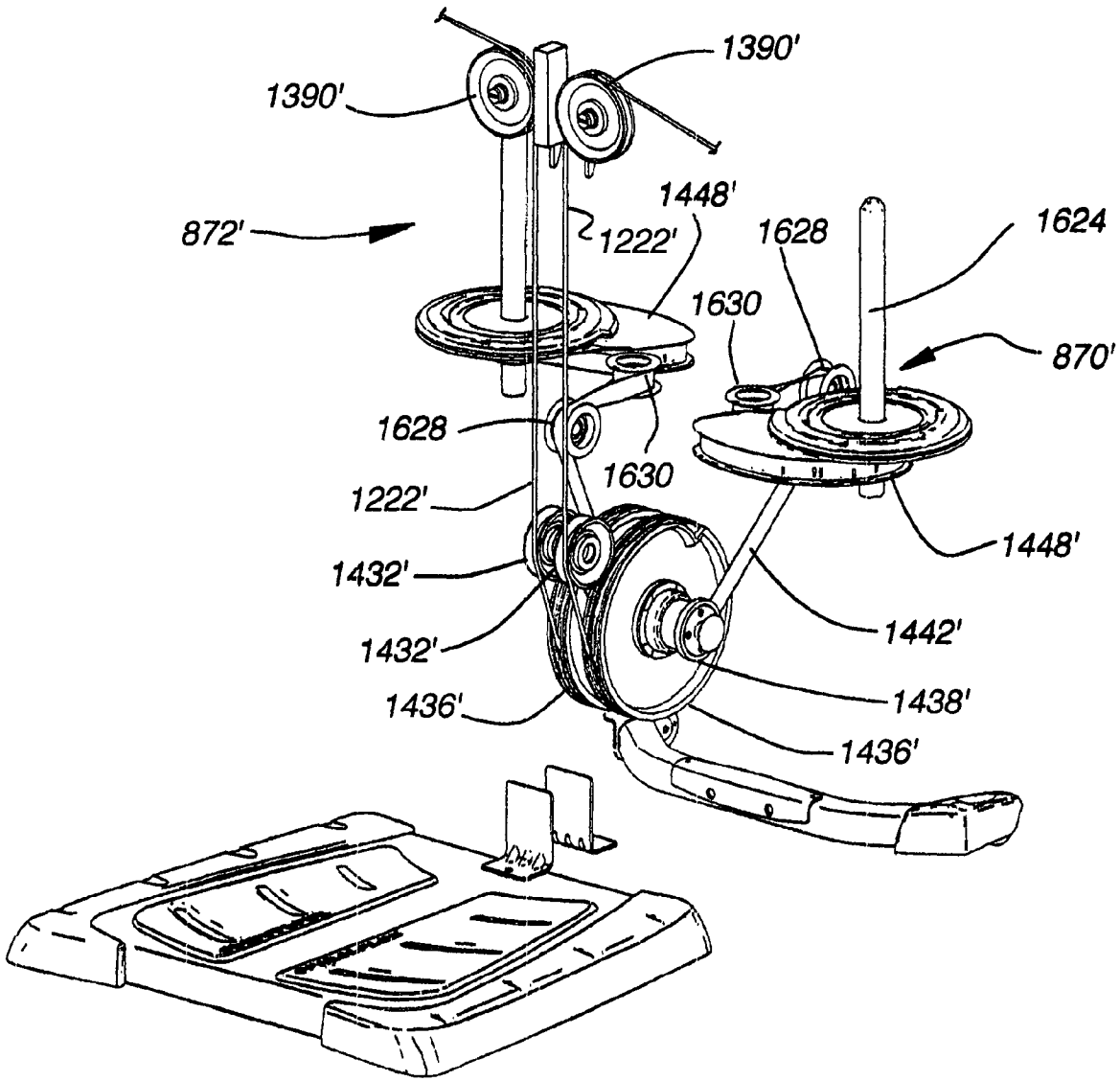

FIG. 36C is right front isometric view of a cable-pulley system of the second alternative exercise device.

Figure 36D:
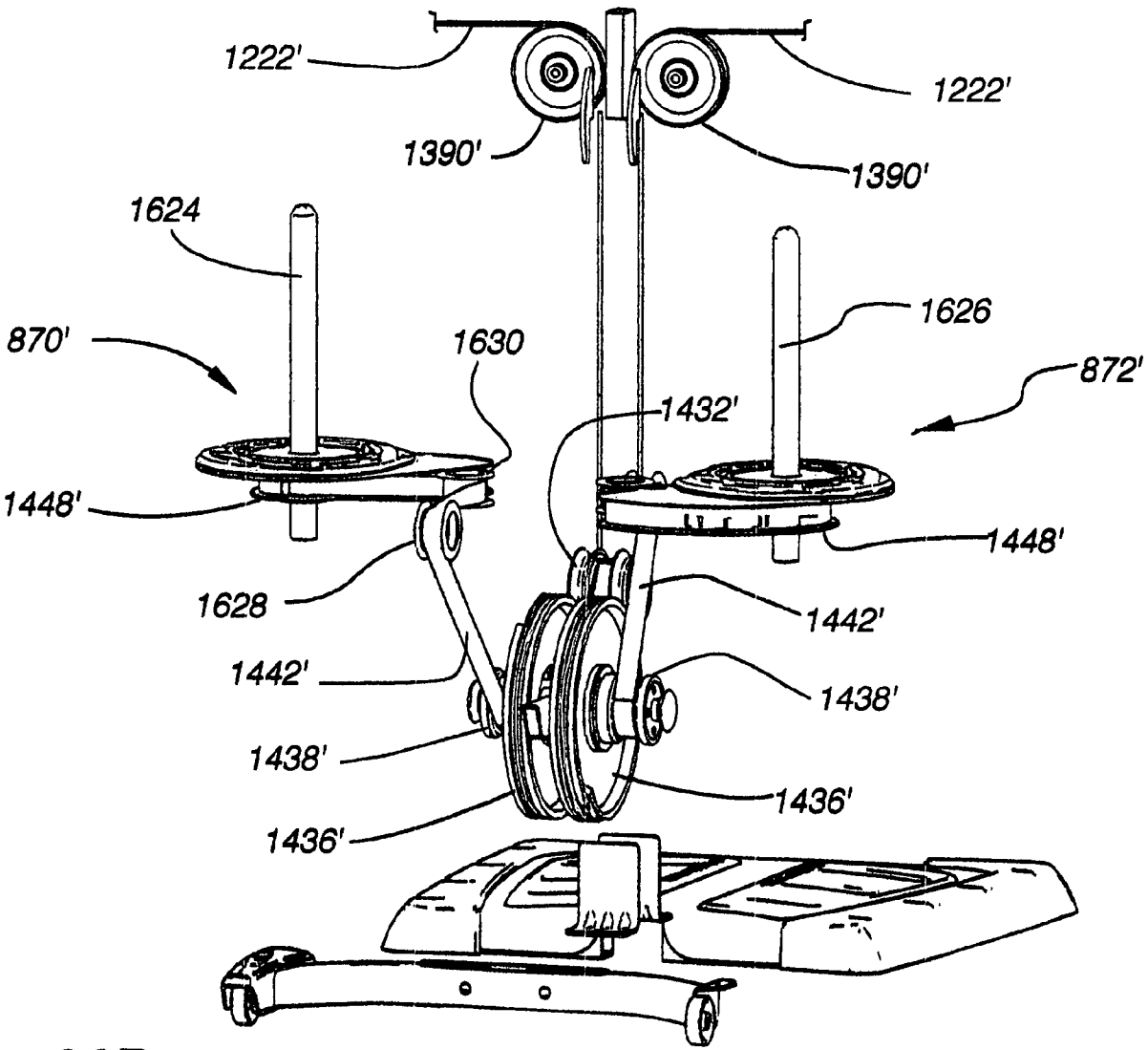

FIG. 36D is left rear isometric view of a cable-pulley system of the second alternative exercise device.

Figure 36E:
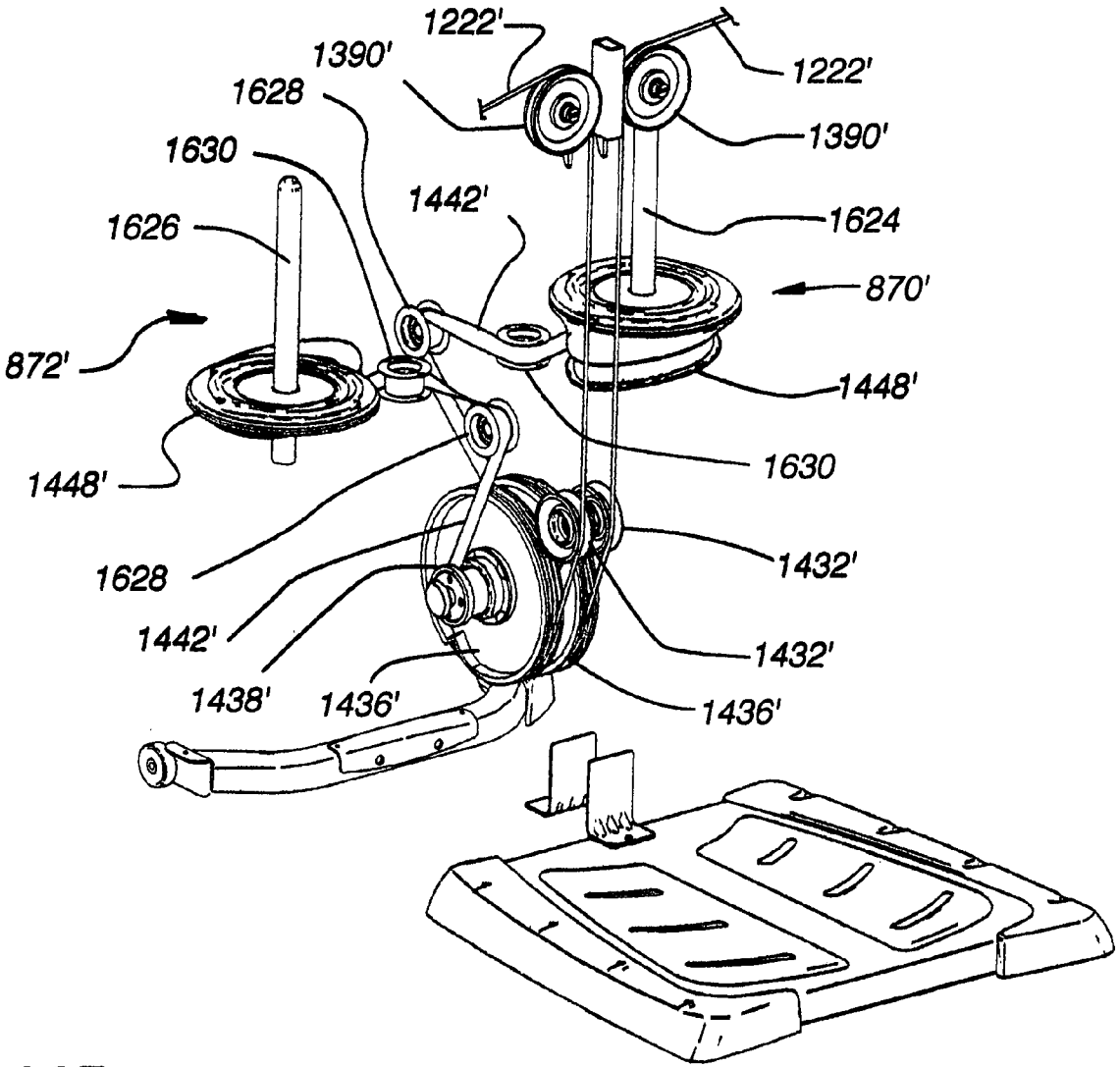

FIG. 36E is left front isometric view of a cable-pulley system of the second alternative exercise device.

Figure 36F:
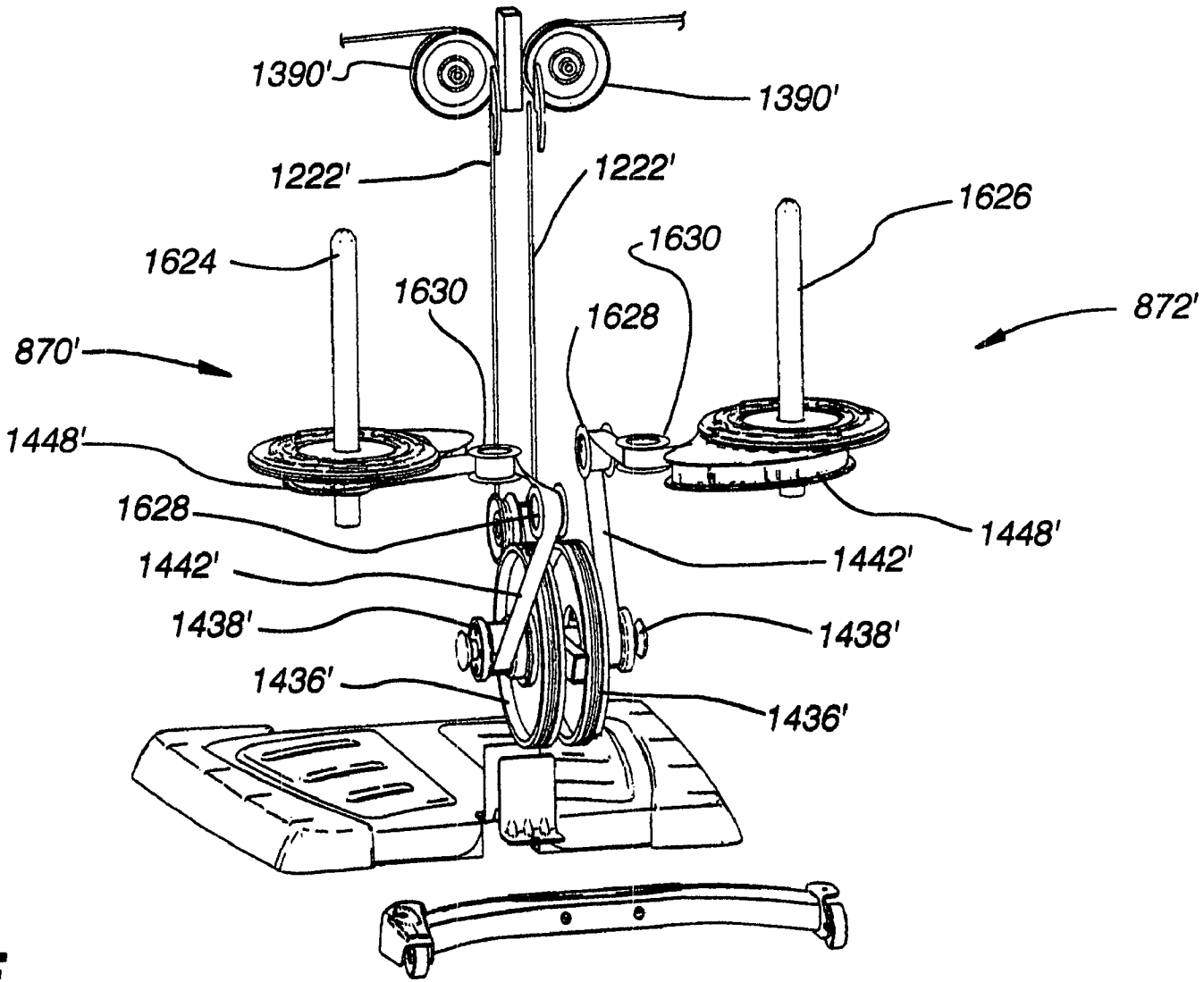

FIG. 36F is right rear isometric view of a cable-pulley system of the second alternative exercise device.

DETAILED DESCRIPTION OF THE INVENTION

Aspects of the present invention involve an exercise device configurable to allow a user to perform various exercises. The exercise devices described and depicted herein include an adjustable bench assembly connected with a frame supporting adjustable arm and cable-pulley assemblies providing a user interface with a resistance system. As discussed below, the exercise devices can include at least one cable having a first end connected with a handle or other actuation component and a second end operably coupled with a resistance pack and/or the resistance system. It is to be appreciated that other embodiments include more than one cable to actuate a single resistance pack. In some embodiments having more than one cable, each cable is operably coupled with a separate resistance arrangement. The exercise devices can also include various types of resistance systems and/or resistance packs. For example, some exercise devices include resistance packs with torsional springs. With such an exercise device, one or more resistance packs are actuated by grasping the handles and pulling the cable such that the torsional springs are wrapped about an axis to impart resistance against the cable motion and hence against the user. Other embodiments of the exercise devices include a resistance system with a transmission supporting a plurality of resistance packs. The transmission allows a user to conveniently engage any number of resistance packs to change the resistance level for a particular exercise.

In addition to being able to select the level of resistance, some embodiments of the exercise devices allow a user to select from a plurality of force curves. A force curve defines how resistance forces from the resistance system vary through a user's range of motion during exercise. For example, some embodiments allow a user to select an increasing resistance which is referred to as a "progressive" force curve. Other embodiments allow a user to select a decreasing resistance which is referred to as a "regressive" force curve. With a progressive force curve, the exercise resistance increases from the beginning of actuation of a resistance pack through full actuation. With a regressive force curve, the exercise resistance decreases from beginning to full actuation. Still other embodiments provide a variable force curve having an initially increasing resistance from the beginning of actuation of a resistance pack and then a decreasing resistance through full actuation. Yet other embodiments provide a variable force curve having an initially decreasing resistance from the beginning of actuation of a resistance pack and then an increasing resistance through full actuation.

In some embodiments of the exercise device, the adjustable bench assembly includes a bench seat and a pivotal back support supported on an adjustable bench frame that allows the user to adjust the height and level of the seat and back support as well as the orientation of the bench relative to the frame. The exercise devices also utilize various configurations of adjustable arm assemblies that are selectively positionable for numerous exercises and to suit a user's particular body size and shape. One embodiment includes a releasable locking mechanism that allows the user to simultaneously maneuver an adjustable arm assembly in more than one range of motion.

A first embodiment of an exercise device 100 conforming to aspects of the present invention is shown in FIGS. 1A-1D. A frame 102 provides structural support for the exercise device 100. It is to be appreciated that the frame can take on numerous different configurations depending on particular arrangements and combinations of the exercise device. Some particular frame arrangements are shown and discussed herein with reference to a bench frame portion 104 and a main frame portion 106. The bench frame 104 includes an arrangement of frame members for supporting a seat or bench assembly 108 and various user interface components. As discussed in more detail below, the bench assembly 108 can be adjustable and can include a bench 110 with a pivoting back support 112 and an adjustable bench seat 114. In addition, the bench frame 104 can include a seat rail 116 with a first end portion 118 pivotally connected with the main frame 106 and a second end portion 120 supported by a forward bench support 122. As shown in FIGS. 1A-1D, the main frame 106 supports adjustments arm assemblies 124, a cable-pulley system 126, a resistance system 128, and other features. The adjustable arm assemblies 124 and cable-pulley assembly 126 provide a user interface with the resistance system 128. Although embodiments of the exercise device are described and depicted has having cable-pulley systems utilizing various types of pulley arrangements, it is to be appreciated that the exercise devices are not limited to specific arrangements described and depicted herein. Further, it is contemplated that the exercise devices can utilize devices other than pulleys to guide cables, such as cylinders, rails, and various other mechanisms. In addition, it is to be appreciated that other embodiments can include movable pulleys and other similar devices that are guided along cables or tracks. As discussed in more detail below, each arm assembly 124 can include a multi-axis release mechanism that allows a user to simultaneously maneuver each arm assembly in two ranges of motion. It is to be appreciated that the main frame 106 can support one or more resistance systems 128. For example, as shown in FIGS. 1A-1D, the exercise device includes a right resistance system 130 and a left resistance system 132. Each resistance system can include a transmission 134 and a resistance assembly 136 having a plurality of selectable resistance packs 138. As discussed in more detail below, embodiments of the resistance system can also include a first selector mechanism 140 operably coupled with the transmission assembly 134 that allows the user select different force curves. A second selector mechanism 142 operably coupled with the resistance assembly 136 allows the user to select a desired level of resistance.

With particular respect to the exercise device of FIGS. 2A-2H, to use the exercise device, a user first selects the amount of resistance and the force curve for a particular exercise. The user also connects resistance cables 144 extending from the arm assemblies 124 with an actuation device 146, such as a bar, a leg developer station, or a handle similar to those shown in FIGS. 2D-2H. Separate actuation devices may be arranged so that each resistance cable 144 and associated resistance system 130, 132 are separately actuated by the user, or the cables coupled together, so that a user actuates both resistance systems simultaneously through one actuation device. As discussed in more detail below, the resistance cables 144 are routed through the arm assemblies and cable-pulley assembly and are operably coupled with the resistance systems 130, 132. The user then places the bench frame 104, bench assembly 108, and arm assemblies 124 into desired orientations for a particular exercise. Next, the user positions his body on the exercise device 100 and begins exercising by exerting forces through the actuation devices 146 on the resistance cables. As the cables 144 are moved in a direction away from ends of the arm assemblies 124, the resistance systems 130, 132 exert resistance forces on the cables in an opposing direction. It is to be appreciated that the order in which the previously described operations can be performed may vary and should not be construed to be limited to the order described. Some of the various exercises that can be performed with the exercise device along with associated component orientations are also illustrated in FIGS. 2A-2H, discussed below.

Figure 2A:
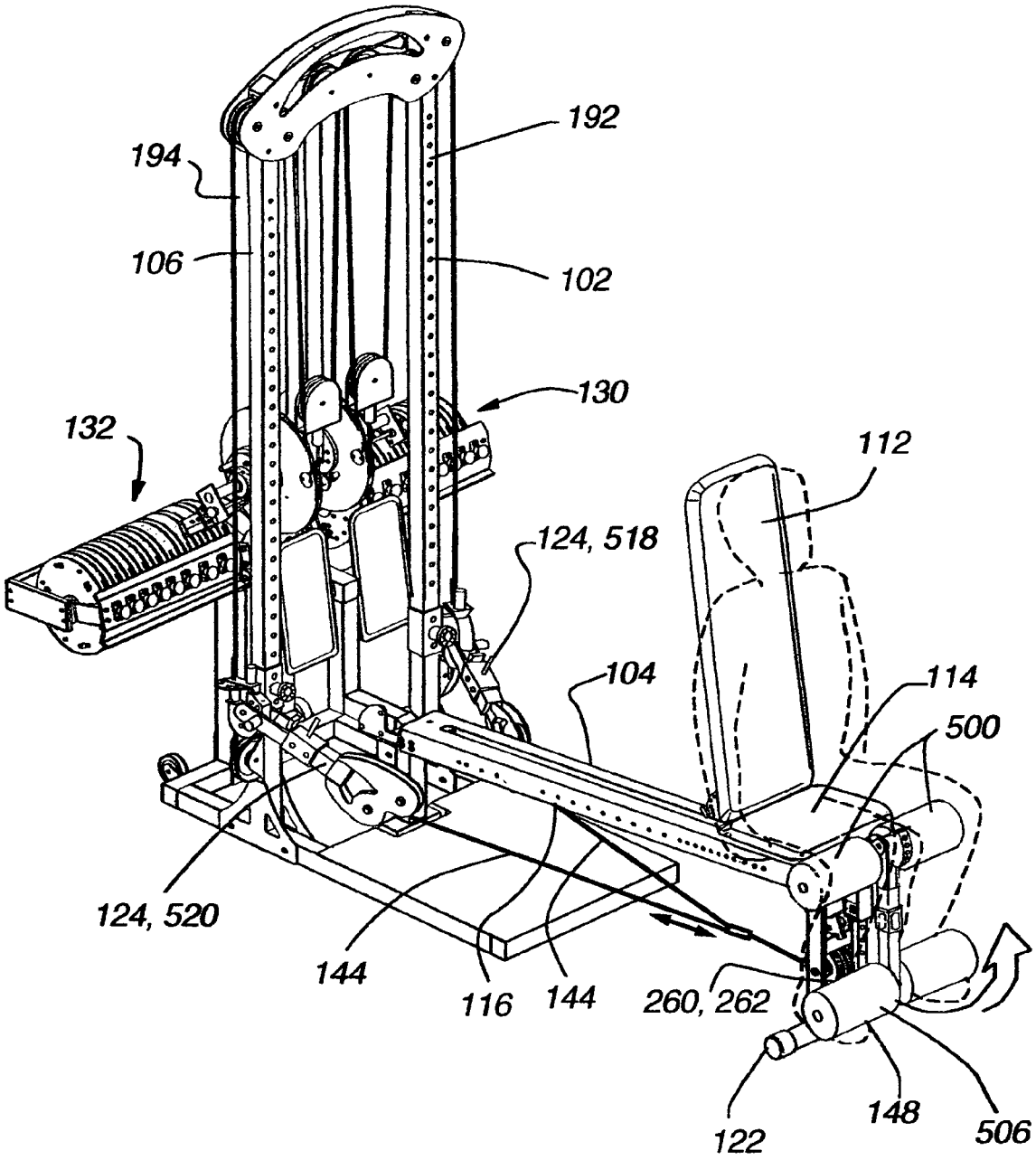
FIG. 2A is a view of the exercise device configured for leg extension exercises.

Embodiments of the exercise devices are described herein with the perspective of a user seated on the bench while facing the main frame 106 and resistance system 128. For example, components designated as "right" are on the right side of the exercise device from the perspective of a user in the previously described position. In many instances, however, users will operate an exercise device conforming to some aspect of the invention while seated facing away from the frame and resistance system, such as shown in FIG. 2A or not seated at all. As such, aspects of the invention are not limited to the orientation of a user, and left and right references are provided merely for the convenience of the reader.

Figure 2B:
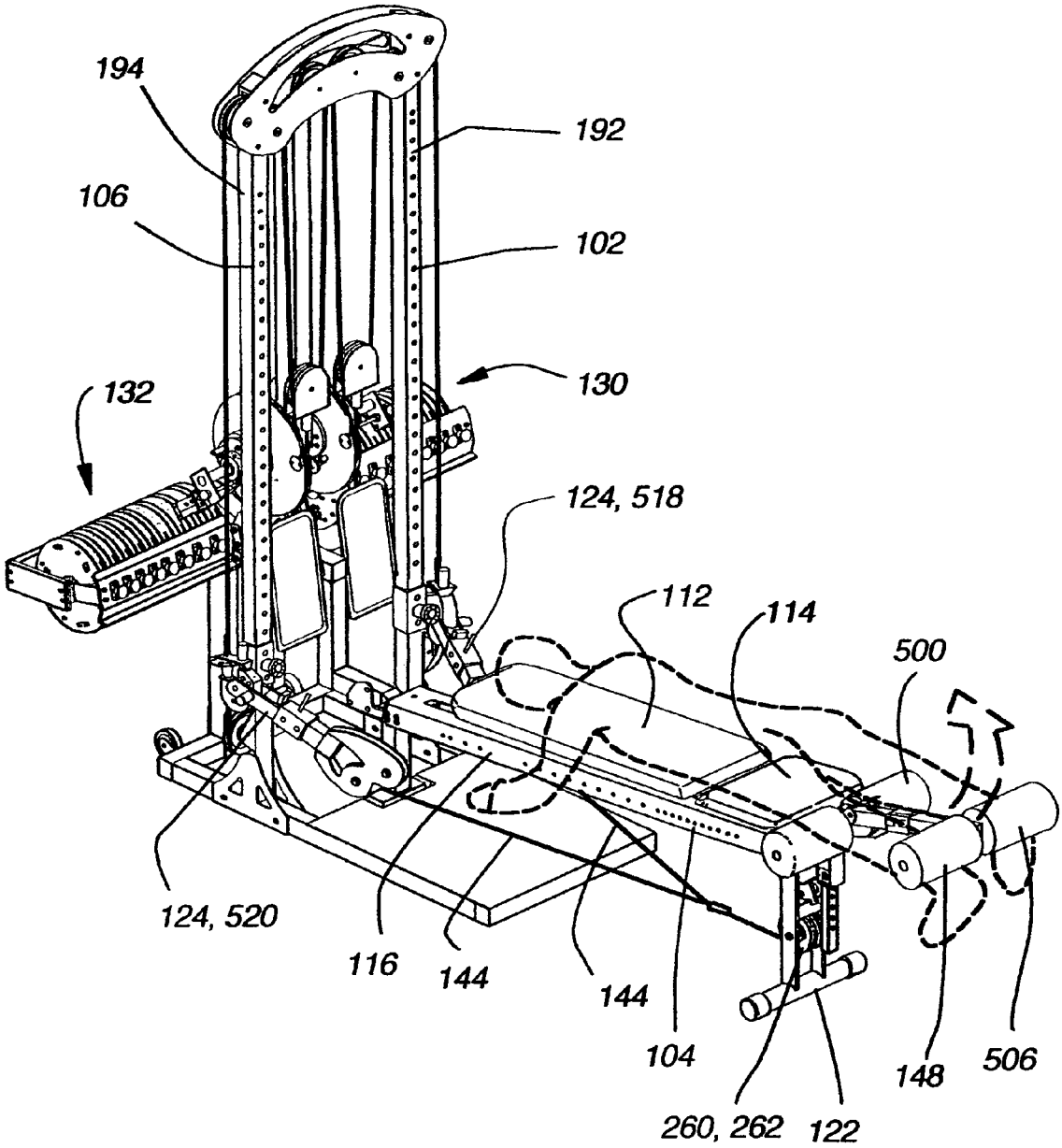
FIG. 2B is a view of the exercise device configured for leg curl exercises.
Figure 2C:
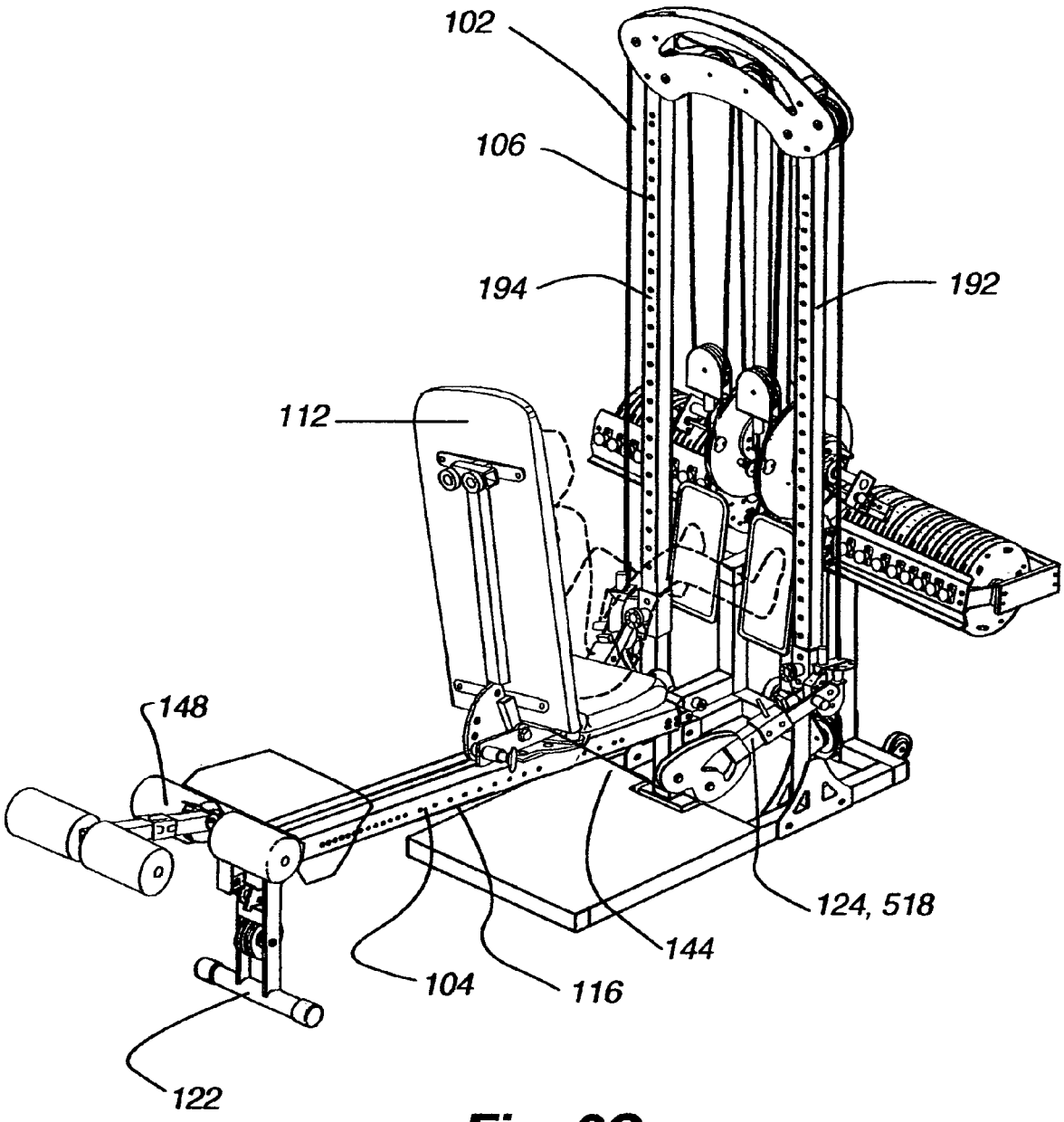
FIG. 2C is a view of the exercise device configured for leg press exercises.
Figure 2D:
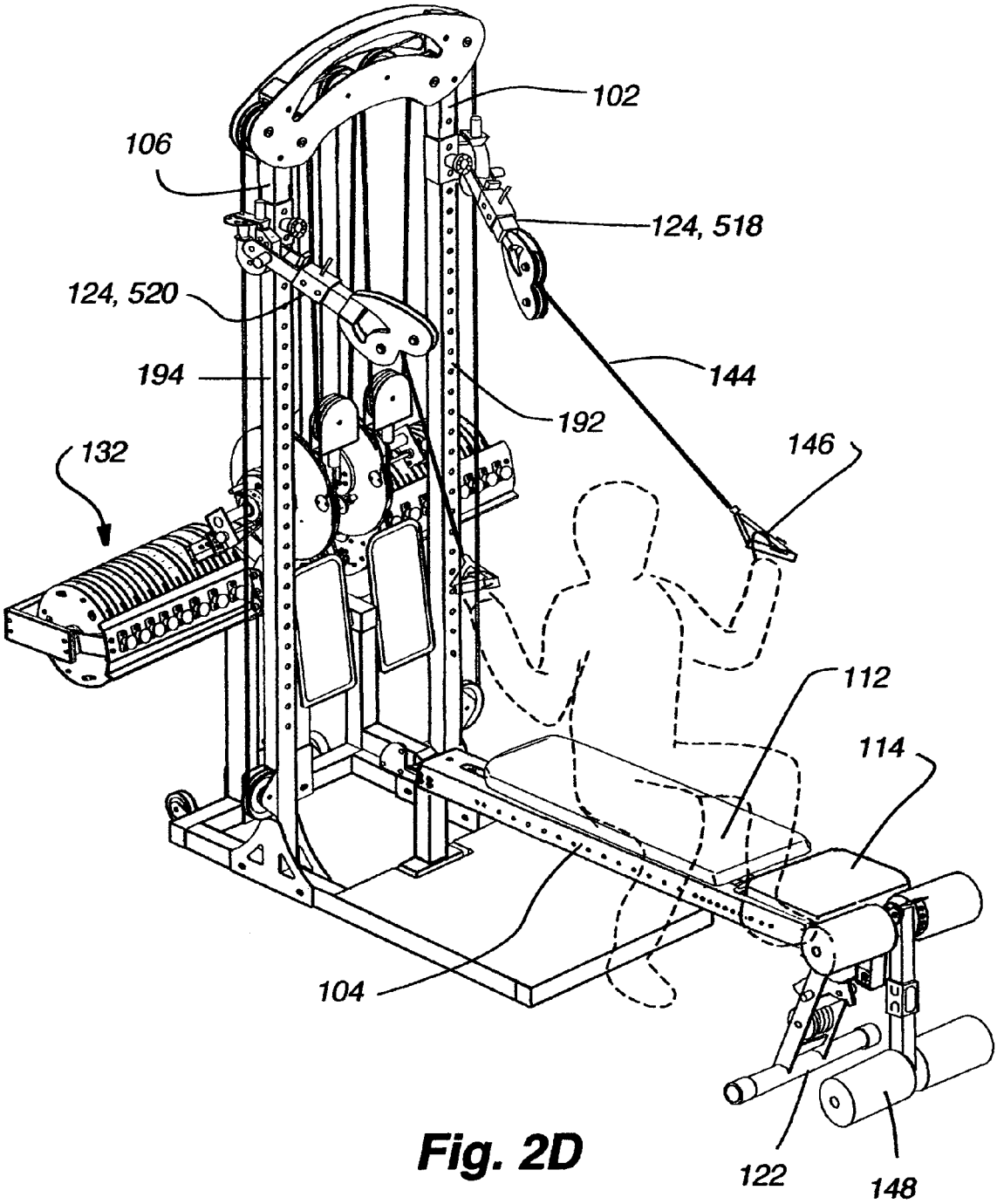
FIG. 2D is a view of the exercise device configured for pull-down exercises.
Figure 2E:
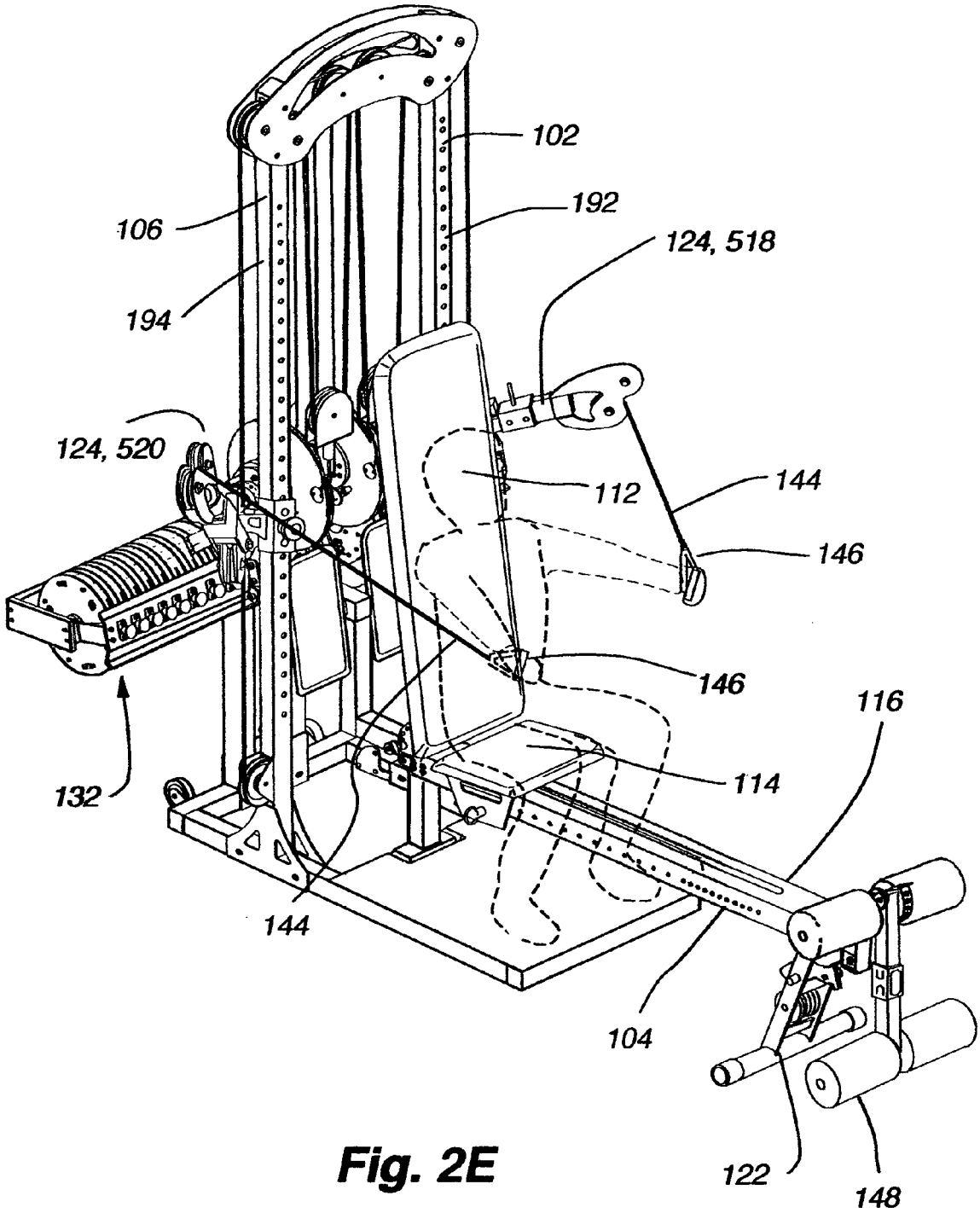
FIG. 2E is a view of the exercise device configured for bench press exercise.
Figure 2F:
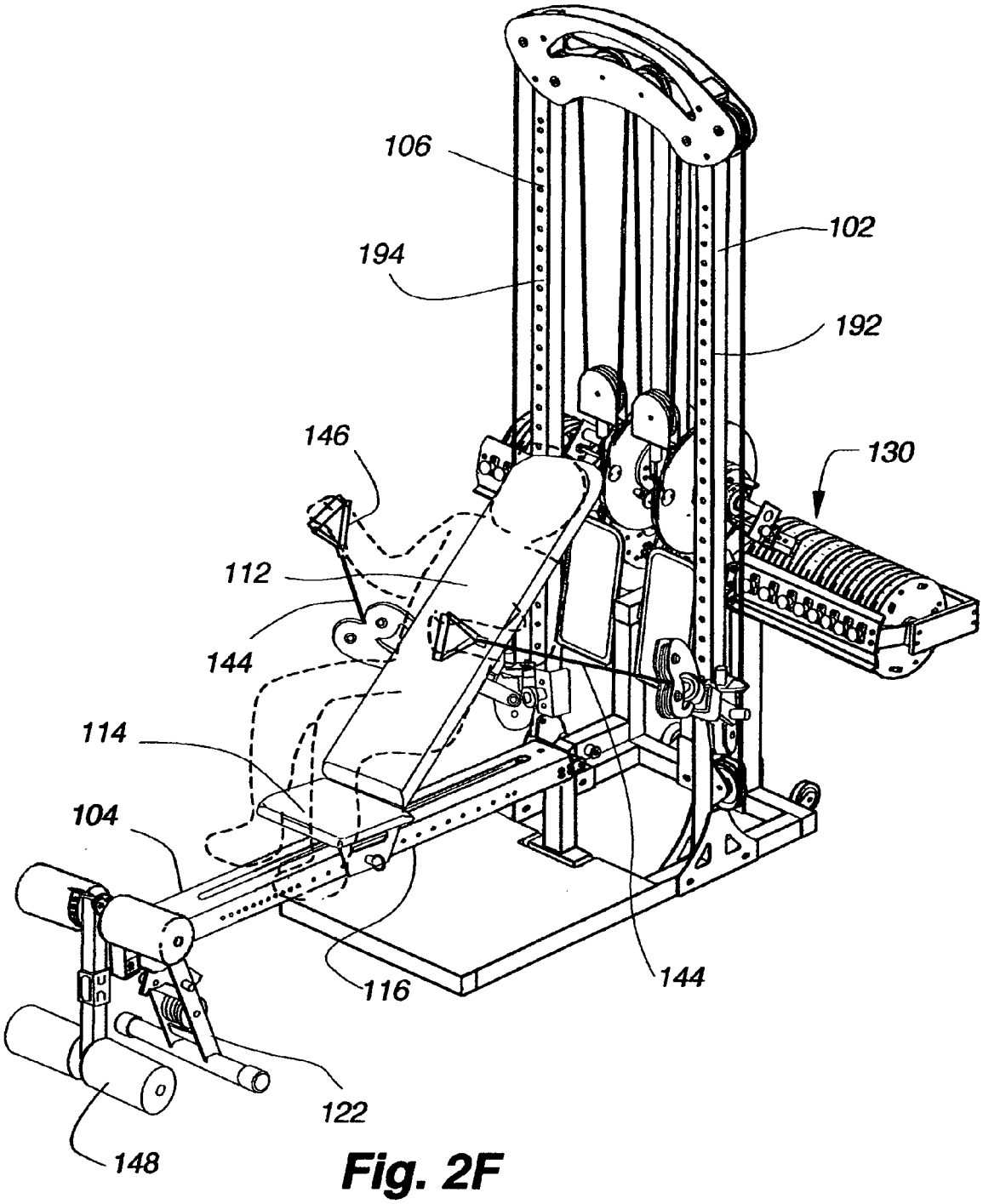
FIG. 2F is a view of the exercise device configured for inclined bench press exercises.

FIGS. 2A-2H illustrate the bench frame 104 in various orientations. As introduced above, the forward bench support 122 is pivotally connected with the seat rail 116 to allow a user to selectively adjust the level and height of the seat rail. For example, as shown in FIGS. 2A-2C, the forward bench support 122 is substantially vertical with respect to the support surface, which causes the second end portion 120 of the seat rail 116 to be elevated relative to the first end portion 118 of the seat rail. The orientations shown in FIGS. 2A-2C provide proper clearance for operation of various types of actuation devices 146, such as a leg developer assembly 148 fitted to a forward portion of the bench frame 104. The leg developer assembly can be configured to allow a user to perform leg extensions, leg curls, and other leg exercises. As shown in FIGS. 2D-2F, a bottom portion of the forward bench support 122 is moved rearwardly such that the forward bench support is tilted with respect to the support surface. As such, the second end portion 120 of the seat rail 116 is pivoted downward from the position of FIGS. 2A-2C to be substantially level with respect to the support surface. The orientations shown in FIGS. 2D-2F and others, provides a substantially level seat rail 116, which is advantageous for performing back squats, rowing, and other exercises where the bench seat 114 moves along the rail 116 during exercise. The substantially level seat rail is also useful in exercises where the seat is stationary. Thus, FIGS. 2A-2H illustrate various use configurations of the bench.

As discussed in more detail below, the bench frame can also be configured to allow a user to place the exercise device in a storage configuration. For example, as shown in FIG. 2H, the exercise device can be placed in a storage configuration by pivoting the second end portion 120 of the seat rail 116 upward toward the main frame 106 until the seat rail is substantially vertical with respect to the support surface. As discussed in more detail below, the seat rail 116 can also be selectively locked in the storage position.

As previously mentioned, the back support 112 and the bench seat 114 can be individually and collectively adjustable. For example, the bench seat 114 may be rollingly coupled with the seat rail 116 such that the bench seat can roll back and forth along the length of the seat rail. Additionally, the back support 112 may be selectively locked in various locations relative to the seat rail. For example, FIGS. 2A, 2E, and 2F show the bench seat 114 selectively locked into various positions along the length of the seat rail 116. Embodiments of the exercise device also allows the user to configure the bench seat 114 to roll freely back and forth along the seat rail. In addition, some embodiments of the bench seat 114 can also selectively rotate or swivel with respect to the seat rail. For example, as shown in FIG. 2A, the bench seat 114 is forward the back support 112 so that a user may sit in a forward direction away from the main frame 106. In contrast, FIG. 2C shows the seat 114 rotated 180.degree with the back support 112 forward the bench seat so that the user may sit in a rearward direction toward the main frame 106. Further, as the back support 112 can also be tilted or pivoted with respect to the seat rail 116 and bench seat 114. For example, FIGS. 2A and 2E show the back support 112 locked in a position that is substantially orthogonal with respect to the bench seat 114, whereas FIG. 2B shows the back support 112 adjacent the seat rail 116 wherein the back support and bench seat collectively define a flat bench. Detailed descriptions related to component structures of the exercise device that provide the various reconfiguration capabilities of the exercise device are provided below.

Figure 3A:
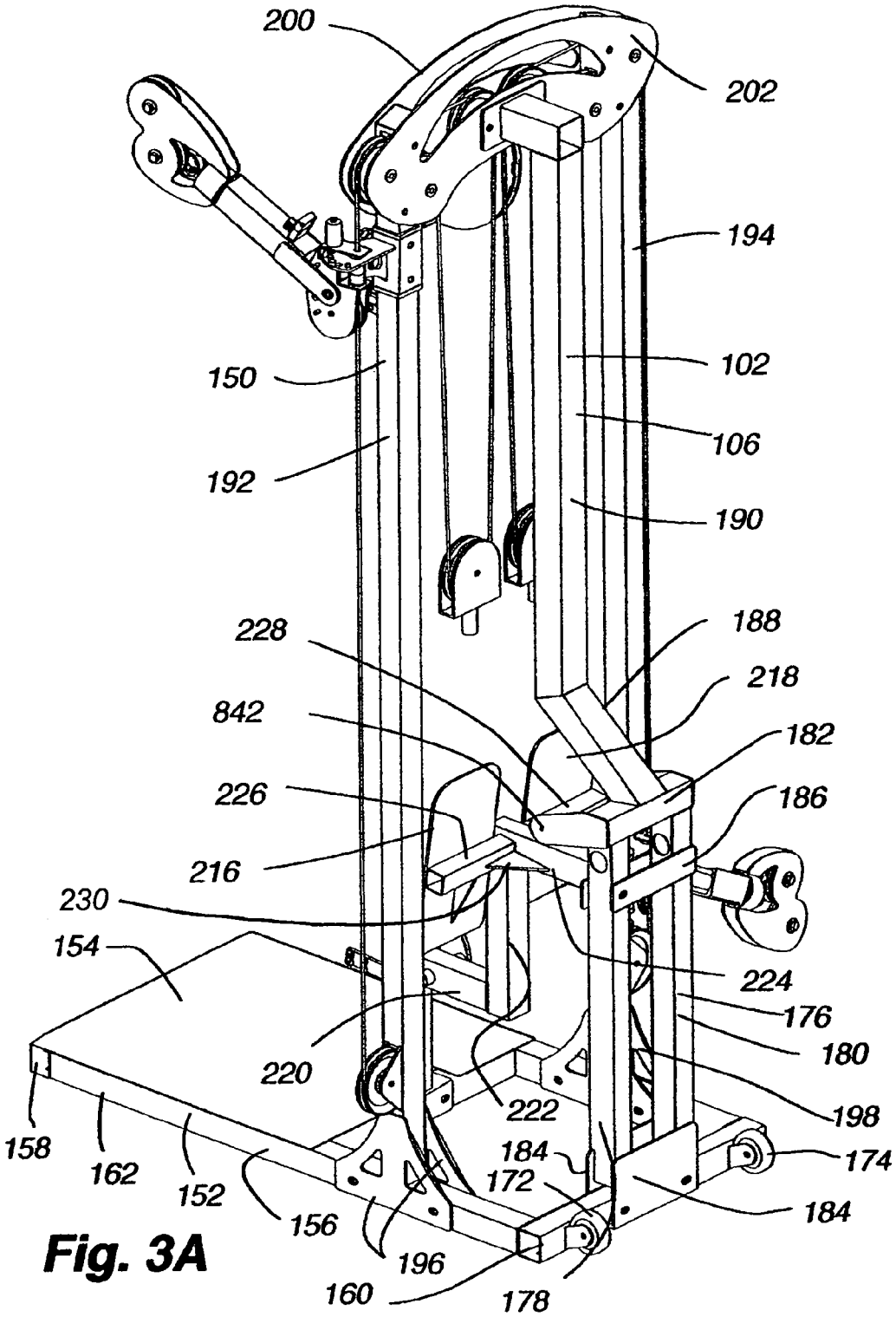
FIG. 3A is a right rear isometric view of an upright portion of a main frame of the exercise device.
Figure 3B:
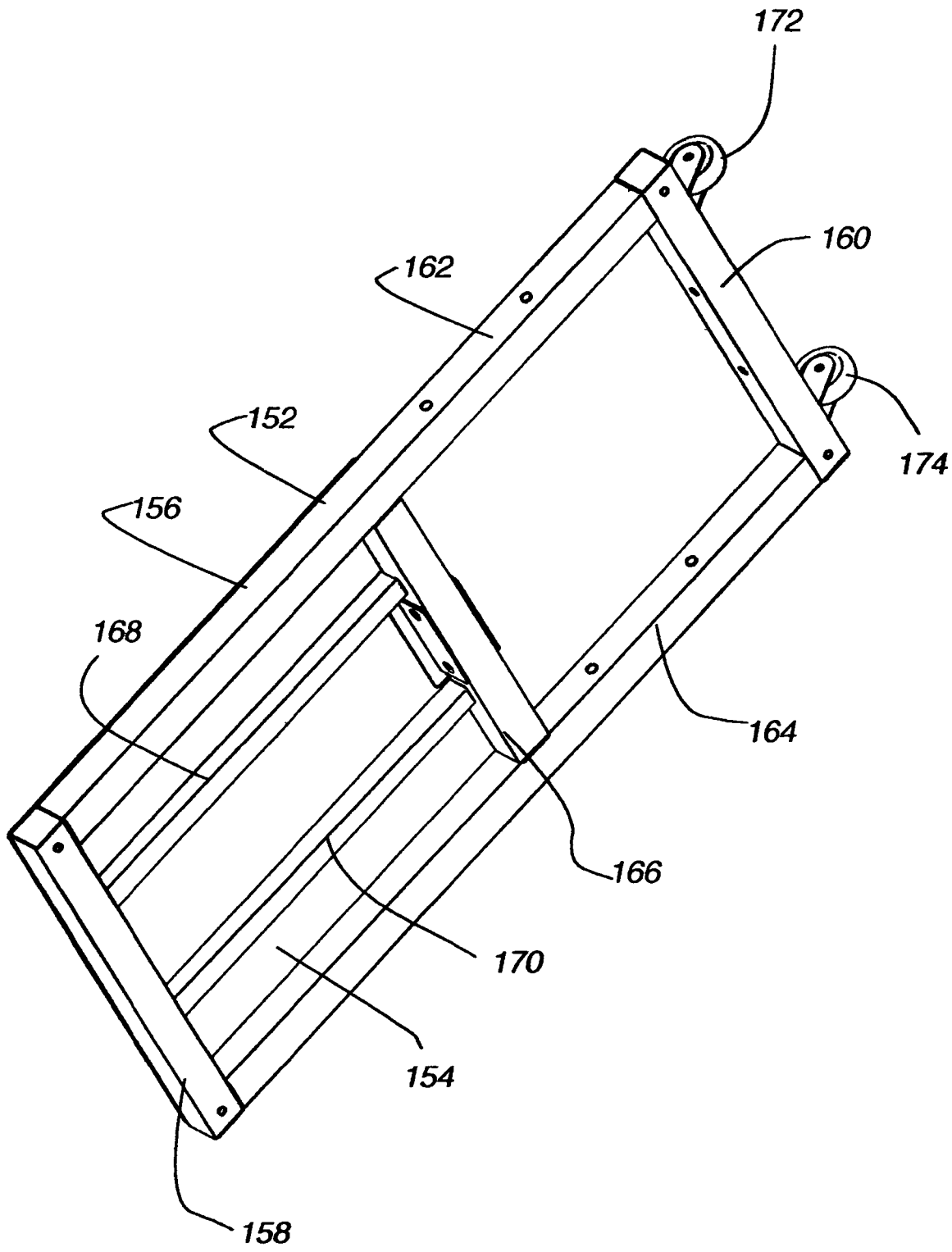
FIG. 3B is a bottom isometric view of the base structure of the main frame.
Figure 3C:
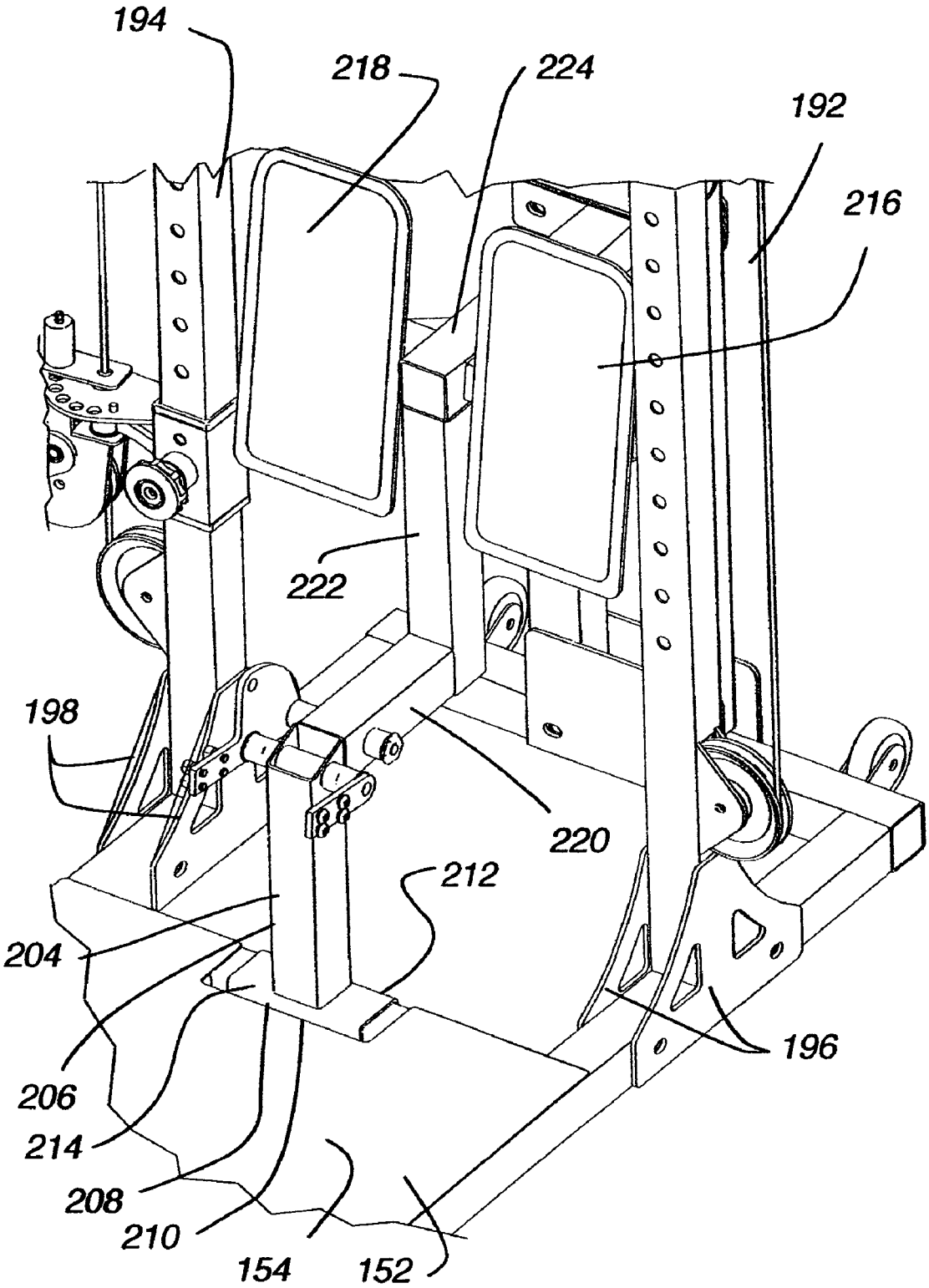
FIG. 3C is a partial view of a bench support portion of the main frame.

As previously mentioned, the main frame 106 of the exercise device 100 supports the resistance system 128, the adjustable arm assemblies 124, and the cable-pulley system 126. Further, the main frame 106 pivotally supports the first end portion 118 of the seat rail 116. As shown in FIGS. 3A-3C and others, the main frame 106 includes an upright structure 150 supported by a base structure 152. The base structure 152 includes a platform plate 154 supported on a substantially rectangular-shaped base frame 156. The base frame 156 includes front and rear cross members 158, 160 connected with and separated by right and left base members 162, 164. The platform plate 154 is supported on upper surfaces of forward end portions of the right and left base members 162, 164 as well as an upper surface of the front cross member 158. The base frame 156 also includes a plate support cross member 166 connected between the right and left base members supporting a rear end portion of the platform plate 154. Right and left plate support members 168, 170 extend between the front cross member 158 and the plate support cross member 166 provide additional support to the platform plate 154.

As shown in FIG. 3A, right and left wheels 172, 174 are rotatably connected with the rear cross member 160 that allow a user to maneuver the exercise device along a support surface from one location to another. Although the exercise device includes wheels, it is to be appreciated that the exercise device can also include rollers, skid plates, or other components to assist with maneuvering the exercise device. When the main frame 106 is supported by the base frame 156, the wheels are positioned adjacent to and slightly above the support surface. To move the exercise device from one location to another, a user can first place the exercise device 100 in the storage configuration shown in FIG. 2H. Once in the storage configuration, the user can pivot the main frame 106 rearward to bring the wheels 172, 174 into engagement with the support surface. The user can then roll the exercise device 100 along the support surface to a desired location.

As previously mentioned, the resistance system 128 is connected with and supported by the main frame 106. More particularly, the upright structure 150 of the main frame includes a resistance support portion 176 defined by an arrangement of frame members for supporting the resistance system 128. As shown in FIG. 3A, the resistance support portion 176 includes a right rear upright member 178 and a left rear upright member 180 connected the rear cross member 160 on the base frame 156. The right rear upright member 178 and the left rear upright member 180 extend upward from the rear cross member 160 and connect with an upper cross member 182. Front and rear base plates 184 are connected with front and rear surfaces of the rear upright members 178, 180 and the rear cross member 160 to provide additional strength to the connections of these members. Front and rear upper cross plates 186 are connected with upper end portions of the right and left rear upright members 178, 180 to provide additional stability the rear upright members. A transmission support member 188 extending upward and forward from the upper cross member 182 supports a lower end portion of a rear upright pulley support member 190. As discussed in more detail below, the combination of the transmission support member 188 and the right and left rear upright members 178, 180 support the resistance system 128 as well as a portion of the cable-pulley system 126.

As shown in FIG. 3A, the main frame 106 further includes right and left upright members 192, 194 that support the arm assemblies. The right and left upright members 192, 194 are connected with end extending upward from the right and left base members 162, 164 of the base frame 156, respectively. For additional structural stability, a pair of right support brackets 196 and a pair of left support brackets 198 are connected with lower end portions of the right and left upright members 192, 194 and the base frame 156. In addition, front and rear upper pulley plates 200, 202 are connected between upper end portions of the right and left upright members. As discussed in more detail below, the front and rear pulley plates rotatably support four pulleys forming a portion of the cable-pulley system 126.

As previously mentioned, the first end portion 118 of the seat rail 116 is pivotally connected with the main frame 106. More particularly, the seat rail 116 is pivotally connected with a bench support portion 204 of the main frame 106, which is defined by an arrangement of frame members. As shown in FIGS. 3A and 3C, the bench support portion 204 includes a forward upright member 206 connected with and extending upward from the base structure 152. A bottom end portion of the forward upright member 206 is connected with a base connection member 208, which in turn, is connected with the plate support cross member 166. The base connection member 208 defines a substantially U-shaped cross section defined by front and rear sides 210, 212 connected with a top side 214. When the base connection member 208 is connected with the plate support cross member 166, the front, rear, and top sides of the base connection member 208 are positioned adjacent to corresponding sides of the plate support cross member. As discussed in more detail below, the bench frame 104 is pivotally connected with the forward upright member 206.

As shown in FIGS. 3A and 3C, the bench support portion 204 of the main frame 106 also supports right and left foot plates 216, 218. The foot plates provide platforms upon which a user can place his feet when performing various exercises, such as leg press exercises as shown in FIG. 2C. Referring to FIG. 3A, the bench support portion 204 includes a forward foot plate support member 220 connected with an upper end portion of the forward upright member 206. The forward foot plate support member 220 extends rearward from the forward upright member 206 and is connected with a bottom end portion of a foot plate upright member 222. The foot plate upright member extends upward and connects with a forward end portion of a rear foot plate support member 224. In turn, the rear foot plate support member 224 extends rearwardly from an upper end portion of the foot plate upright member 222 and connects with the front upper cross plate 186 on the resistance support portion 176 of the main frame 106. The right and left foot plates 216, 218 are connected with and are supported by right and left foot plate support members 226, 228 extending outward from opposing right and left sides of the rear foot plate support member 224. To provide additional support to the right and left foot plate support members, angle brackets 230 are connected with the rear foot plate support member 224 and the right and left foot plate support members 226, 228.

As previously mentioned, the bench assembly 108 and bench frame 104 can be adjustable to support a user's body in different positions while performing various types of exercises. As shown in FIGS. 2A-2H, the bench assembly 108 includes the bench 110 with the back support 112 and the bench seat 114 adjustably connected with the bench frame 104. The incline of bench frame 104 can be adjusted relative to the support surface, and the incline of the back support 112 can be adjusted relative to the bench seat 114. The bench assembly 108 further provides the user with the ability to swivel the bench seat. The user can also selectively adjust the position of the seat along the length of the seat rail 116 and also configure the seat to freely roll back and forth along the seat rail.

Figure 4B:
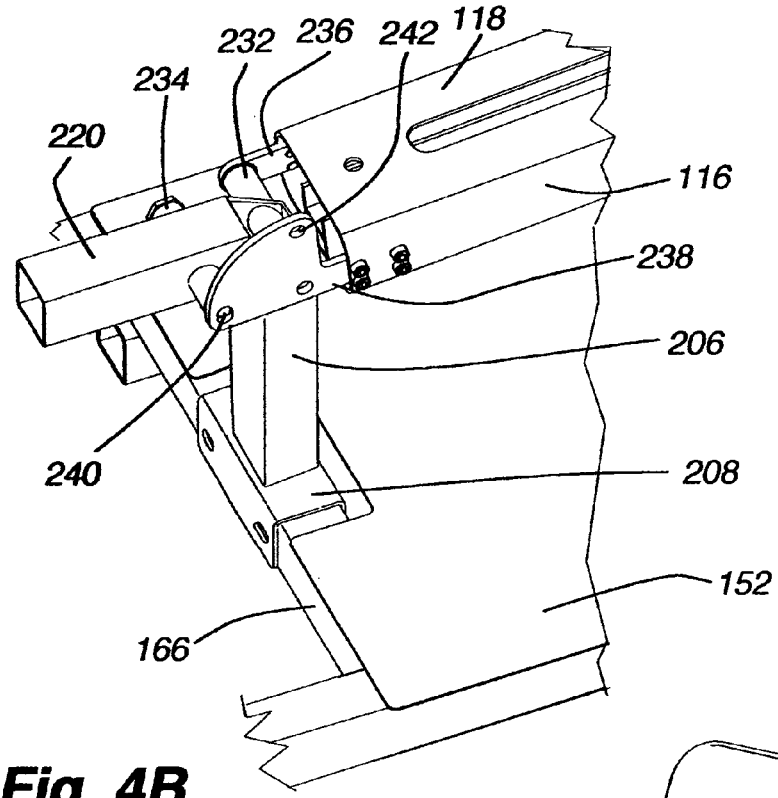
FIG. 4B is a detailed view of a pivotal connection between the bench frame and the bench support portion of the main frame.
Figure 4A:
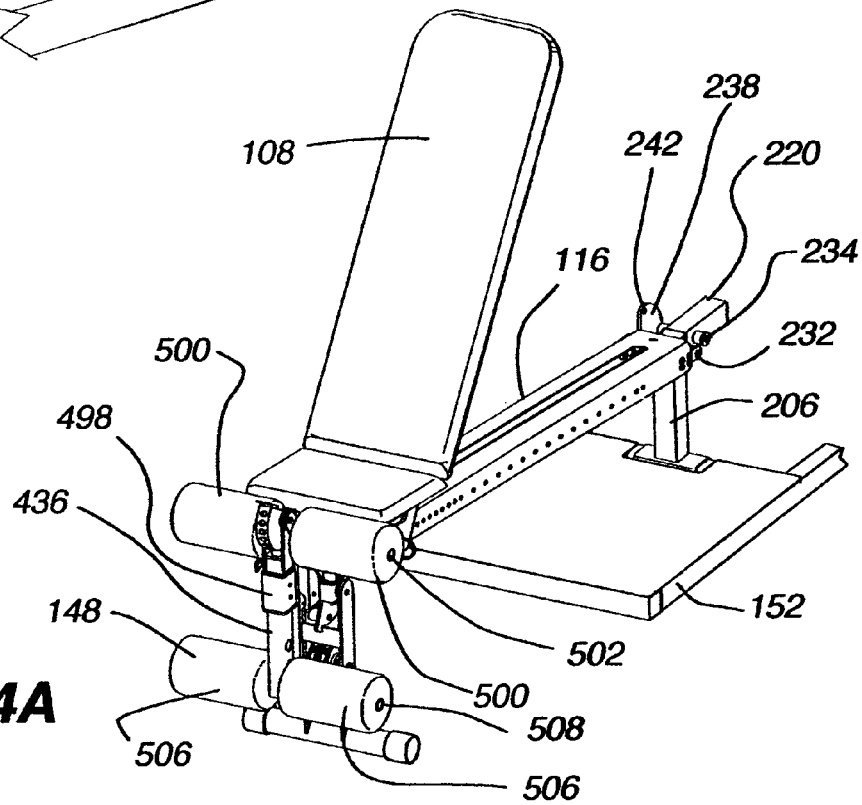
FIG. 4A is a detailed view of bench frame connected with a bench support portion of a main frame.

As previously mentioned, the first end portion 118 of the seat rail 116 is pivotally connected with the forward upright member 206 and can be selectively placed in an upward storage configuration and a downward operating configuration. More particularly, the seat rail 116 is pivotally connected with the forward upright member 206 through a first seat rail axle 232. As shown in FIGS. 4A and 4B, right and left seat rail axle brackets 236, 238 extending from the first end portion 118 of the seat rail 116 include apertures adapted to receive opposing end portions of the first seat rail axle 232, which, in turn, is supported by an upper end portion of the forward upright member 206. As such, the seat rail can pivot about the first rail axle to place the seat rail in the operating configuration and the storage configuration. In some embodiments of the exercise device, the bench frame 104 can be selectively locked in the operating and storage configurations. For example, as shown in FIG. 4B, the exercise device includes first seat rail pop-pin 234 adapted to engage the seat rail 116 to lock the seat rail in the operating and storage configurations. More particularly, the first seat rail pop-pin 234 is supported by the forward foot plate support member 220 and is adapted to selectively engage a first aperture 240 and a second aperture 242 in the left seat rail axle bracket 238.

When the bench frame 104 is in the operative position, as shown in FIGS. 2D and 4B for example, the first seat rail pop-pin 234 is engaged with the first aperture 240 in the left seat rail axle bracket 238. As such, the seat rail 116 is a locked in a downward position that is substantially horizontal with respect to the support surface. In some embodiments that allow the seat rail incline to be adjusted while in the operating configuration, the first aperture 240 can be elongated to allow the seat rail 116 to pivot slightly to allow the seat rail incline to be adjusted. To place the bench frame in the storage configuration, as shown in FIG. 2H for example, a user disengages the first seat rail pop-pin 234 from the first aperture 240 and lifts the second end portion 120 of the seat rail 116 upward. As the second end portion of the seat rail is lifted upward, the seat rail 116 pivots about the first seat rail axle 232 until the first seat rail pop-pin 234 engages the second aperture 242 on the left seat rail axle bracket 238. Once the first seat rail pop-pin engages the second aperture, the seat rail is held in a substantially vertical position with respect to the support surface. To return the bench frame to the operative position, the first seat rail pop-pin 234 is disengaged from the second aperture 242 and the second end portion 120 of the seat rail is lowered until the first seat rail pop-pin engages the first aperture 240.

Figure 4D:
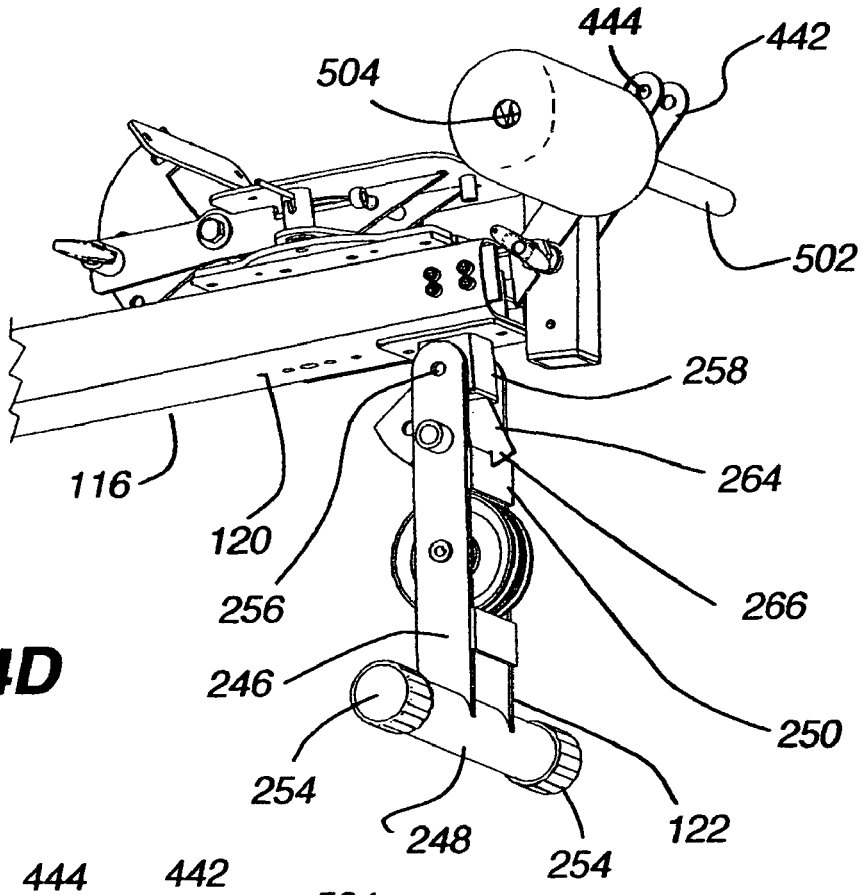
FIG. 4D is a detailed left isometric view of the forward bench support.
Figure 4C:
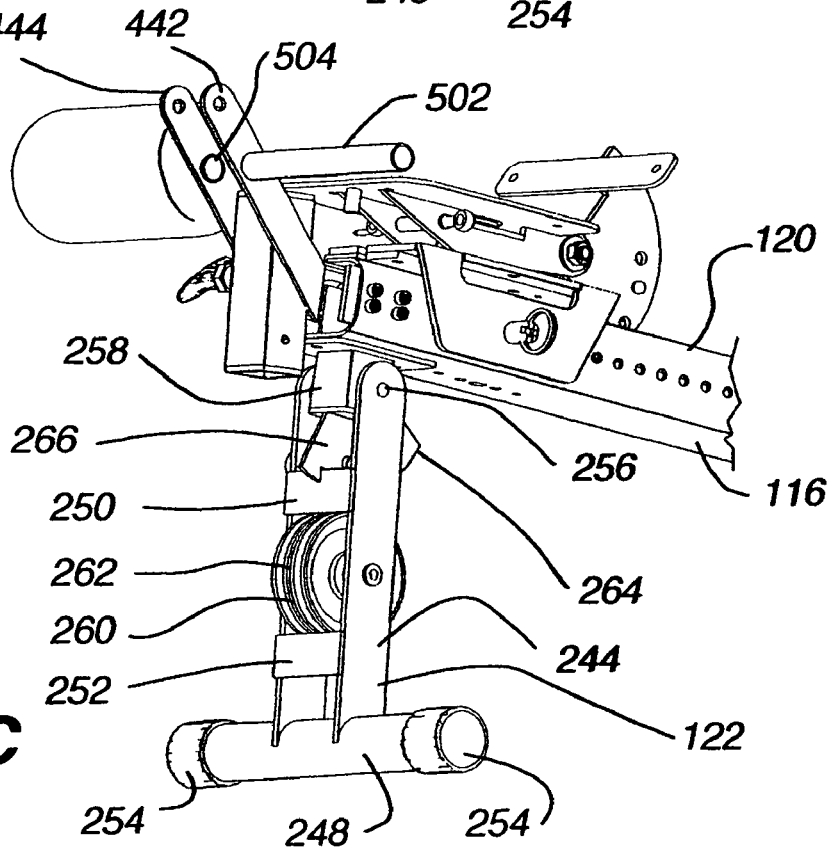
FIG. 4C is a detailed right isometric view of a forward bench support.

As previously mentioned, the incline of the bench frame on some embodiments of the exercise device can be adjusted while in the operating configuration. For example, as shown in FIGS. 4C and 4D, the forward bench support 122 of the exercise device 100 is pivotally connected with and supports the second end portion 120 of the seat rail 116 to allow the incline of the seat rail to be adjusted. As mentioned above with respect to FIGS. 2A-2C, when the forward bench support 122 is substantially vertical with respect to the support surface, the second end portion 120 of the seat rail 116 is elevated relative to the first end portion 118 of the seat rail. Alternatively, as shown in FIGS. 2E-2F, when the forward bench support 122 is pivoted rearwardly such that the forward bench support is tilted with respect to the support surface, the second end portion 120 of the seat rail 116 is pivoted downward from the position of FIGS. 2A-2C to be substantially level with respect to the support surface.

As shown in FIGS. 4C and 4D, the forward bench 122 support includes right and left support members 244, 246 connected with a cross member 248. An upper cross plate 250 and a lower cross plate 252 are connected with front edges of lower and upper end portions, respectively, of the right and left support members. A pair of end caps 254 are connected with opposing end portions of the cross member 248 and are adapted to engage the support surface. The right and left support members 244, 246 extend upward from the cross member and are pivotally connected with the second end portion 120 of the seat rail 116 through a second seat rail axle 256. More particularly, the support members 244, 246 include apertures adapted to receive opposing end portions of the second seat rail axle 256. The second seat rail axle 256, in turn, is supported by an axle support member 258 extending downward from the second end portion 120 of the seat rail 116. As such, the forward bench support can pivot about the second seat rail axle. As shown in FIGS. 4C and 4D, right and left leg station pulleys 260, 262 are rotatably supported between the right and left support members 244, 246 of the forward bench support 122. As discussed in more detail below, the resistance cables 144 can extend from the arm assemblies 124 and partially around the leg station pulleys to connect with various types of actuation devices 146, such as the leg developer assembly 148.

The exercise device 100 can also be configured with a pivotal connection structure 264 that limits the pivotal movement of the forward bench support 122 as well as provide for selected pivotal positioning of the forward bench support. For example, as shown in FIGS. 4C, 4D, and 5A-5AA2, the pivotal connection structure 264 includes an arcuate plate 266 adapted to engage the upper cross plate 250 to limit the range of pivotal movement of the forward bench support. The arcuate plate 266 extends downward from the axle support member 258 between the right and left support members 244, 246. As shown in FIGS. 5AA1 and 5AA2, the arcuate plate 266 includes a curved lower edge 268 with a forward stop 270 and rear stop 272. The forward stop 270 is adapted to engage a front side 274 of the upper cross plate 250 when the forward bench support 122 is pivoted forward as shown in FIG. 5AA1. The rear stop 272 is adapted to engage a rear side 276 of the upper cross plate 250 when the bench support is pivoted rearward, as shown in FIG. 5AA2.

Figure 5:
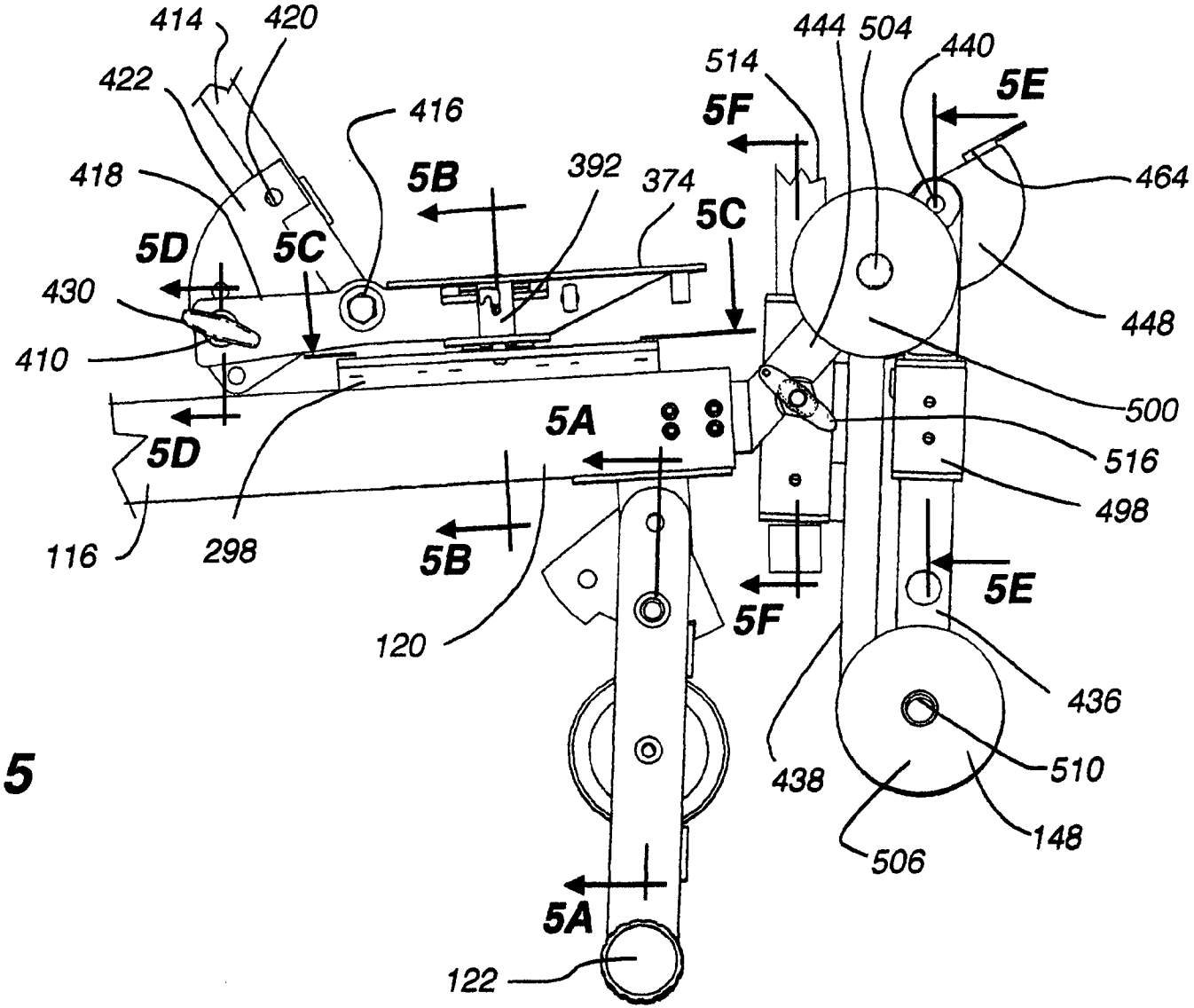
FIG. 5 is a detailed right side view of a seat rail and a forward bench support.
Figure 5A:
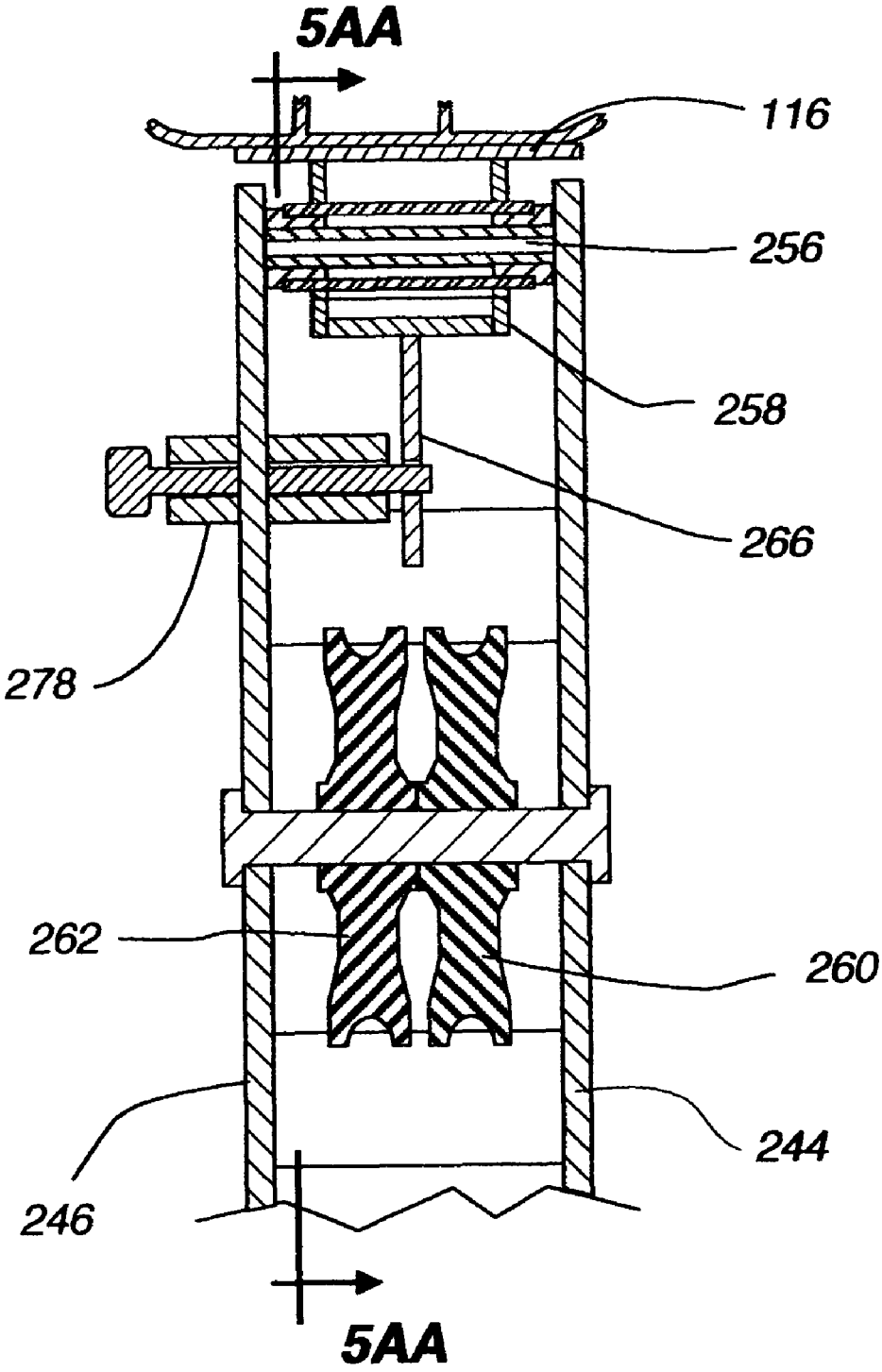
FIG. 5A is a cross-sectional view of the forward bench support depicted in FIG. 5, taken along line 5A-5A.

As shown in FIGS. 5-5AA2, the pivotal connection structure 264 includes a second seat rail pop-pin 278 that provides for selected pivotal positioning of the forward bench support 122. More particularly, the second seat rail pop-pin 278 allows a user to selectively position the second end portion 120 of the seat rail 116 in an inclined position shown for example in FIG. 2C, and a substantially level position shown in FIG. 2D. The second seat rail pop-pin 278 is supported by the left support member 246 and is adapted to selectively engage a forward aperture 280 and a rear aperture 282 in the arcuate plate 266.

Referring to FIGS. 2C and 5AA1, when the bench frame 104 is in the inclined position, the second seat rail pop-pin 278 is engaged with the forward aperture 280 on the arcuate plate 266. In addition, the forward stop 270 on the arcuate plate 266 is in contact with or in close proximity with the front side 274 of the upper cross plate 250. The height of the right and left support members 244, 246 and the cross member 248 elevate the second end portion 120 of the seat rail 116 with respect to the first end portion 118 of the seat rail 116, effectively creating an incline from the second end portion to the first end portion. To place the bench frame 104 in a substantially level position as shown in FIGS. 2D and 5AA2, the second seat rail pop-pin is disengaged from the forward aperture 280, which allows the support members 244, 246 and cross member 248 to pivot rearward toward the main frame 106. Movement of the cross member 248 in a rearward direction causes the right and left support members 244, 246 to pivot about the second seat rail axle 256 until the second seat rail pop-pin 278 engages the rear aperture 282 on the arcuate plate 266. Once the second seat rail pop-pin engages the rear aperture, the right and left support members are held in a tilted position with respect to the support surface. In addition, the rear stop 272 on the arcuate plate 266 is in contact with or in close proximity with the rear side 276 of the upper cross plate 250. The tilting of the right and left support members 244, 246 acts to lower the second end portion 120 of the seat rail 116 with respect to the first end portion 118 such that the first and second end portions are located at substantially the same height above the support surface. To return the bench frame 104 to the inclined position, the second seat rail pop-pin 278 is disengaged from the rear aperture 282 and the cross member 248 is moved in a forward direction until the second seat rail pop-pin 278 engages the forward aperture 280 in the arcuate plate 266.

Figure 6A:
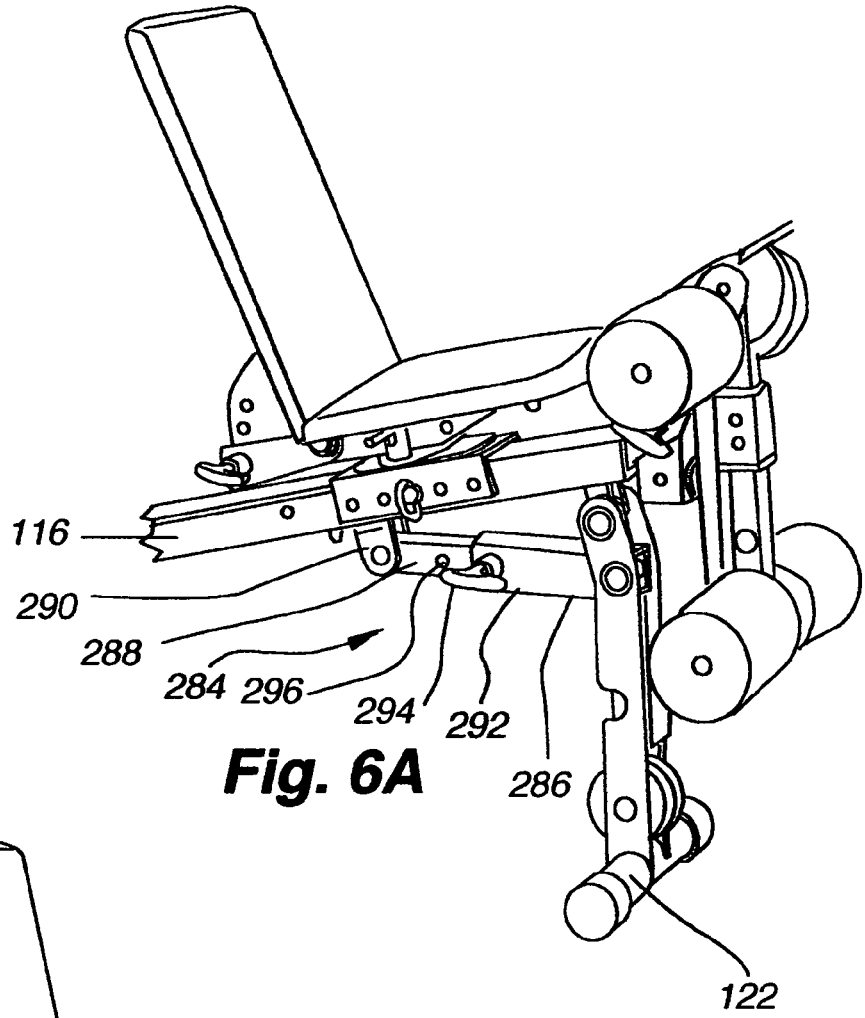
FIG. 6A shows an alternative embodiment of a forward bench support pivotal connection structure.
Figure 6B:
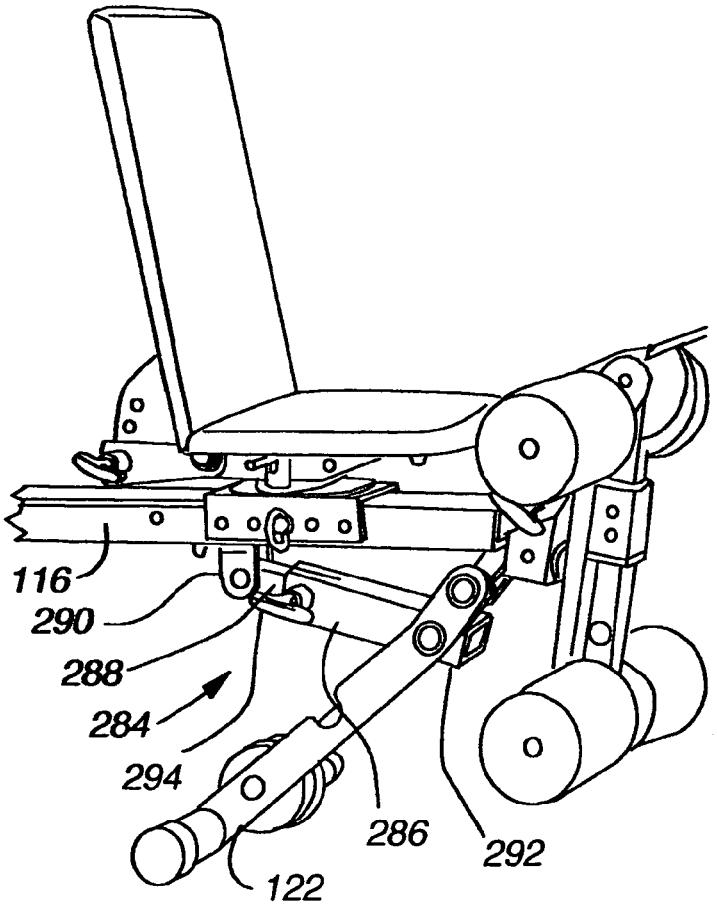
FIG. 6B shows the alternative embodiment of the forward bench support pivotal connection structure with the forward bench support in a tilted position.
Figure 6C:
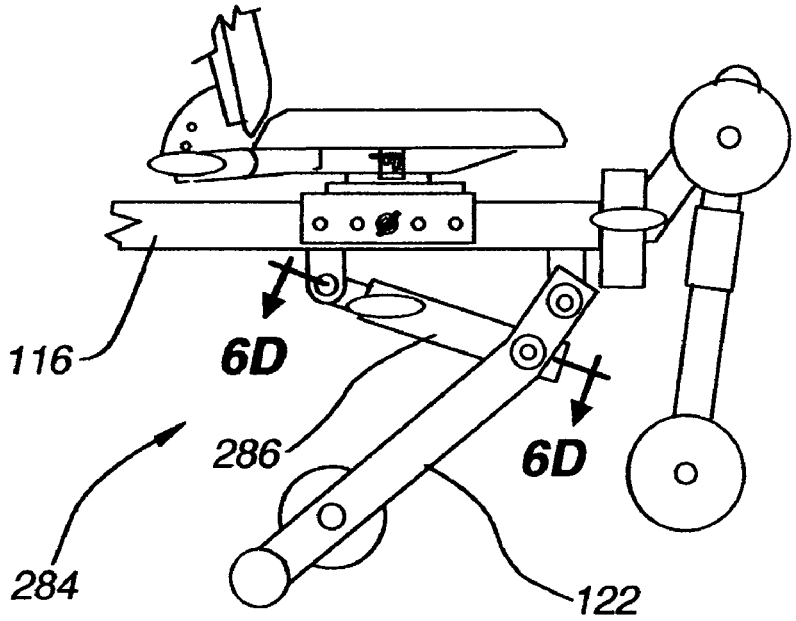
FIG. 6C is a left side view of the alternative embodiment of the forward bench support pivotal connection structure.
Figure 6D:
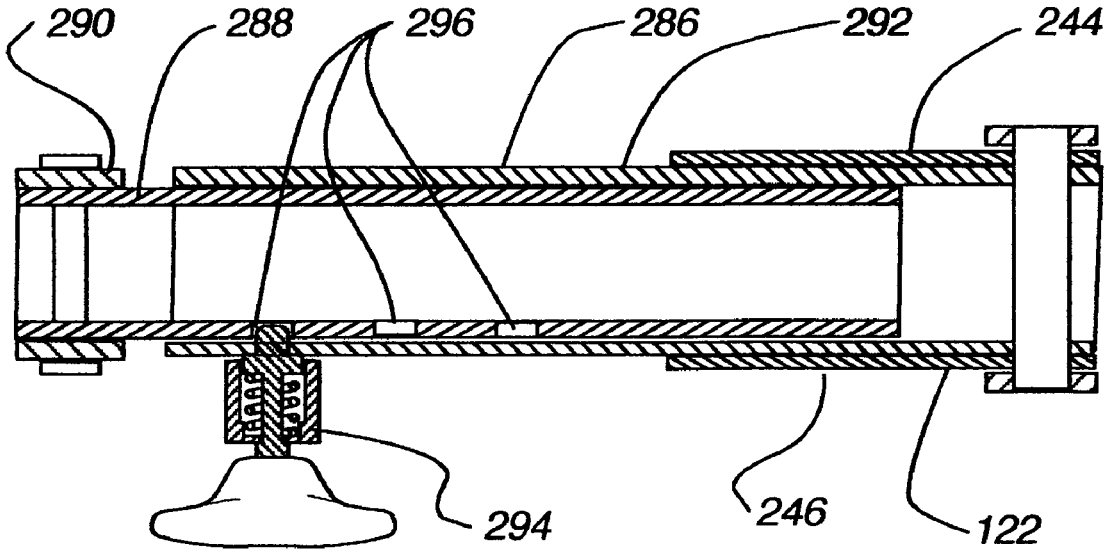
FIG. 6D is a is a cross-sectional view of the forward bench support pivotal connection structure depicted in FIG. 6C, taken along line 6D-6D.
Figure 6E:
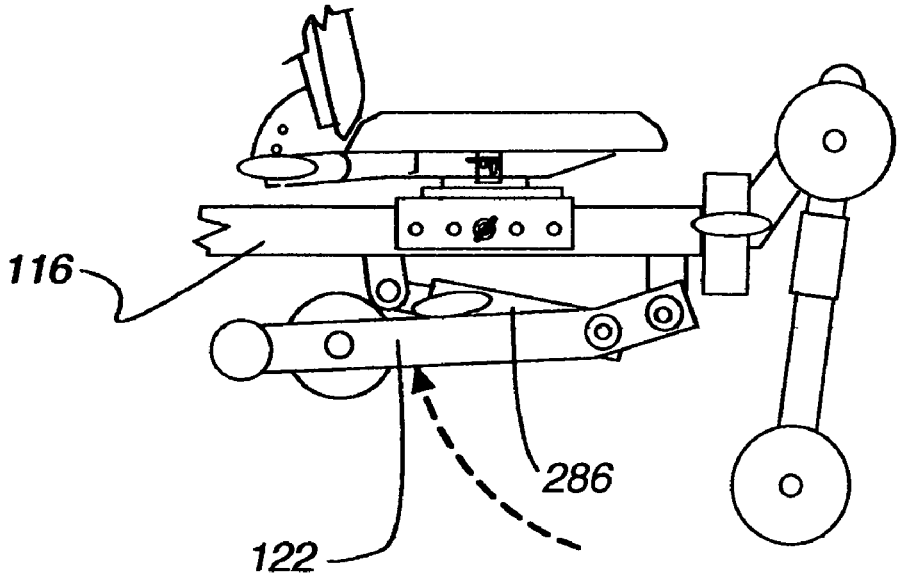
FIG. 6E is a detailed view of the alternative embodiment of the forward bench support pivotal connection structure being placed in a storage configuration.
Figure 6F:
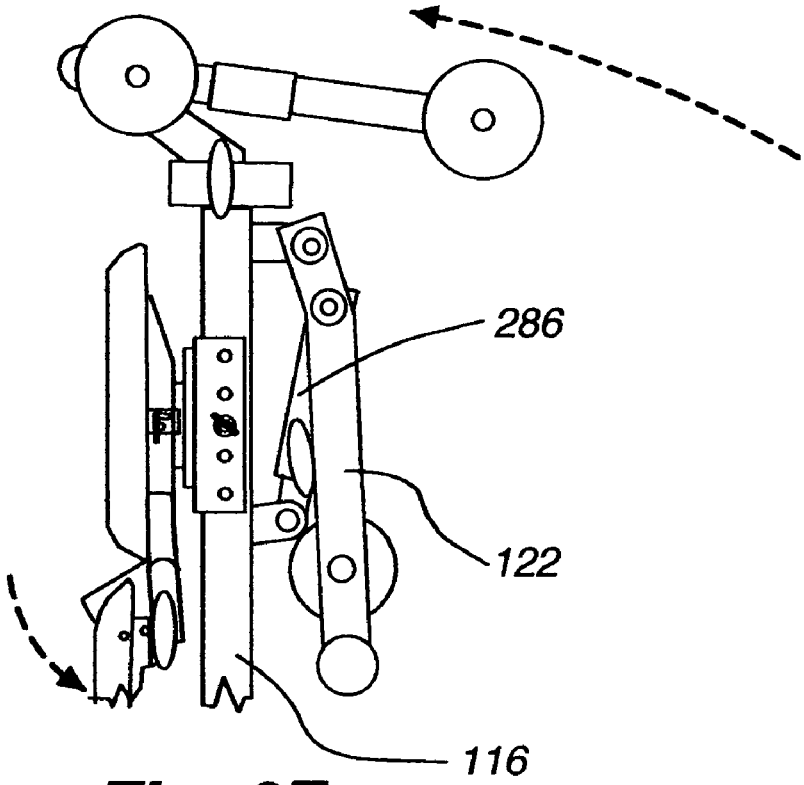
FIG. 6F is a detailed view of the alternative embodiment of the forward bench support pivotal connection structure in a storage configuration.

An alternative embodiment of a pivotal connection structure 284 between the seat rail and the forward bench support 122 is shown in FIGS. 6A-6E. The pivotal connection structure 284 allows the forward bench support 122 to pivot toward the seat rail 116 when the bench frame 104 is placed in the upward storage configuration. In addition, the pivotal connection structure 284 provides for selective adjustment of the seat rail incline. The pivotal connection structure 284 includes a pivot adjustment mechanism 286 connected with the forward bench support 122 and the seat rail 116. The pivot adjustment mechanism 286 provides for selective adjustment of pivotal position of the forward bench support 122 relative to seat rail 116. The pivot adjustment mechanism 286 includes a first member 288 pivotally connected with a support bracket 290 extending downward from the seat rail 116. A second member 292 is pivotally connected between the right and left support members 244, 246 below the second seat rail axle 256. The second member 292 is adapted to telescopically receive the first member 288. A pop-pin 294 supported on the second member 292 is adapted to engage apertures 296 along the length of the first member 288. The pop-pin 294 allows the pivotal position of the forward bench support 122 to be selectively adjusted relative to the seat rail 116. For example, when the pop-pin 294 is disengaged from the apertures 296 in the first member 288, the forward bench support 122 can pivot about the second seat rail axle 256. As the forward bench support 122 pivots rearward and forward about the second seat rail axle, the first member 288 slides into and out of, respectively, the second member 292. When the forward bench support 122 is placed in the desired pivotal position, the pop-pin 294 is engaged with one of the apertures 296 on the first member 288, locking the first and second members in position relative to each other. In turn, the forward bench support 122 is locked into the desired pivotal position relative to the seat rail 116. It is to be appreciated that the second member can include various numbers of apertures to provide for numerous selectable pivotal forward bench support positions. In addition, as previously mentioned, the first and second members 288, 292 can also be configured to allow the forward bench support 122 to pivot about the second seat rail axle 256 to limit the amount the forward bench support protrudes from the seat rail 116 when the seat rail is placed in the storage configuration, as shown in FIGS. 6E and 6F. In particular, FIG. 6E shows the forward bench support being folded upward toward the seat rail and FIG. 6F shows the forward bench support folded with the seat rail in an upright storage configuration.

Figure 5B:
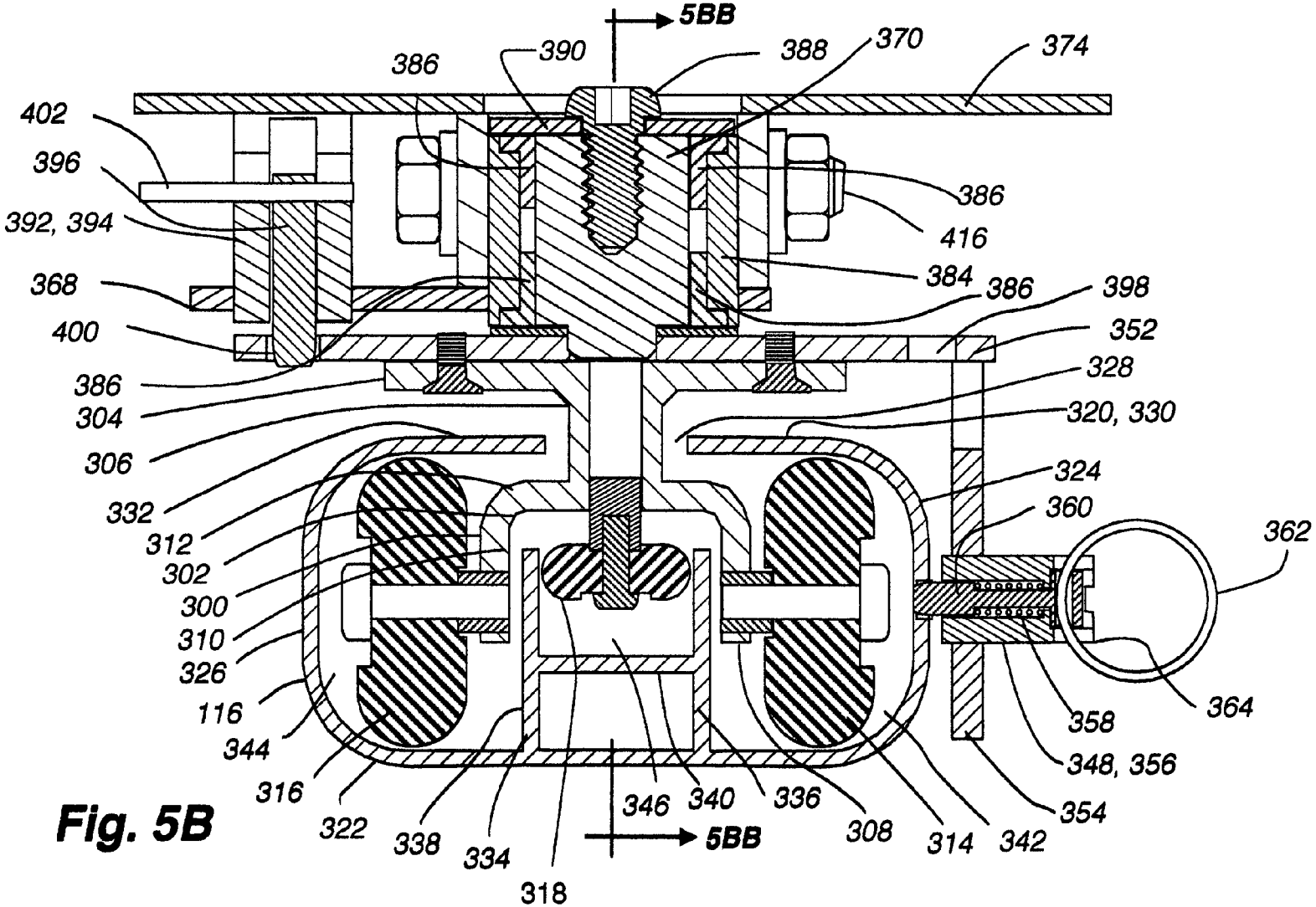
FIG. 5B is a cross-sectional view of the seat rail and wheel car assembly depicted in FIG. 5, taken along line 5B-5B.
Figure 5B:
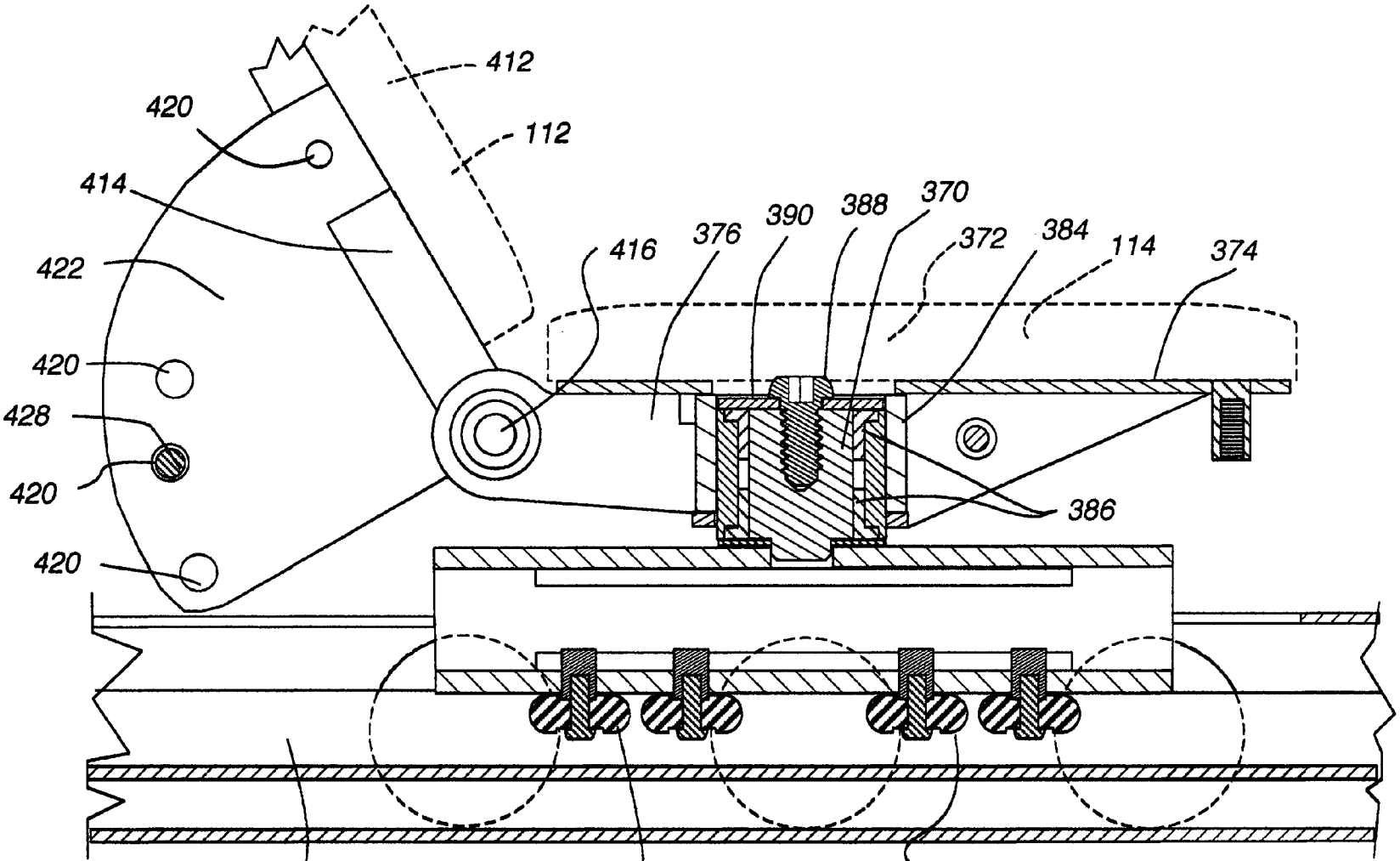
Figure 5C:
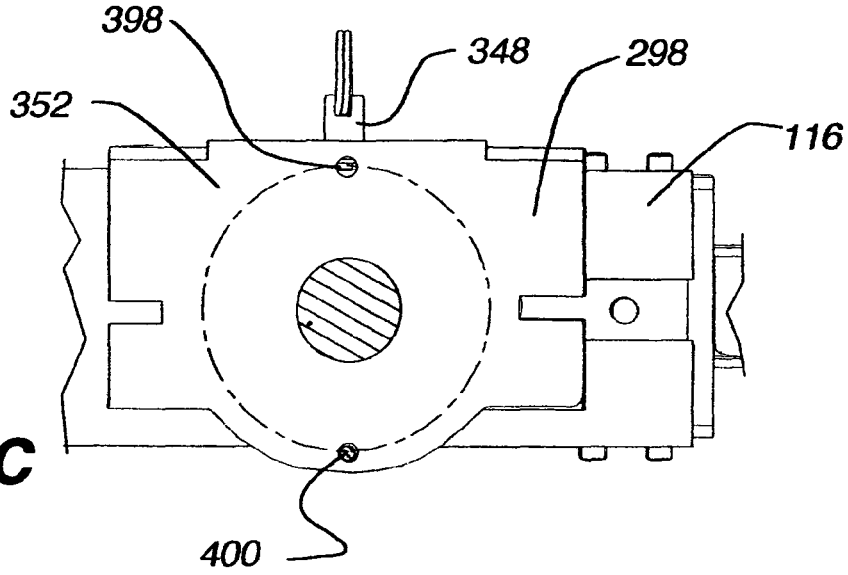
FIG. 5C is a cross-sectional view of the seat rail and wheel car assembly depicted in FIG. 5, taken along line 5C-5C.
Figure 7A:
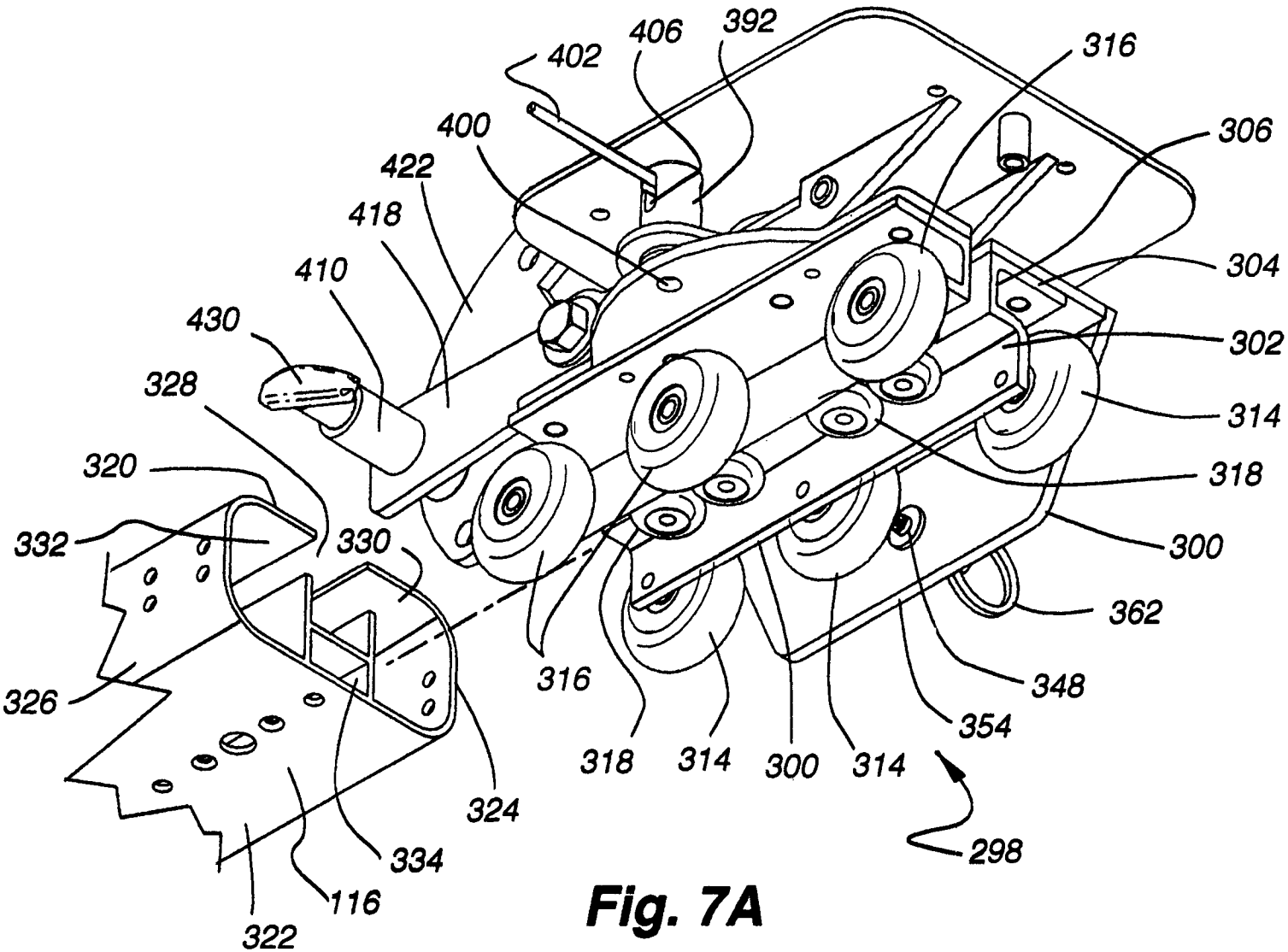
FIG. 7A is an exploded view of the wheel car assembly and the seat rail.

As previously mentioned, the bench seat 114 can be adjustably connected with the bench frame 104 to allow the bench seat to move along the length of the seat rail 116 as well as swivel relative to the seat rail. More particularly, the bench seat 114 is movably coupled with the seat rail 116 through a wheel car assembly 298 that allows a user to roll the bench seat back and forth along the length of the seat rail. As shown in FIGS. 5B, 5BB and 7A, the wheel car assembly 298 includes a body 300 having a lower portion 302 connected with a flat upper portion 304 through a relatively narrow middle portion 306. The lower portion 302 defines a generally upside down U-shaped cross section with a right side 308 and a left side 310 connected with and separated by a top side 312. The right side 308 of the lower portion 302 rotatably supports three right side wheels 314, and the left side 310 of the lower portion 302 rotatably supports three left side wheels 316. The top side 312 of the lower portion 302 rotatably supports four center wheels 318 having an axis of rotation that is substantially orthogonal to the axis of rotation of the side wheels. As shown in FIG. 7A, the seat rail 116 is adapted to receive the wheels on the wheel car assembly 298.

Referring to FIGS. 5B and 7A, the seat rail 116 defines a generally rectangular cross section having a relatively long top and bottom sides 320, 322 connected with and separated by relatively short right and left sides 324, 326. A slot 328 extending the length of the top side 320 the seat rail 116 defines a right top ledge 330 and left top ledge 332. A track member 334 having a generally H-shaped cross section defined by a right side 336 and a left side 338 connected with and separated by a medial side 340 extends the length of the bottom side 322 of the rail 116. A right track 342 is defined between the right side 324 of the seat rail 116 and the right side 336 of the track member 334 and is adapted to rollingly receive the three right side wheels 314 on the wheel car 298. Correspondingly, a left track 344 is defined between the left side 326 of the seat rail 116 and the left side 338 of the track member 334 and is adapted to receive the three left side wheels 316 of the wheel car 298. In addition, a center track 346 defined between the right side 336, left side 338, and medial side 340 of the track member 334 receives the four center wheels 318.

Referring to FIG. 5B, the vertical distance between the bottom side 322 and the right top ledge 330 and the left top ledge 332 of the seat rail 116 is greater than the diameters of the right and left side wheels 314, 316. As such, as the wheel car 298 moves along the length of the seat rail 116, each of the six side wheels roll along either the bottom side 322 or the top side 320 of the seat rail 116. The wheel car assembly 298 is normally supported by the six side wheels 314, 316, which, in turn, are rollingly supported by the bottom side 322 of the seat rail 116. However, if the wheel car assembly 298 is subjected to forces that cause the body 300 of the wheel car assembly to tip backward, forward, or side-to-side, some of the side wheels can disengage the bottom side 322 and engage the top side 320 of the seat rail 116. As shown in FIG. 5B, the distance between the right and left sides 336, 338 of the track member 334 is larger than the diameters of the four center wheels 318. As such, when the wheel car 298 is subjected to forces that cause the wheel car assembly to move from side-to-side, some of the center wheels 318 can engage the right 336 and/or left sides 338 of the track member 334.

As previously mentioned, the bench seat 114 can be configured to either roll freely along the length of the seat rail 116, or can be selectively locked into various positions along the length of the seat rail. More particularly, the wheel car assembly 298 can include a bench seat pop-pin 348 adapted to selectively engage apertures 350 in the seat rail 116 to selectively lock the bench seat into a desired positioned along the length of the seat rail. As shown in FIG. 5B, the narrow middle portion 306 of the wheel car assembly 298 extends upward from the lower portion 302 and through the slot 328 in top side 320 of the seat rail 116. The flat upper portion 304 of the wheel car 298 supports a lower platform 352, which includes a flange 354 extending downward adjacent to the right side 324 of the seat rail 116. The downwardly extending flange 354 supports the bench seat pop-pin 348, which is adapted to engage one of the plurality of apertures 350 located in the right side 324 of the side rail 116. As previously mentioned, the bench seat pop-pin allows a user to selectively lock wheel car assembly 298 and bench seat 114 into various positions along the length of the seat rail 116. For example, the bench seat pop-pin can be disengaged from an aperture on the seat rail, which allows the bench seat to roll backward or forward to a desired position along the length of the seat rail. Once the bench seat is rolled to a desired location along the seat rail, the bench seat pop-pin be engaged with another aperture in the seat rail to lock the bench seat into the desired position.

Figure 7B:
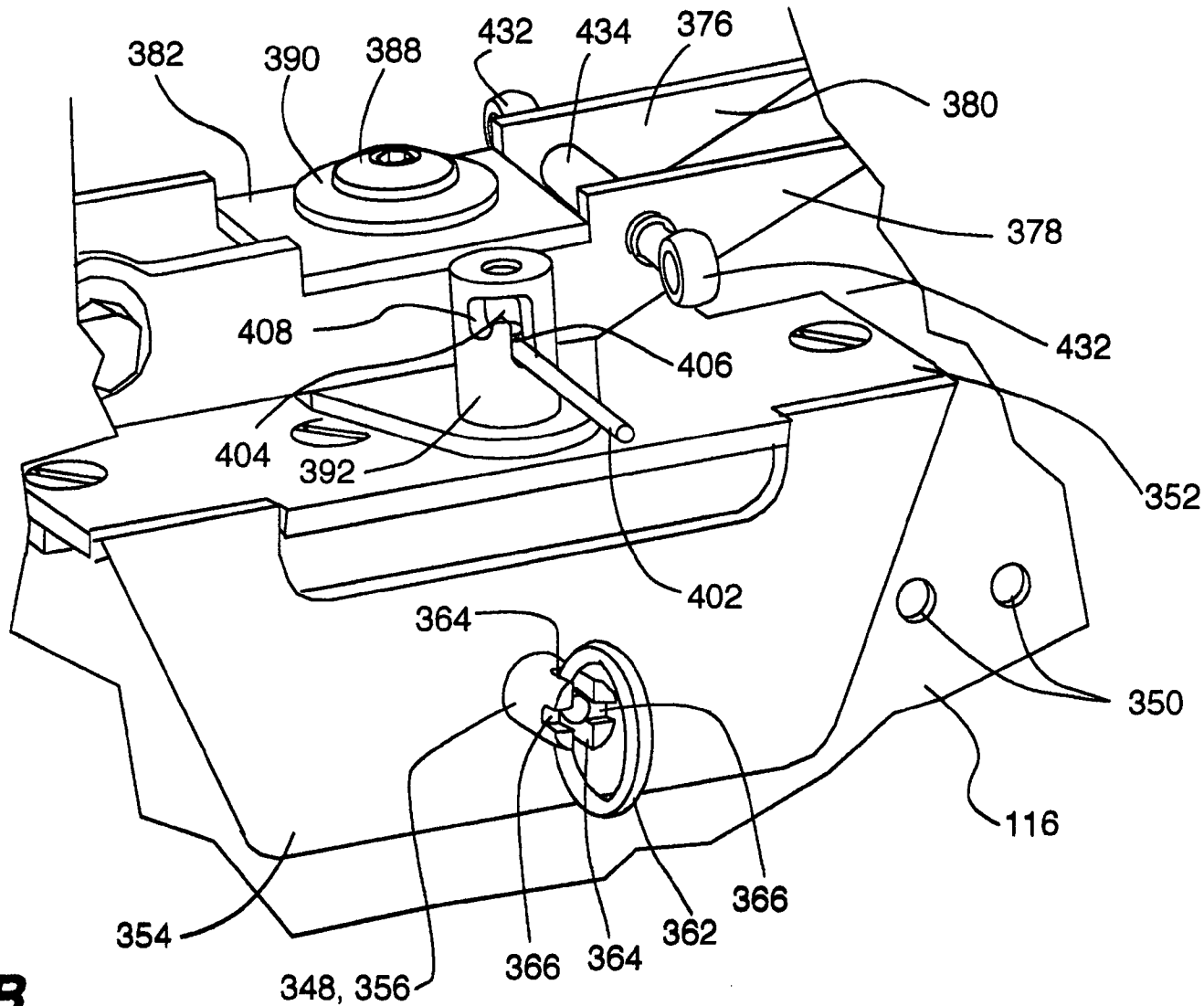
FIG. 7B is a detailed view of a swivel pop-pin engaged with a right aperture.

As shown in FIGS. 5B and 7B, the bench seat pop-pin can include a cylindrically-shaped body 356 housing a spring 358 operably connected with a pin 360. The spring 358 acts to force the pin 360 against the right side 324 of the seat rail 116. The pin 360 can be disengaged from the seat rail 116 by pulling on a ring 362 connected with the pin in a direction away from the right side 324 of the seat rail 116. When moving the bench seat 114 from a first location to a second along the seat rail, a user can pull the ring 362 to disengage the pin 360 from the seat rail 116. While holding the pin in disengagement from the seat rail, the bench seat 114 and wheel car assembly 298 can be rolled to the second location. Once the bench seat is in the second location, the ring 362 can be released, which allows the spring 358 to force the pin 360 back into engagement with the seat rail 116. If the pin 360 is aligned with one of the apertures 350 in the right side of the seat rail, the pin will extend into one of the apertures, locking the bench seat into the second position. If the pin 360 is not aligned with one of the apertures 350, the pin will be forced against the right side 324 of the seat rail 116. The bench seat 114 can then be rolled backward and forward until the pin 360 is aligned with and forced into one of the apertures 350.

As previously mentioned, the bench seat 114 can also be configured to roll freely along the seat rail 116. More particularly, the bench seat pop-pin 348 can be selectively configured to disable the spring-loaded feature so the pin 360 is not forced against the right side 324 of the seat rail 116. As shown in FIG. 7B, the body 356 of the bench seat pop-pin 348 includes a first pair of channels 364 and a second pair of channels 366 extending inward from a distal end portion of the body. The channels 364, 366 are adapted to receive a portion of the ring 362 and act to limit the distance that the pin 360 can extend from the body 356 toward the seat rail 116. A user can align the ring with either pair of channels by pulling the ring 362 outward from the body 356 and turning the ring into alignment with the desired pair of channels. As shown in FIGS. 5B and 7B, when the ring 362 is aligned to be received within the first pair of channels 364, the pin can extend far enough toward the seat rail 116 to engage one of the apertures 350, which prevents the bench seat 114 from freely rolling along the seat rail. The first pair of channels 364 are longer than the second pair of channels 366. As such, when the ring is aligned to be received within the second pair of channels 366, the pin 360 does not extend far enough from the body to engage the seat rail 116. Therefore, when the ring is received within the second pair of channels 366, the bench seat 114 can freely roll back and forth along the seat rail 116 without the spring 358 forcing the pin 360 against the right side 324 of the seat rail 116 and into one of the apertures 350.

As previously mentioned, the bench seat 114 can also be configured to swivel with respect to the seat rail 116. As shown in FIGS. 5B and 5BB, the bench seat 114 is connected with the lower platform 352 on the wheel car assembly 298 through a swivel plate 368 rotatably connected with a bench seat axle 370. More particularly, the bench seat 114 includes a padded portion 372 connected with and supported on a bench seat plate 374. As shown in FIGS. 5B, 5BB, and 7B, the bench seat plate, in turn, is supported on a bench seat support structure 376, which is supported by and connected with the swivel plate 368. The bench seat support structure 376 includes a first seat bracket 378 and a second seat bracket 380 connected with and separated by a center plate 382. The bench seat support structure 376 also includes a cylindrically-shaped sleeve 384 extending between and connected with the swivel plate 368 and the center plate 382. The sleeve 384 is adapted receive the bench seat axle 370 and associated bearings 386. As shown in FIG. 5B, the bench seat axle 370 extends upward from the lower platform 352, through an aperture in the swivel plate 368, and through the bearings 368 inside the sleeve 384 of the bench seat support structure 376. The bench seat support structure is also connected with the bench seat axle 370 by a bolt 388 extending through a top washer 390 and threaded into the bench seat axle 370. As such, the bench seat 114, swivel plate 368, and seat support structure 376 are can rotate together around the bench seat axle 370.

Figure 7C:
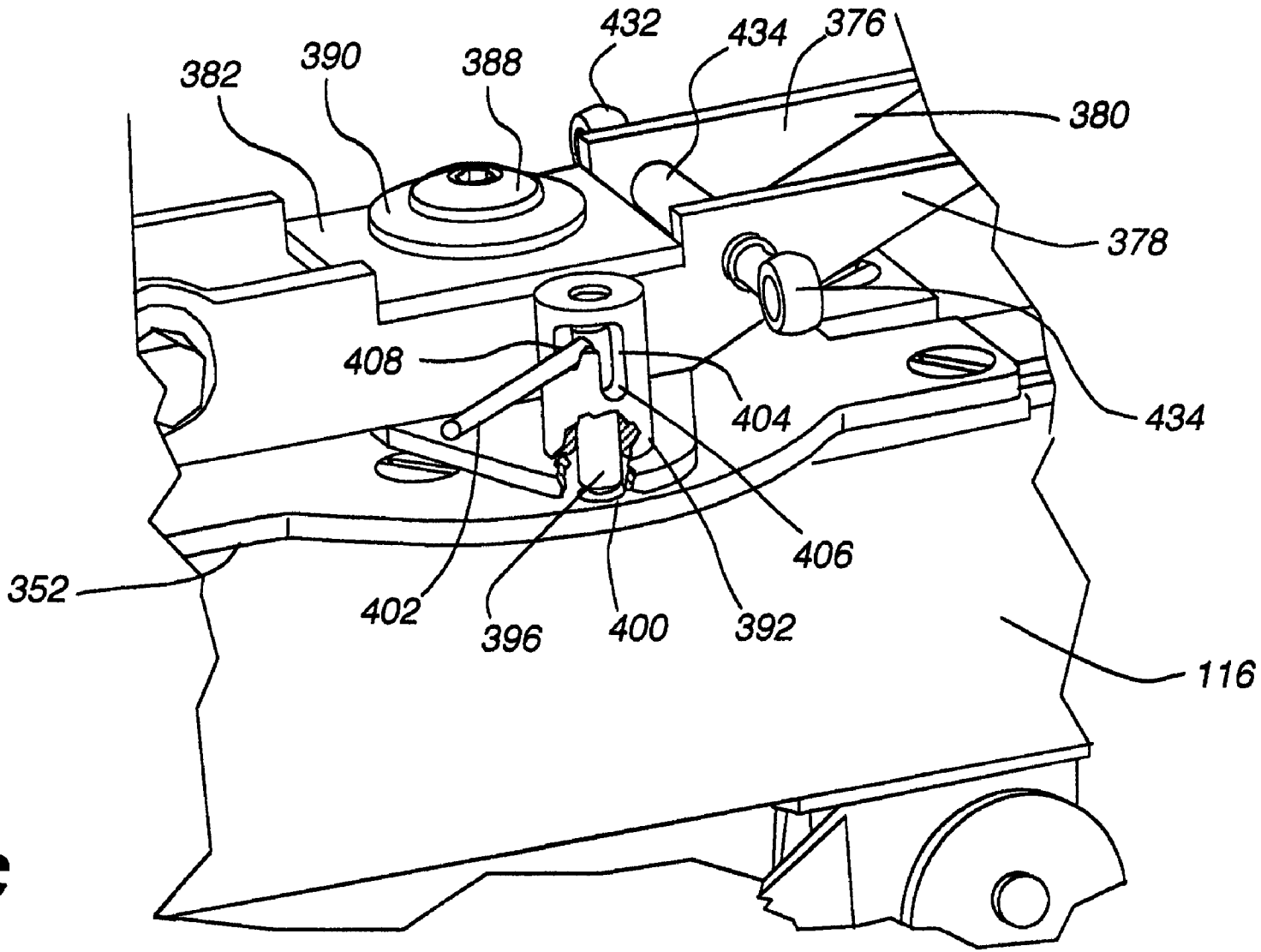
FIG. 7C is a detailed view of the swivel pop-pin in position to engage a left aperture.

The bench seat 114 can be configured to freely swivel around the bench seat axle 370 and can also be selectively locked into a desired pivotal position. As shown in FIGS. 5B, 5C, 7B, and 7C, a swivel pop-pin 392 mounted on the swivel plate 368 is adapted to engage the lower platform 352 to provide for selective adjustment of the rotational position (i.e. swivel) of the bench seat 114 with respect to the seat rail 116. The swivel pop-pin includes a body 394 housing a pin 396 adapted to engage a right aperture 398 and a left aperture 400 in the lower platform 352. A handle 402 connected with the pin 396 can be moved up and down to disengage and engage the pin, respectively, with the lower platform 352. When the swivel pop-pin 392 is engaged with the left aperture 400 in the lower platform 352 as shown in FIG. 7C, a user seated on the bench seat 114 may be facing in a forward direction away from the main frame 106 of the exercise device 100, such as shown in FIG. 2A. To change the orientation of the bench seat, a user can move the handle 402 on the swivel pop-pin 392 upward to disengage the pin 396 from the left aperture 400 on the lower platform 352, which allows the bench seat 114 to rotate around the bench seat axle 370. Once the bench seat is rotated to align the pin 396 with the right aperture 398 in the lower platform 352, the handle 402 can be moved downward to insert the pin into the right aperture, locking the bench seat into position. Once the swivel pop-pin is engaged with the right aperture as shown in FIG. 7B, the user may be facing in a rearward direction toward the frame of the exercise device, such as shown in FIG. 2C. Although the lower platform is depicted and described with right and left apertures, it is to be appreciated that the lower platform can include additional apertures adapted to receive the swivel pop-pin to provide additional rotational positions of the bench seat.

The bench seat 114 can also be configured to pivot freely about the bench seat axle without the swivel pop-pin engaging the lower platform 352. More particularly, the swivel pop-pin 392 can be selectively configured to maintain to the position of the handle 402 to hold the pin 396 out of engagement with the lower platform 352. As shown in FIG. 7C, the handle 402 extends through a slot 404 in the body 394 of the swivel pop-pin 392. The slot 404 includes a first downward extending channel 406 and a second downward extending channel 408. The channels 406, 408 are adapted to support the vertical position of handle 402 and act to limit the distance the pin 396 can extend from the body 394 toward the lower platform 352. A user can move the handle 402 into either channel by lifting the handle upward and moving the handle along the slot 404 and into alignment with the desired channel. As shown in FIG. 7B, when the handle is received within the first channel 406, the pin can extend far enough toward the lower platform 352 to engage one of the apertures 398, 400, which prevents the bench seat 114 from freely pivoting about the bench seat axle 370. The first channel 406 is longer than the second channel 408. As such, when the handle is received within the second channel 408, the pin 396 does not extend far enough from the body to engage the lower platform 352, as shown in FIG. 7C. Therefore, when the handle is received within the second channel, the bench seat can freely pivot about the bench seat axle without the pin engaging the lower platform and/or the right and left apertures.

Figure 1A:
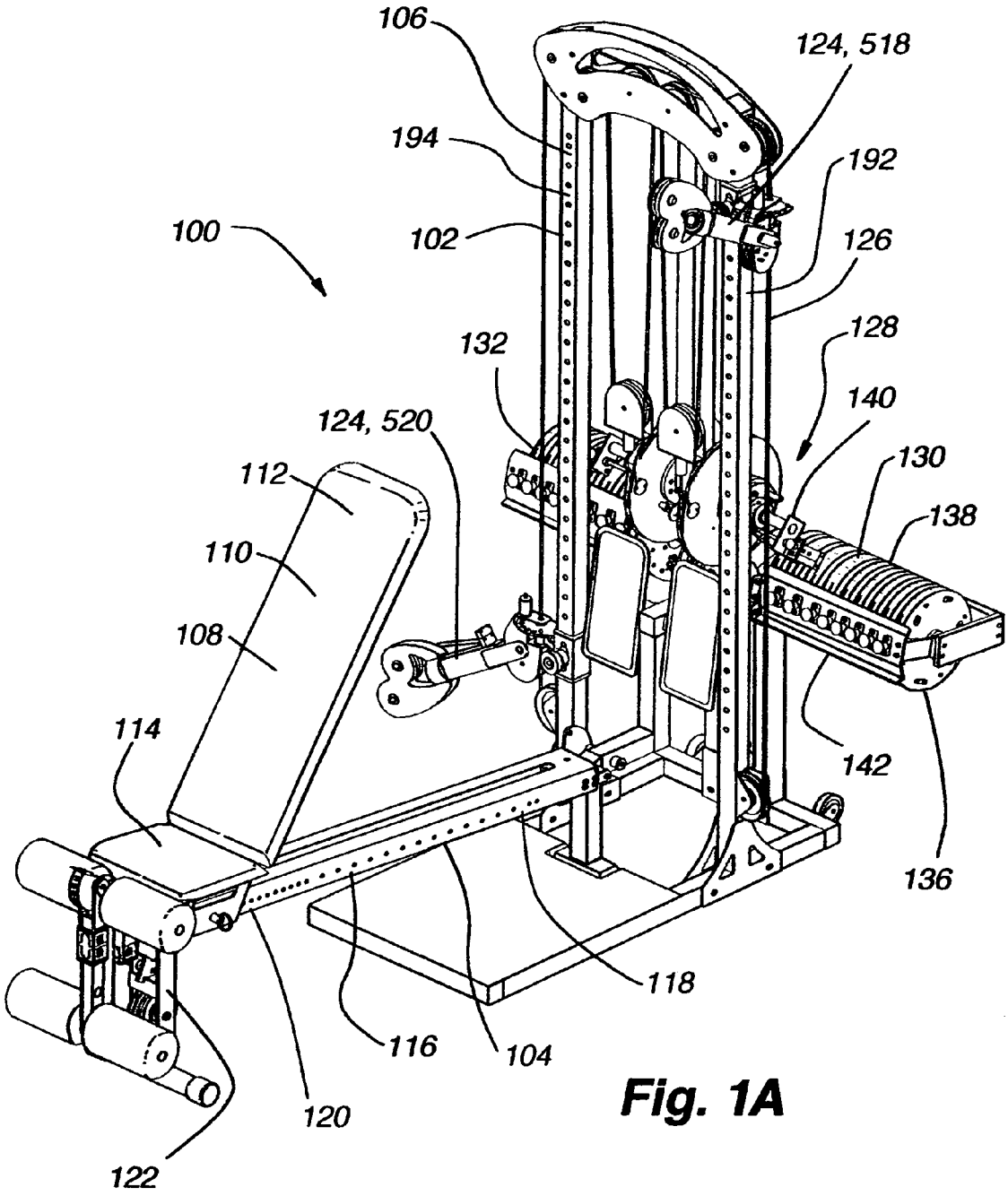
FIG. 1A is a front right side isometric view of a first embodiment of an exercise device according to the present invention.
Figure 1B:
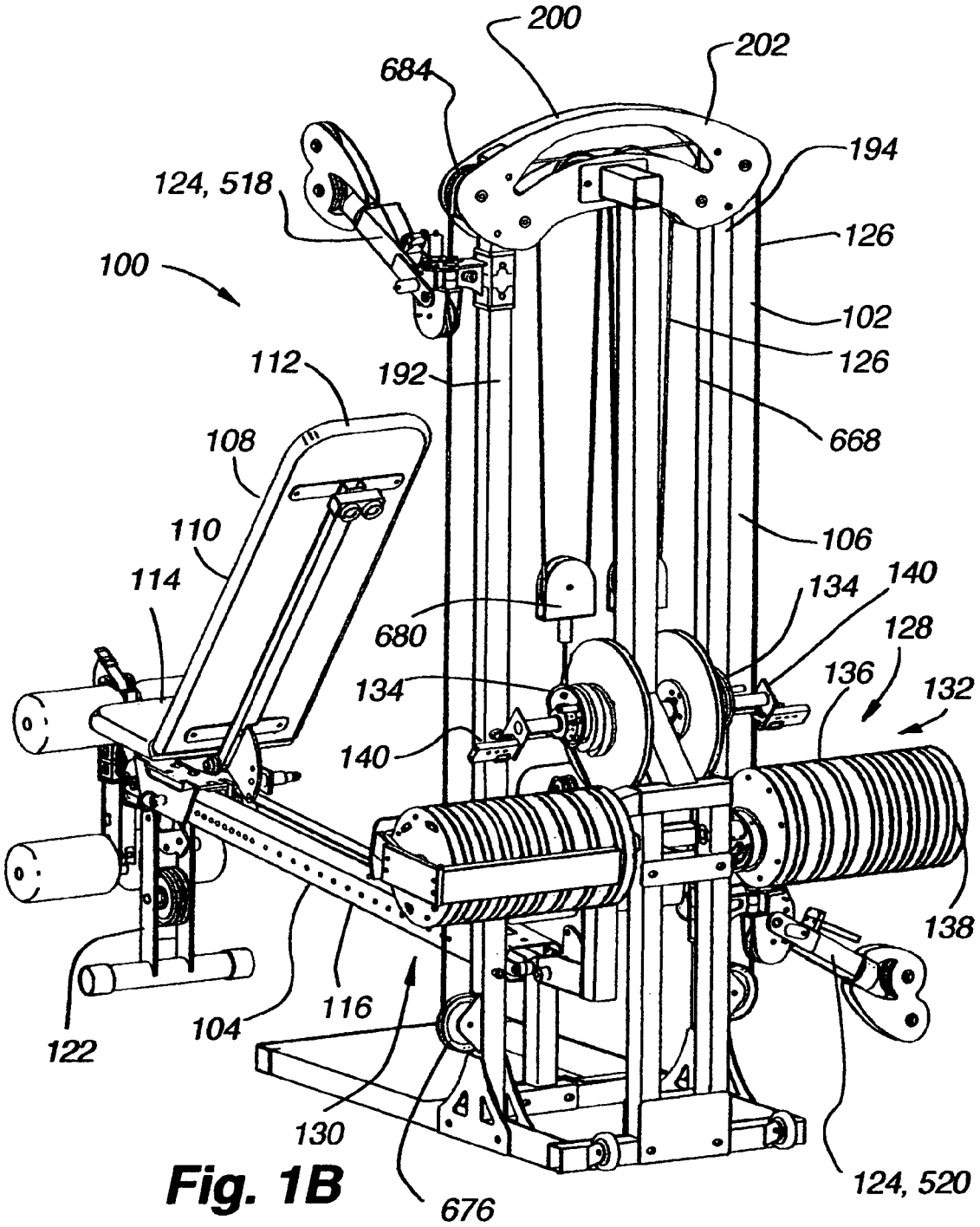
FIG. 1B is a rear right side isometric view of the exercise device of FIG. 1A.

As previously mentioned, the back support 112 of the bench assembly can be configured with a selectively adjustable incline relative to the bench seat 114. More particularly, the back support 112 is pivotally connected with bench seat 114 and can include a back support pop-pin 410 to selectively lock the back support into a desired inclination. As shown in FIGS. 5 and 5BB, the back support 112 includes a padded portion 412 mounted on a back support rail 414, which is pivotally connected with the bench seat support structure 376 through a seat back axle 416. As shown in FIGS. 5B and 5BB, the seat back axle 416 is connected with and extends between the first seat bracket 378 and the second seat bracket 380. As shown in FIG. 5, the back support pop-pin is supported by an extended portion 418 of the first seat bracket 378. The back support pop-pin is adapted to engage apertures 420 an arcuate plate 422 extending rearwardly from the back support rail 414. As such, the arcuate plate 422 pivots up and down with the back support rail 414. As shown in FIG. 1D, the arcuate plate 414 is aligned to be received within the slot 328 in top side 320 of the seat rail 116 as the back support is pivoted downward.

Figure 5D:
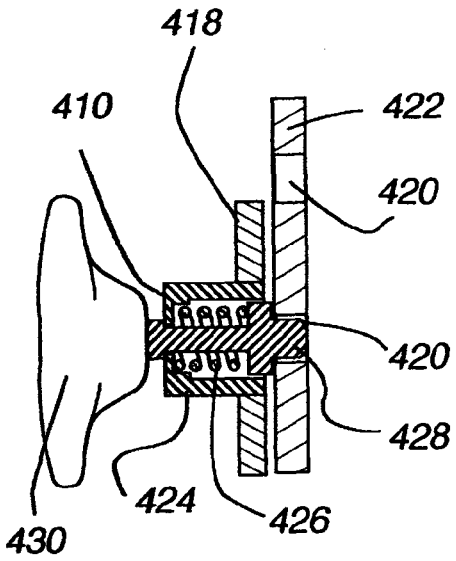
FIG. 5D is a cross-sectional view of a back support pop-pin depicted in FIG. 5, taken along line 5D-5D.

As previously mentioned, the back support pop-pin 410 provides for selective adjustment of the degree of incline of the back support 112 relative to the bench seat 114. As shown in FIGS. 5 and 5D, the back support pop-pin 410 can include a body 424 housing a spring 426 operably coupled with a pin 428. The spring 426 acts to force the pin 428 against the arcuate plate 422 on the back support rail 414. The pin 428 can be disengaged from the arcuate plate 422 by pulling on a handle 430 connected with the pin in a direction away from the arcuate plate 422. When pivoting the back support 112 from a first incline to a second incline, a user can pull the handle 430 to disengage the pin 428 from the arcuate plate 422. While holding the pin in disengagement from the arcuate plate, the back support 112 can be pivoted about the seat back axle 416 to the second incline position. Once the back support is in the second incline position, the handle 430 can be released, which allows the spring 426 to force the pin 428 back into engagement with the arcuate plate 422. If the pin 428 is aligned with one of the apertures 420 in the arcuate plate 422, the pin will extend into one of the apertures, locking the back support 112 into the second level of incline. If the pin is not aligned with one of the apertures, the pin will be forced against the arcuate plate 422. The back support 112 can then be pivoted up and down until the pin 428 is aligned with and forced into one of the apertures 420.

As discussed above with reference to FIGS. 2A-2H, the bench assembly 108 is shown in various positions and configurations to allow a user to perform various exercises. For example, FIGS. 2A, 2B, 2E and 2F show the bench seat 114 and back support 112 selectively locked into various positions along the length of the seat rail 116. In addition, FIG. 2C shows the bench seat configured to roll freely back and forth along the seat rail to perform leg press exercises. As shown in FIG. 2C, the resistance cables 144 are connected with the bench seat 114. More particularly, as shown in FIGS. 2C and 7B, the resistance cables 144 can be connected with eyelets 432 at opposing end portions of a resistance cable connection member 434 connected with and extending between the first and second seat brackets 378, 380.

Figure 1C:
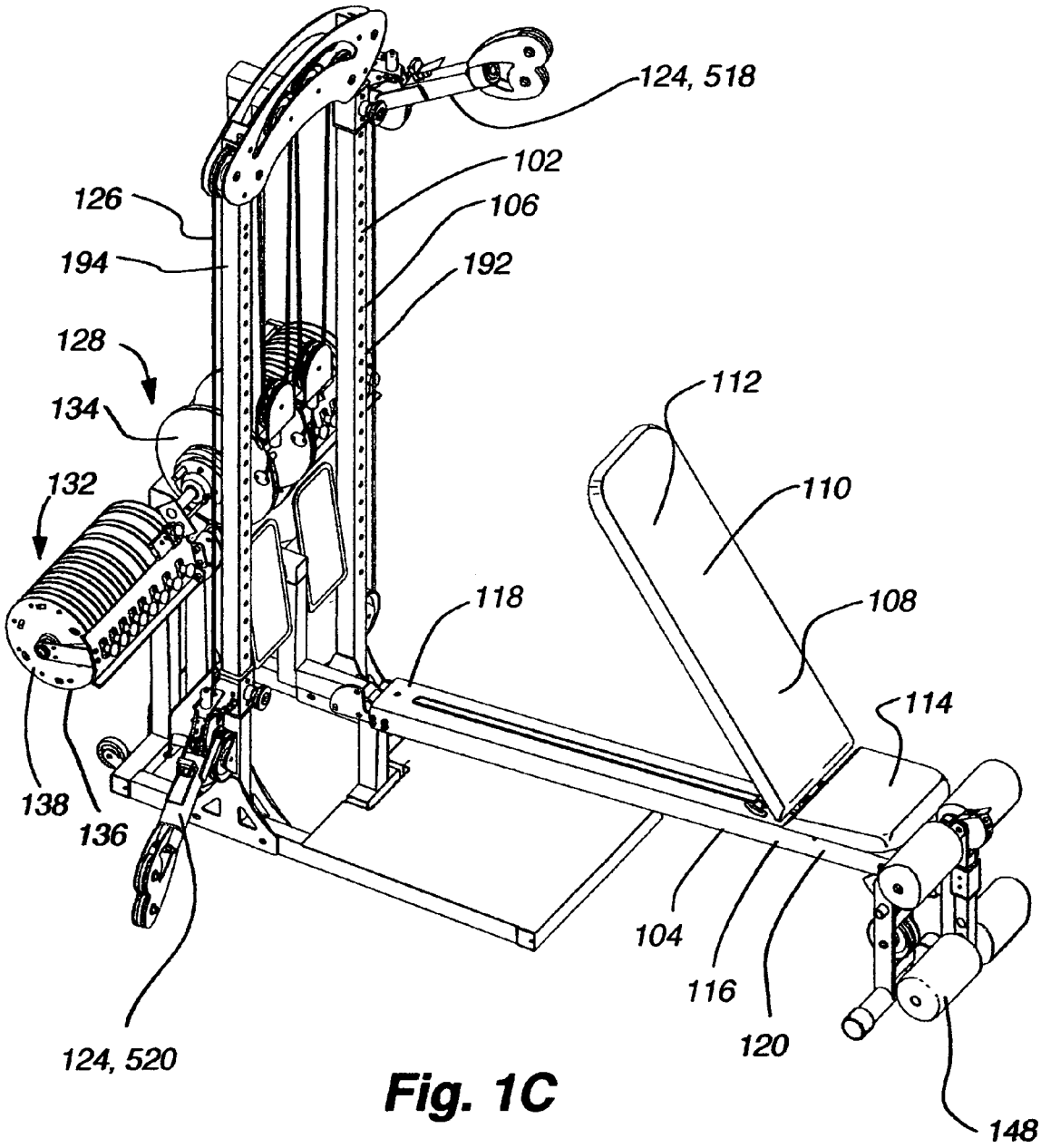
FIG. 1C is a front left side isometric view of the exercise device of FIG. 1A.
Figure 1D:
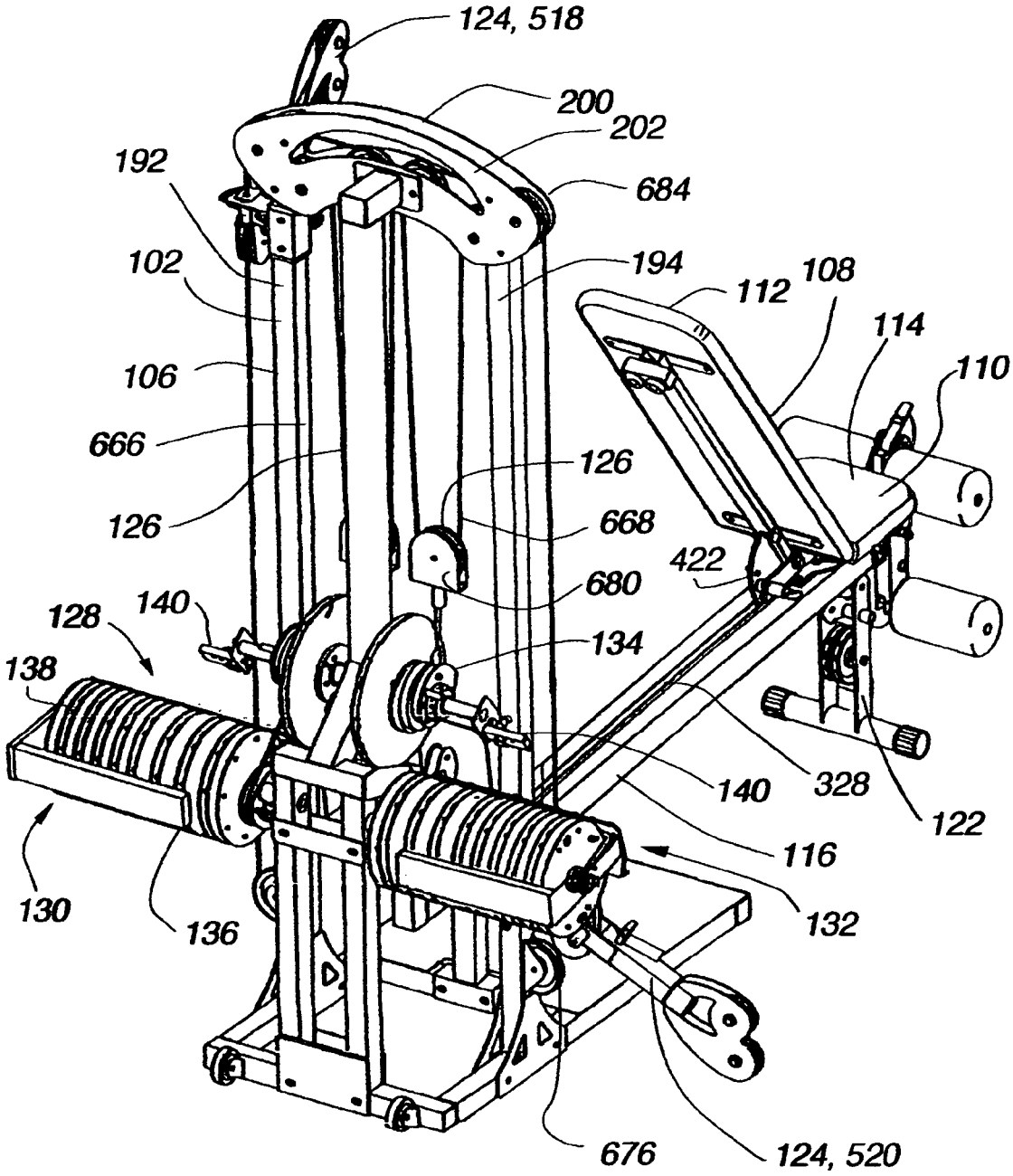
FIG. 1D is a rear left side isometric view of the exercise device of FIG. 1A.
Figure 5F:
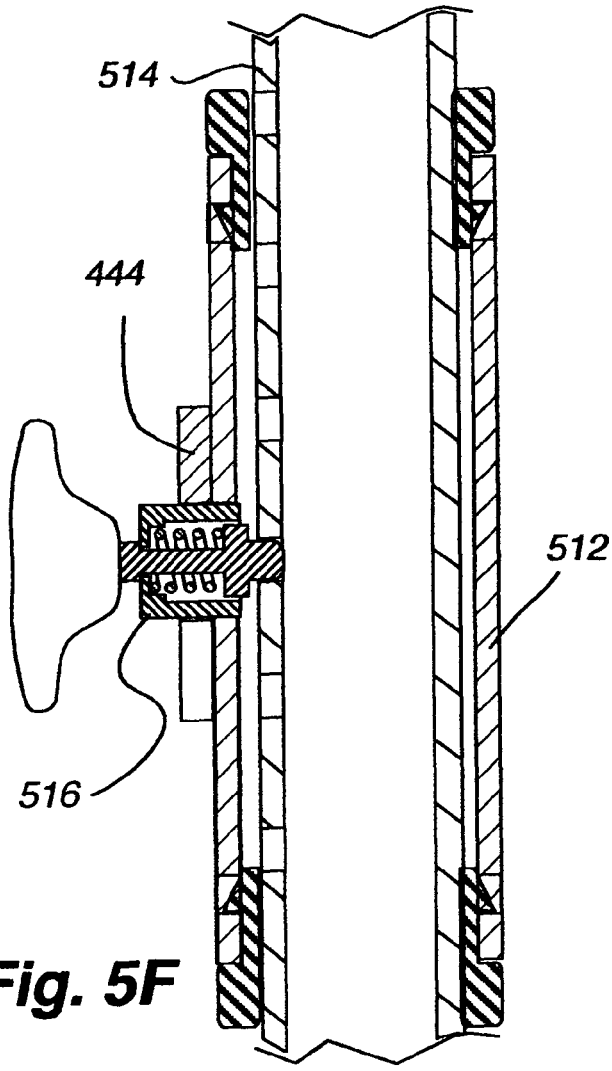
FIG. 5F is a cross-sectional view of a support member and support post depicted in FIG. 5, taken along line 5F-5F.
Figure 5E:
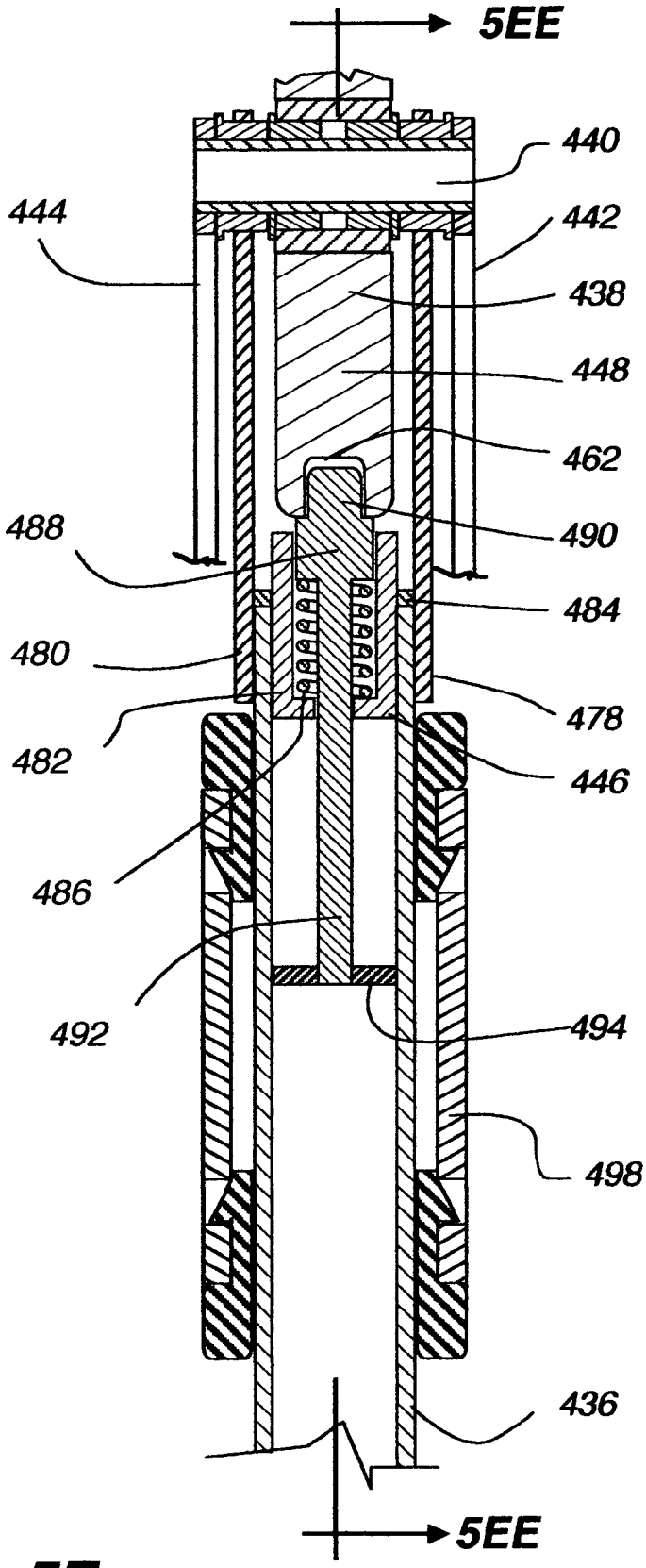
FIG. 5E is a cross-sectional view of a leg developer assembly depicted in FIG. 5, taken along line 5E-5E.
Figure 5E:
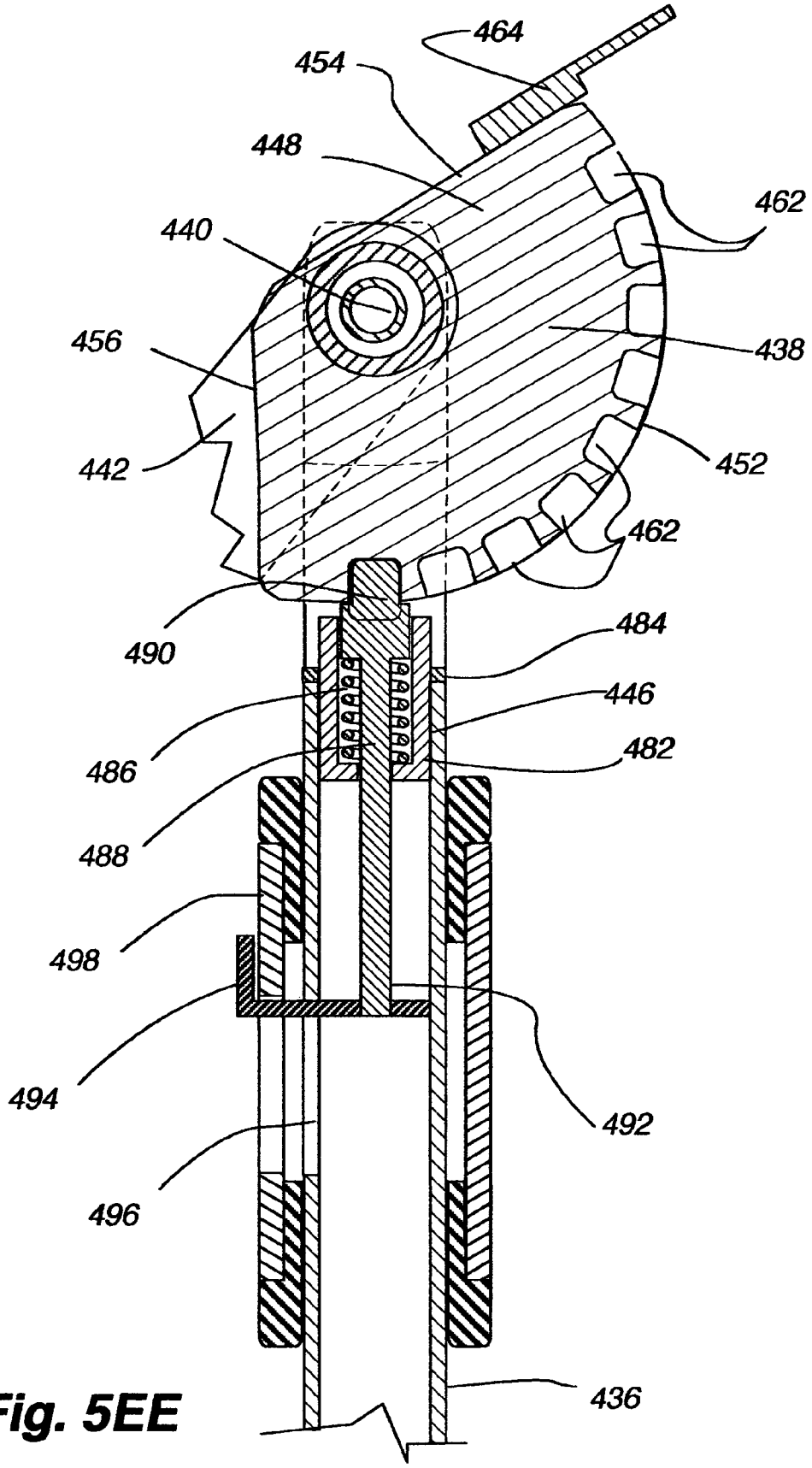

As previously mentioned, the exercise device 100 may include the leg developer assembly 148 shown in FIGS. 1C, 5, and others, that can be used for various types of exercises, such as leg extensions and leg curls. As shown in FIGS. 4A, 5, 5E, and 5EE, the leg developer assembly includes an actuation member 436 and a resistance arm assembly 438, both pivotally supported from the second end portion 120 of the seat rail 116. The resistance arm assembly 438 and the actuation member 436 are pivotally connected with a leg developer axle 440 supported by right and left axle brackets 442, 444 extending from the second end portion 120 of the seat rail 116. As discussed in more detail below, the actuation member 436 is selectively connected with the resistance arm assembly 438 through a leg developer pop-pin 446. As such, the pivotal position of the actuation member 436 relative to the resistance arm assembly 438 can be selectively adjusted to place the leg developer assembly 148 in a desired configuration for use. With the leg developer assembly in the desired configuration, the resistance cables 144 are connected with the resistance arm assembly 438 and the user exercises by applying forces on the leg developer assembly to reciprocatingly pivot the actuation member 436. Because the actuation member 436 is connected with the resistance arm assembly 438 through the leg developer pop-pin 446, the actuation member and the resistance arm assembly pivot together.

Figure 8B:
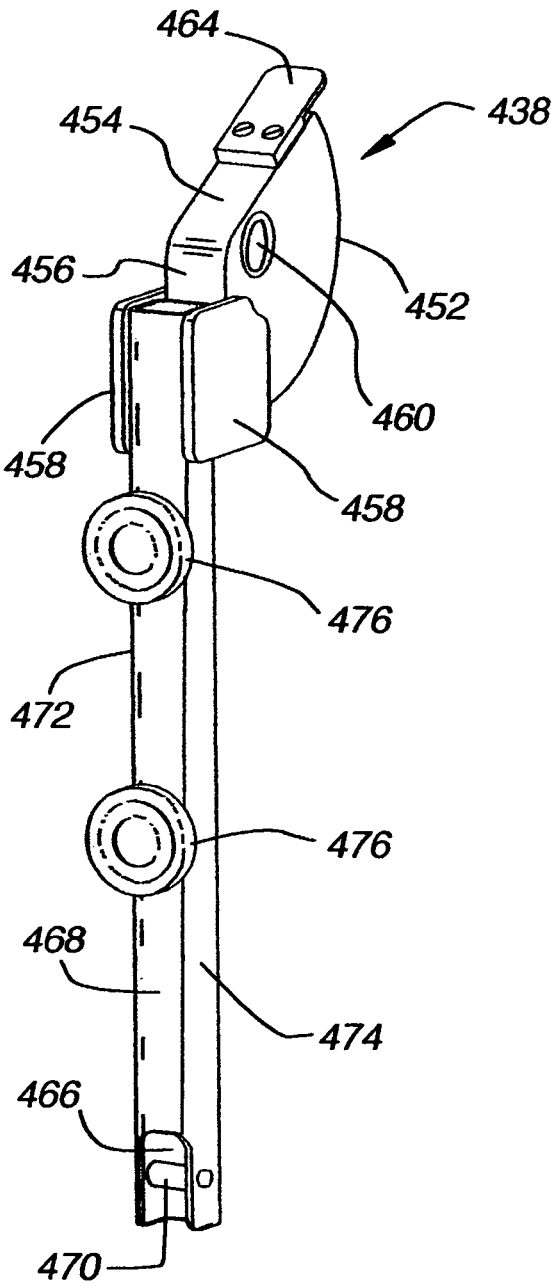
FIG. 8B is a rear isometric view of the resistance arm assembly.
Figure 8A:
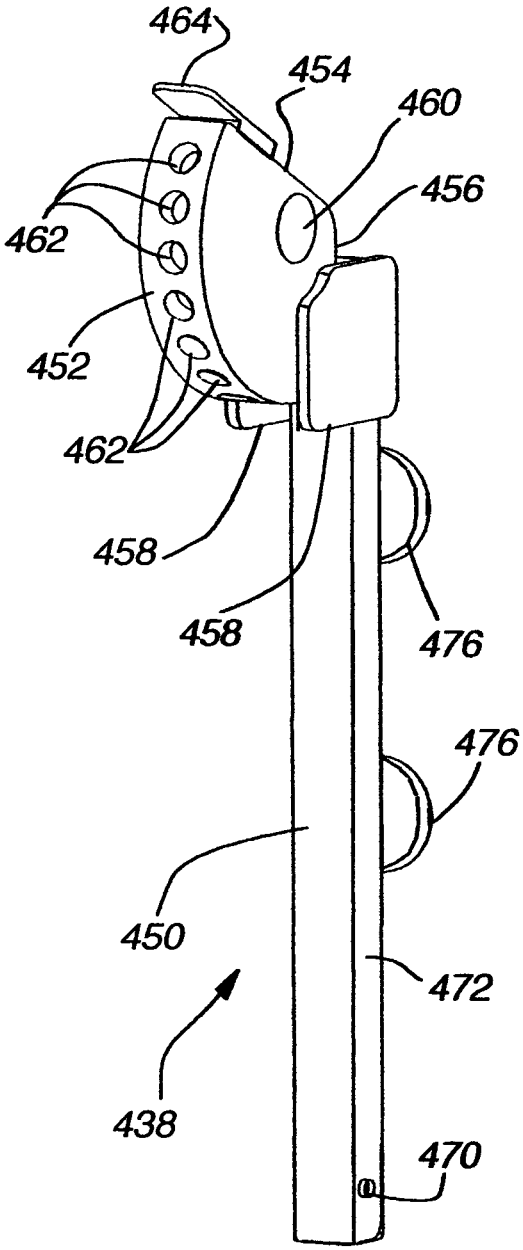
FIG. 8A is a front isometric view of a resistance arm assembly.

As previously mentioned, the resistance cables 144 can be connected with the leg developer assembly 148 through the resistance arm assembly 438. The resistance arm assembly is also pivotally connected with the leg developer axle 440 and is selectively connected with the actuation member 436 through the leg developer pop-pin 446. As shown in FIGS. 8A and 8B, the resistance arm assembly 438 includes a pivot member 448 connected with a resistance arm 450. The pivot member includes an arcuate edge 452 connected with a first substantially flat edge 454 and a second substantially flat edge 456. The first edge 454 is angularly offset from the second edge 456. A portion of the resistance arm 450 extends along the second edge 456 of the pivot member 448 and is connected with the pivot member through side brackets 458. The pivot member 448 includes an axle aperture 460 adapted to receive the leg developer axle 440 to pivotally support the resistance arm assembly 438. The pivot member 448 also includes a plurality of circumferentially spaced apertures 462 extending into the arcuate edge 452. As discussed in more detail below, the leg developer pop-pin 446 is adapted to engage the apertures 462 to provide for selective pivotal positioning of the actuation member relative to the resistance arm assembly. A stop plate 464 connected with first edge 454 of the pivot member 448 provides a limit to the pivotal movement of the actuation member relative to the resistance arm assembly in one direction. As shown in FIG. 8B, a slot 466 in a rear side 468 of a lower end portion of the resistance arm provides access to a shaft 470 extending between right and left sides 472, 474 of the resistance arm 450. As discussed in more detail below, the shaft 470 provides a connection location for the resistance cables 144. As shown in FIG. 8B, pads 476 are connected with upper and lower end portions of the rear side 468 of the resistance arm member. The pads are adapted to prevent direct contact between the resistance arm and the bench frame.

As mentioned above, the actuation member 436 is pivotally connected with the leg developer axle 440 and is selectively connected with the resistance arm assembly 438 through the leg developer pop-pin 446. As shown in FIGS. 5, 5E, and 5EE, and others, the actuation member 436 is connected with the leg developer axle 440 through first and second extension brackets 478, 480 extending from an end portion of the actuation member 436 and along opposing sides of the pivot member 448. The leg developer pop-pin 446 is partially housed within the actuation member 436. The leg developer pop-pin includes a body 482 connected with and supported by an end cap 484 on the actuation member 436. The body 482 houses a spring 486 operably connected with a pin 488. The spring 486 acts to force a distal end portion 490 of the pin 488 against the arcuate edge 452 of the pivot member 448 and into the apertures 462 located therein. A proximal end portion 492 of the pin 488 is connected with a L-shaped bracket 494. A portion of the L-shaped bracket extends through a slot 496 in a rear side of the actuation member 436 and is connected with a slider handle 498. The slider handle 498 is adapted to slide along the outer surface of the of the actuation member 436. As such, the pin 488 can be disengaged from the apertures 462 in the pivot member 448 by moving the slider handle 498 in a direction away from the arcuate edge 452 of the pivot member 448.

As mentioned above, the pivotal position of the actuation member 436 relative to the resistance arm assembly 438 can be adjusted to configure the leg developer assembly 148 for various different exercises. For example, when pivoting the actuation member 436 from a first pivotal position to a second pivotal position relative to the resistance arm assembly, a user can move the slider handle 498 to disengage the pin 488 from the pivot member 448 of the resistance arm assembly 438. While holding the pin in disengagement from the pivot member, the actuation member 436 can be pivoted about the leg developer axle 440 to the second pivotal position. Once the actuation member is in the second position, the slider handle 498 can be released, which allows the spring 486 to force the pin 488 back into engagement with the pivot member 448. If the pin 488 is aligned with one of the apertures 462 in the arcuate edge 452 of the pivot member 448, the pin will extend into one of the apertures, locking the actuation member 436 into the second position. If the pin 488 is not aligned with one of the apertures 462, the pin will be forced against the arcuate edge 452 of the pivot member 448. The actuation member can then be pivoted up and down until the pin is aligned with and forced into one of the apertures.

As shown in FIGS. 4A, 4C, 4D, 5, and others, the leg developer assembly 148 also includes a pair of upper roller pads 500 rotatably supported on right and left upper roller pad support members 502, 504 extending outwardly from the right and left axle brackets 442, 444, respectively. Similarly, a pair of lower roller pads 506 are rotatably supported on right and left lower roller pad support members 508, 510 extending outwardly from opposing sides of the actuation member 436. The roller pads are adapted to support a user's legs when performing leg extension and leg curl exercises.

As previously mentioned, the leg developer assembly 148 can be configured to perform various exercises. For example, as shown in FIGS. 2A and 2B, the leg developer assembly is configured for leg extension and leg curl exercises, respectively. In both configurations, the resistance cables 144 extending from the arm assemblies 124 are routed partially around the leg station pulleys 260, 262 and are connected with the shaft 470 in the lower end portion of the resistance arm 450. As shown in FIG. 2A, a user can perform leg extension exercises by placing the back side of his knees on top of the upper roller pads 500 and the front side of his ankles behind the lower roller pads 506. Once in position, the user can extend his legs in upward in the direction shown in FIG. 2A. To configure the leg develop assembly for leg extension exercises, the user can move the slider handle 498 to disengage the leg develop pop-pin 446 from the resistance arm assembly 438 and pivot the actuation member 436 upward to the position shown in FIG. 2B. The user can then lie on the bench 110 with the front side of his legs positioned on top of upper roller pads 500 and the rear side of ankles positioned under the lower roller pads 506. Once in position, the user can then pivot his ankles upward in the direction shown in FIG. 2B.

As previously mentioned, the exercise device 100 can be configured for various types of exercises. In addition, various types of exercise accessories can be removably attached to exercise device. More particularly, as shown in FIGS. 5A and 5F, the exercise device includes a support member 512 connected with and supported between the right and left axle brackets 442, 444 extending from the second end portion 120 of the seat rail 116. The support member 512 is adapted to receive support posts 514 connected with various types of exercise accessories, such as a preacher curl accessory as described in more detail below. A pop-pin 516 connected with the support member 512 is adapted to engage apertures in the support post 514 to allow for vertical height adjustment of the exercise accessory.

As previously mentioned, the exercise device 100 includes adjustable arm assemblies 124. More particularly, as shown in FIGS. 1A-1D and others, the exercise device includes right and left arm assemblies 518, 520 adjustably connected with the frame. The adjustable arm assemblies 518, 520 and the cable-pulley assembly 126 provide a user interface with the resistance system 128. In use, actuation devices can be connected resistance cables extending from the arm assemblies. As discussed in more detail below, the vertical positions of the arm assemblies can be selectively adjustable. In addition, the right and left arm assemblies can each include a multi-axis locking mechanism 522 that allows a user to pivot each arm assembly in vertical and horizontal directions simultaneously. For clarity purposes, the right and left arm assemblies are depicted in FIGS. 9-12C and others without showing a multi-axis release mechanism. Embodiments of the multi-axis release mechanism as discussed in detail below with reference to FIGS. 13A-13C.

Although the following description refers to figures depicting mainly to the components of the right arm assembly 518, it is to be appreciated that the left arm assembly 520 is substantially a mirror image of the right arm assembly, and as such, includes the same components as the right arm assembly, which operate in relation with each other and with the other components of the exercise device as the right arm assembly.

Figure 9:
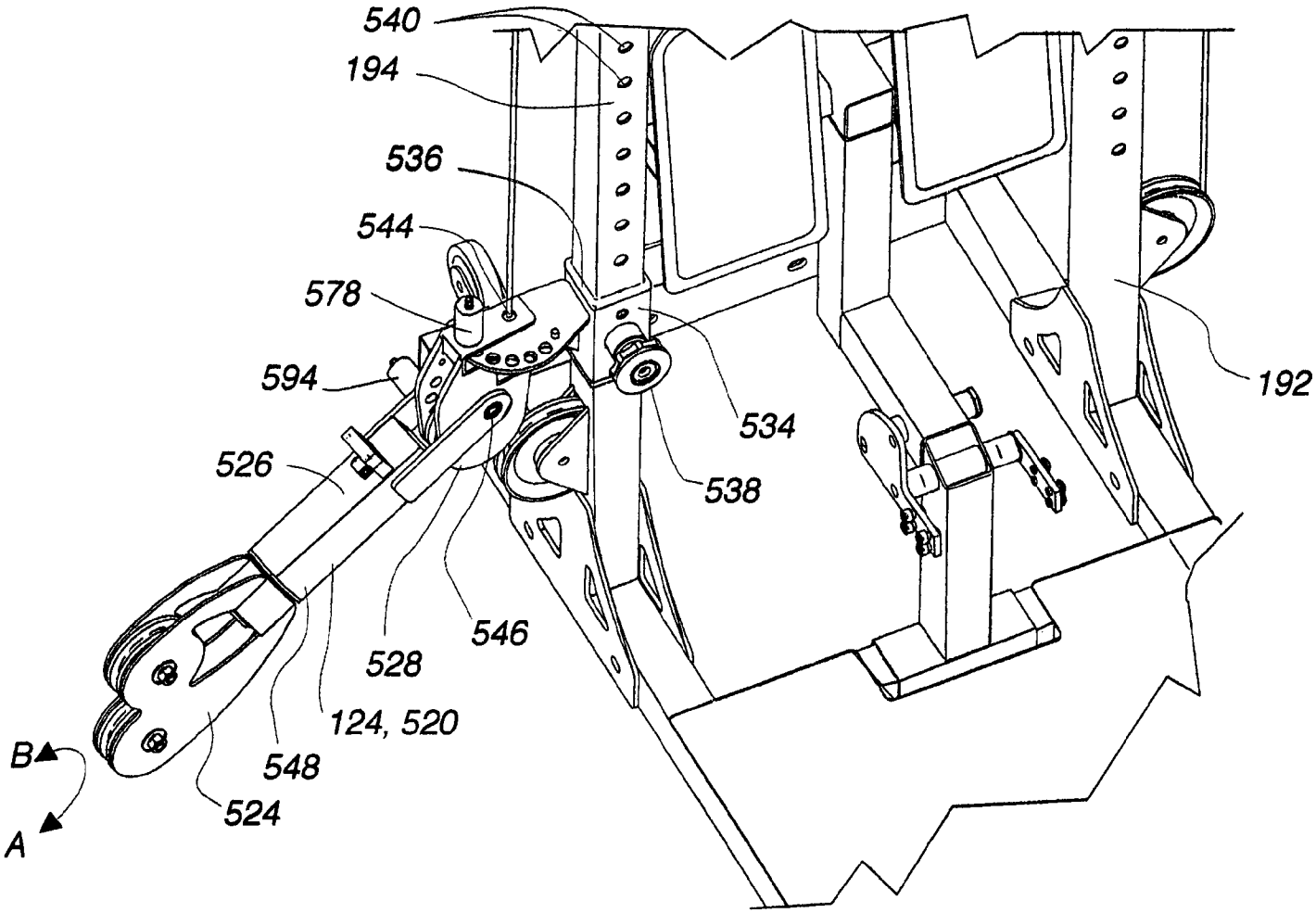
FIG. 9 is a detailed view of a left arm assembly.
Figure 10:
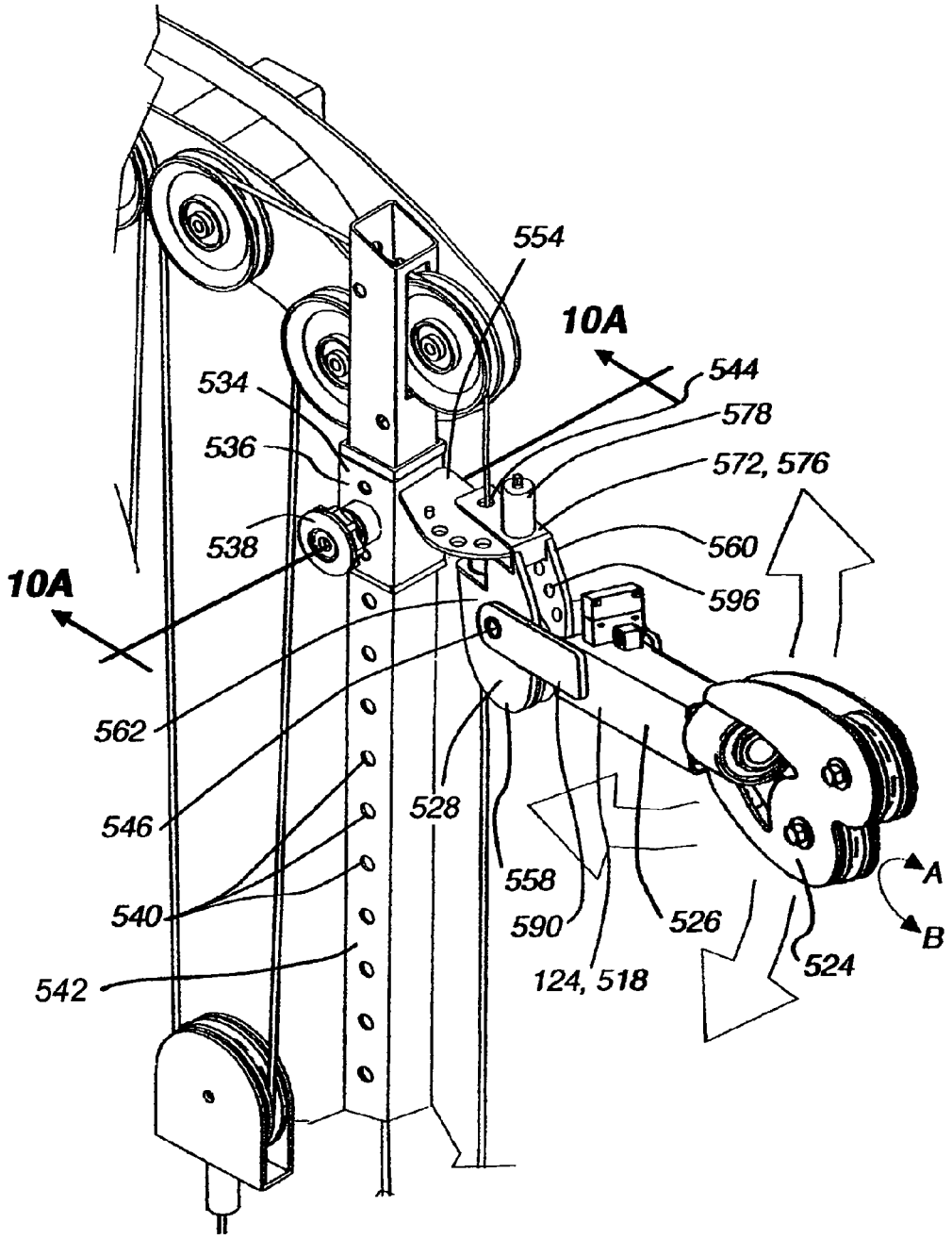
FIG. 10 is a detailed view of a right arm assembly.
Figure 11:
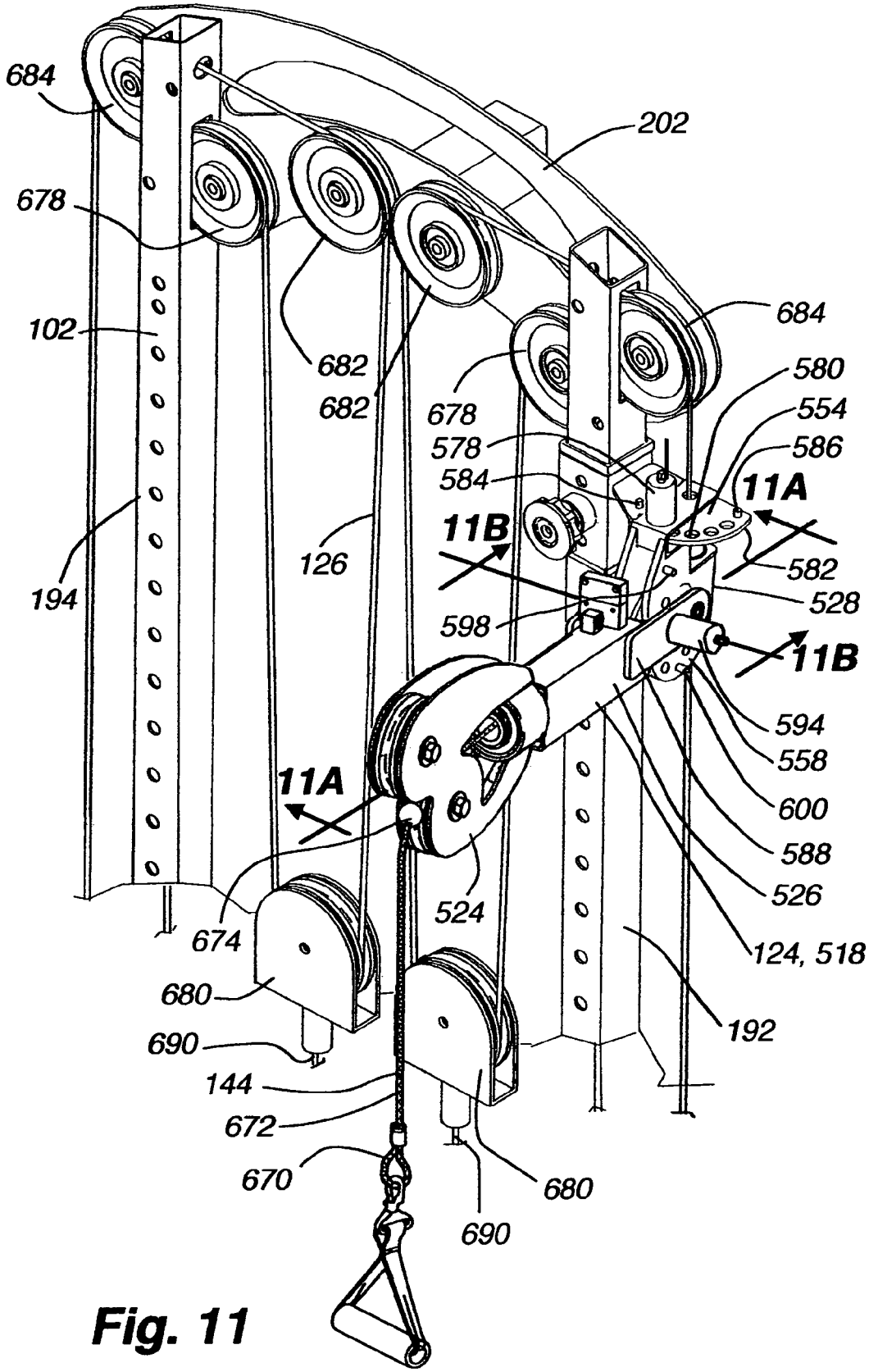
FIG. 11 is a second detailed view of the right arm assembly.
Figure 11A:
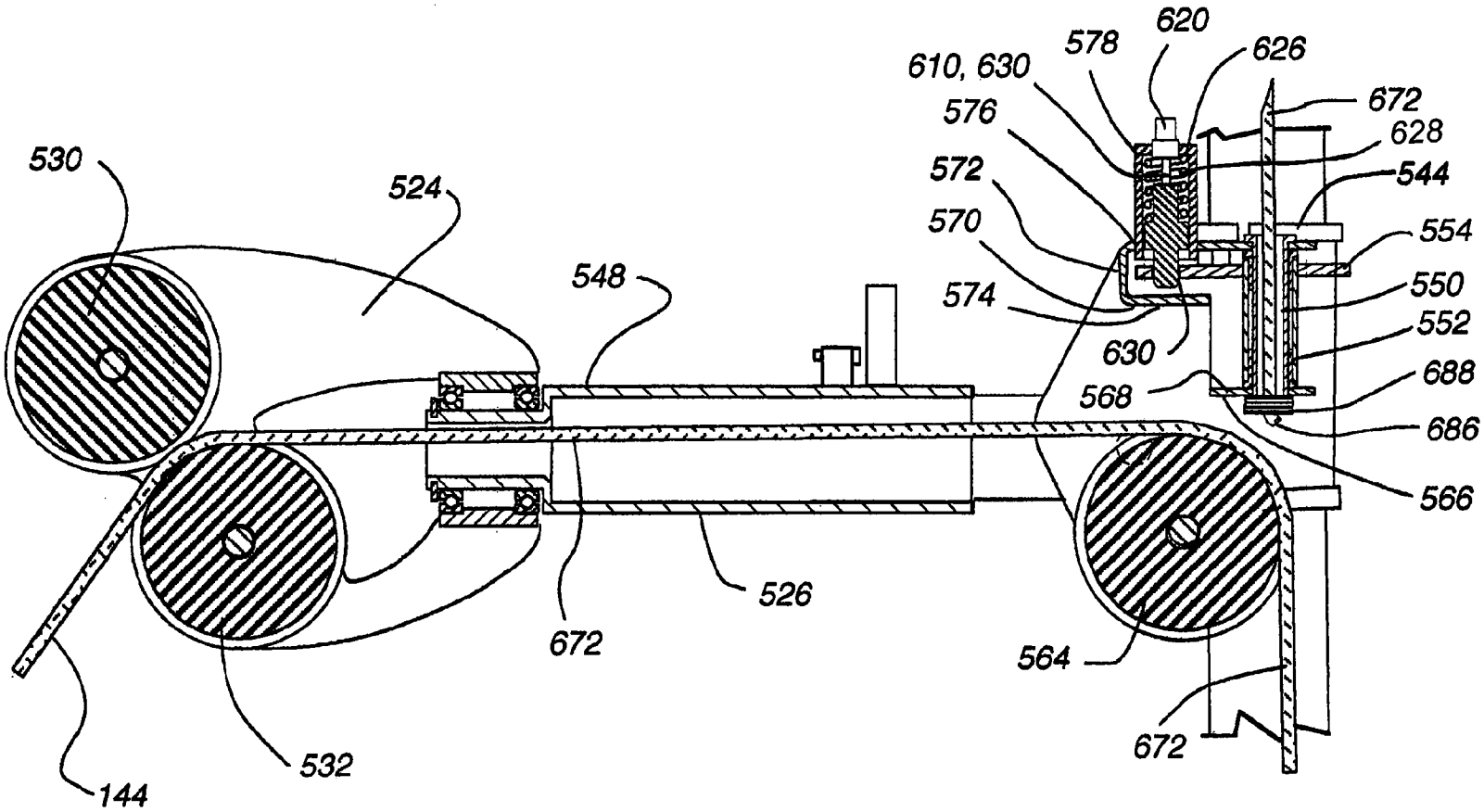
FIG. 11A is a cross-sectional view of the right arm assembly depicted in FIG. 11, taken along line 11A-11A.
Figure 11B:
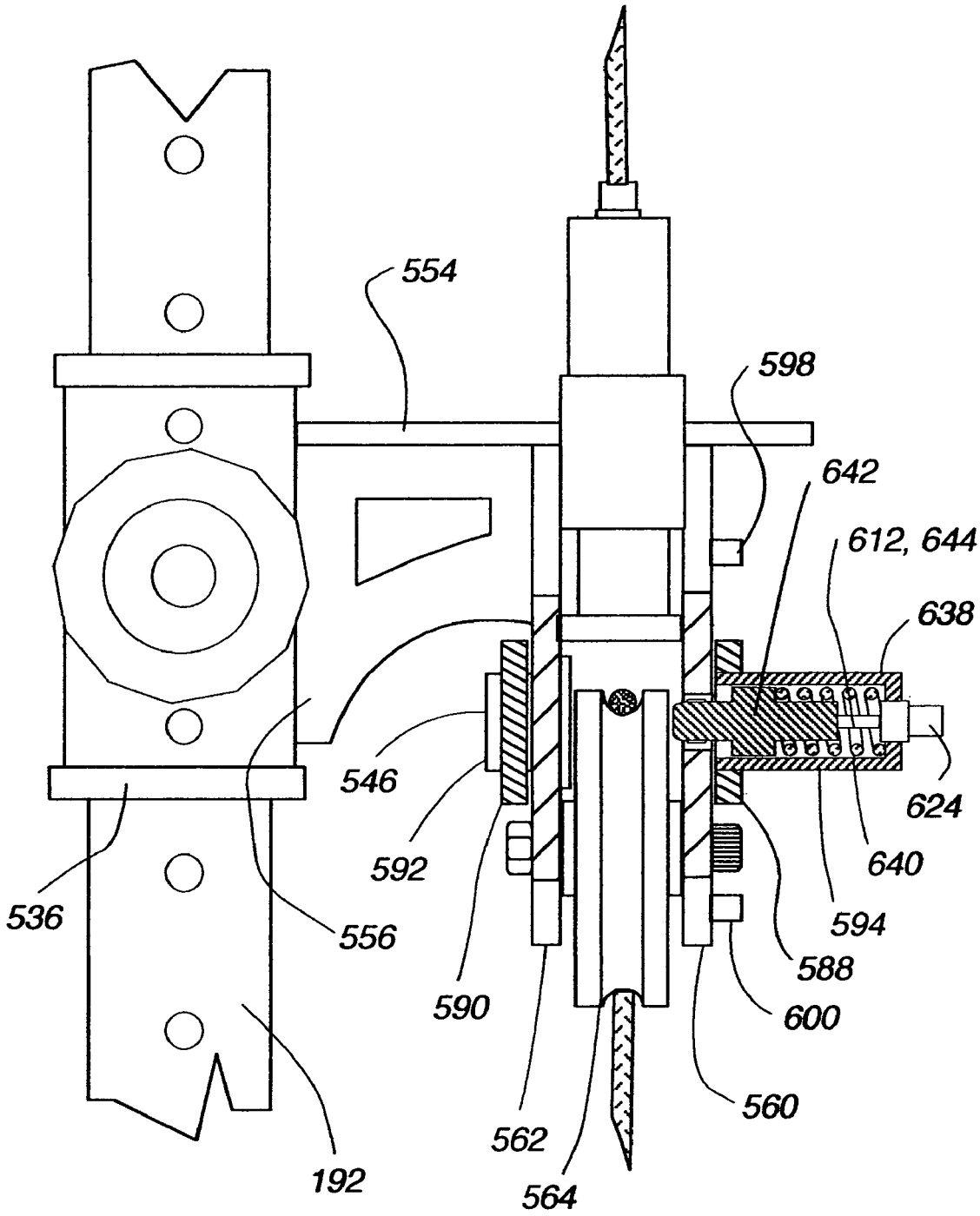
FIG. 11B is a cross-sectional view of the right arm assembly depicted in FIG. 11, taken along line 11B-11B.

As shown in FIGS. 11-11B, the resistance cables 144 extend from the cable-pulley assembly 126 on the frame 102 and through the arm assemblies 124. As such, the arm assemblies each include an arrangement of pulleys to guide the resistance cables. More particularly, the right and left arm assemblies each include a distal pulley housing 524 rotatably connected with an arm member 526. In turn, the arm member is rotatably connected with a proximal pulley assembly 528. As shown in FIGS. 9 and 10, the distal pulley housing 524 can rotate relative the arm member 526 in directions A and B. Rotation of the distal pulley housing helps to align the resistance cables with the actuation device, as discussed in more detail below. The distal pulley housing 524 rotatably supports first and second distal pulleys 530, 532 that help guide the resistance cables 144 through the arm assemblies 124.

As shown in FIGS. 1D, 9, and 10-10A2, the right and left arm assemblies 518, 520 are coupled with the right and left upright members 192, 194, respectively, through arm slider assemblies 534 that provide selective vertical positioning of the arm assemblies. More particularly, the proximal pulley assemblies 528 of each arm assembly are connected with slider members 536. Each slider member 536 defines a hollow cross section that is adapted to receive the upright members 192, 194 such that the slider members can slide up and down along the length the upright members. As shown in FIGS. 10-10A2, each arm slider assembly 534 includes a slider pop-pin 538 mounted on the slider member 536. The slider pop-pin is adapted to selectively engage a plurality of apertures 540 on front sides 542 of the upright members 192, 194. As such, the slider pop-pin 538 allows a user to selectively adjust the vertical position of the arm assemblies 518, 520 along the length of the upright members 192, 194 by moving the slider members 536 along the length the of the upright members and selectively engaging the slider pop-pin with a selected one of the apertures 540 located at a desired vertical position. For example, FIG. 10A1 shows the slider member 536 locked into position on the right upright member 192 with the slider pop-pin 538 engaged with one of the apertures 540. FIG. 10A2 shows the slider pop-pin 538 disengaged from the apertures 540 so the slider member 536 is free to move up and down along the right upright member 192.

As previously mentioned and as discussed below with reference to FIGS. 10-13C, the right and left arm assemblies 518, 520 can each include multi-axis locking mechanisms 522 that allow a user to pivot each arm assembly in vertical and horizontal directions simultaneously. More particularly, the multi-axis locking mechanism 522 is operable to allow the arm assembly 124 to simultaneously pivot about a first axis 544 defined by a pivotal connection between the slider assembly 534 and the proximal pulley assembly 528 (for horizontal pivoting), and a second axis 546 defined by a pivotal connection between the proximal pulley assembly 528 and the arm member 526 (for vertical pivoting). As such, a user can operate the multi-axis locking mechanism to allow a distal end portion 548 of the arm assembly 124 to move right or left and up or down at the same time. In one particular implementation, the distal pulley housing 524 may be moved to various positions in an arcuate path defined by approximately 90° horizontal movement and approximately 180° vertical movement.

As previously mentioned, the proximal pulley assembly 528 is pivotally connected with the slider member 536 through a first axle 550, which defines the first pivot axis 544. As shown in FIG. 11A, the first axle 550 is substantially vertically oriented and rotatably received within a cylindrically-shape first axle housing 552 connected with a horizontal selector plate 554 and a support bracket 556. Both the horizontal selector plate 554 and the support bracket 556 are connected with and extend outward from the slider member 536. From the slider member 536, the support bracket 556 extends along a bottom side of the horizontal selector plate 554. The first axle 550 is connected with and extends along an outer edge of the support bracket 556 and through the horizontal selector plate 554. As shown in FIGS. 10-11B, the proximal pulley assembly 528 includes a proximal pulley housing 558 having a first side 560 and a second side 562 rotatably supporting a proximal pulley 564 therebetween. A first ledge 566 on the proximal pulley housing 558 supports an axle plate 568 connected with a bottom end portion of the first axle 550. A second ledge 570 on an upper portion of the proximal pulley housing 558 supports a pop-pin support member 572. The pop-pin support member 572 is substantially C-shaped and includes a lower side 574 connected with the second ledge 570 and an upper side 576 extending rearward over the top of the horizontal selector plate 554. As shown in FIG. 11A, the upper side 576 of the pop-pin support member 572 is connected with an upper end portion of the first axle 550. As such, the proximal pulley assembly 528, and in turn, the arm assembly 124 can pivot in both right and left directions about the first axle 550.

As shown in FIGS. 9, 10, and 11-11B, each arm assembly 124 includes a first pop pin 578 to select the horizontal pivotal position of the arm assembly. More particularly, the first pop-pin 578 is supported on the upper side 576 of the pop-pin support member 572 and is adapted to engage a plurality of apertures 580 in the horizontal selector plate 554. As shown in FIG. 11 and others, the apertures 580 are circumferentially spaced and are located adjacent an arcuate edge 582 of the horizontal selector plate 554. As described in more detail below, the first pop-pin can be used to selectively engage the apertures 580 in the horizontal selector plate 554 to lock the arm assembly 124 in a desired pivotal orientation relative to the horizontal selector plate. First and second 584, 586 stops extending upward from the horizontal selector plate 554 are adapted to engage the upper side 576 of the pop-pin support member 572 to limit the range of pivotal movement of the arm assembly about the first axis 544 in right and left directions.

As previously mentioned, each arm assembly 124 is also pivotally connected with the proximal pulley assembly 528. As shown in FIGS. 10-11B, first and second arm support members 588, 590 extending rearwardly from the arm member 526 are pivotally connected with pins 592 extending outward from the first and second sides 560, 562 of the proximal pulley housing 558, defining the second pivot axis 546. As such, the arm member, and in turn, the arm assembly can pivot up and down about the second axis.

As shown in FIGS. 9 and 11A-11B, each arm assembly 124 includes a second pop pin 594 to select the vertical pivotal position of each arm assembly. The second pop-pin 594 is supported on the first arm support member 588 and is adapted to selectively engage apertures 596 in the first side 560 of the proximal pulley housing 558. As described in more detail below, the second pop-pin can be used to selectively lock the arm assembly in a desired pivotal orientation relative to the proximal pulley housing 558. Upper and lower stops 598, 600 extending outward from the first side 560 of the proximal pulley housing 558 are adapted to engage the first arm support member 588 to limit the range of pivotal movement of the arm assembly about the second axis in upward and downward directions.

Figure 12A:
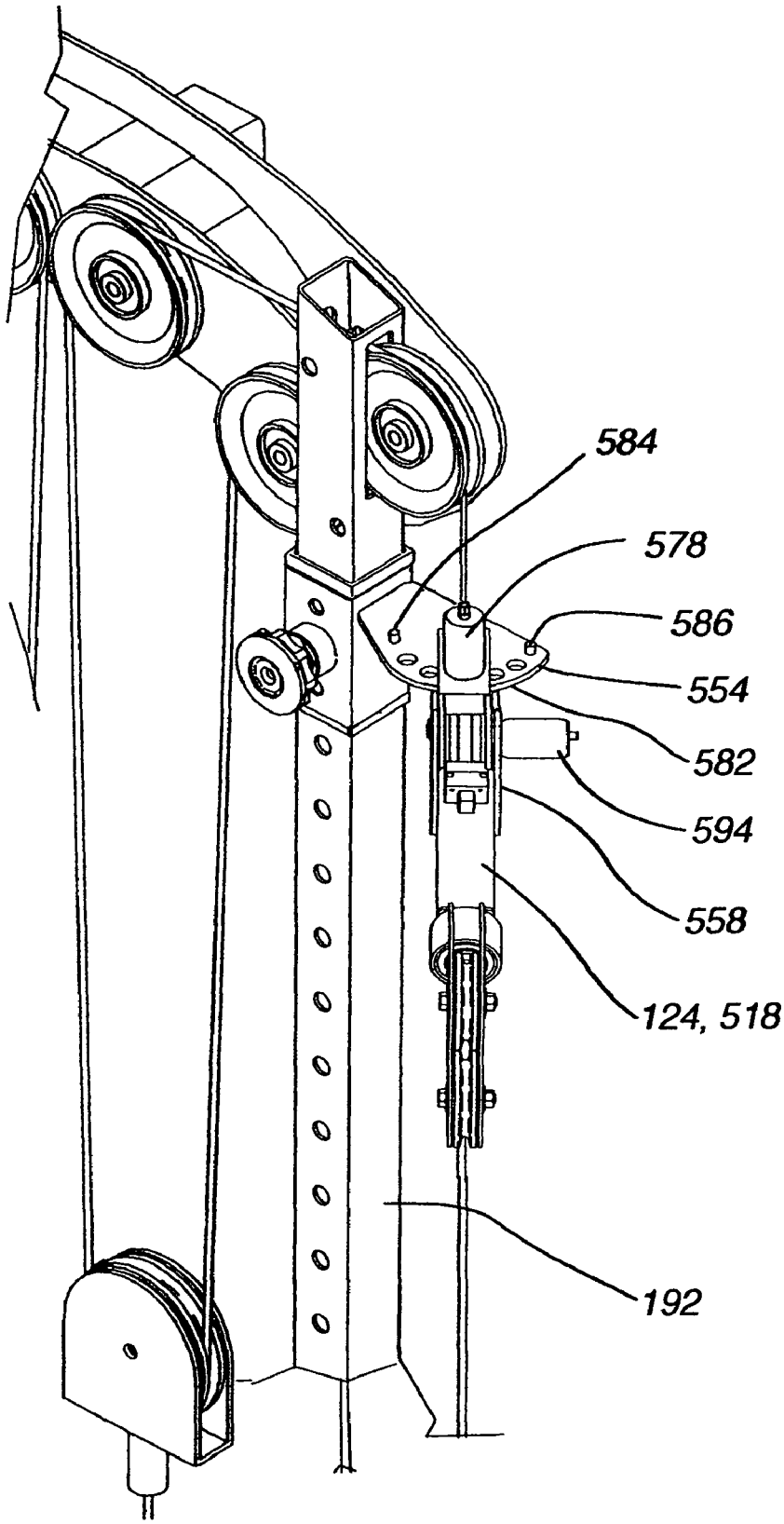
FIG. 12A is a view of the right arm assembly in a first position.
Figure 12B:
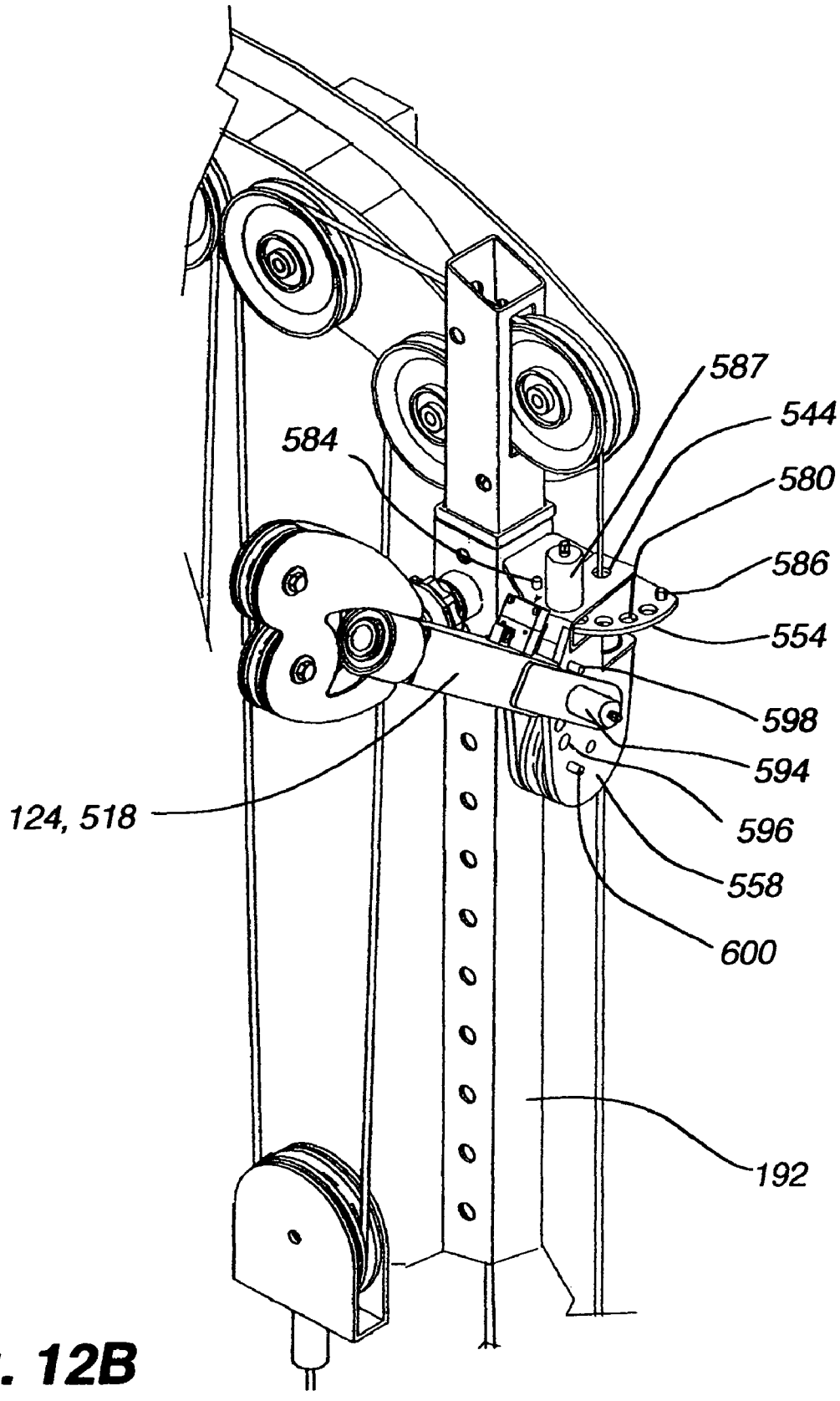
FIG. 12B is a view of the right arm assembly in a second position.
Figure 12C:
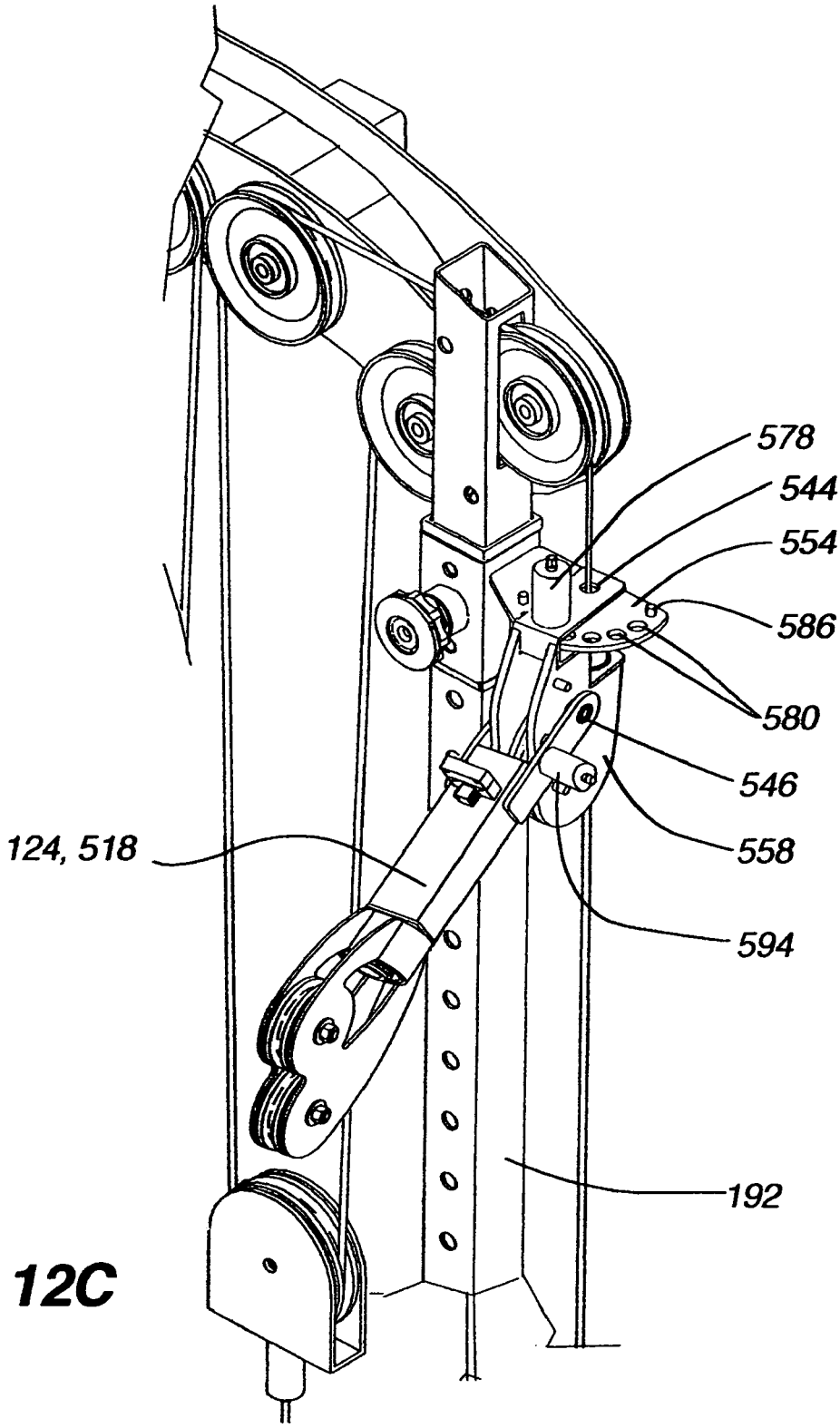
FIG. 12C is a view of the right arm assembly in a third position.
Figure 13A:
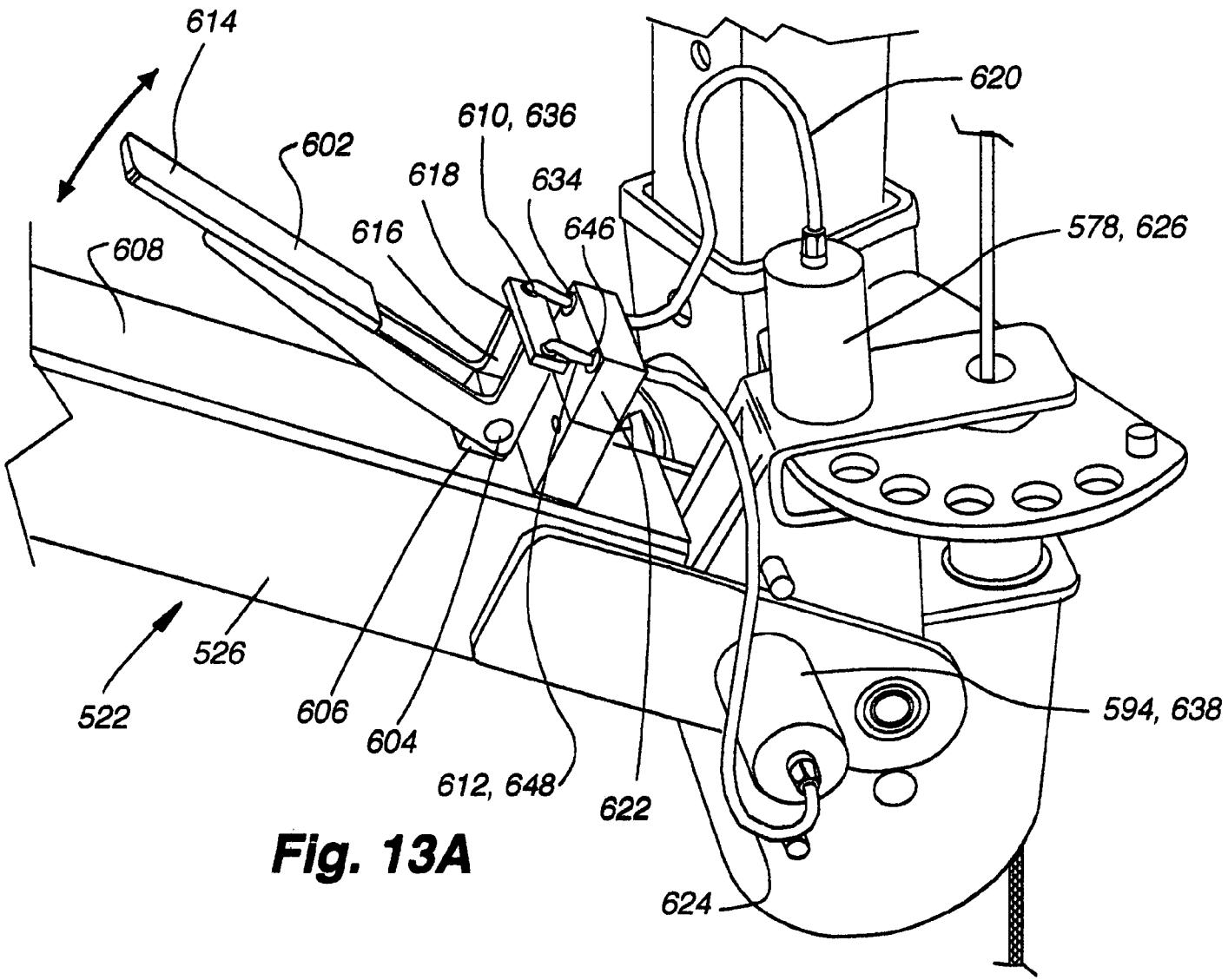
FIG. 13A is a detailed view of a first embodiment of a multi-axis release mechanism.
Figure 13B:
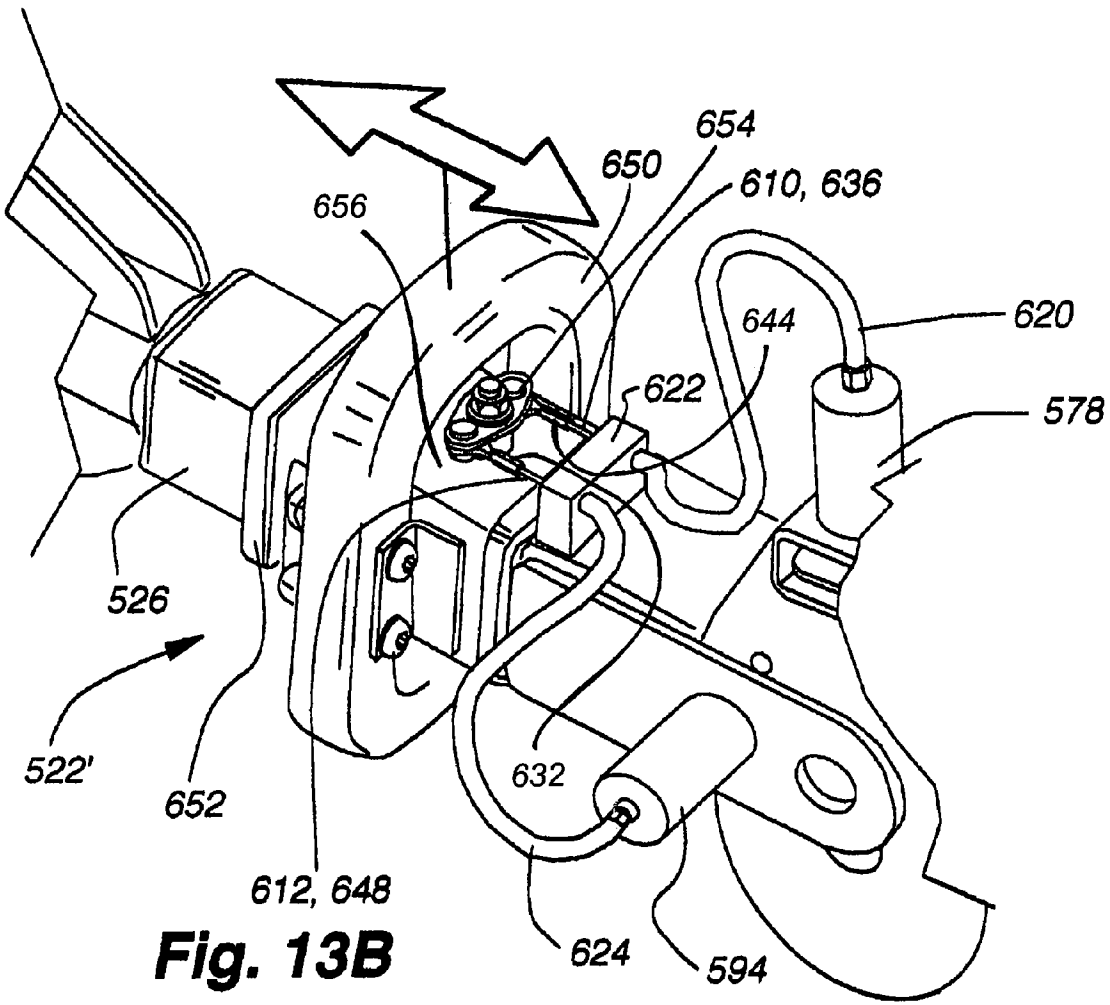
FIG. 13B is a detailed view of a second embodiment of a multi-axis release mechanism.
Figure 13C:
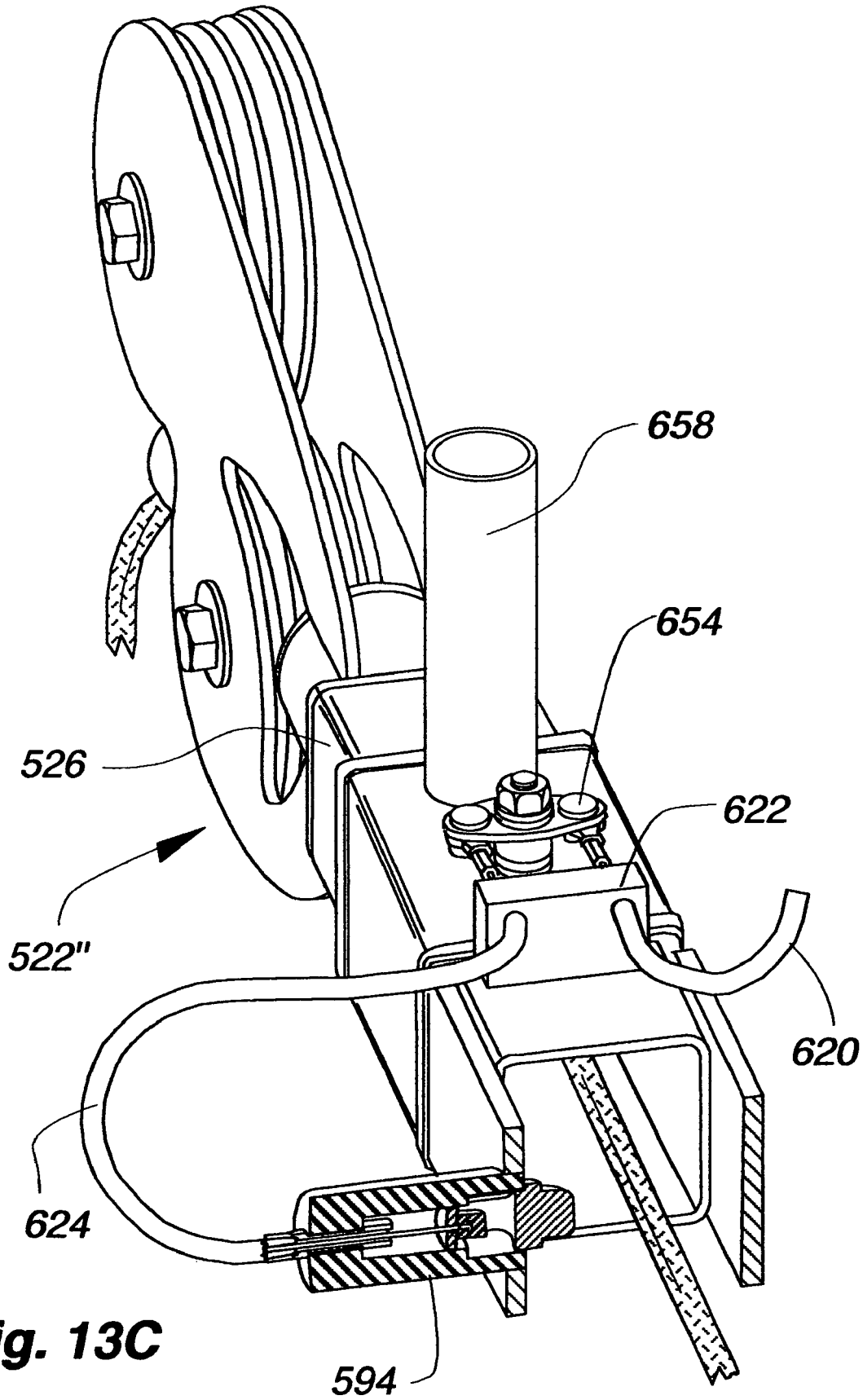
FIG. 13C is a detailed view of a third embodiment of a multi-axis release mechanism.

As previously mentioned, the arm assemblies 124 can include multi-axis release mechanisms 522 that allows a user to disengage the first and second pop-pins 578, 594 simultaneously from their respective apertures 580, 596, which allows the arm assemblies to simultaneously pivot about the first and second axes 544, 546, as illustrated in FIGS. 12A-12C. It is to be appreciated that various embodiments of the multi-axis release mechanism can be used to disengage the first and second pop-pins. For example, FIGS. 13A-13C illustrate three alternative embodiments of a multi-axis pivot mechanism operable to disengage the first and second pop-pins from their respective apertures. It is also to be appreciated that each pop pin may be configured for individual activation. In such an arrangement, the user would likely move the arm vertically and horizontally in separate motions.

As shown in FIG. 13A, the multi-axis release mechanism 522 includes a lever member 602 pivotally connected with a lever axle 604 supported by a mounting block 606 on a top side 608 of the arm member 526. A discussed in more detail below, the lever member is connected with the first and second pop-pins 578, 594 through first and second cables 610, 612. The lever member can be pivoted to pull the cables, which in turn, disengages the pop-pins from respective apertures to allow the arm assembly to simultaneously pivot about the first and second axes. As shown in FIG. 13A, the lever member 602 is substantially L-shaped and includes a handle portion 614 connected with a puller portion 616 supporting a cable connection plate 618. A first cable conduit 620, which houses the first cable 610, extends from the first pop-pin 578 to a cable guide block 622 connected with the top side of the arm member 526. In addition, a second cable conduit 624, which houses the second cable 612, extends from the second pop-pin to the cable guide block 622.

As shown in FIGS. 11A and 13A, the first pop-pin 578 includes a cylindrically-shaped body 626 housing a spring 628 operably connected with a pin 630. The spring 628 acts to force the pin 630 against the horizontal selector plate 554. A first end 632 of the first cable is connected with the pin 630 and extends from the first pop-pin body 626 and through the first cable conduit 620. The first cable 610 exits the first cable conduit 620 and extends through a first aperture 634 in the cable guide block 622 to a second end 636 connected with the cable connection plate 618. As discussed in more detail below, the pin 630 can be disengaged from apertures 580 in the horizontal selector plate 554 by pivoting the lever member 602, which in turn, pulls on the first cable 610 and the pin 630 away from the horizontal selector plate, which allows the arm assembly 124 to pivot about the first axis 544.

With reference to FIGS. 11A, 12A, 12B, and 13A, when moving the arm assembly 124 from a first pivotal position to a second pivotal position relative to the first axis 544, a user can pivot the lever member 602 to disengage the pin 630 from the horizontal selector plate 554. While holding the pin in disengagement from the horizontal selector plate, the arm assembly 124 can be pivoted about the first axis 544 to the second pivotal position. Once the arm assembly is in the second pivotal position, the lever member 602 can be released, which allows the spring 628 to force the pin 630 back into engagement with the horizontal selector plate 554. If the pin 630 is aligned with one of the apertures 580 in the horizontal selector plate, the pin will extend into one of the apertures, locking the arm assembly 124 into the second pivotal position. If the pin 630 is not aligned with one of the apertures 580, the pin will be forced against the horizontal selector plate 554. The arm assembly 124 can then be pivoted right and left until the pin is aligned with and forced into one of the apertures.

As shown in FIGS. 11B and 13A, the second pop-pin 594 includes a cylindrically-shaped body 638 housing a spring 640 operably connected with a pin 642. The spring 640 acts to force the pin 642 against the first side 560 of the proximal pulley housing 558. A first end 644 of the second cable is connected with the pin 642 and extends from the second pop-pin body 638 and through the second cable conduit 624. The second cable 612 exits the second cable conduit 624 and extends through a second aperture 646 in the cable guide block 622 to a second end 648 connected with the cable connection plate 618. As discussed in more detail below, the pin 642 can be disengaged from apertures 596 in first side 560 of the proximal pulley housing 558 by pivoting the lever member 602, which in turn, pulls on the second cable 612 and the pin 642 away from the proximal pulley housing, which allows the arm assembly 124 to pivot about the second axis 546.

With reference to FIGS. 11B, 12B, 12C, and 13A, when moving the arm assembly 124 from a first pivotal position to a second pivotal position relative to the second axis 546, a user can pivot the lever member 602 to disengage the pin 642 from the proximal pulley housing 558. While holding the pin in disengagement from the proximal pulley housing, the arm assembly 124 can be pivoted about the second axis 546 to the second pivotal position. Once the arm assembly is in the second pivotal position, the lever member 602 can be released, which allows the spring 640 to force the pin 642 back into engagement with the proximal pulley housing 558. If the pin 642 is aligned with one of the apertures 596 in the proximal pulley housing, the pin will extend into one of the apertures, locking the arm assembly 124 into the second pivotal position. If the pin 642 is not aligned with one of the apertures 596, the pin will be forced against the proximal pulley housing 558. The arm assembly 124 can then be pivoted up and down until the pin is aligned with and forced into one of the apertures.

Referring to FIGS. 11A, 11B, 12A-12C, and 13A, to operate the first embodiment of the multi-axis release mechanism 522, a user applies a force to the lever member 602 to move the handle portion 614 toward the top side 608 of the arm member 526, causing the lever member to pivot about the lever axle 604. In turn, the cable connection plate 618 on the puller portion 616 of the lever member 602 moves away from the cable guide block 622. As such, the cable connection plate 618 pulls on the first ends 632, 644 of the first and second cables 610, 612, causing the first and second pop-pins to disengage from the horizontal selector plate 554 and the proximal pulley housing 558, respectively. While the first and second pop-pins are disengaged, the user can pivot the arm assembly 124 about the first and second axes 544, 546 at the same time. Once the arm assembly is in the desired position, the handle portion 614 of the lever member 602 can be released. The springs 628, 640 in the first and second pop-pins 578, 596 then force the pins 630, 642 to engage apertures 580, 596 in the horizontal selector plate and the proximal pulley housing, respectively, which locks the arm assembly in the desired position. As the springs move the pins back toward the horizontal selector plate and proximal pulley housing, the first and second cables pull the cable connection plate 618 back toward the cable guide block 622, which in turn, causes the lever member 602 to pivot about the lever axle, moving the handle portion upward 614 from the top side 608 of the arm member 526.

A second embodiment of the multi-axis release mechanism 522' is shown in FIG. 13B. The second embodiment 522' includes a handle 650 connected with an arm slider member 652, as opposed to the lever member 602 described above with reference to the first embodiment 522, to operate the first and second pop-pins 578, 594. More particularly, the arm slider member 652 defines a hollow cross section that is adapted to receive the arm member 526 such that the slider member can slide back and forth along the length of the arm member. The handle 650 defines a substantially square-shaped loop that surrounds the outer periphery of the arm slider member 652 and is connected with two opposing sides of the slider member. The second ends 636, 648 of the first and second cables 610, 612 are connected with a cable connection plate 654 mounted on a top side 656 of the arm slider member 652.

To operate the second embodiment of the multi-axis release mechanism 522', a user applies a force to the handle 650 to move the arm slider member 652 along the arm member 526 away from the cable guide block 622. In turn, the cable connection plate 654 on the arm slide member 652 moves away from the cable guide block 622. As such, the cable connection plate 654 pulls on the first ends 632, 644 of the first and second cables 610, 612, causing the first and second pop-pins to disengage from the horizontal selector plate 554 and the proximal pulley housing 558, respectively. While the first and second pop-pins are disengaged, the user can pivot the arm assembly 124 about the first and second axes 544, 546 at the same time. Once the arm assembly is in the desired position, the handle 650 can be released. The springs 628, 640 in the first and second pop-pins 578, 594 then force the pins 630, 642 to engage apertures 580, 596 in the horizontal selector plate and the proximal pulley housing, respectively, which locks the arm assembly in the desired position. As the springs move the pins back toward the horizontal selector plate and proximal pulley housing, the first and second cables pull the cable connection plate 654 back toward the cable guide member 622, which in turn, pulls the arm slider member 652 toward the cable guide member 622. The cable guide member can also act as a stop to limit the travel of the arm slider member toward the proximal end of the arm assembly.

FIG. 13C illustrates a third embodiment of a multi-axis release mechanism 522" that is substantially similar to the second embodiment 522'. However, the third embodiment 522" includes a handle post 658 connected with the top side of this arm slider member 652, as opposed to the handle 650 described above with reference to the second embodiment 522'. As such, a user applies a force to the handle post 658 to move the arm slider member 652 and operate the first and second pop-pins 578, 594.

With reference to FIGS. 2A-2H, the following provides a brief description of some of the various exercises that can be performed on the exercise device 100 as well as operation of various component on the exercise device in light of the previously described structural details.

As shown in FIG. 2A, the exercise device 100 is configured for leg extension exercises. The back support 112 on the bench frame 104 is locked in an upright position relative to the bench seat 114 with the back support pop-pin 410. The arm assemblies 518, 520 are locked in relatively low vertical positions on the right and left upright members 192, 194 with the slider pop-pins 538 mounted on the slider members 536. Using the multi-axis release mechanism 522, the arm assemblies are oriented with the arm members 526 angled downward and inward toward each other. The resistance cables 144 extend from the distal pulley housings 524 of each arm assembly 518, 520, around the leg station pulleys 260, 262, and are connected with the shaft 470 on the resistance arm 450. A user places his body on the exercise device as illustrated in FIG. 2A and proceeds to move his legs in the directions shown.

As shown in FIG. 2B, the exercise device 100 is configured for leg curl exercises. The back support 112 on the bench frame 104 is locked in a downward position with the back support pop-pin 410 parallel with the bench seat 114. The arm assembly positions and resistance cable configurations are the same as described above with reference to FIG. 2A. The actuation member 436 is locked into position with the leg developer pop-pin to extend forward from the forward bench support 122. A user places his body on the exercise device as illustrated in FIG. 2B and proceeds to move his legs in the directions shown.

As shown in FIG. 2C, the exercise device 100 is configured for leg press exercises. The bench seat 114 and back support 112 are locked into position with the swivel pop-pin 392 wherein the user is facing in a rearward direction toward the main frame 106. The bench seat pop-pin 348 is configured to allow the bench seat to freely roll back and forth along the length of the seat rail 116. The resistance cables 144 extending from the arm assemblies 518, 520 are connected with the eyelets 432 on the bench seat 114. A user places his body on the exercise device as illustrated in FIG. 2C and proceeds to press his feet against the foot plates 212, 218 to move the bench seat in the directions shown.

As shown in FIG. 2D, the exercise device 100 is configured for pull down exercises. The back support 112 on the bench frame 104 is locked in a downward position parallel with the bench seat 114 with the back support pop-pin 410. The arm assemblies 518, 520 are locked in relatively high vertical positions on the right and left upright members 192, 194 with the slider pop-pins 538 mounted on the slider members 536. Using the multi-axis release mechanism 522, the arm assemblies are oriented with the arm members 526 angled downward and inward toward each other. A user places his body on the exercise device as illustrated in FIG. 2D, grasps the handles 146 connected with the resistance cables 144 extending from the arm assemblies, and proceeds to pull with his arms in the directions shown.

As shown in FIGS. 2E and 2F, the exercise device 100 is configured for bench press exercises. In FIG. 2E, the back support 112 on the bench frame 104 is locked in an upright position with the back support pop-pin 410. The bench seat 114 and back support 112 are locked in an orientation with the swivel pop-pin 392 wherein the user is facing in a forward direction away from the main frame 106. The arm assemblies 518, 520 are locked in intermediate vertical positions on the right and left upright members 192, 194 with the slider pop-pins 538 mounted on the slider members 536. Using the multi-axis release mechanism 522, the arm assemblies are oriented with the arm members 526 angled upward and outward away from each other. A user places his body on the exercise device as illustrated in FIG. 2E, grasps the handles 146 connected with the resistance cables 144 extending from the arm assemblies, and proceeds to push with his arms in the directions shown. In FIG. 2F, the exercise device 100 is configured for an inclined bench press exercise. As such, the back support 112 is locked in an inclined position with the back support pop-pin 410. The arm assemblies 518, 520 are locked in a relatively low vertical position on the right and left uprights 192, 194 with the slider pop-pins 538.

Figure 2G:
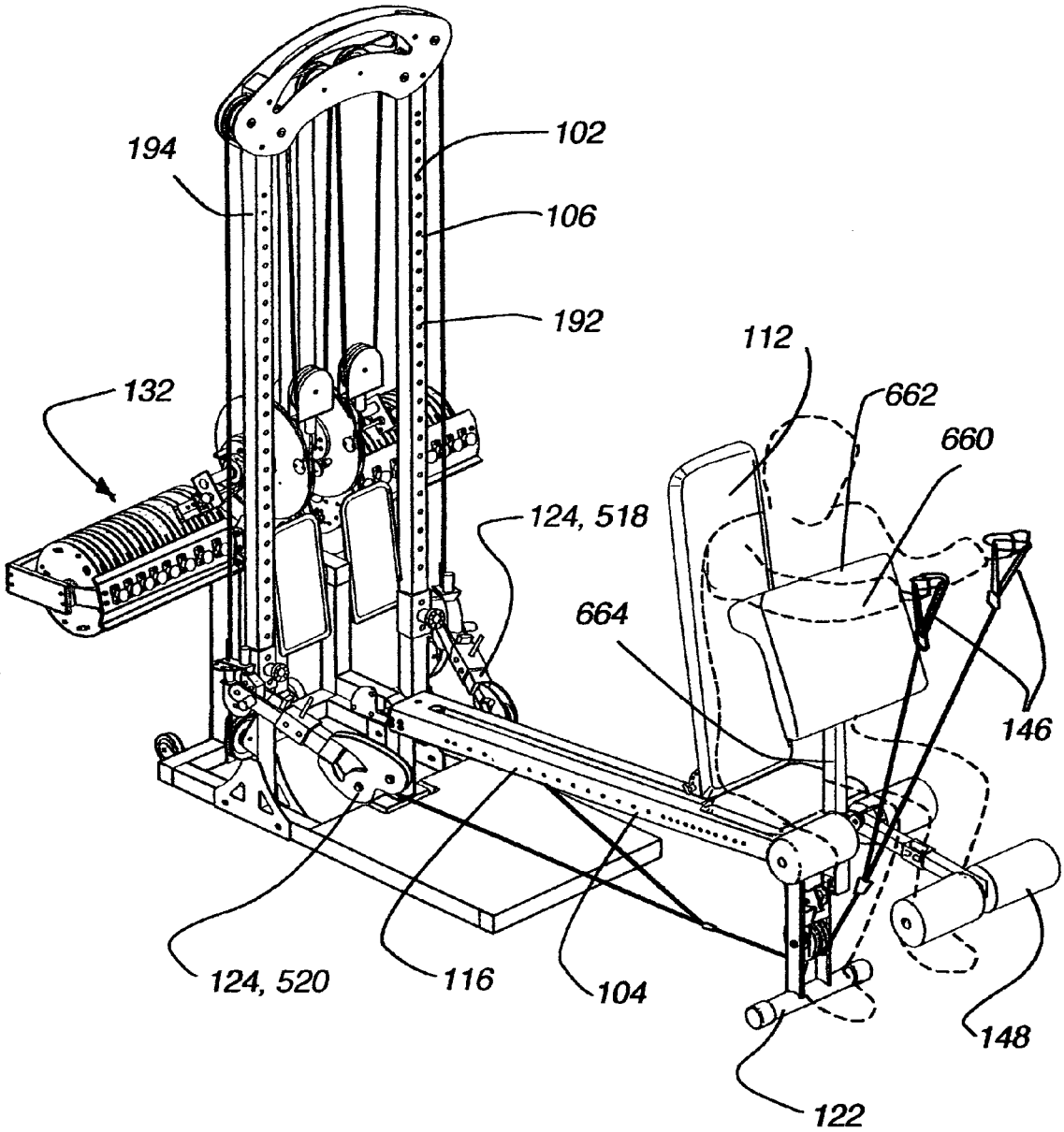
FIG. 2G is a view of the exercise device configured for preacher curl exercises.
Figure 2H:
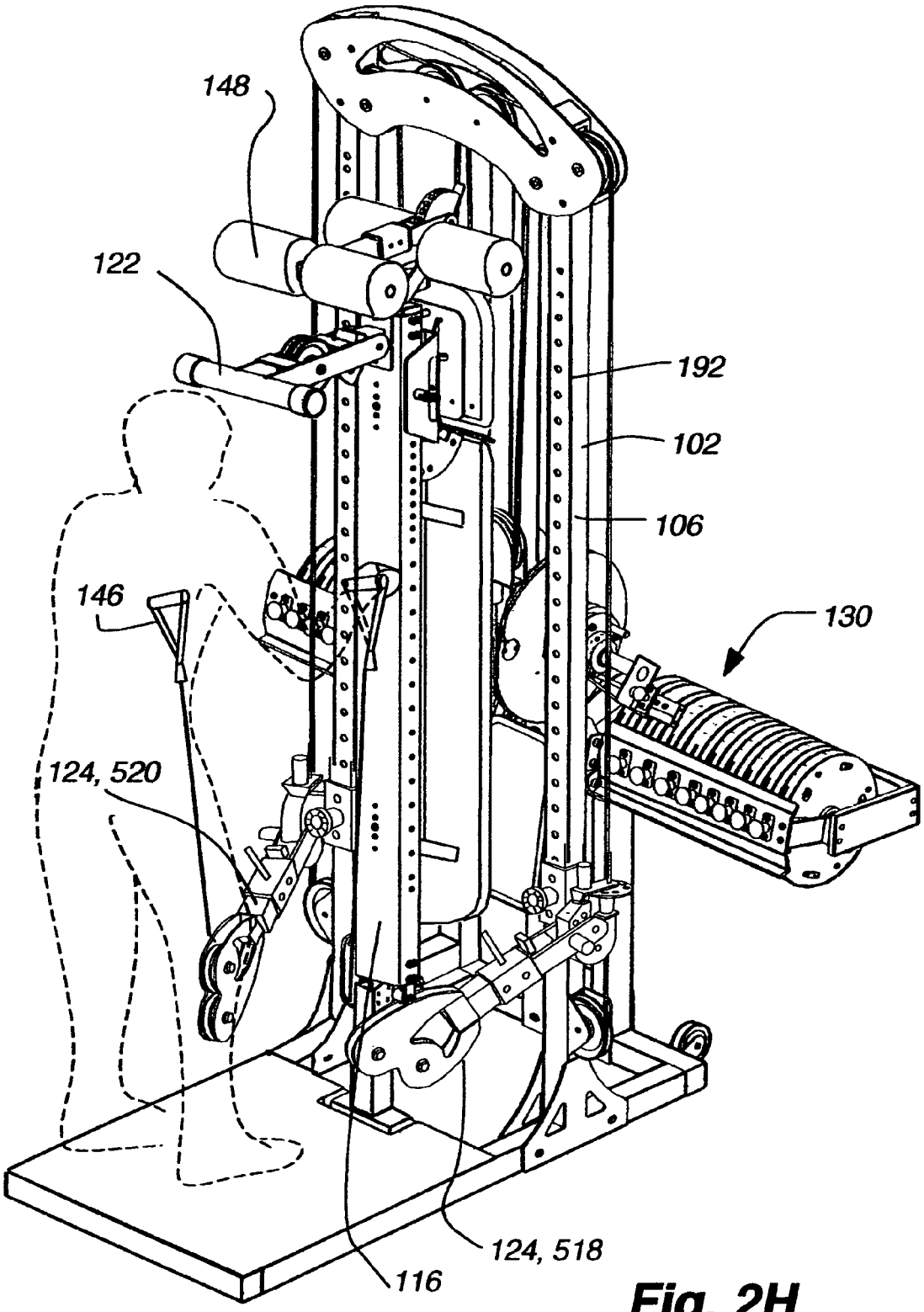
FIG. 2H is a view of the exercise device configured in a storage configuration.

As shown in FIG. 2G, the exercise device 100 is configured for preacher curl exercises with a preacher curl accessory 660 connected with the bench frame 104. More particularly, the preacher curl accessory includes an inclined preacher curl pad 662 connected with a support post 664. The support post 664 is inserted into the support member 512 supported between the right and left axle brackets 442, 444 extending from the second end portion 120 of the seat rail 116 as described above with reference to FIGS. 5 and 5F. The pop-pin 516 on the support member 512 is adapted to engage apertures in the support post 664 to allow for selective height adjustment of the preacher curl pad 662. The arm assemblies 518, 520 and resistance cables 144 are oriented in the same manner as described with reference to FIG. 2A, except handles 146 are connected with the resistance cables. A user places his body on the exercise device as illustrated in FIG. 2G, grasps the handles and proceeds to pull with his arms in the directions shown.

As shown in FIG. 2H, the exercise device 100 is placed in the storage configuration with the seat rail 116 held in an upright pivotal position by the first seat rail pop-pin 234. As shown in FIG. 2H, when the exercise device is placed in the storage configuration, the user can stand on the platform plate 154 and perform various types of exercises, such as pull downs, curls, and shoulder exercises.

Figure 14:
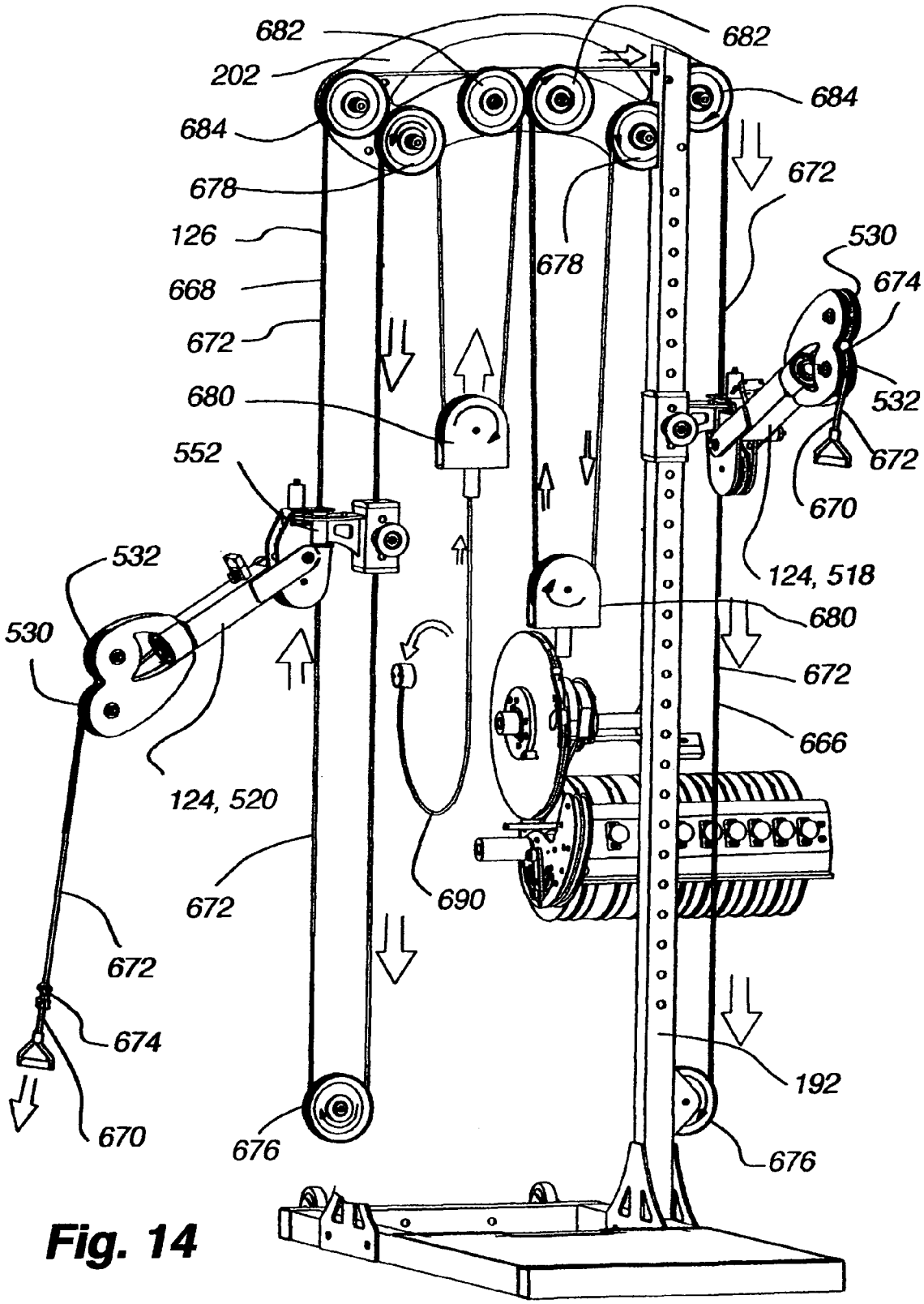
FIG. 14 is a detailed view of a right and left cable-pulley assemblies of the exercise device.

As previously mentioned, the user actuates the resistance system 128 through the cable-pulley system 126. As shown in FIGS. 1B, 1D, and 14, the cable-pulley system 126 can include separate right and left cable-pulley systems 666, 668 that couple the right and left resistance systems 130, 132 with resistance cables 144 extending from distal end portions of the right and left arm assemblies 518, 520, respectively. Although the following description refers to figures depicting mainly to the components of the right cable-pulley system 666, it is to be appreciated that the left cable-pulley system 668 is substantially a mirror image of the right cable-pulley system, and as such, includes the same components as the cable-pulley system, which operate in relation with each other and with the frame as the right cable-pulley system.

FIGS. 1B, 1D, 11, 11A and 14 illustrate the cable routing from the arm assemblies 518, 520 to the resistance systems 130, 132. From a first end 670, a first resistance cable 672 extends through a cable stop 674 engaged with the first and second distal pulleys 530, 532 of the arm assembly 124 and through the inside of the arm member 526 to the proximal pulley 564. The cable stop is connected with the first resistance cable and prevents the cable from being withdrawn into the arm assembly. The first resistance cable 672 wraps around a portion of the proximal pulley 564 and extends downward to and wraps around a portion of a lower directional pulley 676. The lower directional pulleys are rotatably supported by the lower end portions of the right and left upright members 192, 194. The first resistance cable 672 extends upward from the lower directional pulley 676 to a first upper directional pulley 678. The first upper directional pulleys are rotatably supported between the front and rear pulley plates 200, 202 connected with upper end portions of the right and left upright members. The first resistance cable wraps partially around the first upper directional pulley 678 and extends downward to a floating pulley 680. The first resistance cable wraps partially around the floating pulley and extends upward to wrap partially around a second upper directional pulley 682. From the second upper directional pulley 682, the first resistance cable 672 extends outward to a third upper directional pulley 684. The second and third upper directional pulleys are also rotatably supported between the front and rear pulley plates connected with upper end portions of the right and left upright members. The first resistance cable 672 wraps partially around the third upper directional pulley 684 and extends downward, through the first axle housing 552 connected with the arm slider assembly 534. The first resistance cable extends from the first axle housing 552 to a second end 686 connected with a cable termination 688. As shown in FIG. 11A, the cable termination 688 abuts the bottom end portion of the first axle housing 552 on the arm assembly. Because both ends of the first resistance cables 672 are terminated on the arm assemblies 518, 520, the arm assemblies can move relative to the main frame 106 without affecting the tension to the first resistance cables. As such, the position of the arm assemblies 518, 520 can be changed without actuating the resistance systems 130, 132.

When using the exercise device 100, the user applies a force to either or both first resistance cables 672 extending from the arm assemblies 518, 520, which pulls the first end 670 of the resistance cable 672 from the distal pulley housing 524. Because the second end 686 of the first resistance cable 672 is terminated at the first axle housing 552, pulling the first end 670 of the first resistance cable from the distal pulley housing 524 causes the floating pulley 680 to move upward. Movement of the floating pulley 680 in the upward direction translates forces to the resistance system 128 through a second resistance cable 690 extending downward from the floating pulley. As previously mentioned, the resistance systems 130, 132 include transmissions 134 and resistance assemblies 136 having pluralities of selectable resistance packs 138. The second resistance cable 690 connects the floating pulley 680 with the transmission assembly 134, which in turn, is connected with the resistance assembly 136 through a third resistance cable 692. As such, movement of the floating pulley 680 in an upward direction causes the transmission assembly 134 to apply torsional forces to the resistance assembly 136. As described in more detail below, the plurality of resistance packs 138 of the resistance assembly utilize torsional springs to provide a selectable level of resistance. As such, the resistance assembly provides resistance to the torsional forces exerted thereon by the transmission assembly.

Although the following description refers mainly to the components of the transmission assembly and resistance assembly associated with the right resistance system 130, it is to be appreciated that the transmission and resistance assemblies associated with the left resistance system 132 are substantially mirror images of the transmission and resistance assemblies of the right resistance system, and as such, include the same components and operate in relation with each other and with the other components of the exercise device as the transmission and resistance assemblies of the right resistance system.

Figure 15:
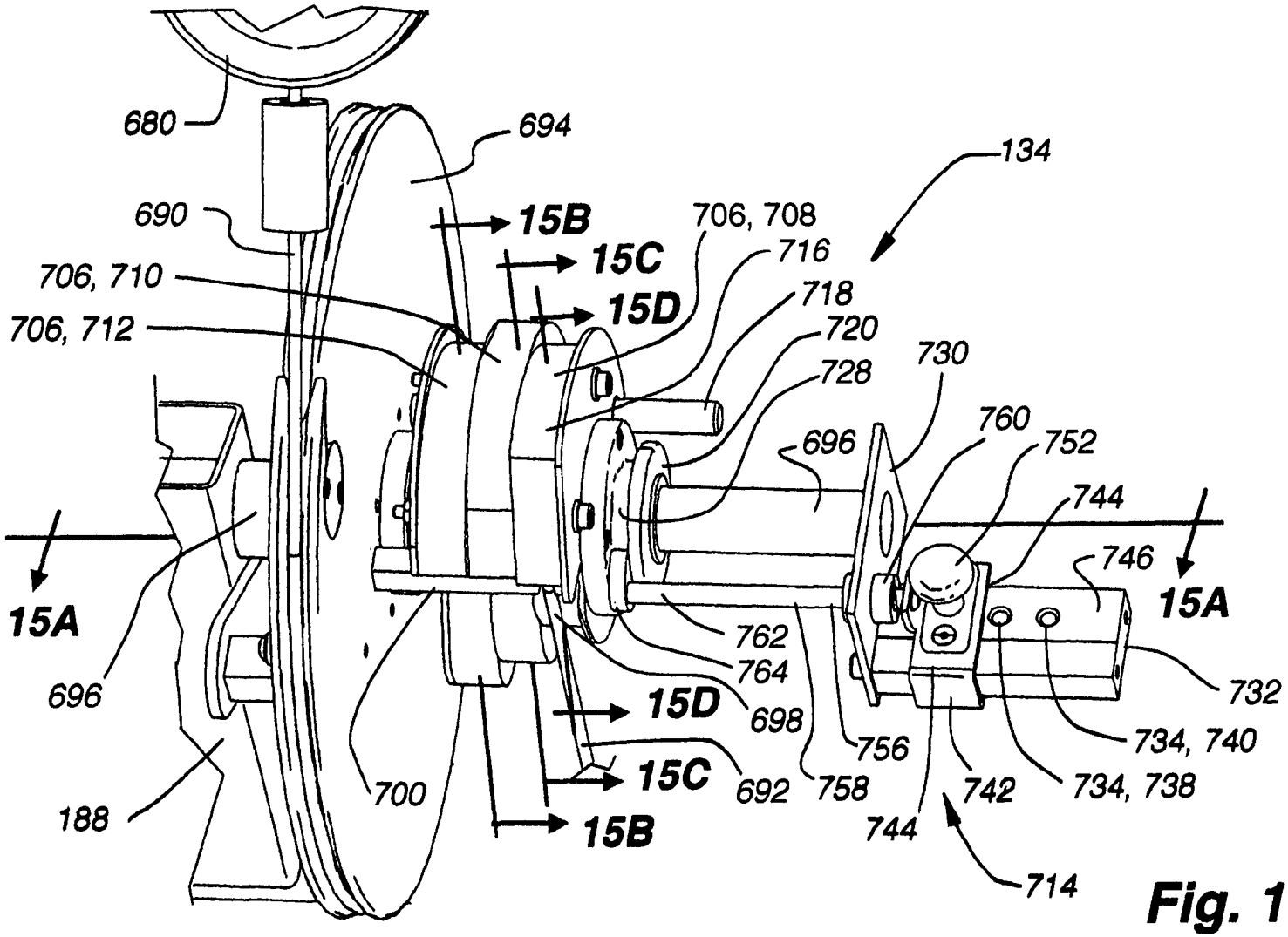
FIG. 15 is a detailed view of a transmission assembly.
Figure 15A:
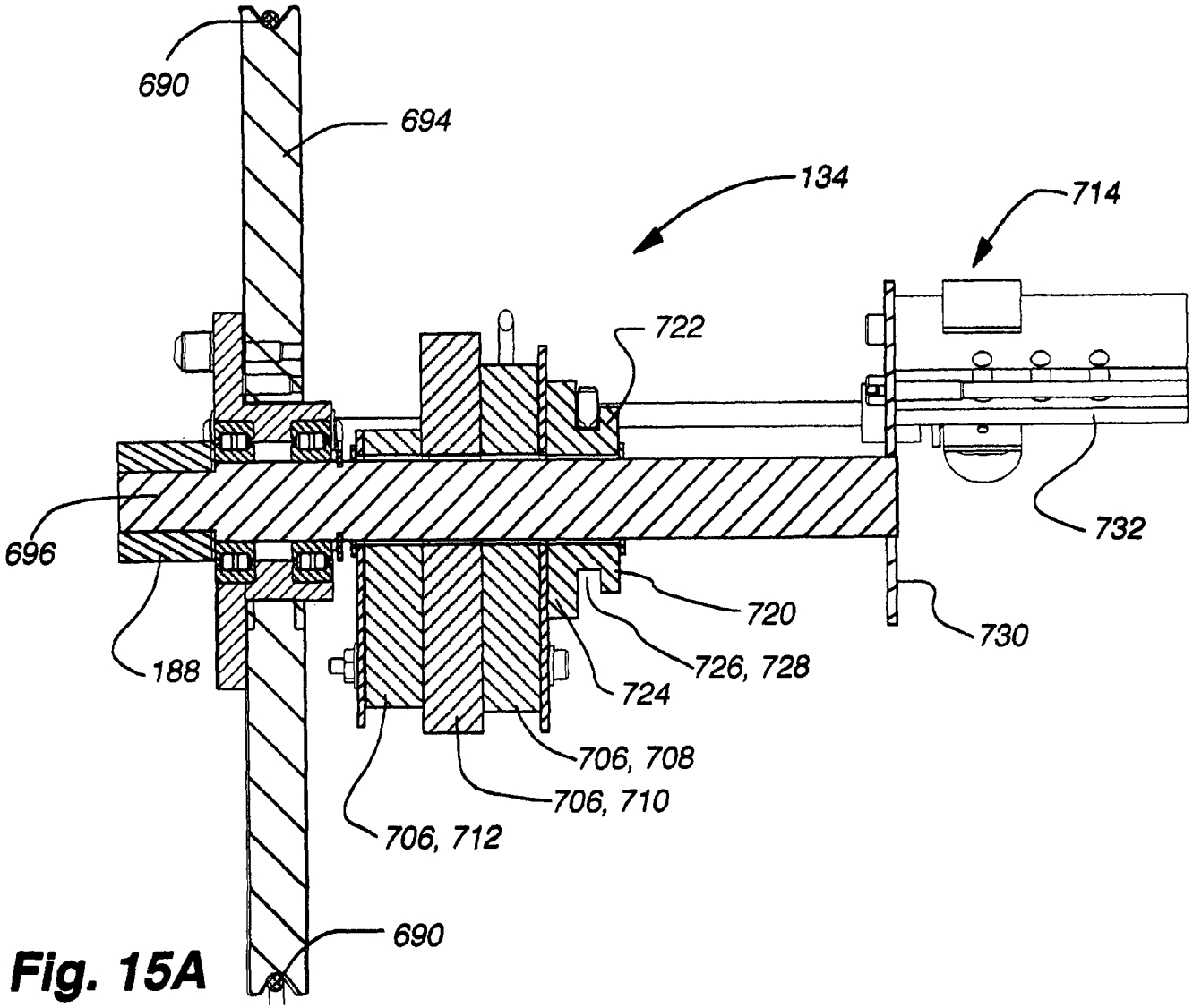
FIG. 15A is a cross-sectional view of the transmission assembly depicted in FIG. 15, taken along line 15A-15A.
Figure 15B:
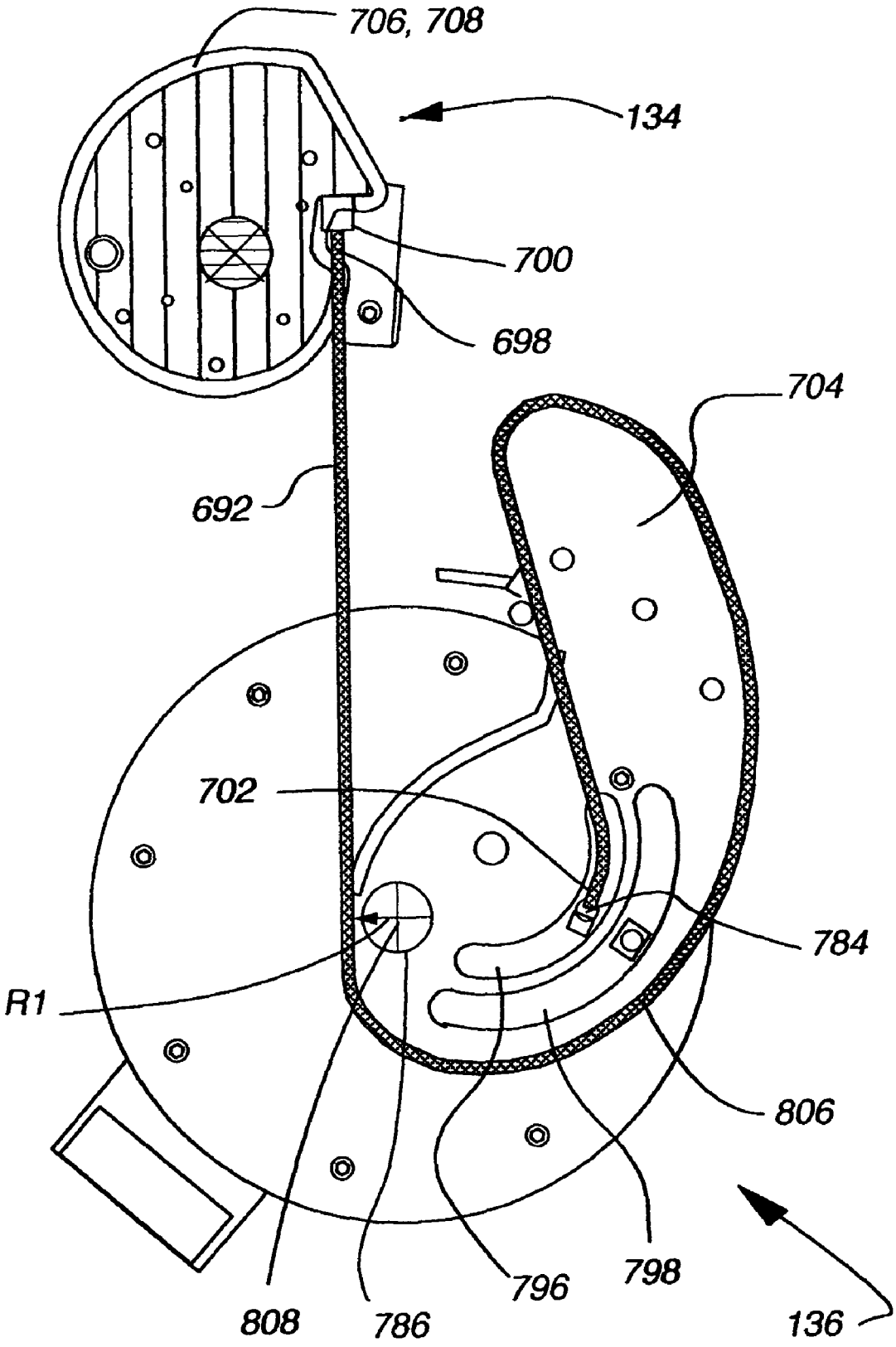
FIG. 15B is a cross-sectional view of the transmission assembly depicted in FIG. 15, taken along line 15B-15B.
Figure 15C:
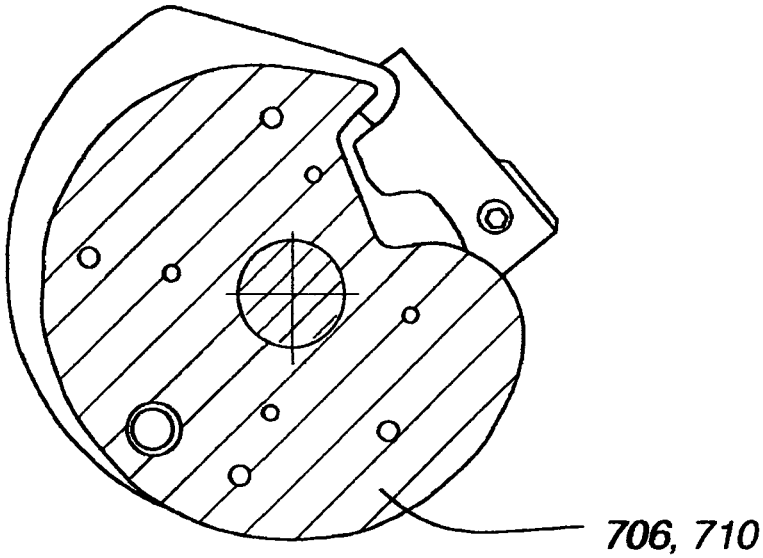
FIG. 15C is a cross-sectional view of the transmission assembly depicted in FIG. 15, taken along line 15C-15C.
Figure 15D:
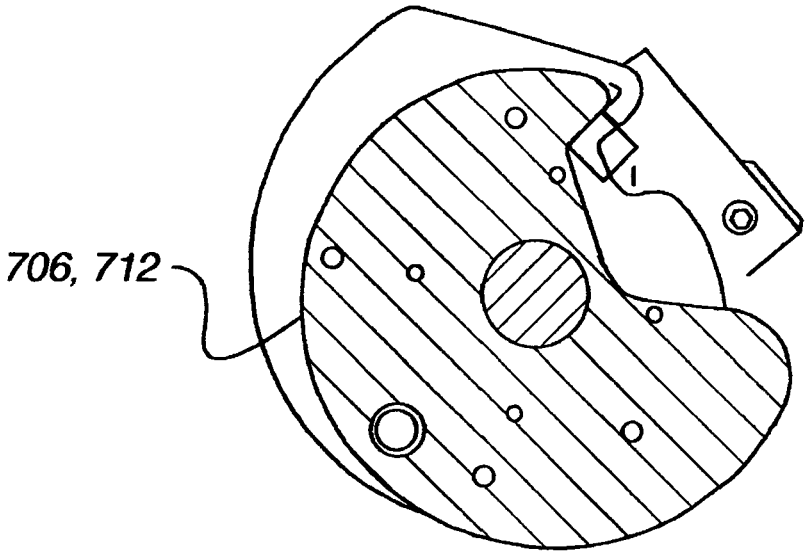
FIG. 15D is a cross-sectional view of the transmission assembly depicted in FIG. 15, taken along line 15D-15D.

As shown in FIGS. 15-15D, the transmission assembly 134 includes a transmission pulley 694 rotatably supported by a transmission axle 696 extending from the transmission support member 188 on the frame 106. During exercise, as the user applies a force to the first resistance cable 672, the floating pulley 680 moves upward, and in turn, the second resistance cable 690 is pulled upward and unwinds from the transmission pulley 694, causing the transmission pulley to rotate around the transmission axle in a first direction. Conversely, as the user lessens the force exerted on the first resistance cable, the resistance assembly 136 pulls against the transmission pulley 694 through the third resistance cable 692, causing the transmission pulley to rotate around the transmission axle in a second direction opposite the first direction. As the transmission pulley 694 rotates in the second direction, the second resistance cable 690 pulls the floating pulley 680 downward and winds back onto the transmission pulley. In one example, pulling the first resistance cable 672 from the right arm assembly 518 pulls the floating pulley 680 of the right cable-pulley system 666 upward. As such, the floating pulley pulls against the second resistance cable 690, causing the second resistance cable to unwind from the transmission pulley 694 of the right resistance system 130, which in turn, causes the transmission pulley to rotate in a clockwise direction (as viewed from the right side of the exercise device). As discussed in more detail below, rotation of the transmission pulley in the clockwise direction pulls the third resistance cable 692 and exerts torsional forces on the resistance assembly. Conversely, releasing the tension on the first resistance cable 672 allows the right resistance system pull against the third resistance cable 692, causing the transmission pulley 694 to rotate counterclockwise (as viewed from the right side of the exercise device). Rotation of the transmission pulley in the counterclockwise direction pulls downward on the second resistance cable and winds the second resistance cable back onto the transmission pulley while at the same time pulling the floating pulley downward.

As shown in FIG. 15-15B, a first end 698 of the third resistance cable 692 is connected with a cable termination member 700 extending outward from a side of the transmission pulley 694. As such, the as the transmission pulley rotates, the cable termination member 700 also rotates around the transmission axle 696 along with the first end 698 of the third resistance cable 692. A second end 702 of the third resistance cable 692 is connected with a linearizing cam 704 on the resistance assembly 136. As discussed in more detail below, when the transmission pulley 694 rotates in a direction that pulls upward on the third resistance cable 692, the linearizing cam 704 imparts a torsional force to selected resistance packs 138.

Figure 15E:
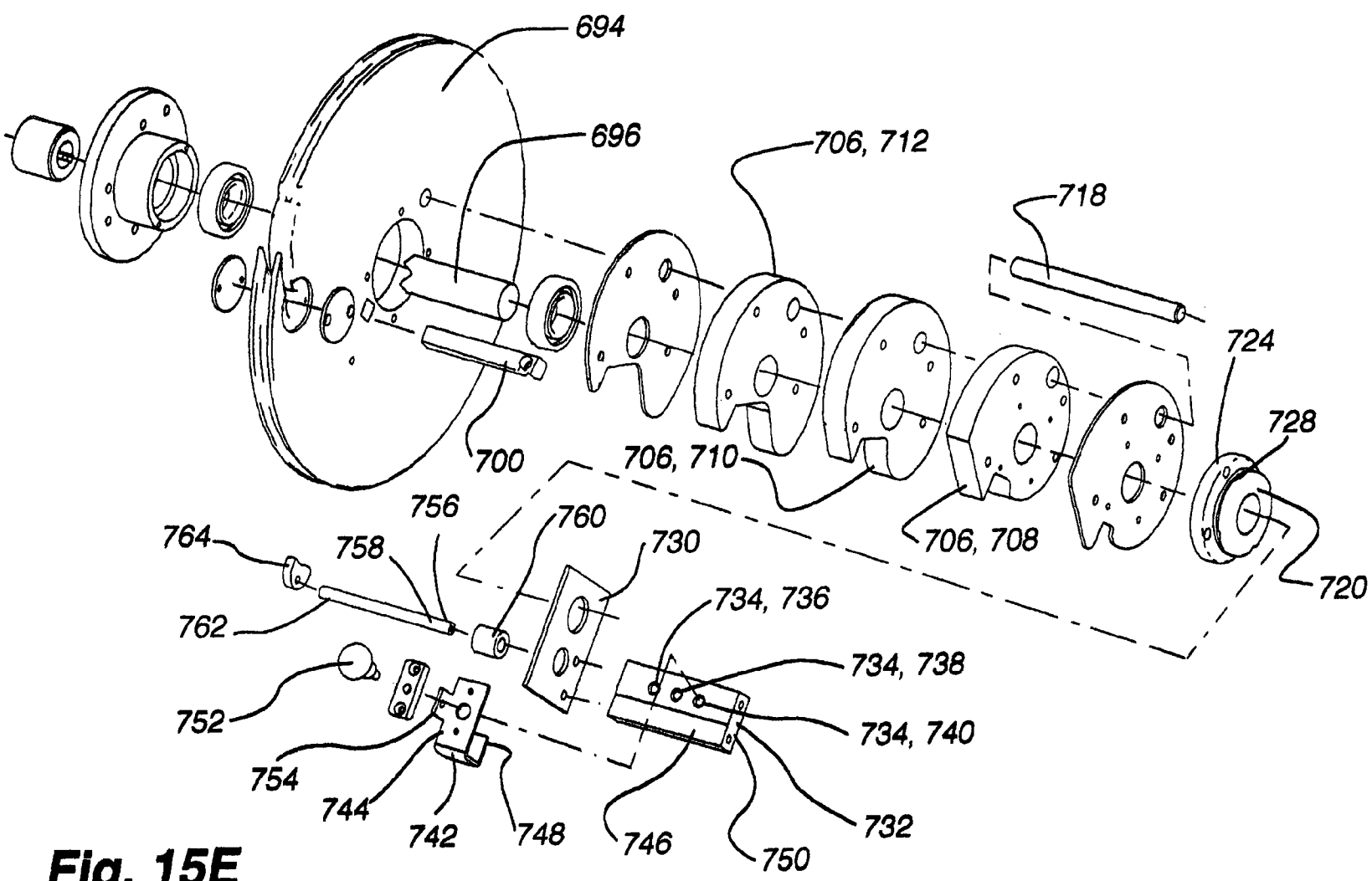
FIG. 15E is an exploded view of the transmission assembly of FIG. 15.

As shown in FIGS. 15-15E, the transmission assembly 134 includes cams 706 connected with and adapted to rotate with the transmission pulley 694 around the transmission axle 696. The three cams 706 are individually referred to herein as a first cam 708, a second cam 710, and a third cam 712. A cam selector mechanism 714 is connected with an end portion of the transmission axle 696 and provides the ability to selectively position the cams 706 along the length of the transmission axle. More particularly, the cam selector mechanism 714 allows a user to selectively position any one of the three cams 706 in alignment with the third resistance cable 692 extending from the cable termination member 700. When one of three cams is aligned to engage the third resistance cable, the cam is referred to as a "selected" cam 716. As such, when the floating pulley 680 is pulled upward to cause the transmission pulley 694 to rotate, the selected cam 716 will rotate with the transmission pulley and engage the third resistance cable. As the selected cam 716 rotates, a portion of the third resistance cable wraps onto an outer cam surface of the cam. As discussed in more detail below, the shape of the selected cam affects the shape of the force curve.

As previously mentioned, the three cams 706 are slidingly mounted on the transmission axle 696 and as such, would not rotate with the transmission pulley 694 unless otherwise restrained. As shown in FIGS. 15 and 15E, a cam retention rod 718 located radially outward from the transmission axle 696 extends axially outward from the transmission pulley 694 parallel to the transmission axle. The cam retention rod 718 extends through the cams 706 and forces the cams to rotate with the transmission pulley. The cams 706 are connected with each other and are adapted to slide back and forth along the length of the transmission axle 696 and the cam retention rod 718. A cam hub 720 including a first flange 722 and a second flange 724 separated by a cylindrical center portion 726 adapted to receive the transmission axle is connected with the first cam 708. The diameter of the first flange 722 and the second flange 724 of the cam hub are larger than the diameter of the center cylindrical portion 726, defining a channel 728 between the first and second flanges. As discussed below, the cam selector mechanism 714 is connected with the channel 728 on the cam hub to provide for selective axial position of the cams 706 along the transmission axle.

As shown in FIGS. 15 and 15B, the cam selector mechanism 714 includes a mounting plate 730 connected with an outer end portion of the transmission axle 696. The mounting plate 730 supports a selector block 732 having three apertures 734 located therein. The three apertures 734 are individually referred to herein as a first aperture 736, a second aperture 738, and a third aperture 740. A C-shaped slider bracket 742 adapted to slide back and forth along the length of the selector block 732 includes a top side 744 adjacent to a top side 746 of the selector block 732 and a bottom side 748 adjacent to a bottom side 750 of the selector block 732. A cam pop-pin 752 mounted on the top side 744 of the slider bracket 742 is adapted to engage the three apertures 734 on the selector block 732. A tongue 754 extending upward from the top side 744 of the slider bracket 742 is connected with a first end portion 756 of a tie rod 758. From the first end portion 756, the tie rod 758 extends through a tie rod cylinder 760 connected with the mounting plate 730 to a second end portion 762 connected with an engagement member 764, connected with the channel 728 in the cam hub 720. As such, the tie rod 758 and engagement member 764 connect the slider bracket 742 with the three cams 706 through the cam hub 720. Therefore, when the slider bracket 742 moves back and forth along the selector block 732, the tie rod 758 pushes or pulls the cam hub 720 and cams 706 back and forth along the length of the transmission axle 696 and the cam retention rod 718.

Figure 16A:
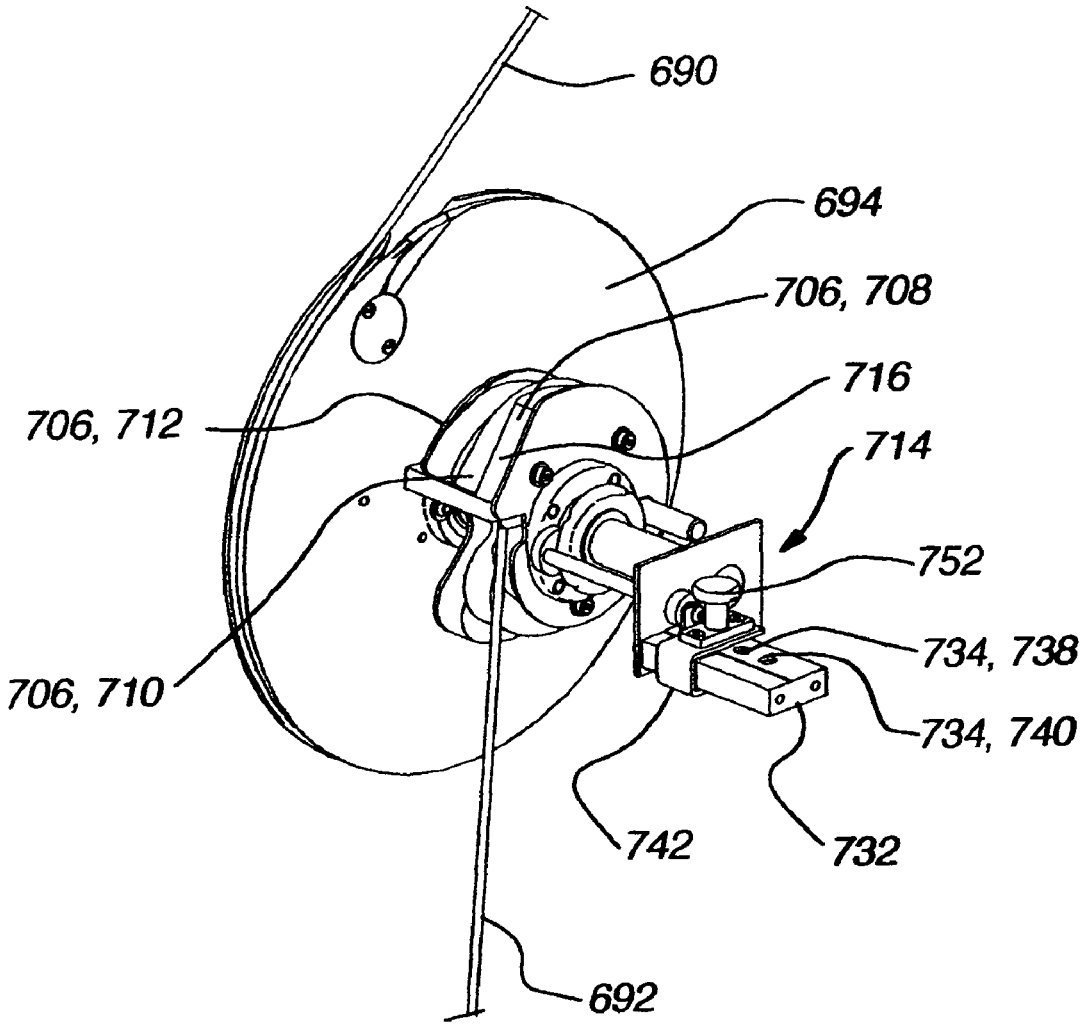
FIG. 16A is a detailed view of the transmission assembly with a first cam aligned with a third resistance cable.
Figure 16B:
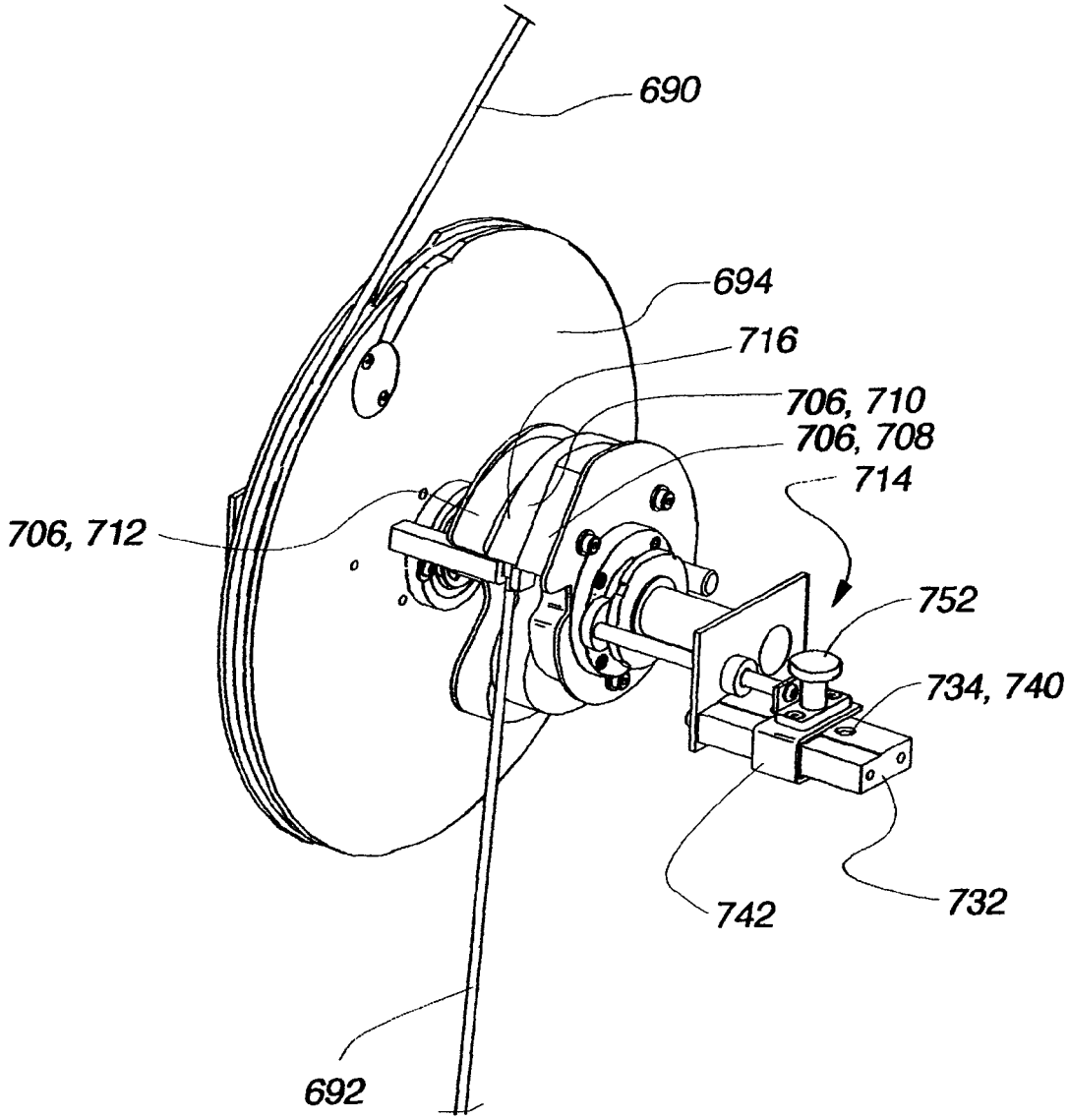
FIG. 16B is a detailed view of the transmission assembly with a second cam aligned with the third resistance cable.
Figure 16C:
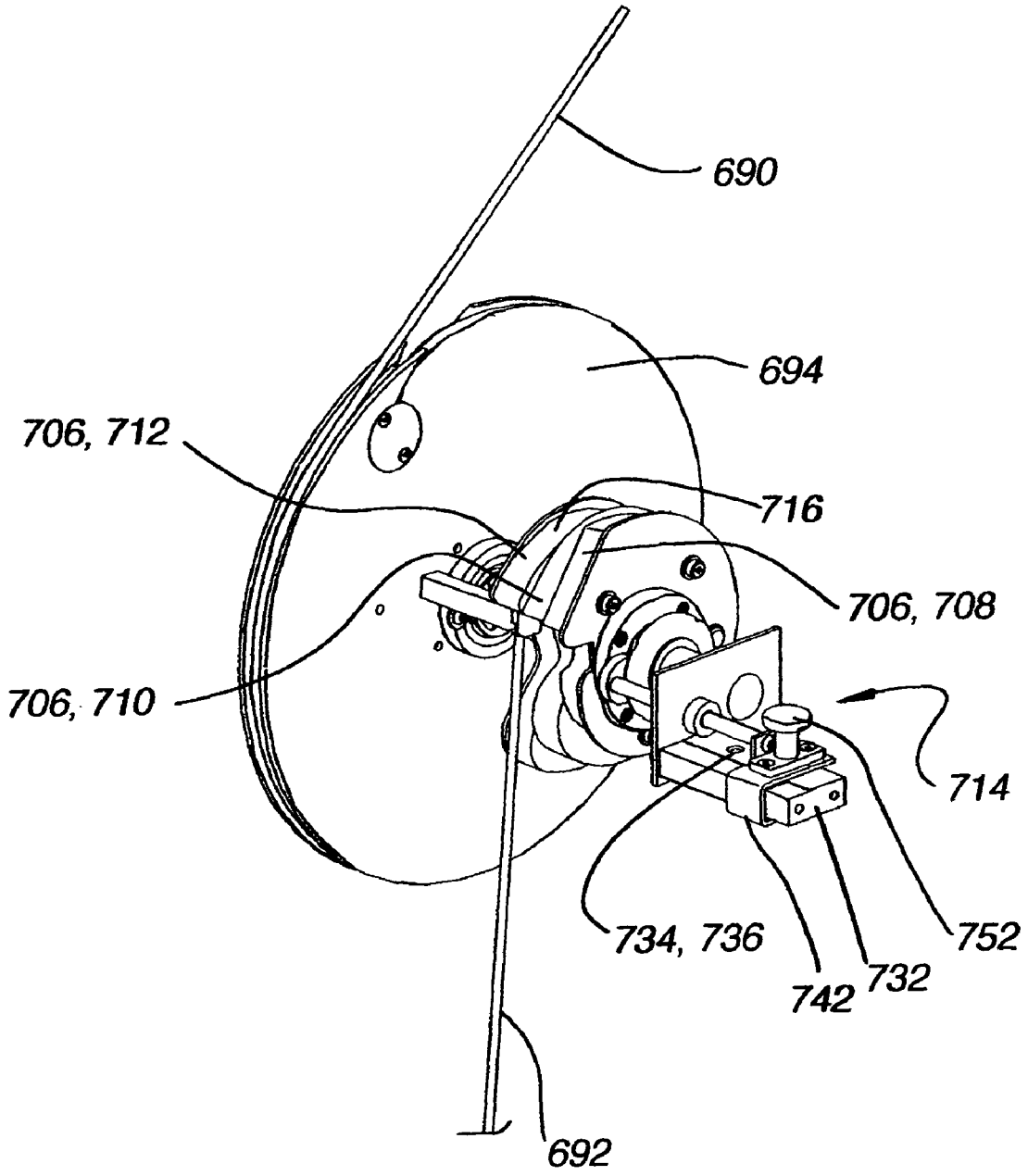
FIG. 16C is a detailed view of the transmission assembly with a third cam aligned with the third resistance cable.

The slider bracket 742 the selector mechanism 714 can be used to position any one of the three cams 706 in alignment with the third resistance cable 692. Once the selected cam is aligned with the third resistance cable, the slider bracket 742 and cams 706 can be locked in position by engaging the cam pop-pin 752 with a corresponding aperture 734 on the selector block 732. In the embodiment shown in FIG. 16A, when the cam pop-pin 752 is engaged with the first aperture 736 in the selector block 732, the first cam 708 is the selected cam 716. In addition, when the cam pop-pin is engaged with the second aperture 738 in the selector block, the second cam 710 is the selected cam as shown in FIG. 16B. Further, when the cam pop-pin is engaged with the third aperture 740 in the selector block, the third cam 712 is the selected cam as shown in FIG. 16C.

Figure 16D:
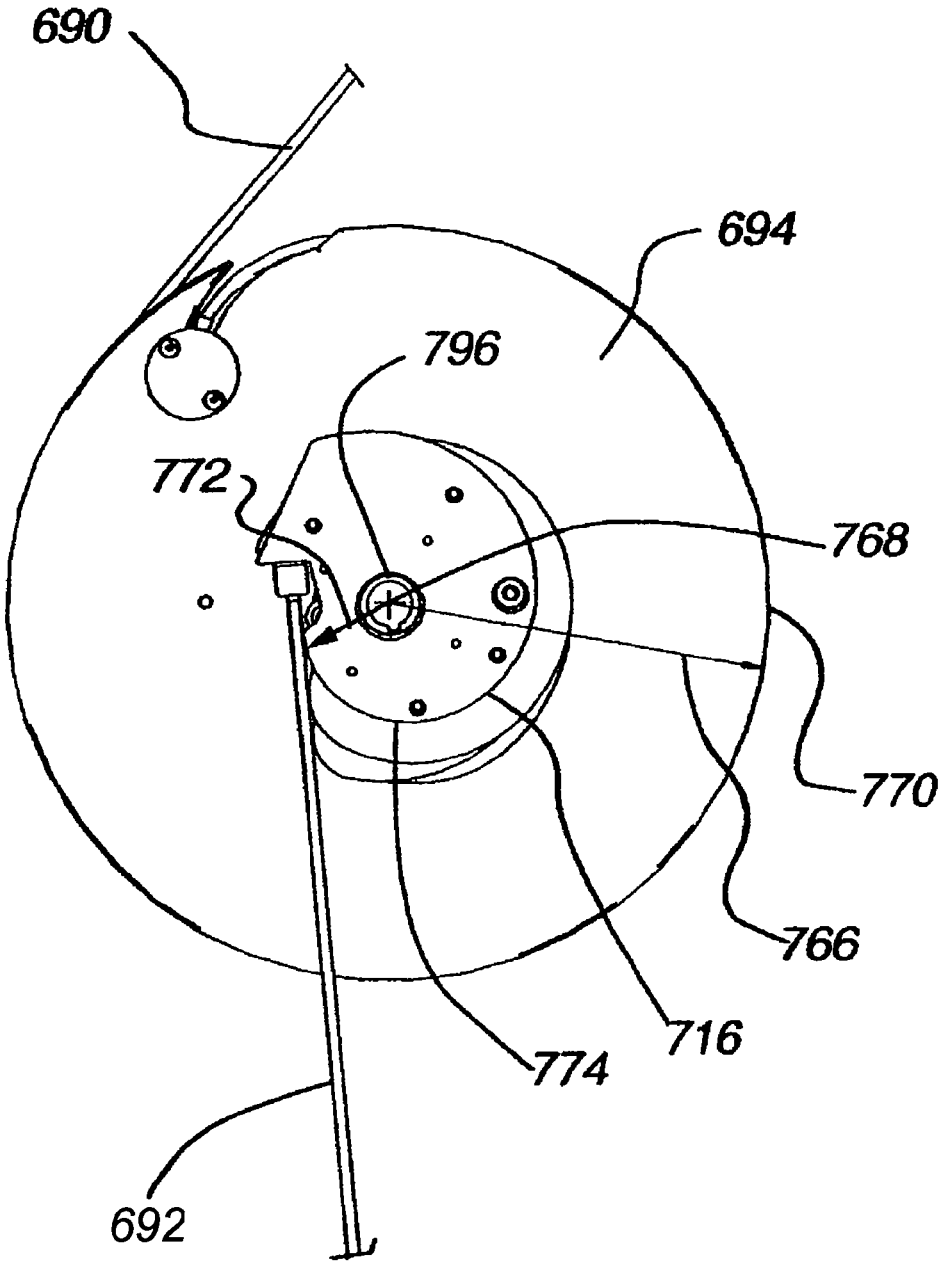
FIG. 16D is a side view of the transmission assembly with a cam selector mechanism removed.

As previously mentioned, the shape of the outer circumferential surfaces of the cams can affect the shape of the force curve. The contour or shape of the outer surface of each cam is defined by radii of varying length extending from the center of the cam (i.e. the transmission axle) to an outer circumference of the cam. It is to be appreciated that embodiments of the present invention can utilize various types of cams having differently shaped outer cam surfaces and are not limited to that which are disclosed herein. As shown in FIG. 16D, a first radial distance 766 from a center longitudinal axis 768 of the transmission axle 796 to an outer circumference 770 of the transmission pulley 694 is greater than a second radial distance 772 from the center longitudinal axis of the transmission axle to an outer circumference 774 of the selected cam 716, which could be any one of the three cams shown. The difference between the first and second radial distances provides a mechanical advantage between a first force exerted on the second resistance cable 690 (acting to rotate the transmission pulley) and a second force exerted on the third resistance cable 692 as the third resistance cable wraps onto the outer circumferential surface of the selected cam.

It is to be appreciated that the mechanical advantage between forces exerted on the second and third resistance cables 690, 692 can increase as the third resistance cable 692 wraps onto the outer circumferential surface 774 of selected cam 716 at locations defined by a progressively decreasing radial distance from the center longitudinal axis of the transmission axle. In other words, a first force applied to the second cable acting to rotate the transmission pulley 694 will result in a second force exerted on the third resistance cable 692 that progressively increases as the third resistance cable wraps onto the outer cam circumferences 774 at locations defined by a progressively decreasing radial distance from the center longitudinal axis 768 of the transmission axle 696. Conversely, the mechanical advantage between forces exerted on the second and third resistance cables can decrease as the third resistance cable wraps onto the outer circumferential surface of selected cam at locations defined by a progressively increasing radial distance from the center longitudinal axis of the transmission axle. In other words, a first force applied to the second cable acting to rotate the transmission pulley will result in a second force exerted on the third resistance cable that progressively decreases as the third resistance cable wraps onto the outer cam surface at locations defined by a progressively increasing radial distance from the center longitudinal axis of the transmission axle. Further, the mechanical advantage between forces on the second and third resistance cables will not change as third resistance cable wraps onto the outer circumferential surface of selected cam at locations defined by a constant radial distance from the center longitudinal axis of the transmission axle.

Figure 17A:
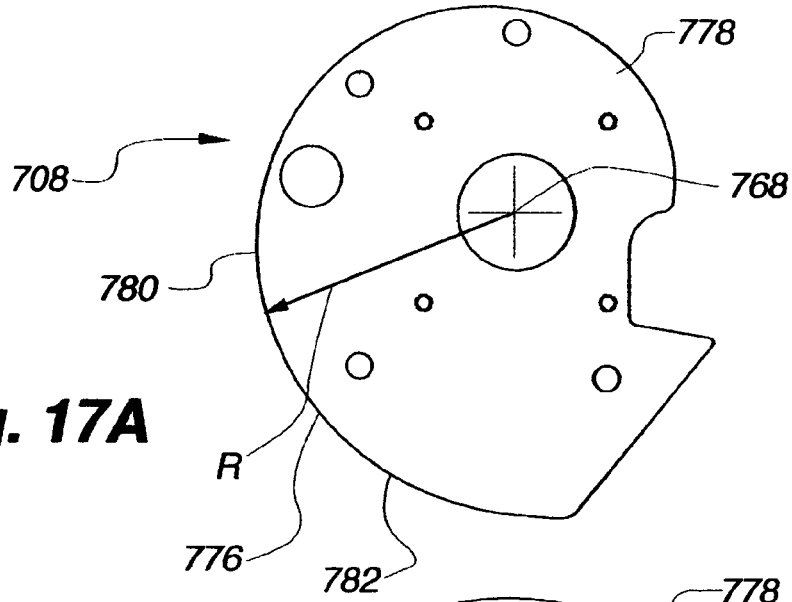
FIG. 17A shows one embodiment of the first cam.
Figure 17B:
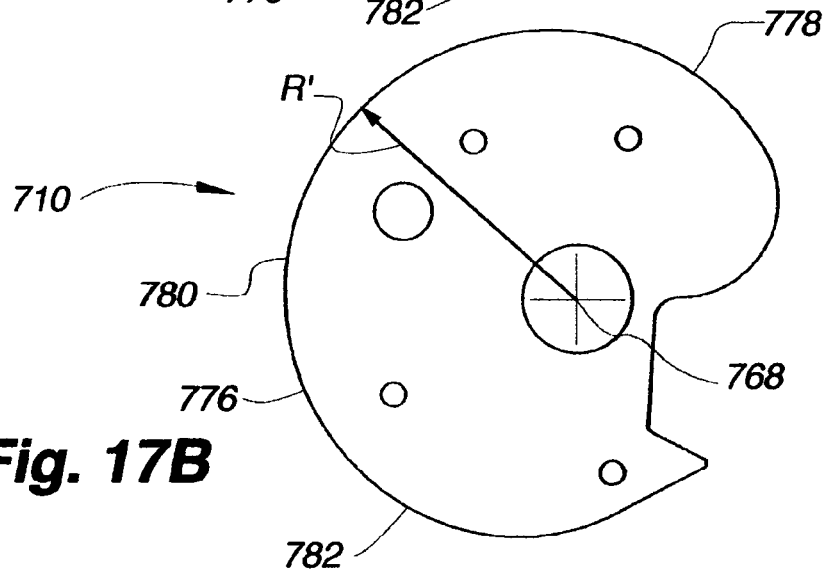
FIG. 17B shows one embodiment of the second cam.
Figure 17C:
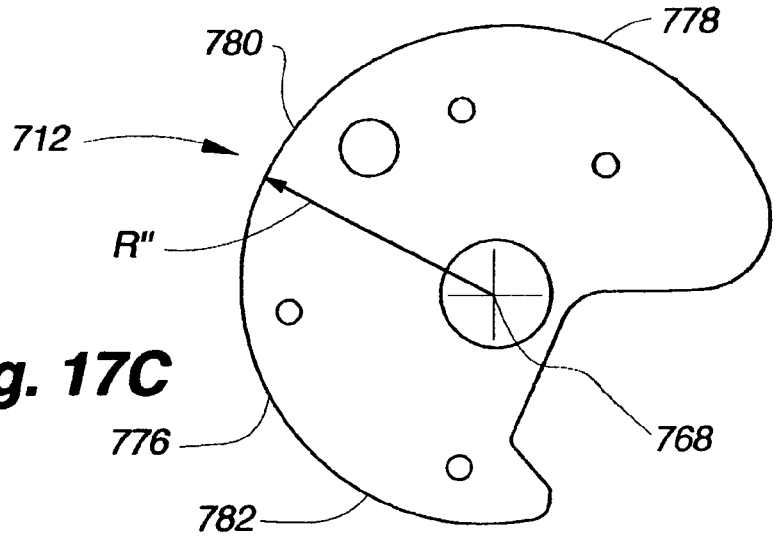
FIG. 17C shows one embodiment of the third cam.

FIGS. 17A-17C illustrate the contours or shapes of the outer circumferential surfaces of the first cam 708, second cam 710, and third cam 712 for one embodiment of the present invention. As illustrated, each cam includes an arcuate outer surface 776 including a first engagement region 778, a second engagement region 780, and a third engagement region 782 defined by varying radial distances from the center longitudinal axis 768 of the transmission axle 696. The three engagement regions of the outer cam surfaces are also defined below in the context of describing the rotation of the transmission pulley 694 of the right resistance system 130. The transmission pulley 694 is shown in FIGS. 18A-18F as rotating in a clockwise direction (as viewed from the right side of the exercise device) in response to an upward movement of the floating pulley 680. As the transmission pulley begins to rotate in the clockwise direction, the third resistance cable first 692 wraps onto the first engagement region of the selected cam surface. As the transmission pulley continues its rotation in the clockwise direction, the third resistance cable wraps onto the second engagement region of the selected cam surface. Further, as the transmission pulley nears full rotation in the clockwise direction, the third resistance cable wraps onto the third engagement region of the selected cam surface. It is to be appreciated that the references to the three engagement regions are for descriptive purposes and should not be construed to limit the sizes and shapes of the cams used with the present invention.

Figure 18B:
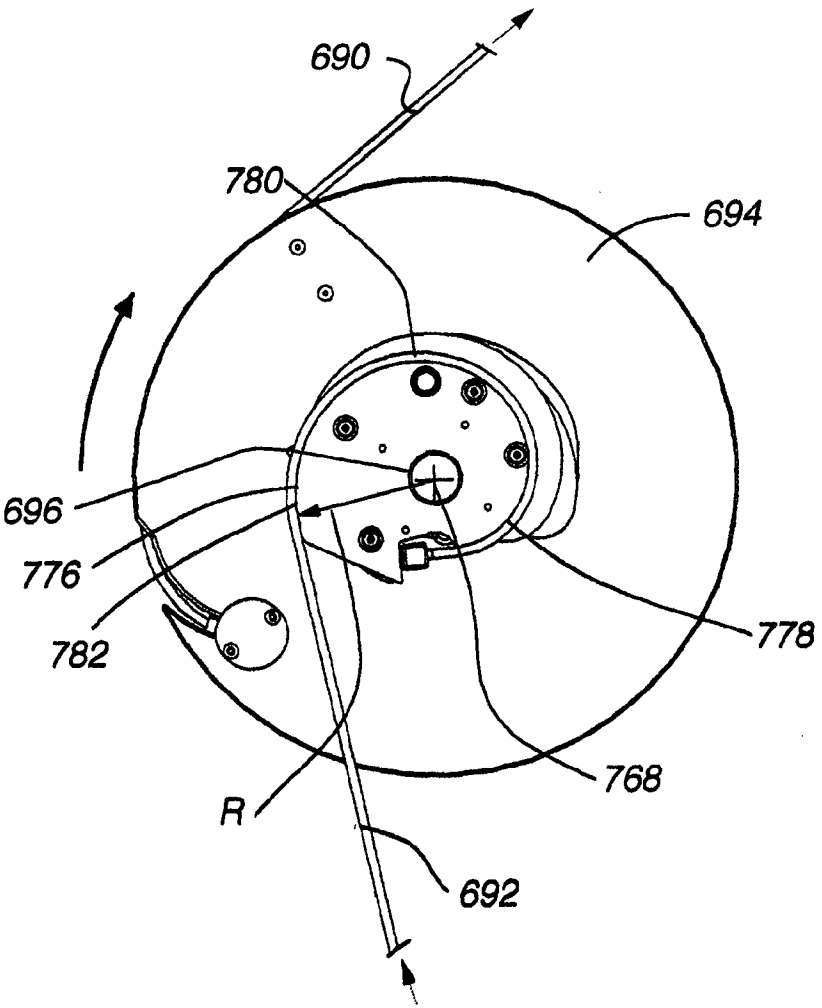
FIG. 18B is a side view of the third cable and first cam shown in FIG. 18A.
Figure 18A:
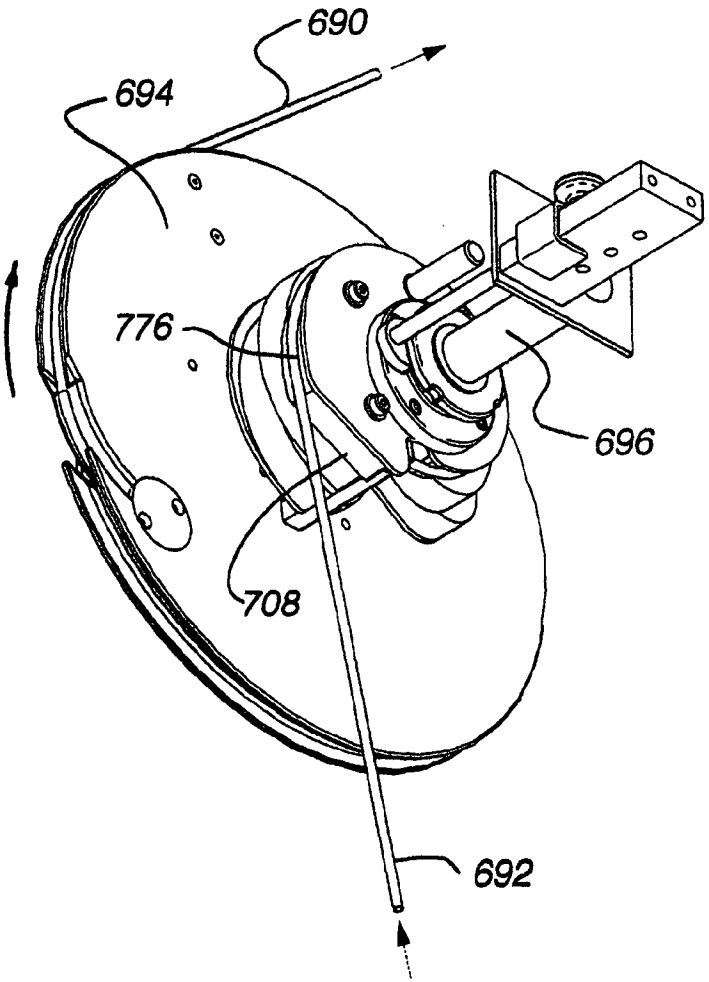
FIG. 18A is detailed view of the transmission assembly showing the third resistance cable wrapped onto the first cam.
Figure 18D:
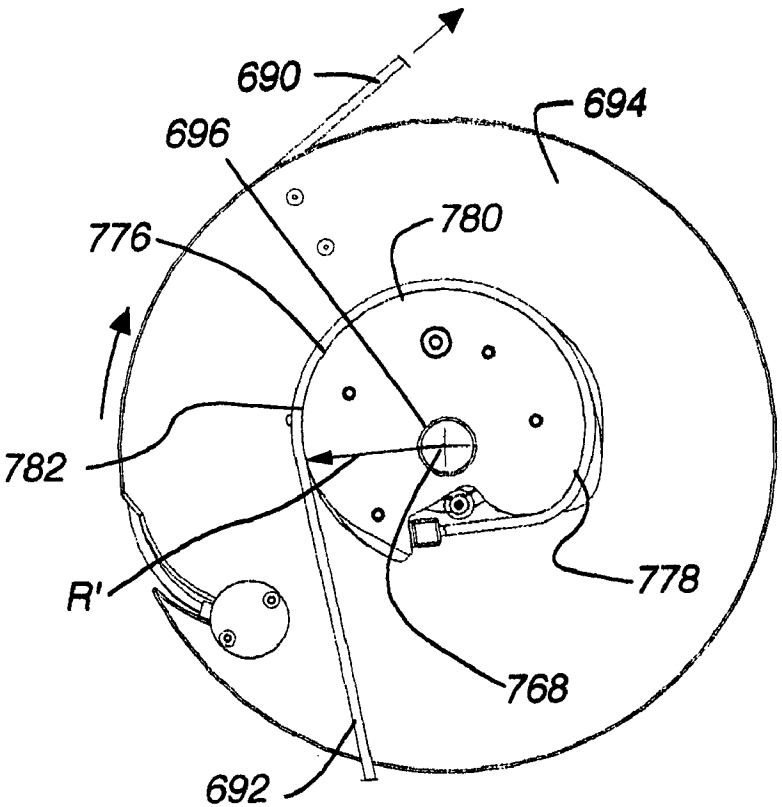
FIG. 18D is a side view of the third cable and second cam shown in FIG. 18C.
Figure 18C:
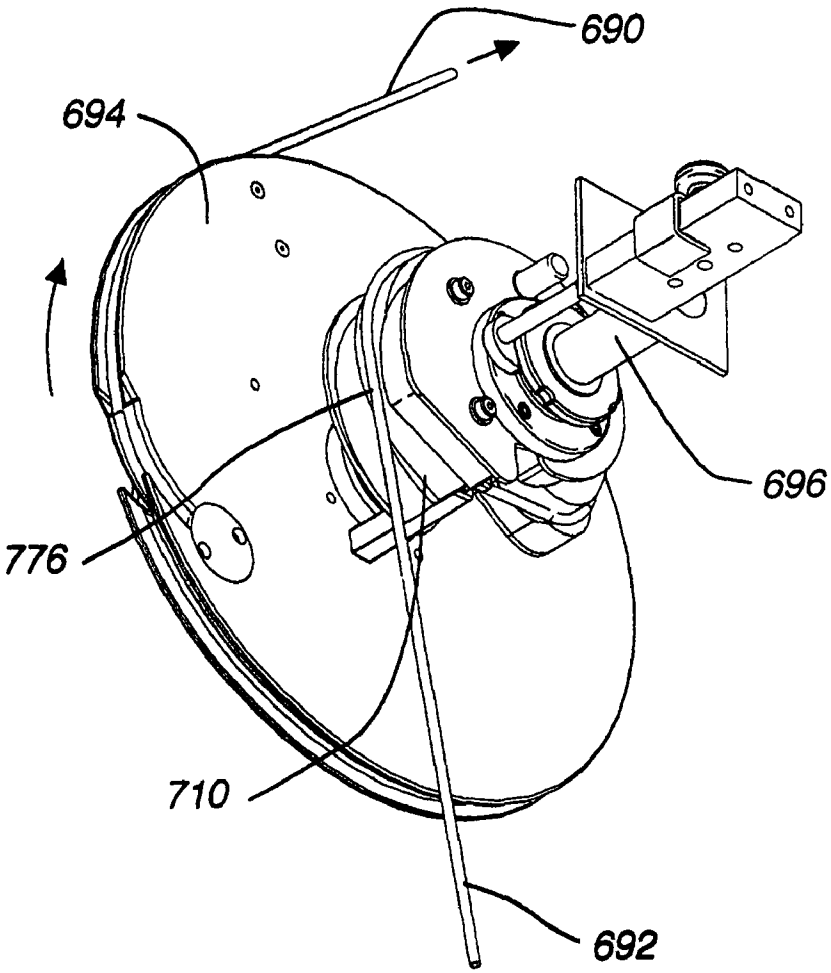
FIG. 18C is detailed view of the transmission assembly showing the third resistance cable wrapped onto the second cam.

As shown in FIGS. 17A and 18A-18B, a radial distance R from the center longitudinal axis 768 of the transmission axle 696 to the outer arcuate surface 776 of the first cam 708 increases from the first engagement region 778 to the second engagement region 780. The radial distance R also increases from the second engagement region 780 to the third engagement region 782. As shown in FIGS. 18A-18B, as the third resistance cable 692 wraps onto the first cam 708 as the first cam rotates clockwise with the transmission pulley 694, the mechanical advantage between forces on the second and third resistance cables 690, 692 will decrease, resulting in a progressive force curve. In other words, a user of the exercise device will encounter progressively greater resistance as the user pulls the first end of the first resistance cable 672 from the distal pulley housing 524 on the arm assembly 124. As shown in FIGS. 17B and 18C-18D, the radial distance R' the center longitudinal axis 768 of the transmission axle 696 to the outer arcuate surface 776 of the second cam 710 remains constant from the first engagement region 778 to the second engagement region 780, and from the second engagement region to the third engagement region 782. As shown in FIGS. 18C-

Figure 18F:
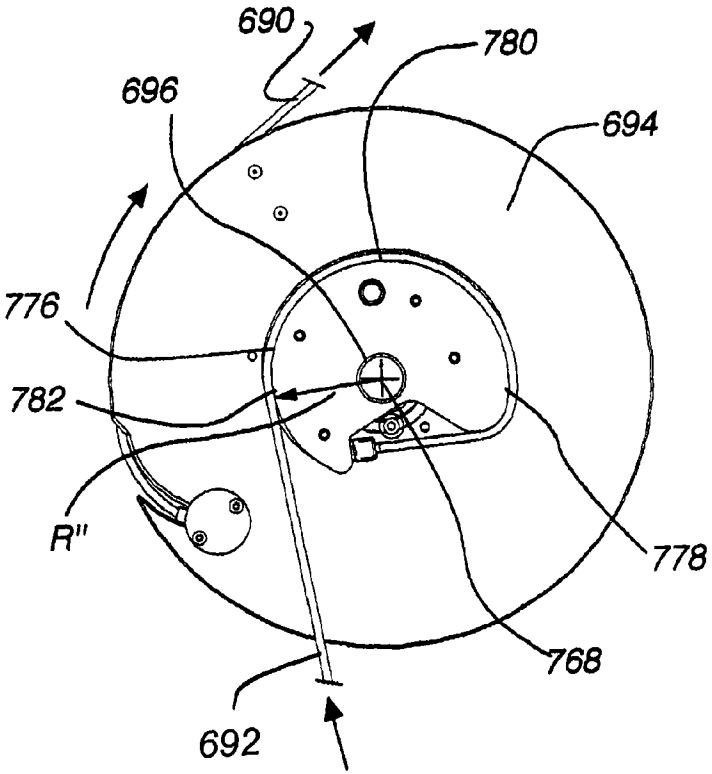
FIG. 18F is a side view of the third cable and third cam shown in FIG. 18F.
Figure 18E:
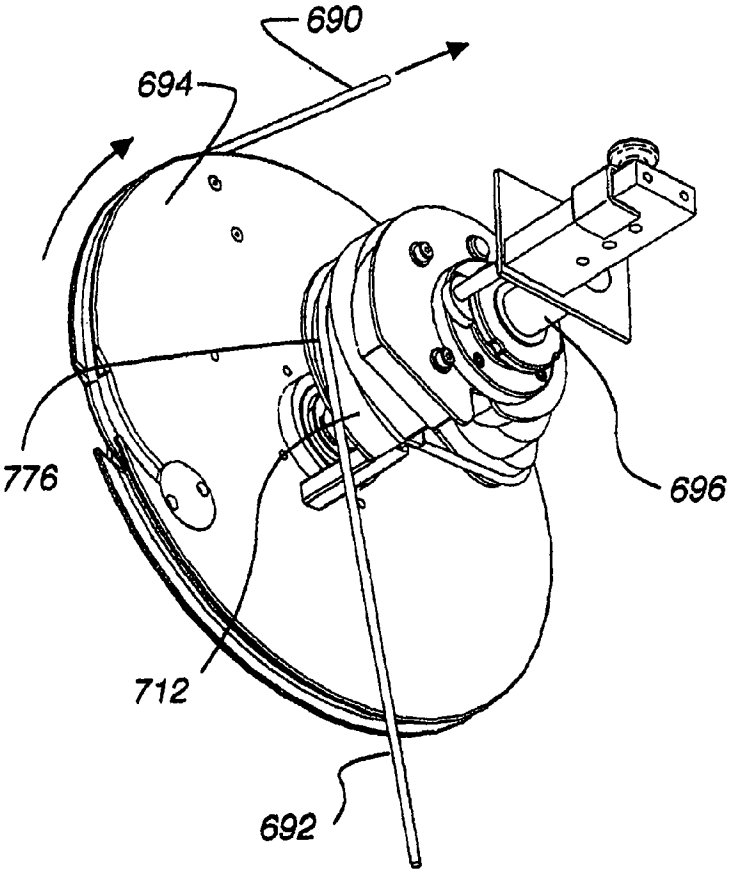
FIG. 18E is detailed view of the transmission assembly showing the third resistance cable wrapped onto the third cam.

18D, as the third resistance cable 692 wraps onto the second cam 710 as the second cam rotates clockwise with the transmission pulley 694, the mechanical advantage between the forces on the second and third resistance cables will remain constant, resulting in a linear force curve. In other words, a user of the exercise device will encounter a substantially constant resistance as the user pulls the first end of the first resistance cable 672 from the distal pulley housing 524 on the arm assembly 124. As shown in FIGS. 17C and 18E-18F, the radial distance R" the center longitudinal axis 768 of the transmission axle 696 to the outer arcuate surface 776 of the third cam 712 decreases from the first engagement region 778 to the second engagement region 780, and from the second engagement region 780 to the third engagement region 782. As shown in FIGS. 18E-18F, as the third resistance cable 692 wraps onto the second cam 710 as the second cam rotates clockwise with the transmission pulley 694, the mechanical advantage between forces on the second and third resistance cables will increase, resulting in a regressive force curve. In other words, a user of the exercise device will encounter progressively less resistance as the user pulls the first end of the first resistance cable 672 from the distal pulley housing 524 on the arm assembly 124.

As previously mentioned, the transmission assembly 134 is connected with the resistance assembly 136 through the third resistance cable 692. As shown in FIGS. 15, 15B and 19A-19C, the third resistance cable extends from the first end 698 connected with the cable termination member 700 on the transmission pulley 694 to the second end 702 connected with a cable termination 784 on the linearizing cam 704 on the resistance assembly 136. The linearizing cam is rotatably mounted on a resistance axle 786 connected with the main frame 106. The resistance assembly also includes a selector mechanism 788 connected with the linearizing cam 704. The selector mechanism allows a user to selectively connect a desired number of resistance packs 138 with the linearizing cam. As described in more detail below with reference to FIGS. 20A-20E and others, the resistance packs 138 include resilient resistance elements 790 that act as torisional springs enclosed within a housing 792. The resistance elements 790 are connected with center hubs 794, which in turn, are connected with the resistance axle 786. More particularly, the center hubs 794 are connected with resistance axle through an arrangement of splines, and as such, do not rotate about the resistance axle. As discussed in more detail below, the housings 792 of the resistance packs 138 can be selectively connected with the selector mechanism 788. Therefore, as the linearizing cam 704 and the selector mechanism 788 rotate together, housings of resistance packs connected with the selector mechanism also rotate. As the housings rotate, the center hubs remain stationary, which causes the torsional springs be stretched within the housings. As the torsional springs stretch, the torisional springs exert progressively increasing resistive torsional forces on the linearizing cam, which are translated to the third resistance cable.

Figure 19A:
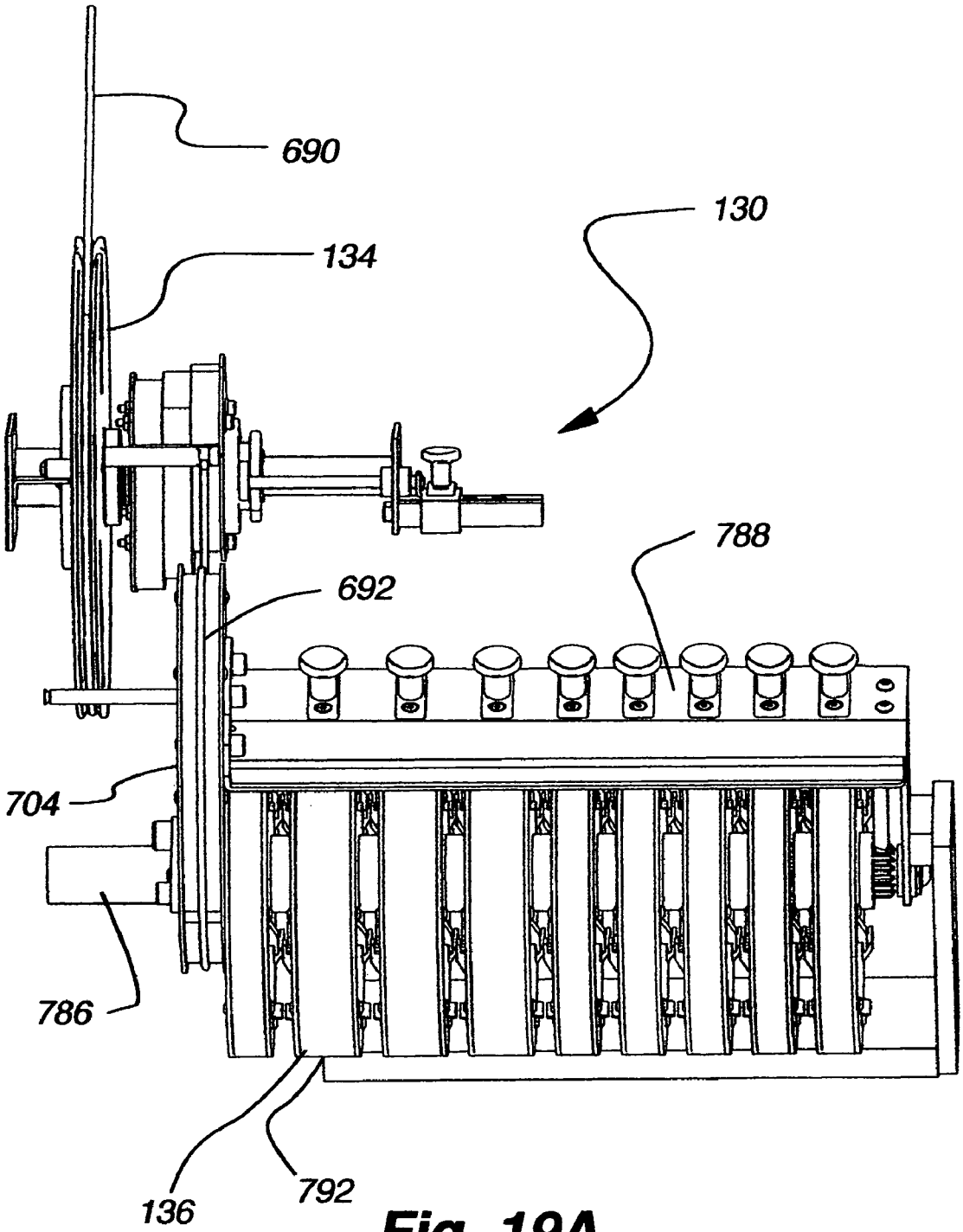
FIG. 19A is a front view of a transmission assembly and a resistance assembly of the right resistance system.
Figure 19B:
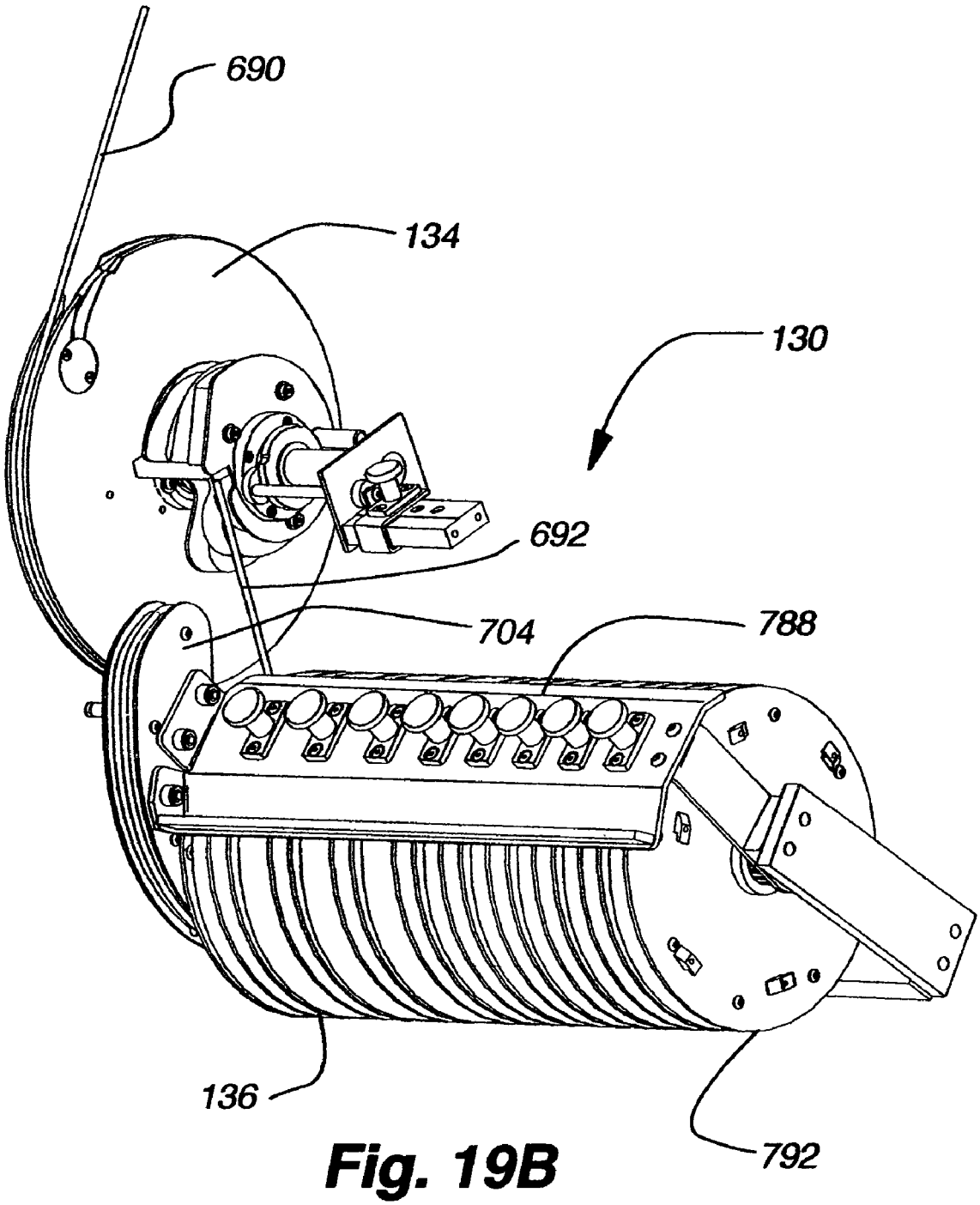
FIG. 19B is a right isometric view of the transmission assembly and resistance assembly of FIG. 19A.
Figure 19C:
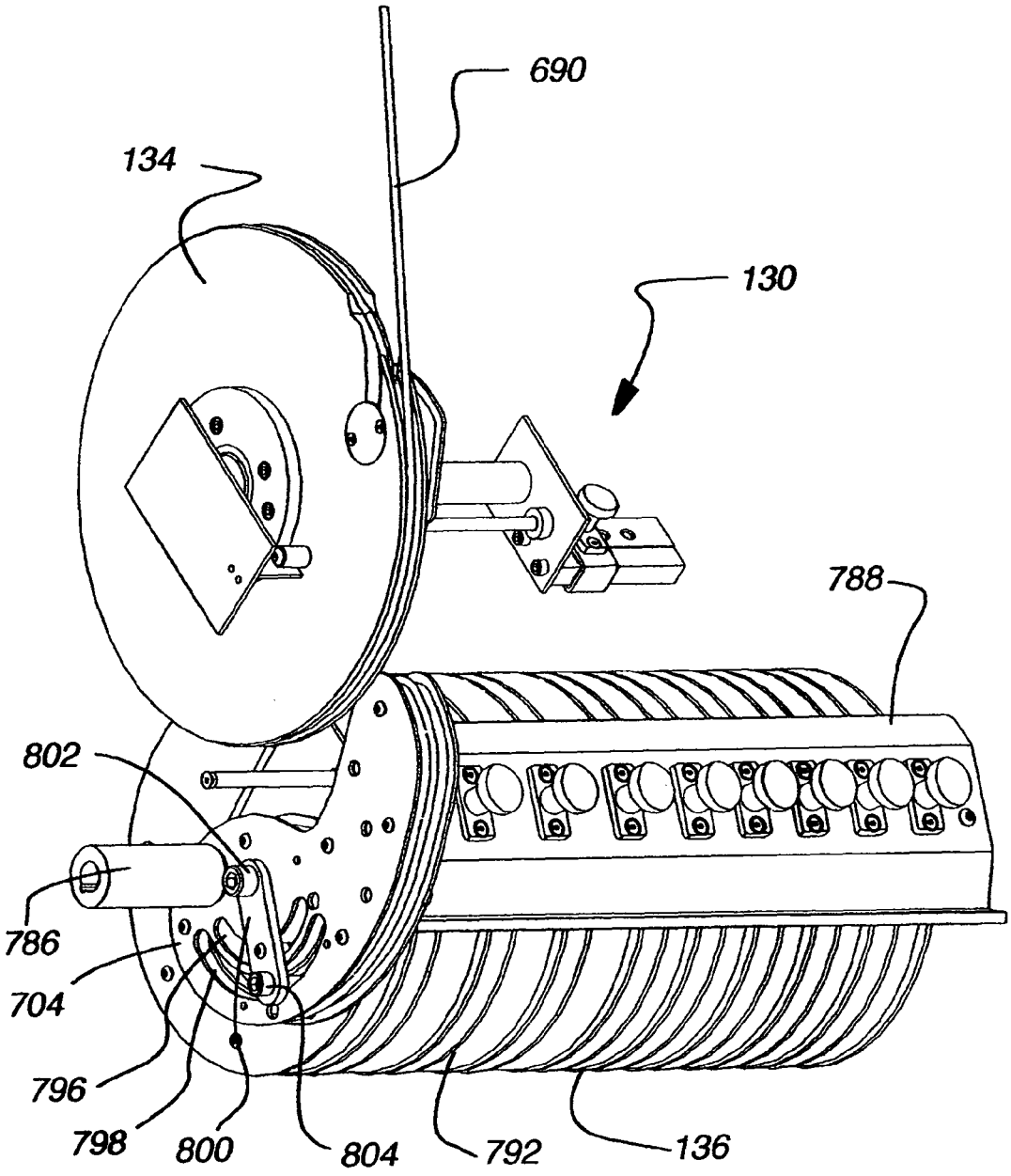
FIG. 19C is a left isometric view of the transmission assembly and resistance assembly of FIG. 19A.

As previously mentioned, each resistance axle 786 of the right and left resistance systems supports the linearizing cam 704 as well as the plurality of resistance packs 138. The resistance axles 786 of the right and left resistance systems 130, 132 are connected with and extend outward from the right and left rear upright members 178, 180 of the frame 106 described above with reference to FIG. 3A. As shown in FIGS. 19A-19C, the linearizing cam 704 is rotateably mounted on the resistance axle 786 and is connected with the second end 702 of the third resistance cable 692. The connection of the third resistance cable 692 with the linearizing cam 704 provides for selective tensioning of the third resistance cable. As shown in FIGS. 15B and 19C, the linearizing cam 704 includes a first arcuate slot 796 and a second arcuate slot 798. The third resistance cable 692 extending downward from the transmission assembly 134 wraps around the outer surface of the linearizing cam 704 to where the second end 702 of the third resistance cable 692 connects with the cable termination 784 inside the first arcuate slot 796. The cable termination 784 is connected with a plate 800 extending between a first bolt 802 and a second bolt 804. As shown in FIG. 20C, the second bolt 804 extends through the second slot 798 in the linearizing cam. The combination of the first and second bolts and the plate allow the tension of the third resistance cable to be adjusted. For example, when adjusting the tension in the third resistance cable 692, the first and second bolts 802, 804 are loosened so as to allow the second bolt 804, cable termination 784, and plate 800 to pivot around the first bolt 802. The plate 800 can then be pivoted to provide the desired tension on the third resistance cable 692 through the cable termination 784 connected with the plate. Once the desired tension in the third resistance cable is achieved, the first and second bolts are retightened.

As previously mentioned, the selector mechanism 788 is used to selectively connect a desired number of resistance packs 138 with the linearizing cam 704. Therefore, when tension is placed on the third resistance cable 692 that causes the linearizing cam to rotate around the resistance axle 786, the selector plate also rotates along with the housings 792 of resistance packs 138 connected with the selector mechanism. Due to the resilient construction of the resistance elements 790 inside the housings of the resistance packs 138, the resistance forces exerted by the resistance packs progressively increase as the linearizing cam rotates. As such, an outer circumferential surface 806 of the linearizing cam 704 can be shaped to offset the progressive increase in forces exerted by the resistance packs. More particularly, as the third resistance cable 692 unwinds from linearizing cam 704, a radial distance R1, shown in FIG. 15B, from a center longitudinal axis 808 of the resistance axle 786 to a location where the third resistance cable separates from the outer surface of the linearizing cam increases. In other words, a first force exerted on the third resistance cable 692 that causes the linearizing cam 704 to rotate will result in a progressively increasing torque exerted on the linearizing cam 704 as the linearizing cam rotates around the resistance axle 786. As such, although the resistance packs 138 provide a progressively increasing resistance torque as the housings 792 are rotated relative the resistance axle 786, the progressively increasing torque exerted by the third resistance cable on the linearizing cam results in a substantially linear resistance force exerted on the third resistance cable 692. It is to be appreciated that linearizing cams having different outer shapes can be used with the present invention and as such, should not be limited to the shape of the linearizing cam described and depicted herein.

It is to be appreciated that the exercise devices described herein can include resistance systems that utilize various types of devices to provide resistance. For example, FIGS. 20A-20E show one embodiment of the resistance pack 138 that can be used with the exercise device 100. The resistance pack 138 is similar the resistance packs disclosed in U.S. Pat. No. 4,944,511, titled "Adjustable Resilient Reel Exerciser," filed on Jan. 23, 1989; U.S. Pat. No. 5,209,461, titled "Elastomeric Torsional Spring Having Tangential Spokes with Varying Elastic Response," filed on Jun. 12, 1992; U.S. Pat. No. 6,126,580, titled "Resistance Exercise Machine with Series Connected Resistance Packs," filed on Aug. 7, 1998; and U.S. Pat. No. 6,440,044, titled "Resistance Mechanism with Series Connected Resistance Packs," filed on Aug. 1, 2000, all of which are hereby incorporated by reference herein.

As previously mentioned, the housing 792 of the resistance pack 138 encloses resistance elements 790 that act as torsional springs. In turn, the torsional springs are connected with center hubs 794, which are connected with the resistance axle 786 through an arrangement of splines. As shown in FIGS. 20A-20E, the housing 792 includes a flat, disc-shaped base panel 810 with a first side 812 and a second side 814. A plurality of rigid triangular frames 816 extend outward from each of the sides of the base panel, each frame 816 having a tab 818 projecting from an outer edge thereof. Although the resistance pack shown in FIGS. 20A-20E has eight triangular frames, it is to be appreciated that the resistance pack can have more or less than eight triangular frames. A circular rim 820 is connected with and extends along the circular periphery of the base panel 810. As shown in FIGS. 20A-20D, the housing 792 also includes a first side wall 822 and a second side wall 824 connected with the rim 820 and the base panel 810 on opposite sides of the resistance pack. The side walls are substantially circularly-shaped with a portion of the periphery of each side wall extending beyond the rim 820 to form a ledge 826. A connection block 828 having an aperture 830 therein extends between the side walls 822, 824 near the ledge 826. As discussed in more detail below, the selector mechanism is adapted to engage the aperture 830 to selectively connect the housing 792 with the linearizing cam 704.

Figure 20A:
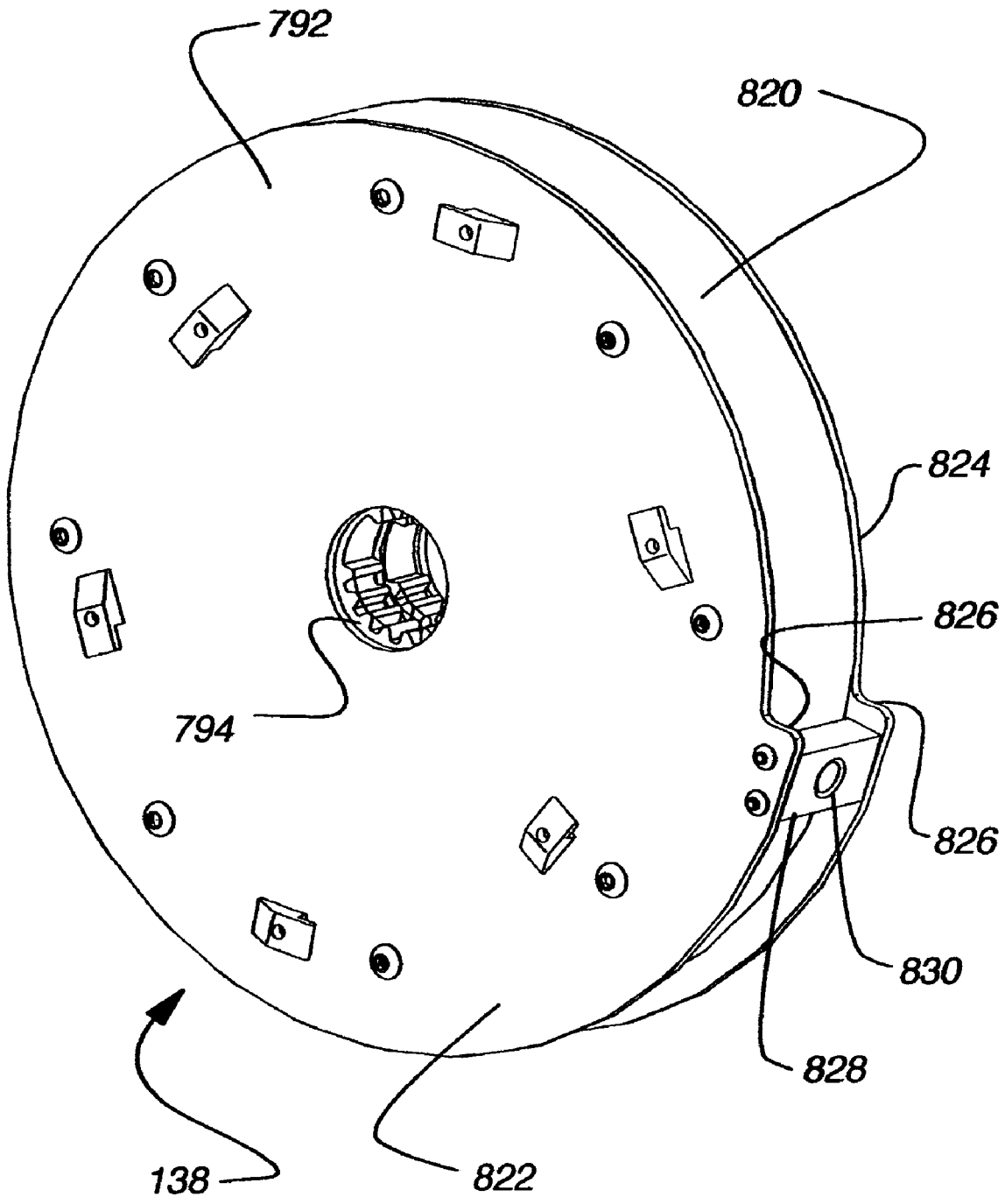
FIG. 20A is an isometric view of a first side of a resistance pack.
Figure 20B:
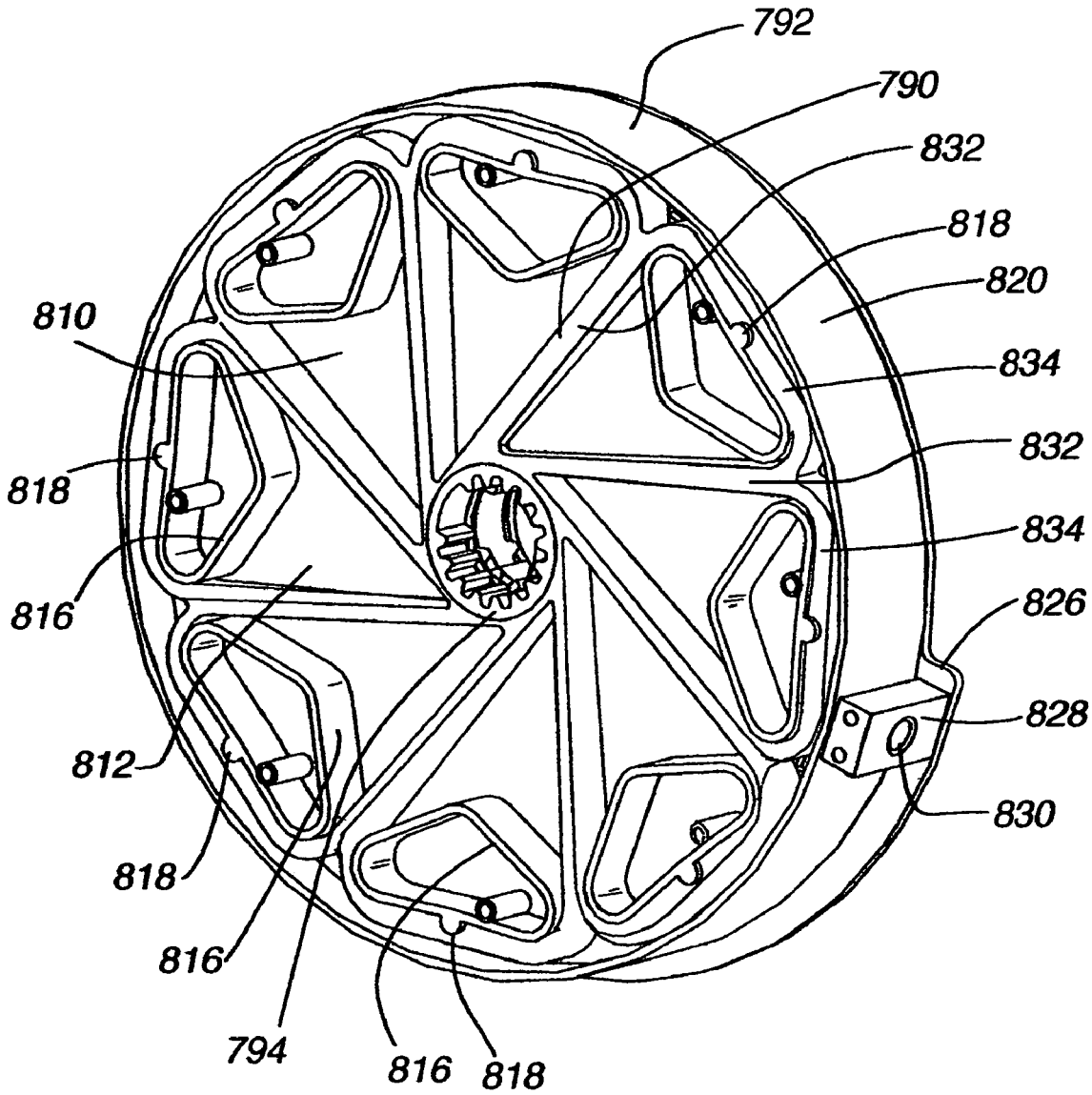
FIG. 20B is a view of the resistance pack in FIG. 20A with the first side removed.
Figure 20C:
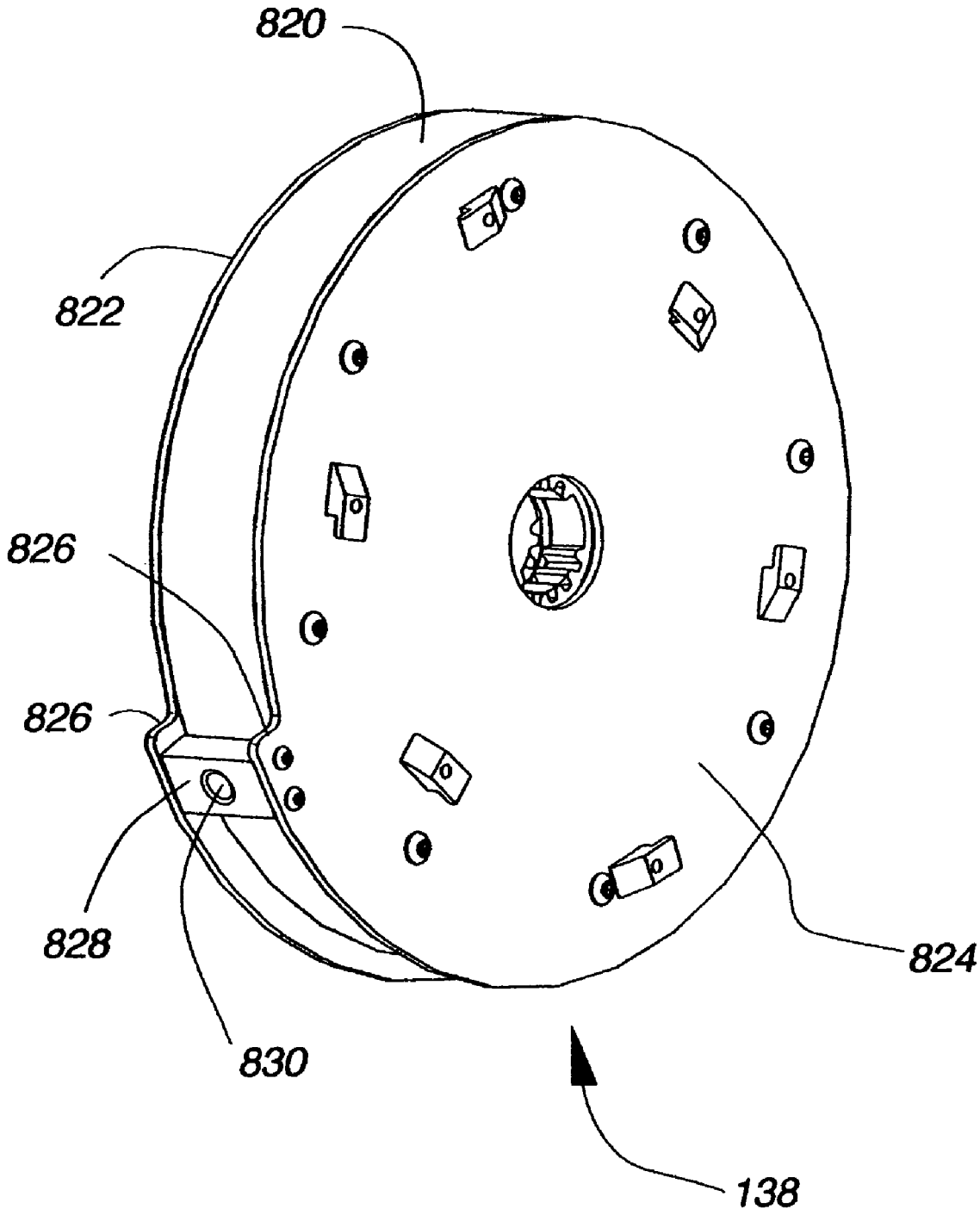
FIG. 20C is an isometric view of a second side of the resistance pack of FIG. 20A.
Figure 20D:
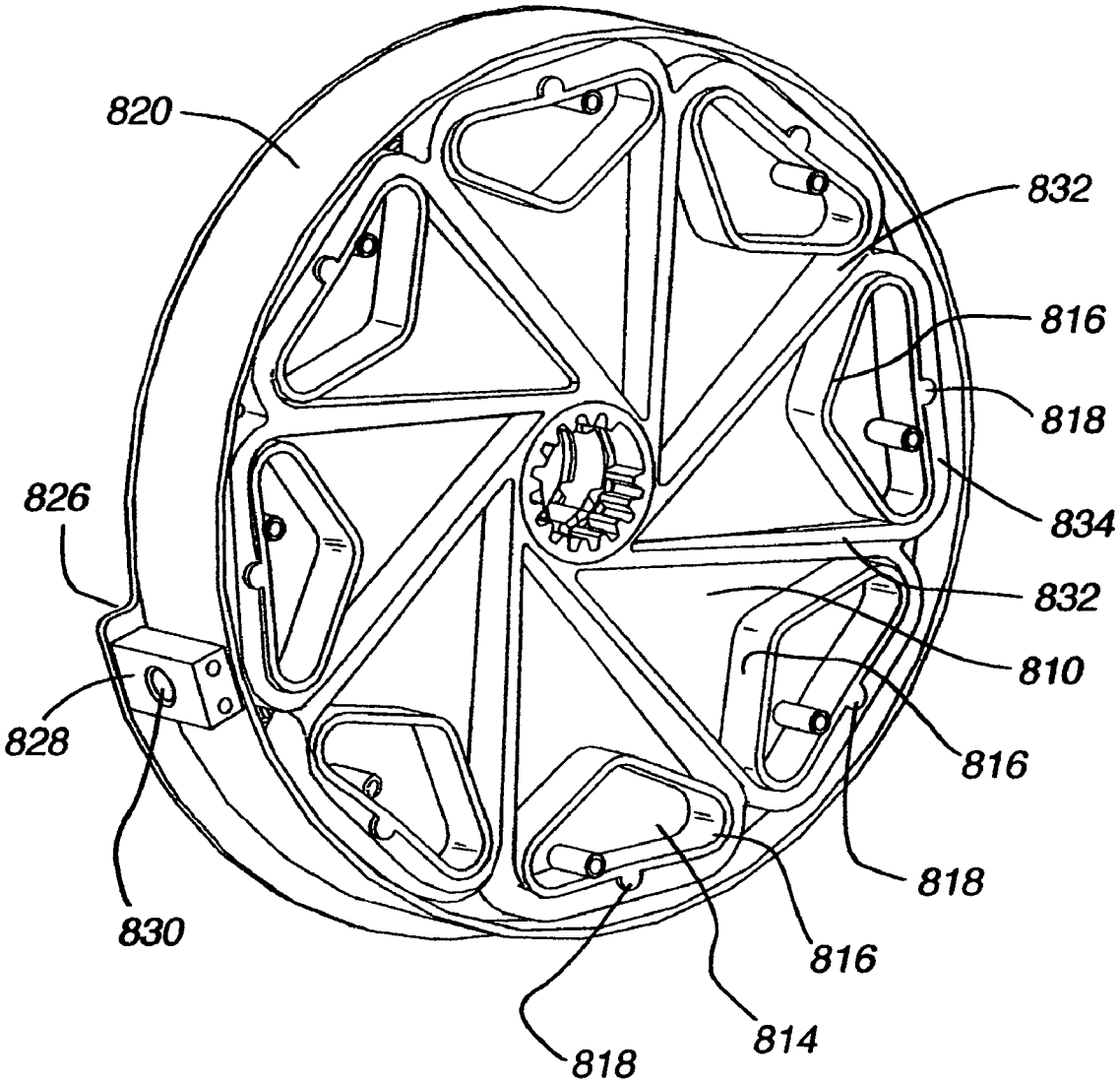
FIG. 20D is a view of the resistance pack in FIG. 20C with the second side removed.
Figure 20E:
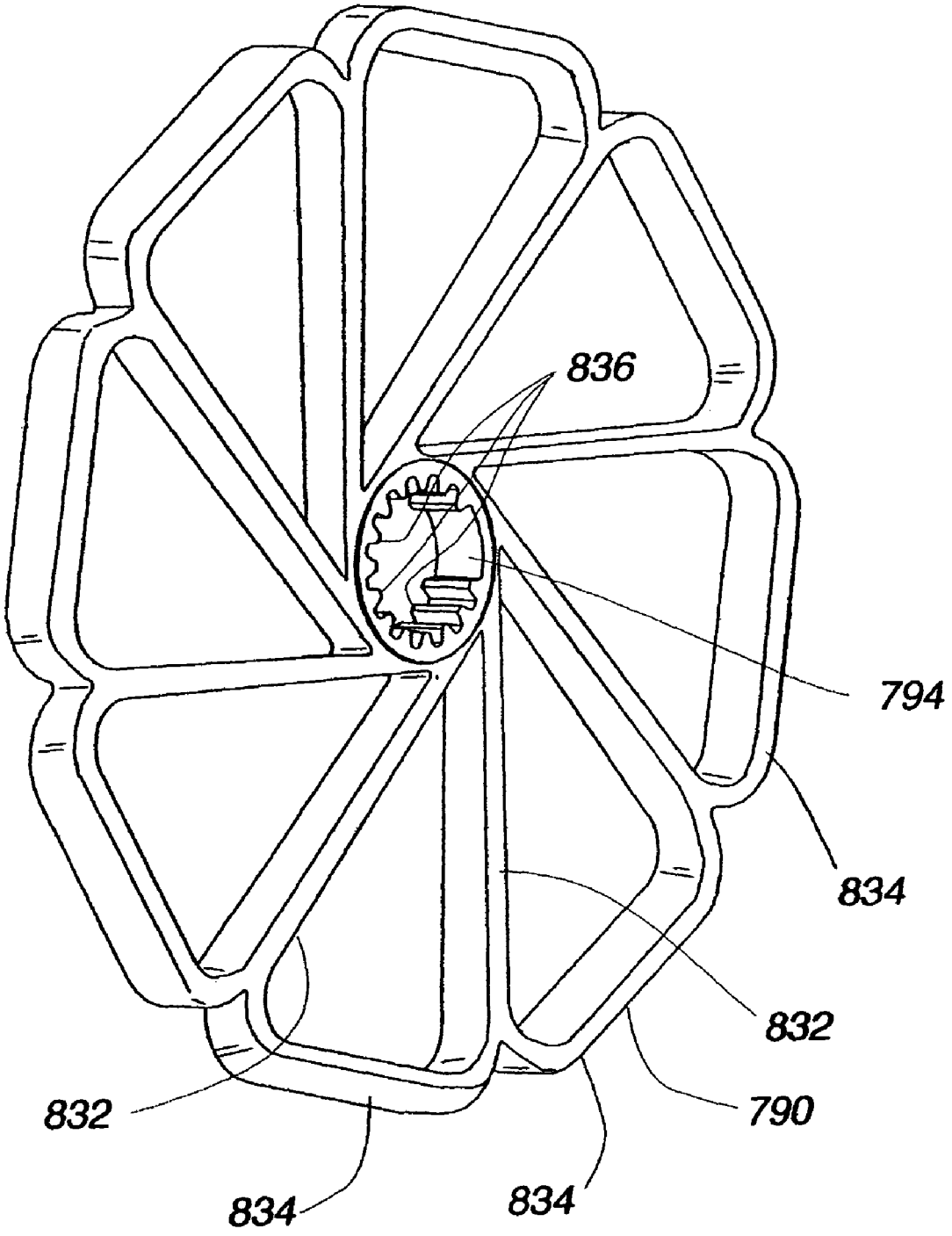
FIG. 20E is an isometric view of a resistance element.

As shown in FIGS. 20B and 20D, the resistance pack 138 includes two resistance elements 790. It is to be appreciated that the resistance pack can include more or less than two resistance elements. As previously mentioned, the resistance elements act as torsional springs and may be constructed of a suitable elastomeric substance exhibiting resiliency and resistance to stretching. As shown in FIG. 20E, the resistance elements 790 each include a plurality of spokes 832 connected with and extending radially outward from the center hub 794. A plurality of peripheral portions 834 of the resistance elements 790 extend between outer ends of the spokes 832. The center hub 794 may be constructed of a rigid material which may be glued or otherwise bonded to the elastomeric inner ends of the spokes. As discussed in more detail below, the center hub 794 also includes splines 836 adapted to engage corresponding splines 838 the resistance axle 786. The resistance elements are installed with the spokes extending between the adjacent triangular frames 816 and with the peripheral portions 834 beneath the tabs 818 extending from the triangular frames. As such, one resistance element is adjacent the first side 812 of the base panel 810, and the other resistance element is adjacent the second side 814. When the housing of the resistance pack containing the resistance elements is rotated relative to the center hubs of each resistance element, the spokes and the peripheral portions of the resistance elements are stretched. The resilient construction of the resistance elements resist stretching of the spokes and peripheral portions to provide a resistive force that opposes the stretching of the arms and peripheral portions. It is to appreciated that the resistive forces increases the more the resistance elements are stretched. In other words, the more the housing of the resistance pack is rotated relative to the hub, the greater the resistance force.

Figure 21B:
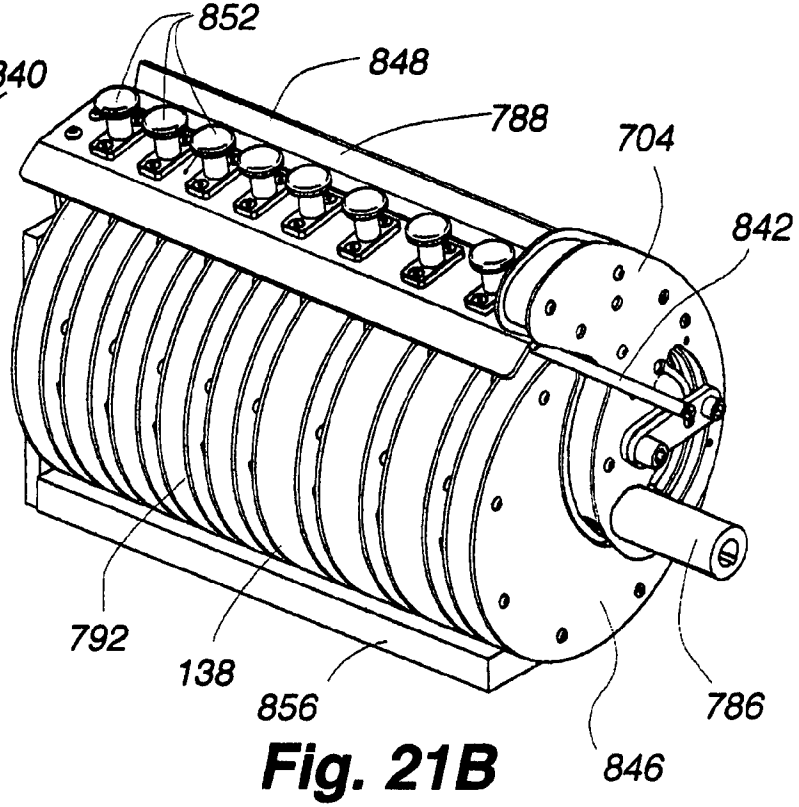
FIG. 21B is an isometric view of a resistance assembly.
Figure 21A:
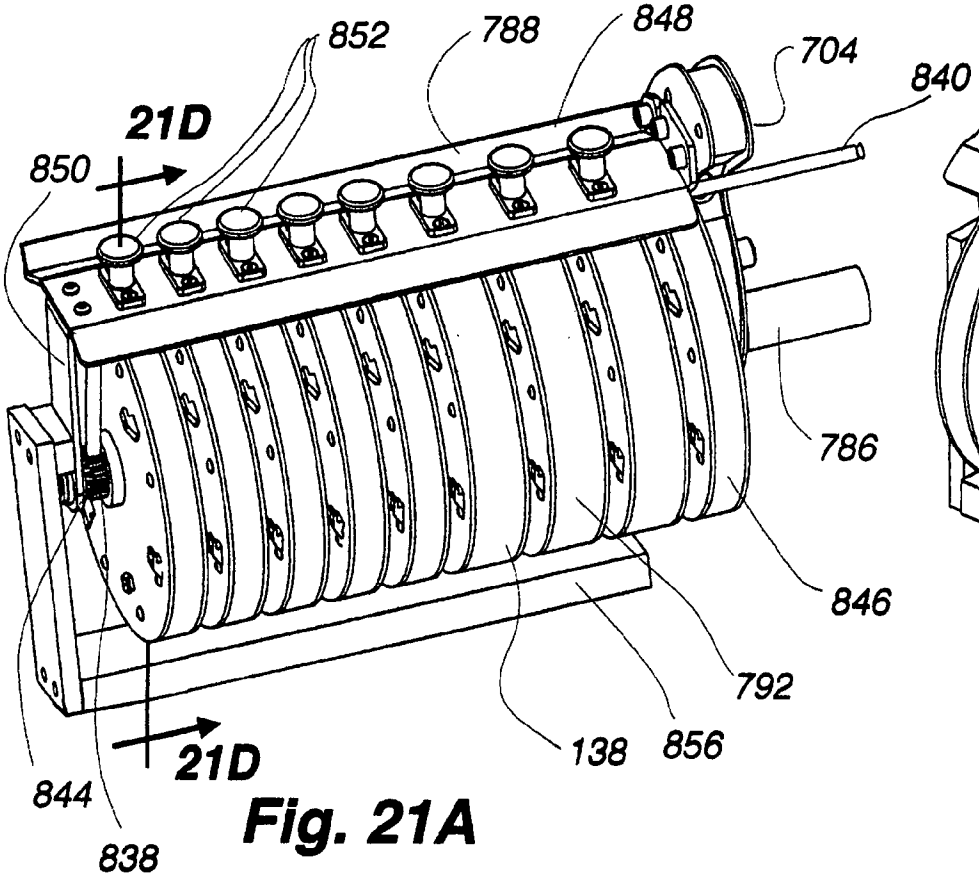
FIG. 21A is an isometric view of a resistance assembly.
Figure 21C:
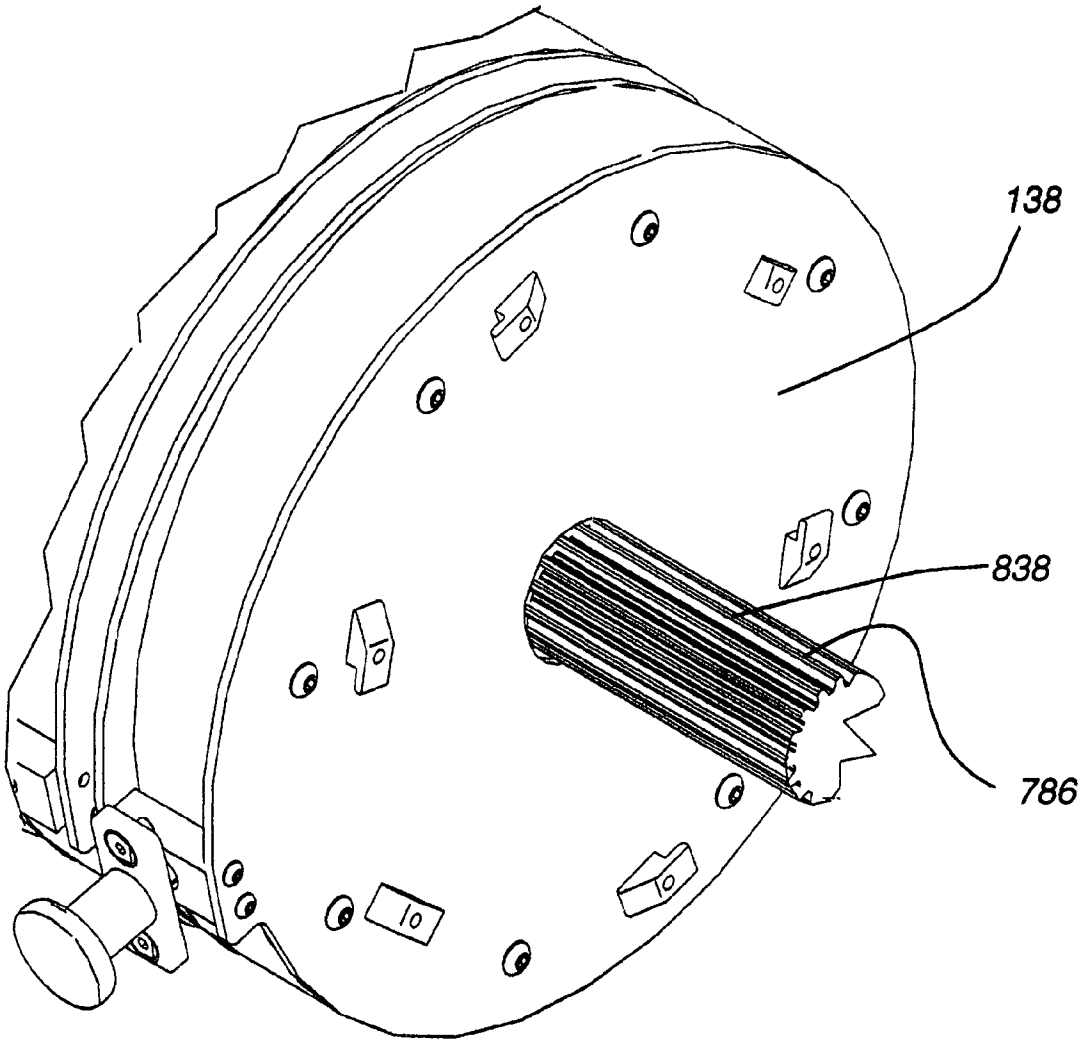
FIG. 21C is a detailed view showing a resistance pack mounted on a splined portion of a resistance axle.
Figure 21D:
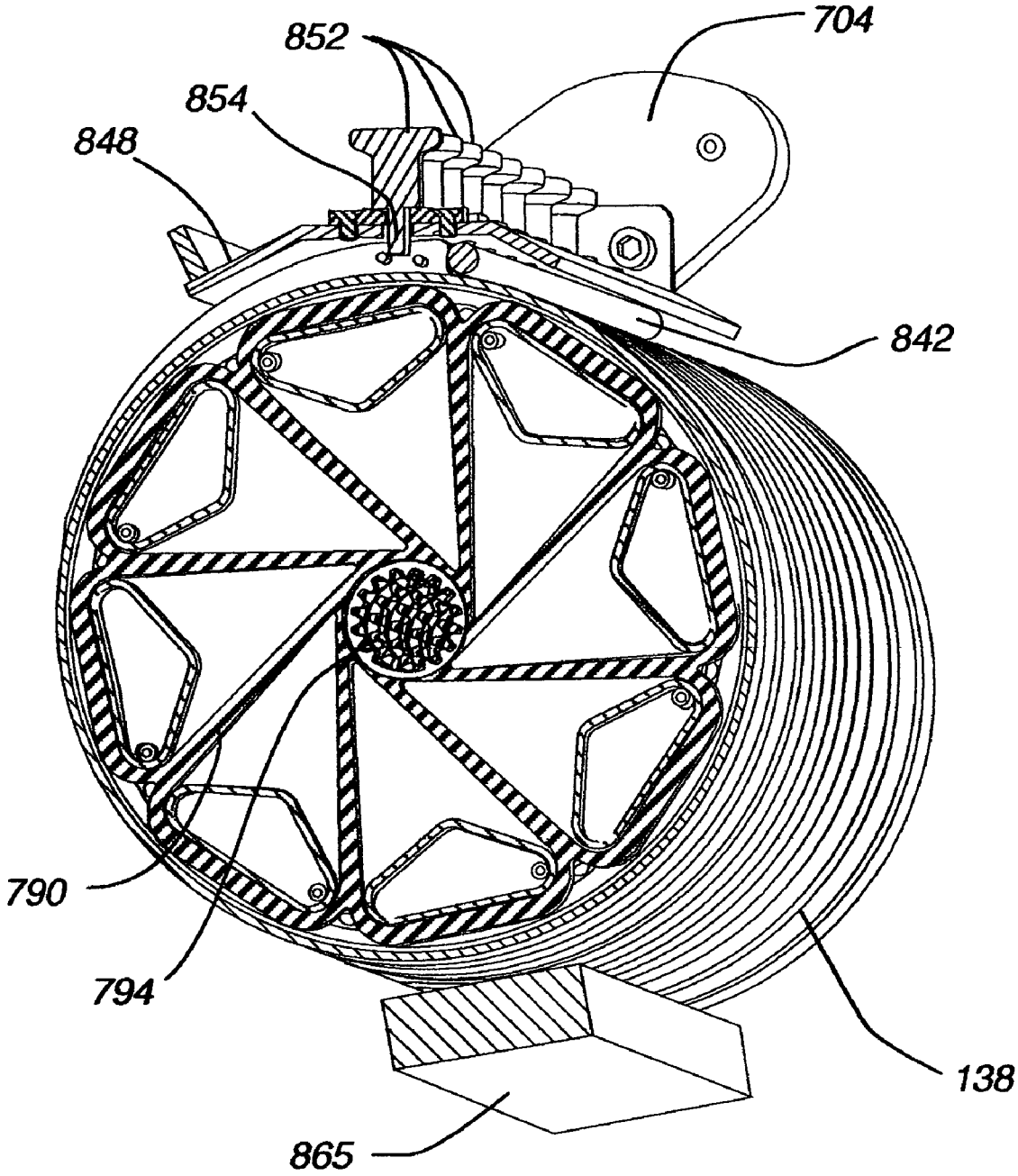
FIG. 21D is a cross-sectional view of the resistance assembly depicted in FIG. 21A, taken along line 21D-21D.
Figure 21E:
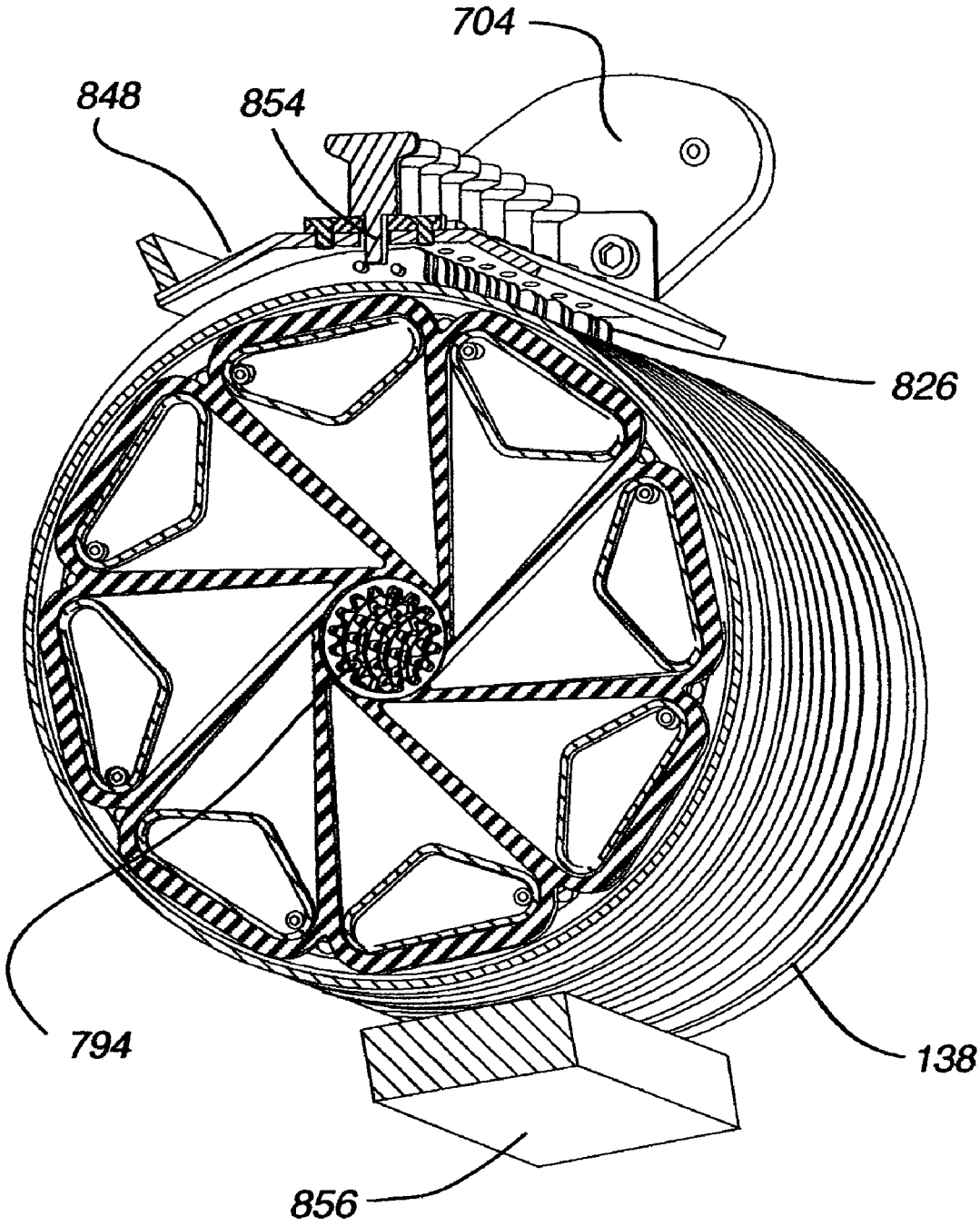
FIG. 21E is a view of the resistance assembly shown in FIG. 21D with a stop rod removed.

As previously mentioned, the resistance axle 786 supports the linearizing cam 704 and the plurality of resistance packs 138. As shown in FIGS. 21A-21E, the plurality of the resistance packs 138 is mounted on a splined portion 838 of the resistance axle 786 extending outward from the linearizing cam 704. The splined portion 838 of the resistance axle 786 is adapted to be received within the center hubs 794 of each resistance pack 138. As such, the center hubs 794 of each resistance pack do not rotate about the resistance axle 786. A stop rod 840 extends outward from a bracket 842 connected with the upper cross member 182 on the main frame 106, discussed above with reference to FIG. 3A. As shown in FIGS. 21A, 21B and 21D, the stop rod 840 extends outward from the bracket 842 and along the ledges 826 of each resistance pack. As shown in FIG. 21A an outer portion of the stop rod 840 extends radially inward to connect with a distal end portion 844 of the resistance axle 786. The resistance packs can be placed on the resistance axle so that the when the ledges on the resistance packs are in contact with the stop rod, the torsional spring is slightly stretched, which creates a relatively small amount of pre-load resistance. The pre-load resistance helps to hold the ledges 826 of the resistance packs 138 against the stop rod 840 and positions the apertures 830 on the connection blocks 828 in a desired alignment with the selector mechanism 788. As shown in FIGS. 21A and 21B, a first resistance pack 846 configured with a pre-load is connected with the linearizing cam. As such, the ledges on the resistance packs abut stop rod to the maintain the linearizing cam in a constant initial starting position when not in use.

As previously mentioned, the selector mechanism 788 is used to selectively connect the housings 792 of a desired number of resistance packs 138 with the linearizing cam 704. As shown in FIGS. 21A and 21B, the selector mechanism 788 includes a selector plate 848 connected with an outer side of the linearizing cam 704 and extends outward adjacent to the ledges 826 and connection blocks 828 on the resistance packs 138. A selector plate support 850 rotatably supported on the distal end portion 844 of resistance axle 786 extends radially outward from the resistance axle and connects with a distal end portion of the selector plate 848. As such, the selector plate rotates about the resistance axle with the linearizing cam. As shown in FIGS. 21A, 21B, 21D, and 21E, the selector plate 848 supports a plurality of knobs 852 having pins 854 extending therefrom. The pins 854 are adapted to engage the apertures 830 in the connection blocks 828 on each resistance pack. For example, moving the knobs 852 toward the resistance packs 138 inserts the pins 854 into the apertures 830 on the connection blocks 828, which connects the housings 792 of the resistance packs 138 with the selector plate 848. Therefore, when the knob is moved to insert the pin in the connection block of a resistance pack, the housing of the selected resistance pack rotates with the selector plate and linearizing cam. As shown in FIGS. 21A and 21B, some embodiments of the present invention can include a counter weight 856 extending around the plurality of resistance packs 138 opposite from the selector plate 848. The counter weight 856 is connected with and rotates with the selector mechanism 788 and linearizing cam 704. As such, the counter weight acts to cancel or eliminate effects from the weight of the selector mechanism as it rotates around the resistance axle.

A description of the operation of the components associated with the cable-pulley system and resistance systems located on the right and left sides of the exercise device is provided below with reference to FIGS. 1A-21E. Descriptions of rotational directions (i.e. clockwise and counterclockwise) are from a point of reference as viewed from the right side of the exercise device.

When using right side of the exercise device, the user applies a force to the first resistance cable 672, pulling the first end 670 of the resistance cable from the distal pulley housing 524 of the right arm assembly 518. Because the second end 686 of the first resistance cable 672 is terminated in the first axle housing 552 on the right arm assembly, pulling the first end of the first resistance cable from the right arm assembly causes the floating pulley 680 of the right cable-pulley system 666 to move upward. Movement of the floating pulley in the upward direction causes the second resistance cable 690 to unwind from the transmission pulley 694 on the right resistance system 130, which rotates the transmission pulley in a clockwise direction around the transmission axle 696. The three cams 706 also rotate clockwise with the transmission pulley 694. As such, the third resistance cable winds 692 onto the outer cam surface of the selected cam 716. As the third resistance cable 692 winds onto the selected cam, the third resistance cable unwinds from the linearizing cam 704, which causes the linearizing cam to rotate counterclockwise around the resistance axle 786. The selector mechanism 788 and counterweight 856 also rotate with the linearizing cam along with the housings 792 of the resistance packs 138 that have been connected with the selector mechanism. The connected resistance packs provide a resistance force to the third resistance cable 692 as the linearizing cam of the right resistance system rotates counter clockwise.

When the user releases the first resistance cable 672, the resistance elements 790 of selected resistance packs 138 on the right resistance system 130 force the housings 792 of the resistance packs to rotate around the resistance axle 786 with the selector mechanism 788 and linearizing cam 704 in the clockwise direction until the ledges 826 on the housings of the resistance packs 138 engage the stop rod 840. Rotation of the linearizing cam 704 in the clockwise direction unwinds the third resistance 692 from the selected cam, causing the three cams 706 and the transmission pulley 694 to rotate counterclockwise. Rotation of the transmission pulley 694 in the counterclockwise direction winds the second resistance cable 690 back onto the transmission pulley, which pulls the floating pulley 680 of the right cable-pulley system 666 in a downward direction, which in turn, causes the first resistance cable 672 to retract back into the right arm assembly 518.

When using left side of the exercise device, the user applies a force to the first resistance cable 672, pulling the first end 670 of the first resistance cable from the distal pulley housing 524 of the left arm assembly 520. Because the second end 686 of the first resistance cable is terminated in the first axle housing 552 on the left arm assembly, pulling the first end of the first resistance cable from the left arm assembly causes the floating pulley 680 of the left cable-pulley system 668 to move upward. Movement of the floating pulley in the upward direction causes the second resistance cable 690 to unwind from the transmission pulley 694, which rotates the transmission pulley 694 in a clockwise direction around the transmission axle 696. The three cams 706 also rotate clockwise with the transmission pulley 694. As such, the third resistance cable 692 winds onto the outer cam surface of the selected cam 716. As the third resistance cable winds onto the selected cam, the third resistance cable 692 unwinds from the linearizing cam 704 of the left resistance system 132, which causes the linearizing cam to rotate counterclockwise around the resistance axle 786. The selector mechanism 788 and counterweight 856 also rotate with the linearizing cam 704 along with the resistance packs 138 that have been connected with the selector mechanism. The selected resistance packs provide a resistance force to the third resistance cable as the linearizing cam of the left resistance system rotates counter clockwise.

When the user releases the first resistance cable 672, the resistance elements 790 in the selected resistance packs 138 of the left resistance system 132 force the housings 792 of the resistance packs to rotate around the resistance axle 786 with the selector mechanism 788 and linearizing cam 704 in the clockwise direction until the ledges 826 on the housings of the resistance packs engage the stop rod 840. Rotation of the linearizing cam 704 in the clockwise direction unwinds the third resistance 692 from the selected cam, causing the three cams 706 and the transmission pulley 694 to rotate counterclockwise. Rotation of the transmission pulley in the counterclockwise direction winds the second resistance cable 690 back onto the transmission pulley, which pulls the floating pulley 680 of the left cable-pulley system 668 in the downward direction, which in turn, causes the first resistance cable to retract back into the left arm assembly 520.

FIGS. 22A-22G show an alternative exercise device 858 conforming to aspects of the present invention. The exercise device allows a user to perform various exercises and includes an adjustable bench assembly 860 connected with a main frame 862. The main frame supports adjustable arm assemblies 864 and cable-pulley assemblies 866 providing a user interface with a resistance system 868, which is also supported on the main frame. Structurally, the exercise device of FIGS. 22A-22G varies from the devices of FIGS. 1A-1D in several ways. For example, the alternative exercise device 858 does not include a multi-axis release mechanism for the arm assemblies, an adjustment mechanism to selectively adjust the force curve, and a selector mechanism to select the amount of resistance. Instead, the resistance system 868 of the alternative exercise device 858 includes right and left resistance systems 870, 872, each utilizing a plurality of removable resistance packs 874 adapted to connect with each other, enabling the user to change the amount of resistance. The resistance system is partially covered by shroud members 876 supported by the main frame. Each of the right and left resistance systems also include a tensioning mechanism 878 to adjust the tension of a portion of the cable-pulley assembly. In addition, the main frame 862 of the alternative embodiment 858 is configured differently than the frame of earlier embodiments. For example, the alternative embodiment includes a forward bench support 880 that automatically folds inward when the exercise device is placed in the storage configuration.

As shown in FIGS. 22A-22G, the exercise device can be configured with various accessories to allow a user to perform various types of exercises. The exercise device 858 includes a bench frame 882 supporting the adjustable bench assembly 860 having an adjustable back support 882 and bench seat 884. The bench frame 882 includes a seat rail 888 with a first end portion 890 pivotally connected with the main frame 862 and a second end portion 892 supported by the forward bench support 880. The main frame 862 also supports right and left adjustable arm assemblies 894, 896 and cable-pulley assemblies 898, 900 that provide a user interface with the right and left resistance systems 870, 872. The adjustable arm assemblies 894, 896 are pivotally connected with the frame 862 to provide the user with the ability to adjust the position of the arm assemblies along vertically oriented arcs. The resistance systems 870, 872 are also connected with and are supported by the main frame 862. Each resistance system includes a transmission assembly 902 and resistance assembly 904. The transmission assembly 902 includes the previously mentioned tensioning mechanism 878, but does not include a cam selector and a plurality of selectable cams as described above with reference to earlier embodiments. However, it is to be appreciated that the selectable cams described above may be utilized with the exercise device of FIGS. 22A-22G. The resistance assemblies 870, 872 utilize resistance packs 874 similar to those used with earlier embodiments; however, the resistance systems do not include a selector mechanism to allow a user to select the amount of resistance. Instead, the user stacks a desired number of resistance packs 874 onto a resistance axle 906 to select the amount of resistance. As described below, the resistance packs have interconnecting housings. It should be appreciated, however, that the selector mechanism of earlier embodiments may be employed in the exercise device 858 of FIGS. 22A-22G.

Figure 22A:
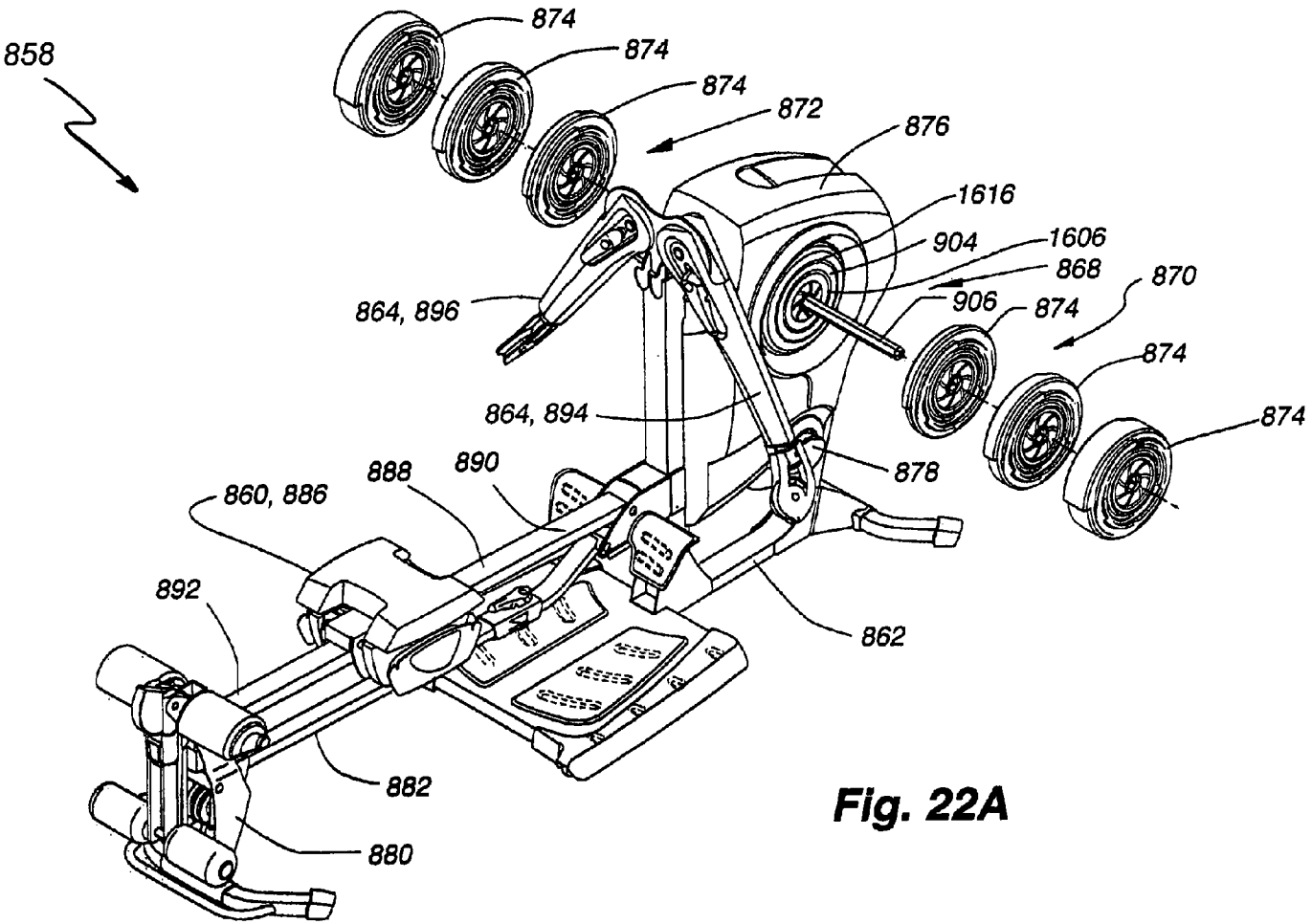
FIG. 22A is an isometric view of an alternative exercise device.

Similar to earlier embodiments, the forward bench support 880 of the exercise device 858 is pivotally connected with the seat rail 888. In addition, the first end portion 890 of the seat rail 892 is pivotally connected with the frame 862, which allows a user to place the exercise device 858 in a storage configuration, as shown in FIG. 22G, wherein the second end portion 892 of the seat rail 888 is rotated upward toward the frame until the seat rail is substantially vertical with respect to the support surface. Further, the back support 884 and the bench seat 886 are adjustably coupled with the bench frame 882. More particularly, the bench seat 886 is rollingly connected with the seat rail 888 such that the bench seat can roll back and forth along the length of the seat rail. As shown in FIGS. 22A-22G, the bench seat can also be selectively locked into various positions along the length of the seat rail as well as being configured to roll freely back and forth along the seat rail. As shown in FIGS. 22A, 22C, and 22D, the back support 884 is not fixedly connected with the exercise device 858, and as such, is removable. When the bench seat 886 is positioned on the seat rail 888 in a rearward direction relatively close to the frame 862, the back support 884 can be placed in an inclined position supported between the bench seat 886 the frame 862, as shown in FIG. 22D.

Figure 23A:
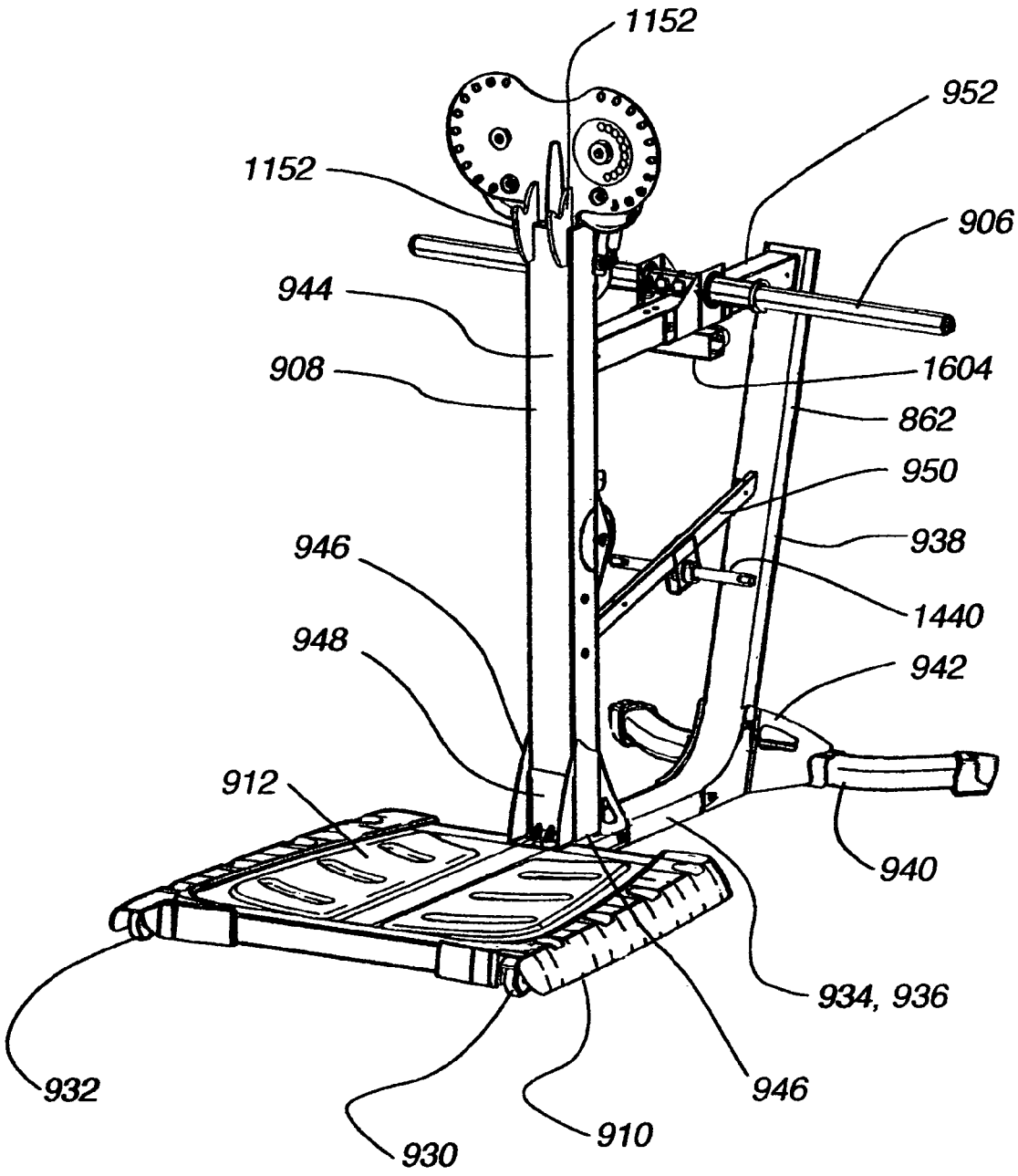
FIG. 23A is a right side isometric view of a main frame of the exercise device of FIG. 22A.
Figure 23B:
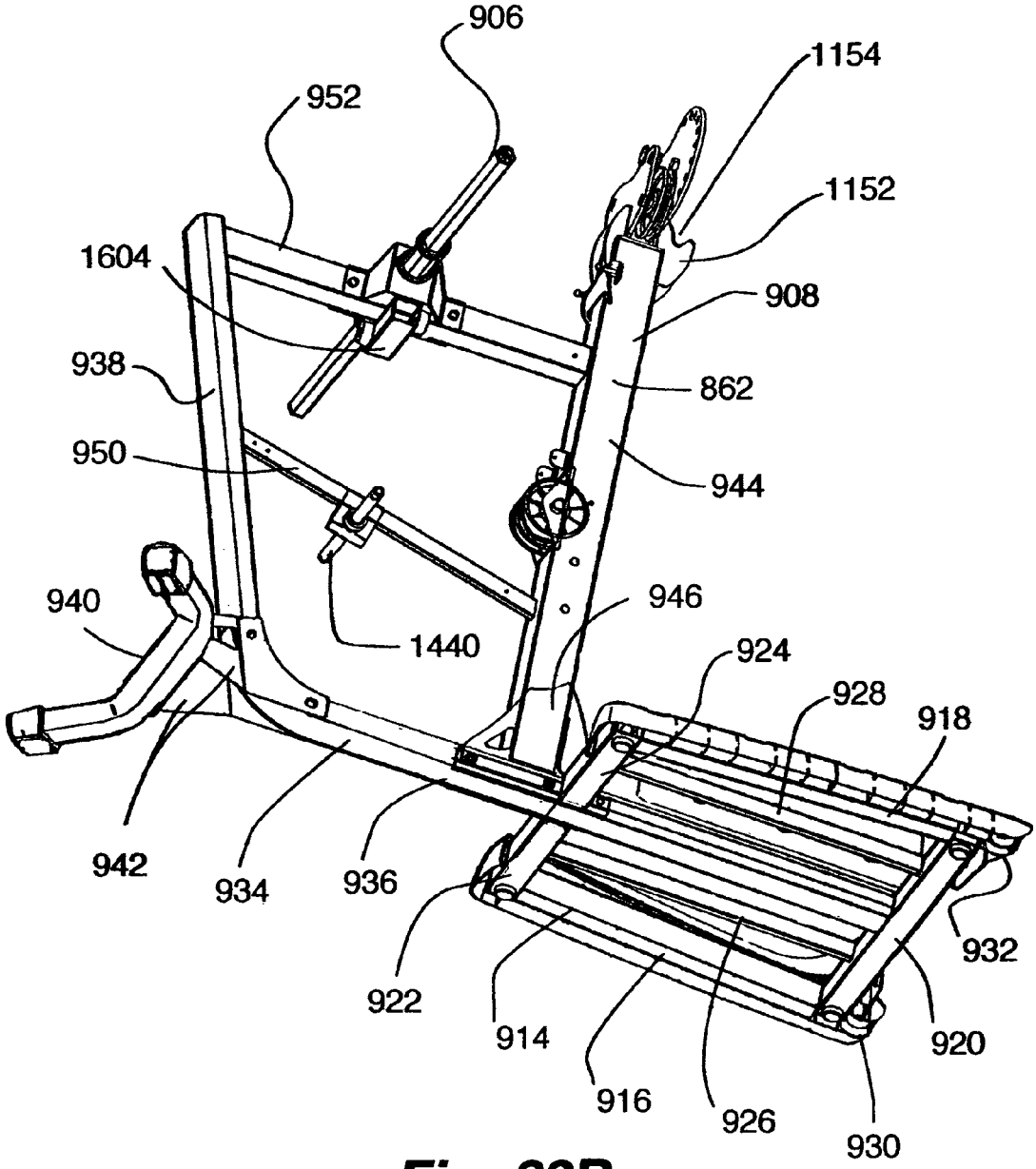
FIG. 23B is a left bottom side isometric view of the main frame of the exercise device of FIG. 22A.

As previously mentioned, the main frame 862 supports the resistance system 868, the adjustable arm assemblies 864, the cable-pulley assembly 866, and the first end portion 890 of the seat rail 888. As shown in FIGS. 23A-23B, and others, the main frame 862 includes an upright structure 908 connected with a base structure 910, which includes a platform plate 912 supported on a base frame 914. The base frame 914 includes right and left base members 916, 918 connected with and separated by a front cross member 920 and first and second rear cross members 922, 924 to define a substantially square shape. The platform plate 912 is connected with and is supported on upper surfaces of the members defining the base frame 914. Right and left plate support members 926, 928 extending between the front cross member 920 and the first and second rear cross members 922, 924 provide additional support to the platform plate.

As shown in FIGS. 23A and 23B, right and left wheels 930, 932 are rotatably connected with the front cross member 920 that allow a user to maneuver the exercise device along a support surface from one location to another. Although the exercise device includes wheels, it is to be appreciated that the exercise device can also include rollers, skid plates, or other components to assist with maneuvering the exercise device. When the main frame 862 is supported by the base frame, the wheels are positioned adjacent to and slightly above the support surface. To move the exercise device from one location to another, a user can place the exercise device 858 in the storage configuration shown in FIG. 22G. Once in the storage configuration, the user can pivot the main frame 862 forward to bring the wheels 930, 932 into engagement with the support surface. The user can then roll the exercise device along the support surface to a desired location.

As shown in FIGS. 23A and 23B, the base frame 914 also includes a generally L-shaped center support member 934 having a base portion 936 and an upright portion 938. More particularly, the base portion 936 of the center support member 934 extends rearwardly from the front cross member 920, between the first and second rear cross members 924, 926, and from under the base plate to the upwardly extending upright portion 938. A rear base member 940 which adds lateral support to the frame 862 is connected with the center support member 934 through rear support brackets 942 connected with the base portion and the upright portion of the center support member.

Figure 23C:
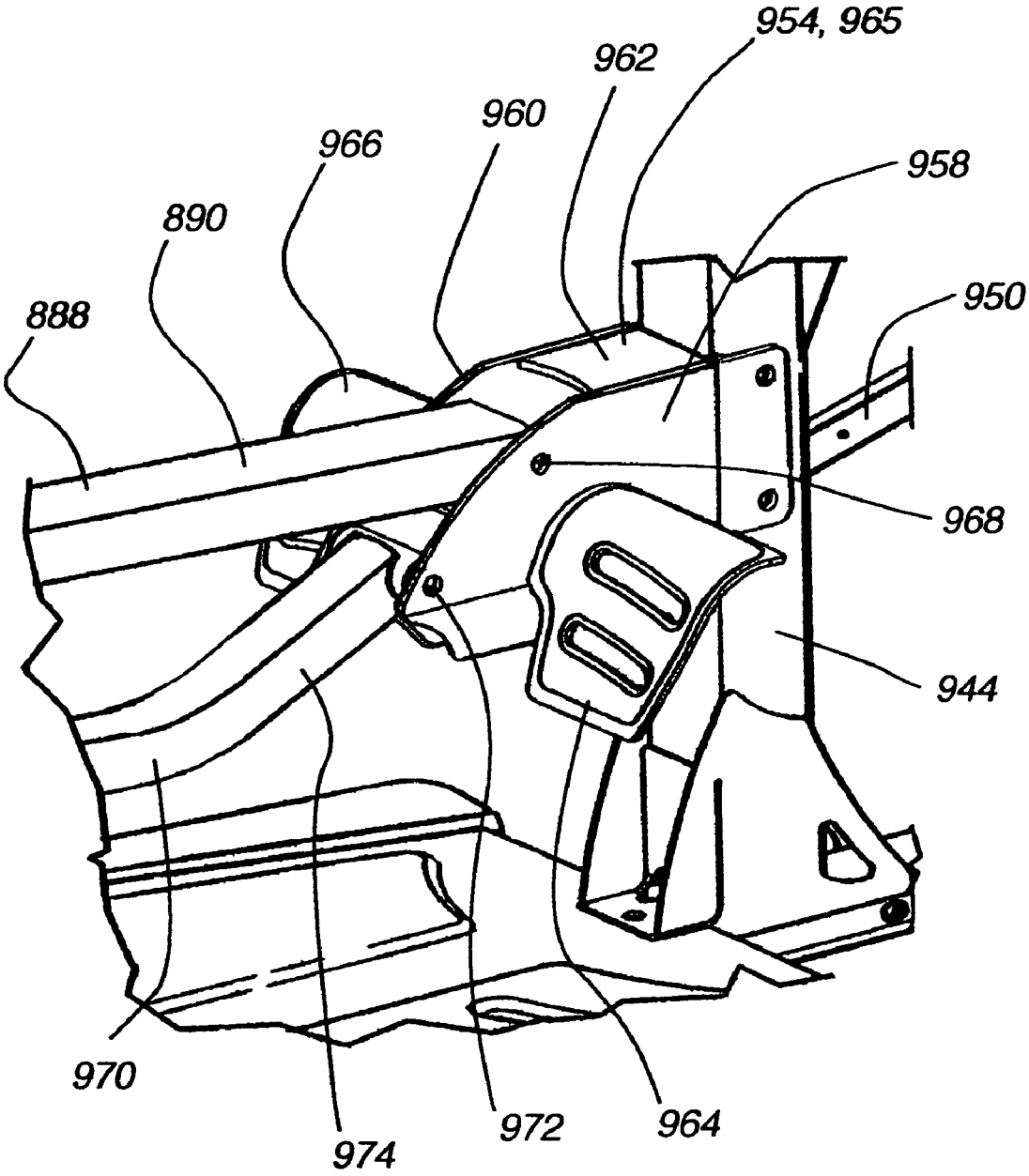
FIG. 23C is a detailed view of a lower foot plate assembly connected with a main frame of the exercise device of FIG. 22A.

Referring to FIGS. 23A, 23B, and others, the upright structure 908 includes an arm support member 944 extending upward from the top surface of the base portion 936 of the center support member 934. A pair of forward side support brackets 946 and a center support bracket 948 are connected with the arm support member 944 and the center support member 934. A transmission support member 950 extends rearward from the arm support member 944 and connects with the upright portion 938 of the center support member 948. A resistance support member 952 extends rearward from the arm support member 944 above the transmission support member 950 and connects with the upright portion 938 of the center support member 934. As shown in FIG. 23C, a lower foot plate 954 assembly is connected with and extends forward from a lower portion on the arm support member 944. The lower foot plate assembly 954 includes a housing 956 extending forward from the arm support member 944 and is defined by right and left side plates 958, 960 separated by a top side plate 962. The right and left side plates are connected with right and left sides of the arm support member. Right and left foot plates 964, 966 extend outward from the right side plate and the left side plate. The foot plates provide platforms upon which a user can place his feet when performing various exercises, such as leg press exercises.

Figure 22B:
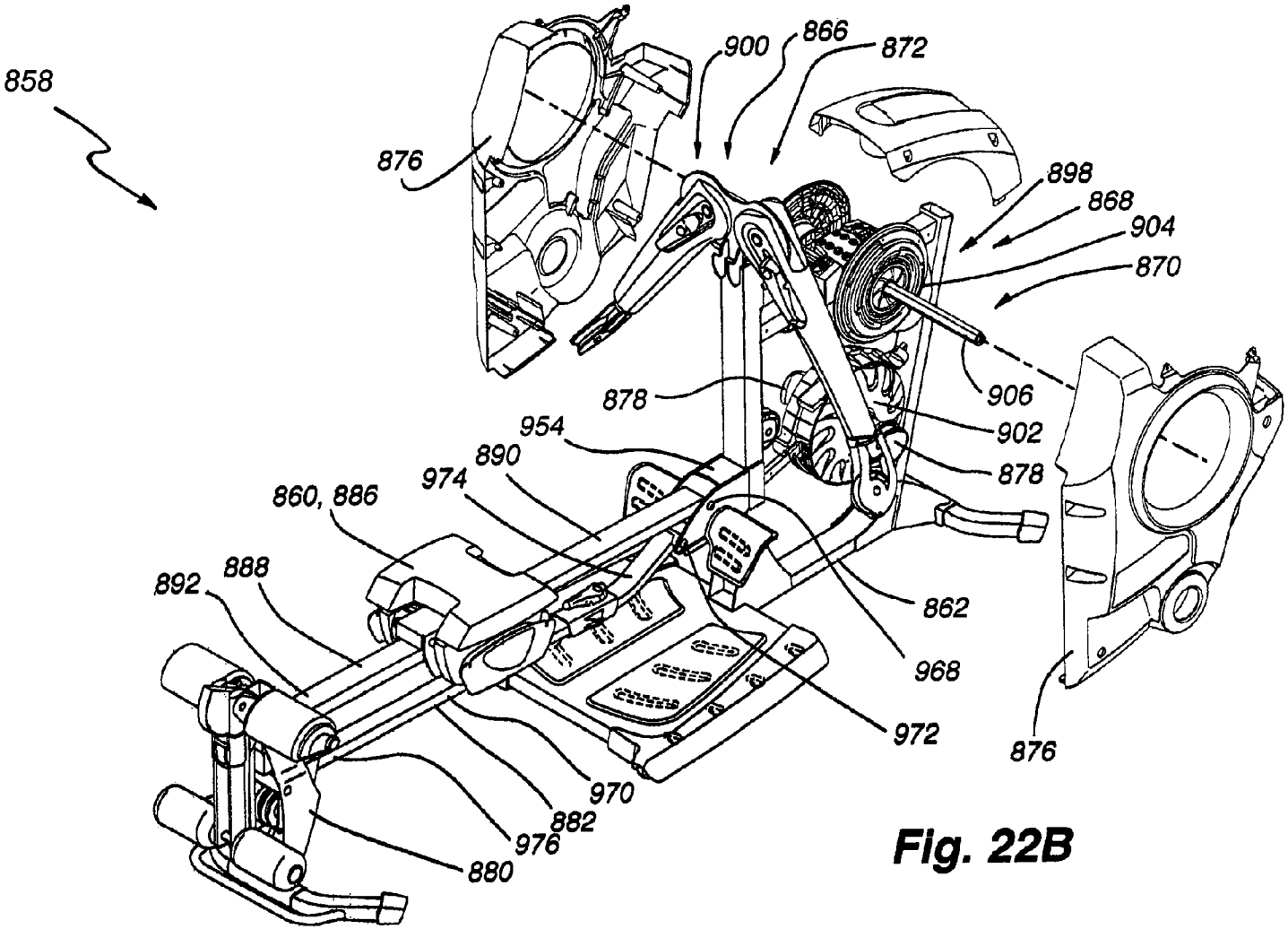
FIG. 22B is an exploded view of a shroud cover of the exercise device of FIG. 22A.
Figure 22C:
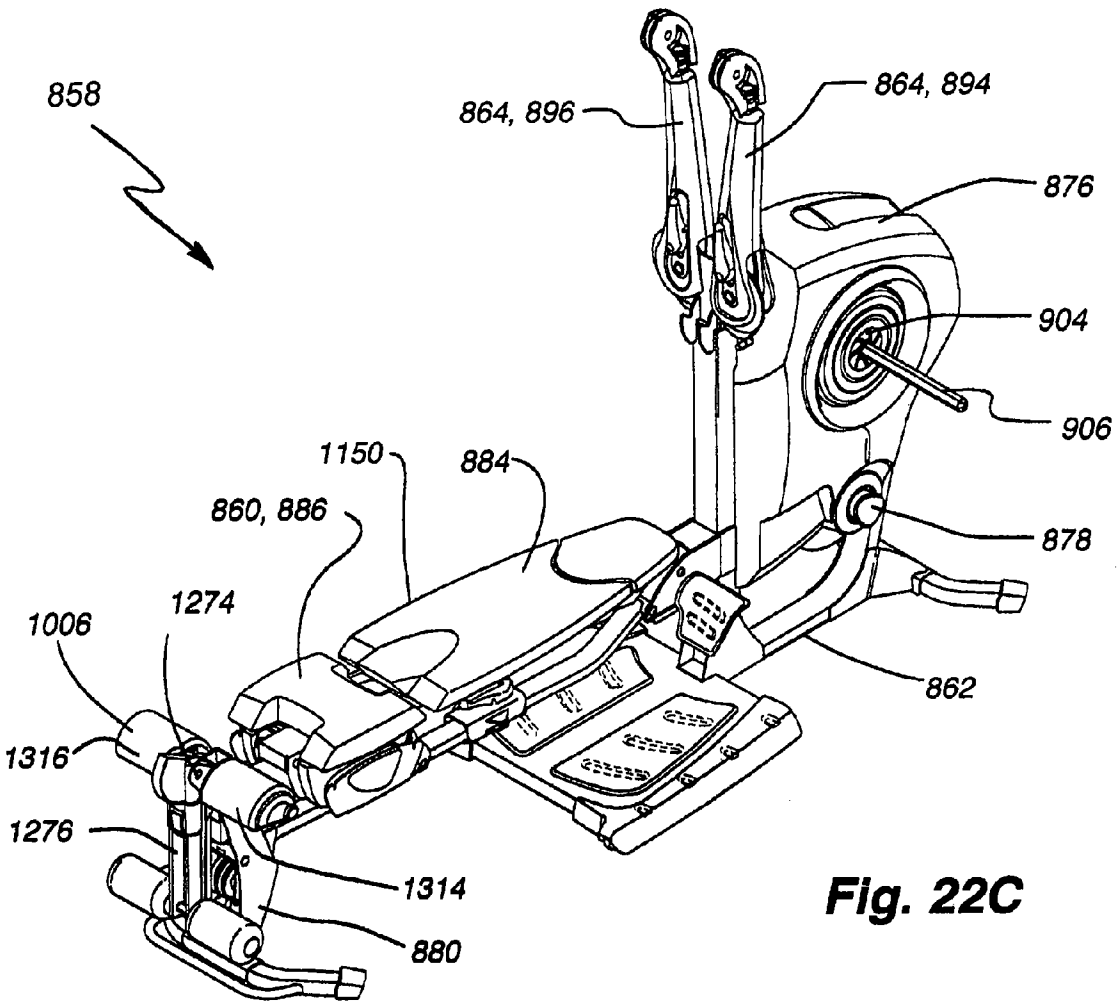
FIG. 22C is an isometric view of the exercise device of FIG. 22A with a back support configured as a flat bench.
Figure 22D:
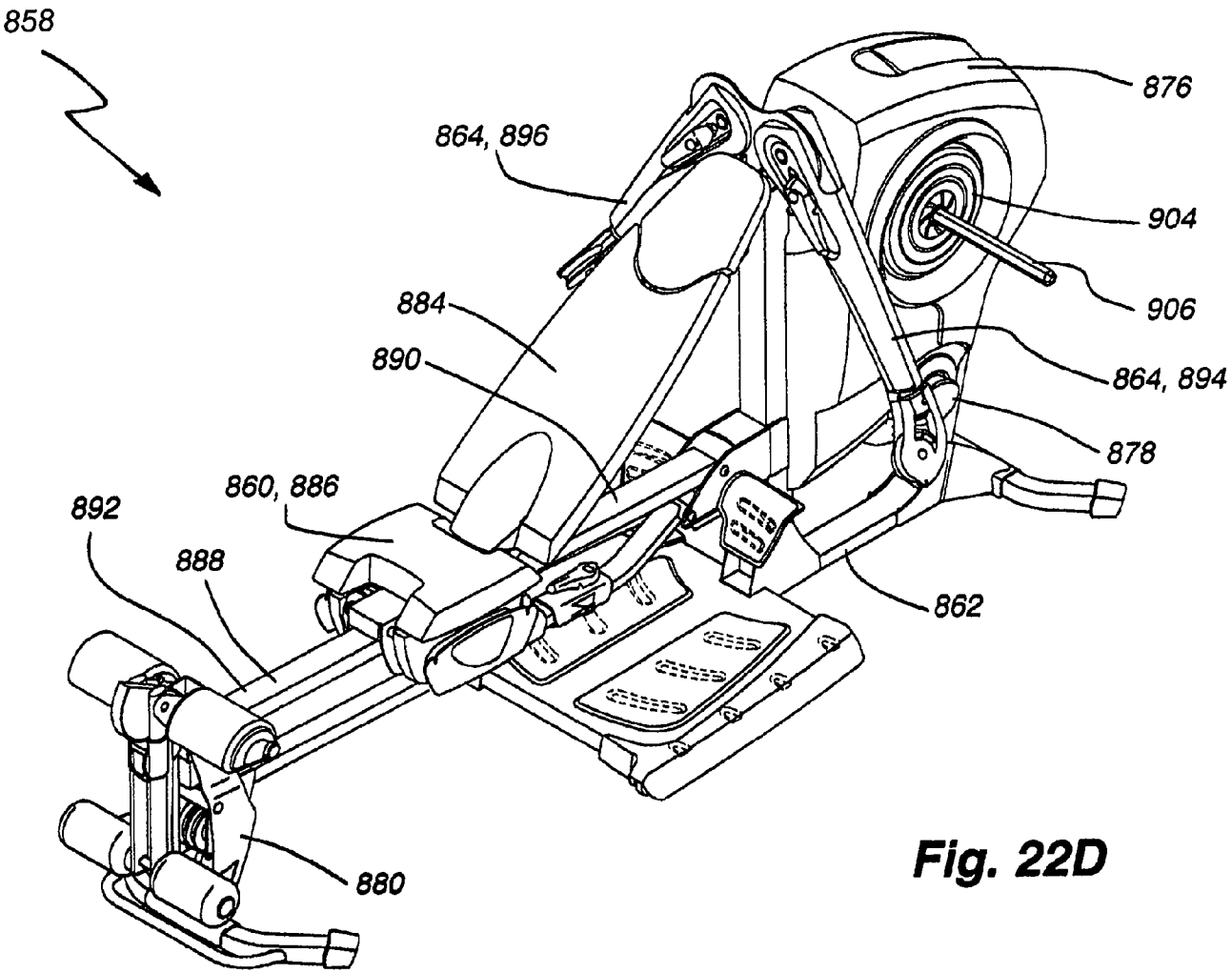
FIG. 22D is an isometric view of the exercise device of FIG. 22A with the back support in an inclined position.
Figure 22E:
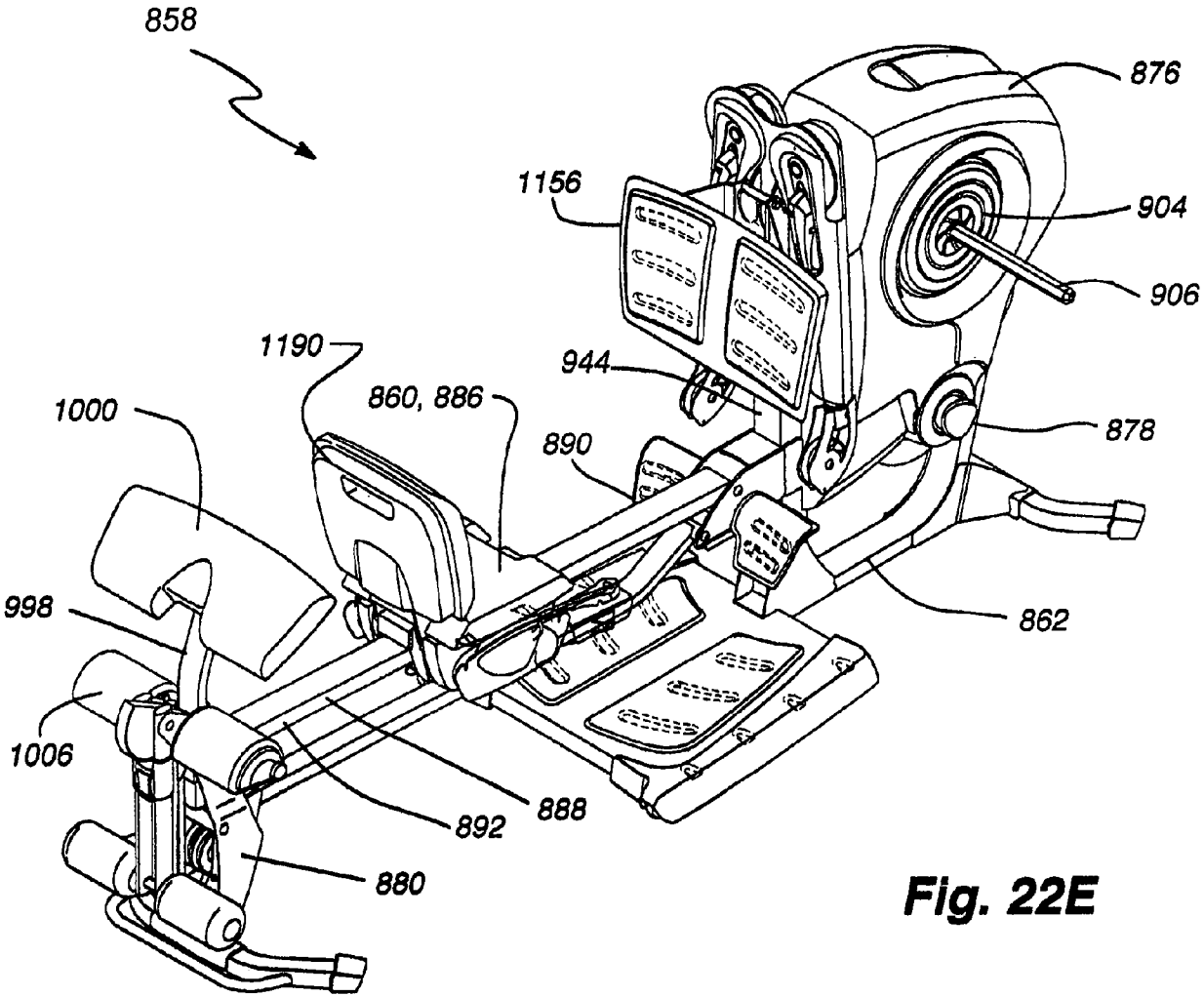
FIG. 22E is an isometric view of the exercise device of FIG. 22A configured for leg press exercises with a removable seat back support.
Figure 22F:
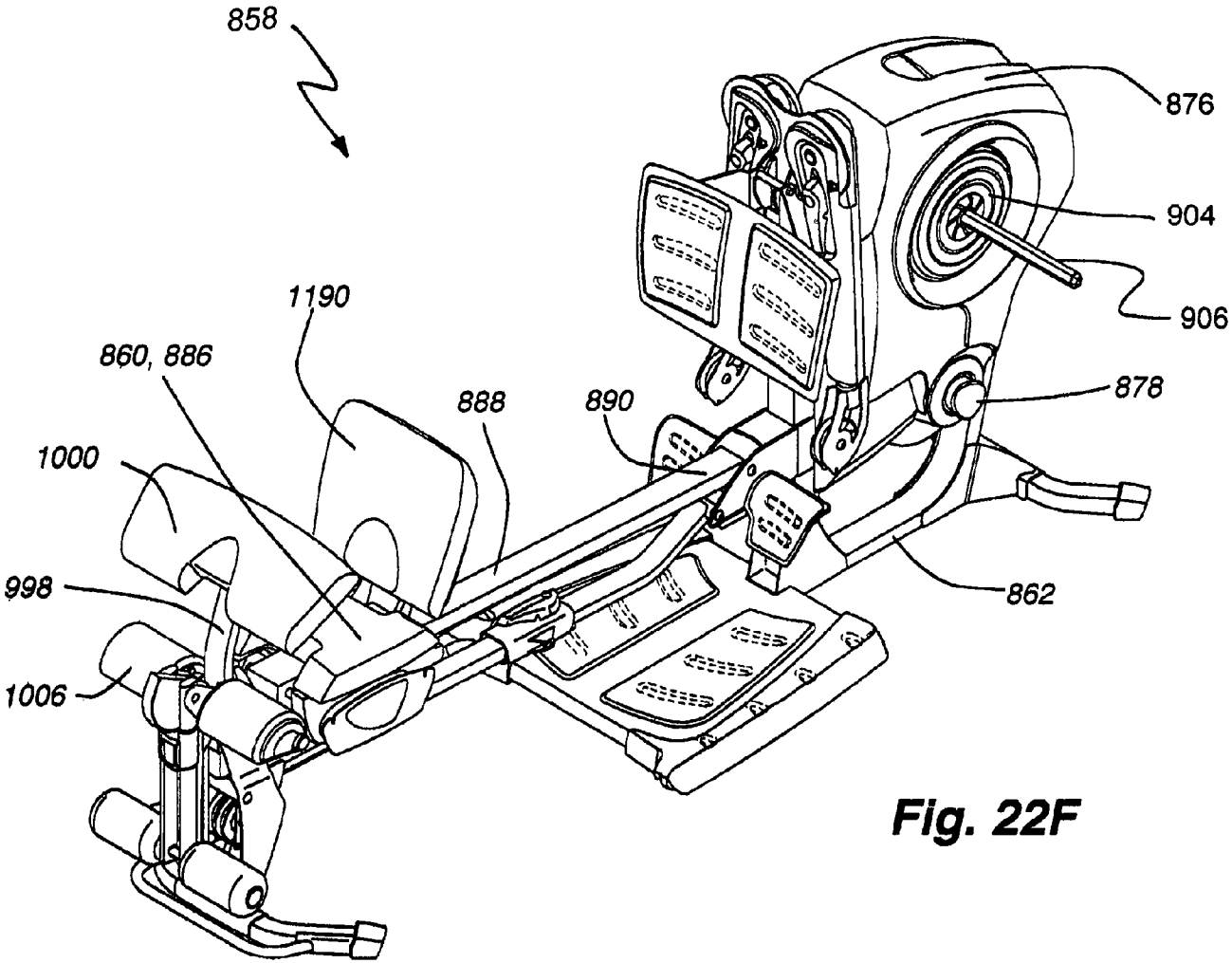
FIG. 22F is an isometric view of the exercise device of FIG. 22A configured for preacher curl exercises.
Figure 22G:
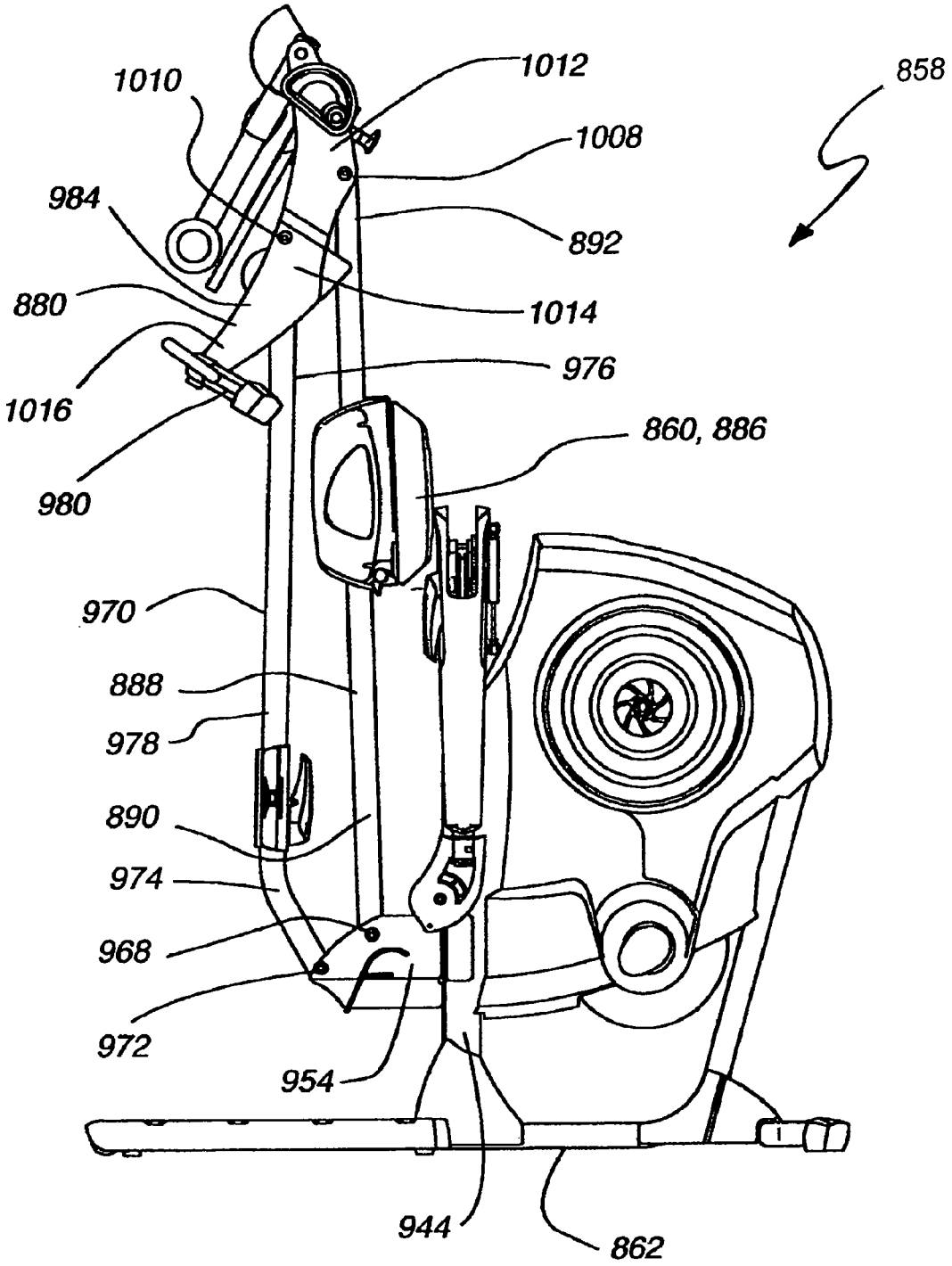
FIG. 22G is a right side view of the exercise device of FIG. 22A in a storage configuration.

As shown in FIGS. 22B, 22G, 23C, and others, the seat rail 888 is pivotally connected with and extends forward from the lower foot plate assembly 954. More particularly, the first end portion 890 of the seat rail 888 is pivotally connected with a first seat rail axle 968 supported between the right and left side plates 958, 960 of the lower foot plate assembly 954. The bench frame 882 also includes a bottom rail 970 pivotally connected with the lower foot plate assembly 954 through a first bottom rail axle 972. More particularly, the first bottom rail axle 972 is supported between the right and left side plates 958, 960 of the lower foot plate assembly below and forward of the first seat rail axle 968. The bottom rail 970 is a generally elongate member with first and second end portions 974, 976, the first end portion being angled upwardly from a mid portion 978. The first end portion 974 of the bottom rail 970 is pivotally connected with the first bottom rail axle 972. The bottom rail 970 is located under the seat rail 888 and extends forward from the first bottom rail axle in a direction generally parallel with the seat rail 888 to the second end portion 976 of the bottom rail 970. As discussed in more detail below, when the exercise device is placed in the storage configuration, the bottom rail acts to pull the forward bench support 880 inward toward the bottom rail 970 and the seat rail 888.

Figure 24A:
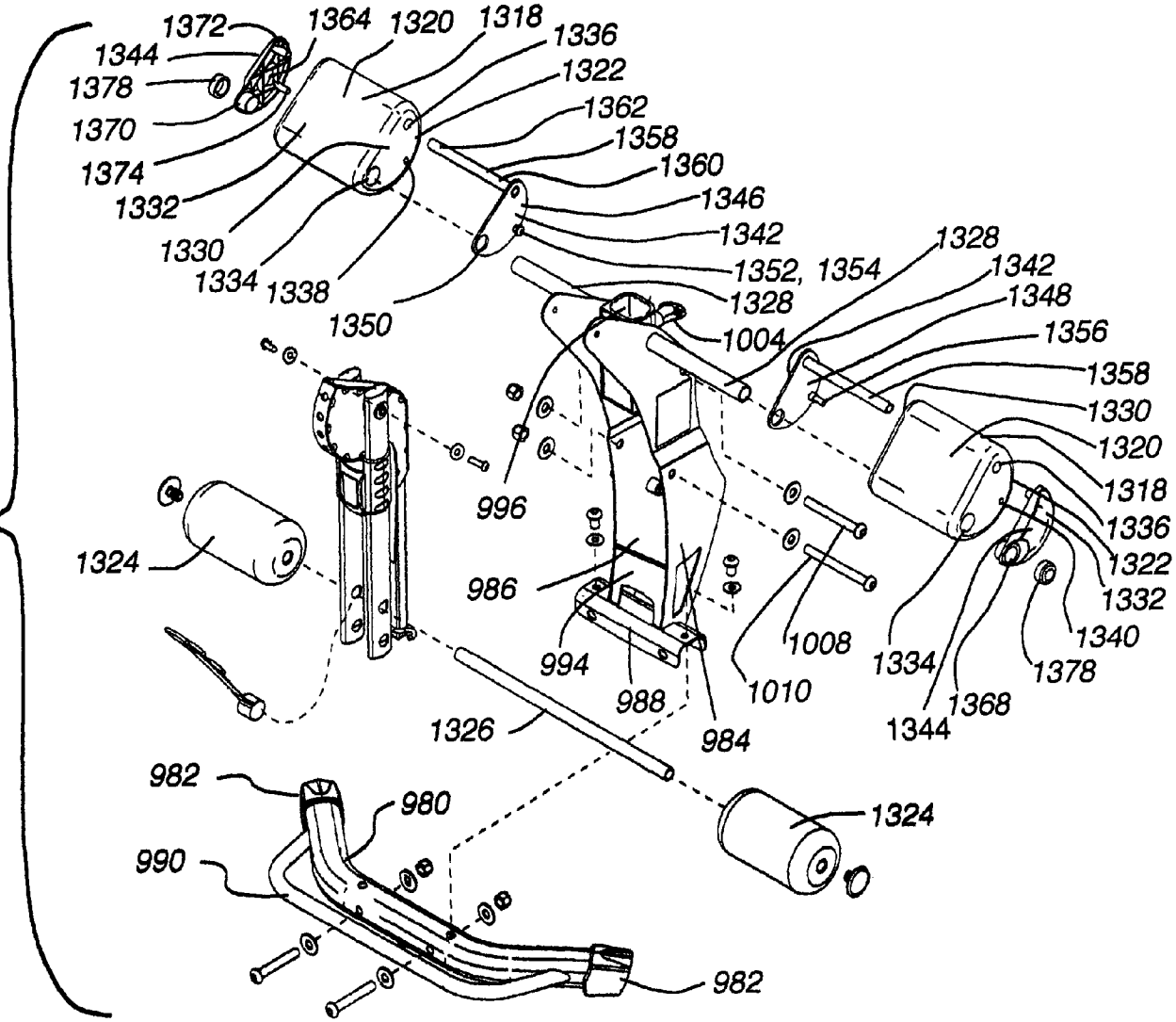
FIG. 24A is an exploded view of a forward bench support.

As shown in FIGS. 22B, 22G, 24A, and others, the forward bench support 880 is pivotally connected with and adjustably supports the second end portions of the seat rail 888 and the bottom rail 970 above the support surface. The forward bench support 880 includes a cross member 980 having a pair of end caps 982 at opposing end portions thereof adapted to engage the support surface. Right and left support members 984, 986 extend upward from opposing end portions of a support bracket 988 connected with the cross member 980. A handle 990 connected with and extending along a front side of the cross member 980 can be used to lift the second end portions of the bottom rail 970 and seat rail 888 when placing the exercise device 858 in the storage configuration. The forward bench support 880 can also include a collar support bracket 992 connected between the right and left support members 984, 986. It is to be appreciated that the forward bench support can include additional components for added rigidity, stability, and/or strength. For example, the forward bench support 880 includes a U-shaped gusset 994 connected with the support members and support bracket. The collar support bracket 992 can be connected with an accessory support member or collar 996 adapted to receive a support post 998 connected with an exercise accessory 1000, such as a preacher curl accessory 1000 shown in FIGS. 22E and 22F. The accessory support collar 996 can also include an accessory pop-pin 1004 adapted to engage apertures on the exercise accessory support post for selective height adjustment of the exercise accessory. Also, a leg developer assembly 1006 can be pivotally supported between the right and left support members 984, 986.

As shown in FIGS. 22G and 24A-24C, the second end portion 892 of the seat rail 888 is connected with the second end portion 976 of the bottom rail 970 through the right and left support members 984, 986 of the forward bench support 880. More particularly, the second end portion 892 of the seat rail 888 is pivotally connected with the forward bench support through a second seat rail axle 1008, and the second end portion of the bottom rail is pivotally connected with the forward bench support through a second bottom rail axle 1010. As shown in FIGS. 22G and 24A-24C, and others, upper regions 1012 of the support members 984, 986 adjacent to right and left sides of the second end portion 892 of seat rail 888 are pivotally connected with opposing end portions of the second seat axle 1008. Mid regions 1014 of the support members adjacent to right and left sides of the second end portion 976 of the bottom rail 970 are pivotally connected with opposing end portions of the second bottom rail axle 1010.

As previously mentioned, the bottom rail 970 acts on the support members 984, 986 to fold the forward bench support 880 inward and upward toward the bottom rail 970 when the bench frame 882 is moved from the downward operative position to the upright storage position. FIG. 22B shows the exercise device 858 with the bench frame 882 in the downward position, and FIG. 22G shows the exercise device with the bench frame in the upright position. The bench frame 882 is placed in the upright position by pivoting the seat rail 888 and bottom rail 970 upward in a clockwise direction (as viewed from the right side of the exercise device) around the first seat rail axle and the first bottom rail axle, respectively. As the seat rail and bottom rail pivot clockwise, the second end portions of the seat rail 888 and the bottom rail 970 move along arcs that are not parallel. More particularly, because the first seat rail axle 968 is located above and rearward of the first bottom rail axle 972, the second end portion 976 of the bottom rail 970 and the second bottom rail axle 1010 move rearward and upward relative to the second end portion 892 of the seat rail 888 and the second seat rail axle 1008. The movement of the second end portion 976 of the bottom rail 970 with respect to the second end portion 892 of the seat rail 888 causes the second bottom rail axle to pull on the mid regions 1014 of the support members 984, 986, which in turn, causes the support members to pivot counterclockwise (as viewed from the right side of the exercise device) around the second seat rail axle 1008. As the support members pivot counterclockwise around the second seat rail axle, lower regions 1016 of the support members 984, 986 and the cross member 980 pivot toward the bottom rail 970.

Conversely, when moving the bench frame 882 from the upright position (FIG. 22G) to the downward position (FIG. 22B), the bottom rail 970 acts on the support members 984, 986 to extend the forward bench support 880 outward and downward away from the bottom rail 970. The bench frame 882 is placed in the downward position by pivoting the seat rail 888 and bottom rail 970 counterclockwise (as viewed from the right side of the exercise device) around the first seat rail axle 968 and the first bottom rail axle 972, respectively. As the seat rail 888 and bottom rail 970 pivot counterclockwise, the second end portions of the seat rail and the bottom rail move along arcs that are not parallel. More particularly, the second end portion 976 of the bottom rail 970 and the second bottom rail axle 1010 move forward and downward relative to the second end portion 892 seat rail 888 and the second seat rail axle 1008. The movement of the second end portion 976 of the bottom rail 970 with respect to the second end portion 892 of the seat rail 888 causes the second bottom rail axle 1010 to push on the mid regions 1014 of the support members 984, 986, which in turn, causes the support members to pivot clockwise (as viewed from the right side of the exercise device) around the second seat rail axle 1008. As the support members 984, 986 pivot clockwise around the second seat rail axle 1008, the lower regions 1016 of the support members 984, 986 and the cross member 980 pivot away from the bottom rail 970.

Figure 24B:
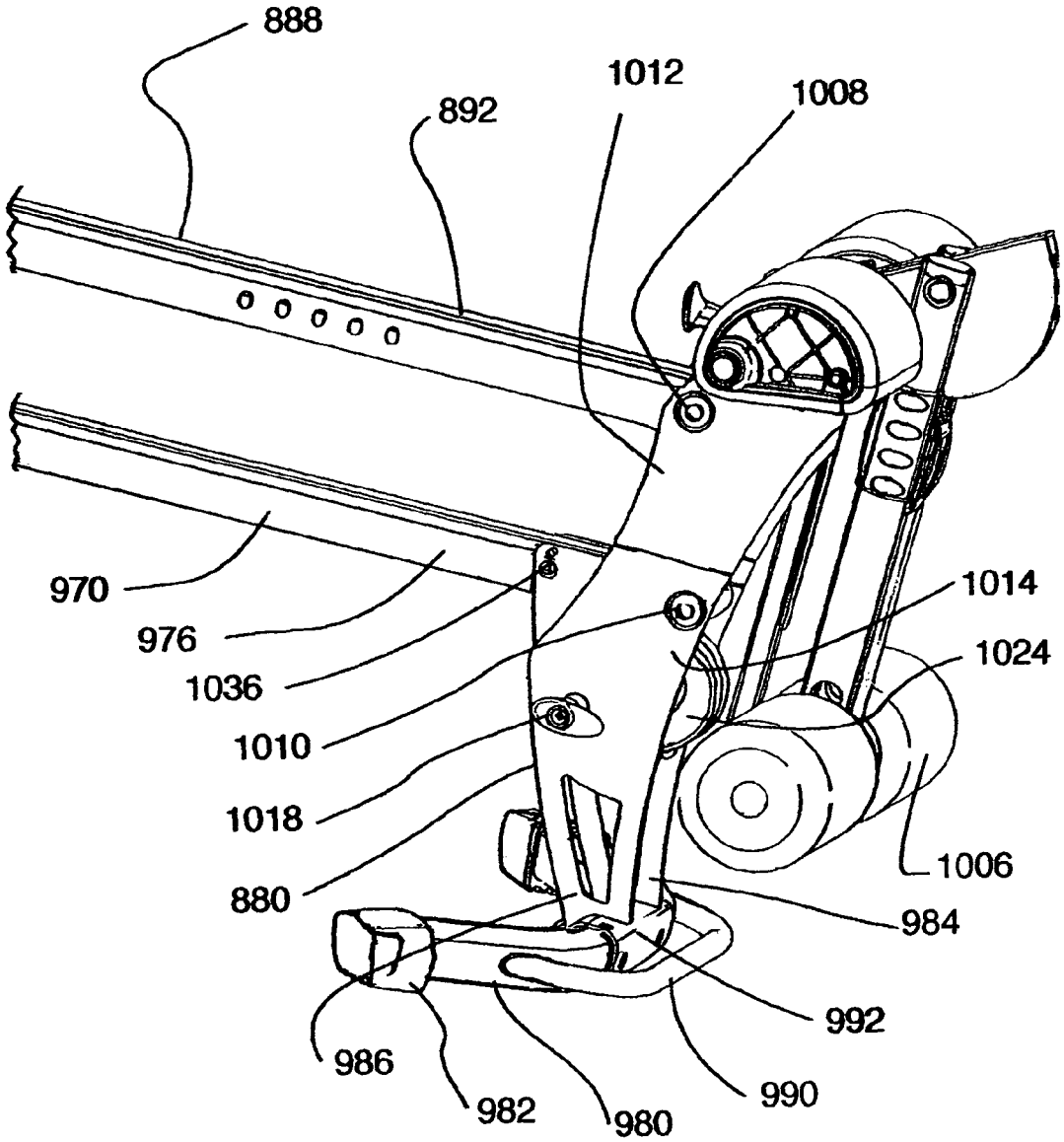
FIG. 24B is a left side detailed isometric view of the forward bench support.
Figure 24C:
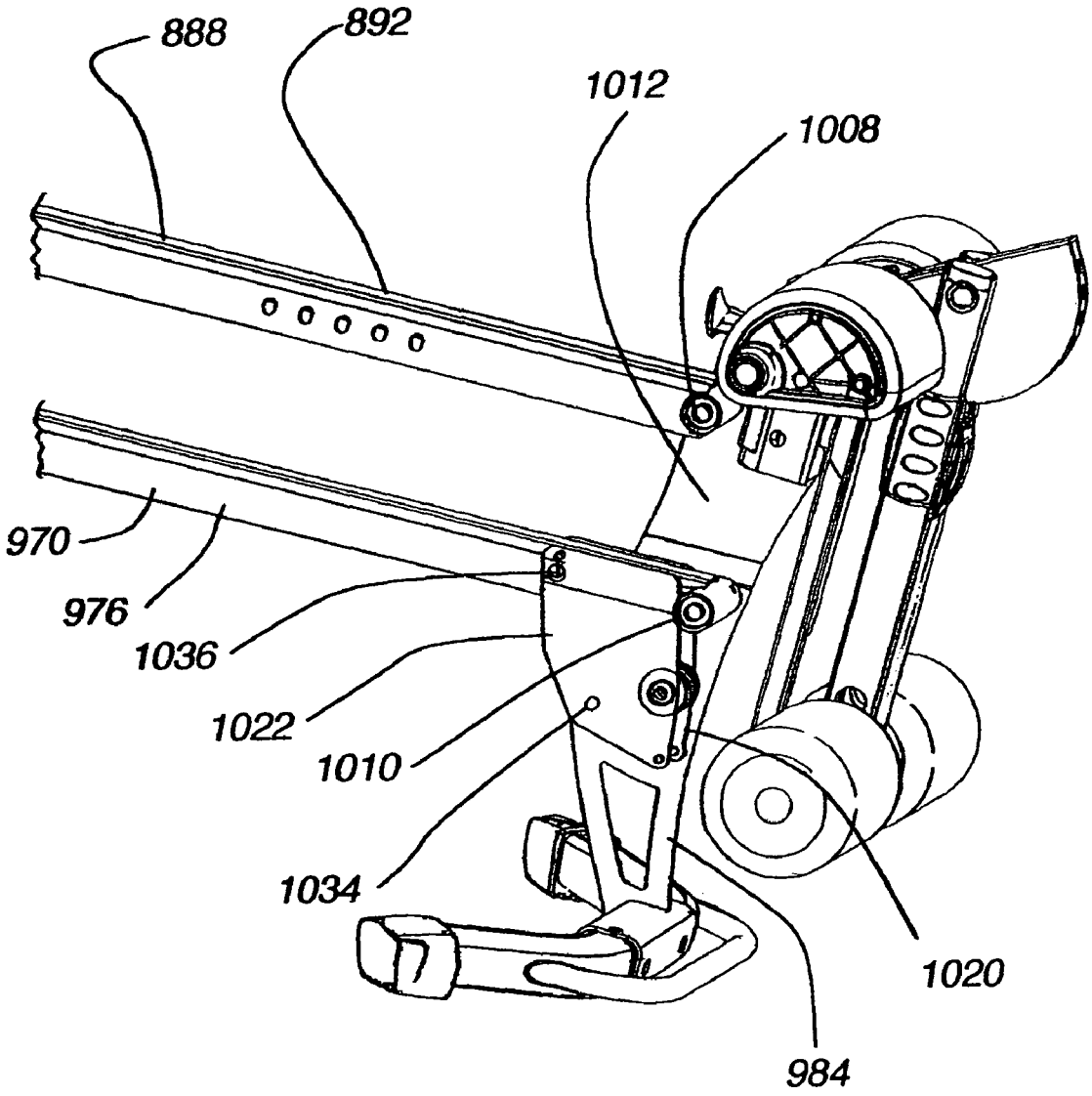
FIG. 24C is a left side detailed isometric view of the forward bench support with a left support member removed.

The exercise device 858 can also include a pop-pin 1018 or similar device to selectively lock the bench frame 882 in the downward and upright positions. As shown in FIGS. 24A-24C, the pop-pin 1018 is connected with the left support member 986 of the forward bench support 880. The pop-pin 1018 is adapted to selectively connect the forward bench support 880 with the bench frame 882. More particularly, as shown in FIGS. 24B and 24C, right and left extension plates 1020, 1022 rotatably supporting two pulleys 1024 are connected with the second end portion 976 of the bottom rail 970. As discussed in more detail below, the two pulleys 1024 are adapted to interact with the cable-pulley assembly. The pop-pin 1018 is spring loaded and adapted to selectively engage apertures in the left extension plate 1022 to selectively lock the bench frame 882 in the downward and/or upright positions. As shown in FIG. 24B, the pop-pin can include a body housing a spring operably connected with a pin. The spring acts to force the pin through the left support member 986 and against the left extension plate 1022. The pin can be disengaged from the left extension plate 1022 by pulling on a handle 1032 connected with the pin in a direction away from the left extension plate. The pop-pin 1018 is adapted to engage a first aperture 1034 and a second aperture 1036 in the left extension plate. As discussed in more detail below, when the pop-pin 1018 engages the first aperture 1034, the bench frame 882 is selectively locked into the downward position. Alternatively, when the pop-pin 1018 is engages the second aperture 1036, the bench frame 882 is selectively locked into the upright position. It is to be appreciated that the pop-pin 1018 can be located on other locations on the exercise device, such as on the right support member 984. It is also to be appreciated that the bench frame can be configured to be selectively locked in only the upright or downward positions and need not be configured to be selectively locked in both the downward and upright positions.

FIG. 22B shows the bench frame 882 locked in the downward position with the pin 1030 of the pop-pin 1018 engaged with the first aperture 1034 in the left extension plate 1022. When the pop-pin 1030 is engaged with the first aperture 1034, the left support member 986 of the forward bench support 880 is connected with the bottom rail 970 through the left extension plate 1022 as well as the second bottom rail axle 1010. As such, the left support member 986 is selectively locked into a fixed position relative to the bottom rail 970, which in turn, prevents the forward bench support 880 from pivoting about the second seat rail axle 1008. As described above, relative movement between the second seat rail axle and second bottom rail axle when placing the bench frame in the upright position causes the support members 984, 986 of the forward bench support 880 to pivot clockwise (as viewed from the right side of the exercise device) around the second seat rail axle 1008. However, when the pop-pin 1018 is engaged with the first aperture 1034, the forward bench support is prevented from pivoting around the first pivot axle, locking the bench frame in the downward position.

To place the bench frame 880 in the storage position, as shown in FIG. 22G, the pop-pin 1018 is first disengaged from the first aperture 1034 of the left extension plate 1022 by pulling the handle 1032 away from the left extension plate. The second end portions of the seat rail 888 and bottom rail 970 are then lifted and pivoted clockwise (as viewed from the right side of the exercise device) around the first seat rail axle 968 and the first bottom rail axle 972. As described above, the movement of the second end portion 976 of the bottom rail 970 with respect to the second end portion 892 of the seat rail 888 causes the forward bench support to pivot counterclockwise (as viewed from the right side of the exercise device) around the second seat rail axle 1008. As the forward bench support pivots counterclockwise around the second seat rail axle, the lower regions 1016 of the support members 984, 986 and the cross member 980 move toward the bottom rail 970. In addition, the pop-pin 1018 connected with the left support member 986 moves toward the bottom rail 970 until the pop-pin 1018 is aligned with and engaged with the second aperture 1036 in the left extension plate 1022, locking the bench frame in the upright position.

FIG. 22G shows the bench frame 882 locked in the upright position with the pop-pin 1018 engaged with the second aperture 1036 in the left extension plate 1022. When the pop-pin is engaged with the second aperture in the left extension plate, the left support member 986 of the forward bench support 880 is connected with the bottom rail 970 through the left extension plate 1022 as well as the second bottom rail axle 1010. As such, the left support member 986 is selectively locked into a fixed position relative to the bottom rail 970, which in turn, prevents the forward bench support 880 from pivoting about the second seat rail axle 1008. As described above, relative movement between the second seat rail axle and the second bottom rail axle when placing the bench frame in the downward position causes the forward bench support to pivot clockwise (as viewed from the right side of the exercise device) around the second seat rail axle. However, when the pop-pin 1018 is engaged with the second aperture 1036, the forward bench support 880 is prevented from pivoting around the second seat rail axle. Therefore, the bench frame is locked in the upright position when the pop-pin is received within the second aperture.

From the storage position of FIG. 22G, when placing the bench frame 880 in the operative position shown in FIG. 22B, the pop-pin 1018 is disengaged from the second aperture 1036 of the left extension plate 1022. The second end portions of the seat rail 888 and bottom rail 970 are then moved downward and are pivoted counterclockwise (as viewed from the right side of the exercise device) around the first seat rail axle 968 and the first bottom rail axle 972. As described above, the movement of the second end portion 976 of the bottom rail 970 with respect to the second end portion 892 of the seat rail 888 causes the second bottom rail axle 976 to push on the mid regions 1014 of the support members 984, 986, which in turn, causes the forward bench support 880 to pivot clockwise (as viewed from the right side of the exercise device) around the second seat rail axle 1008. As the support members pivot clockwise around the second seat rail axle, the lower regions 1016 of the support members 984, 986 and the cross member 980 move away from the bottom rail 970. In addition, the pop-pin 1018 connected with the left support member 986 moves away from the bottom rail until the pop-pin is aligned with and engaged with the first aperture 1034 in the left extension plate 1022, locking the bench frame in the downward position.

Figure 25A:
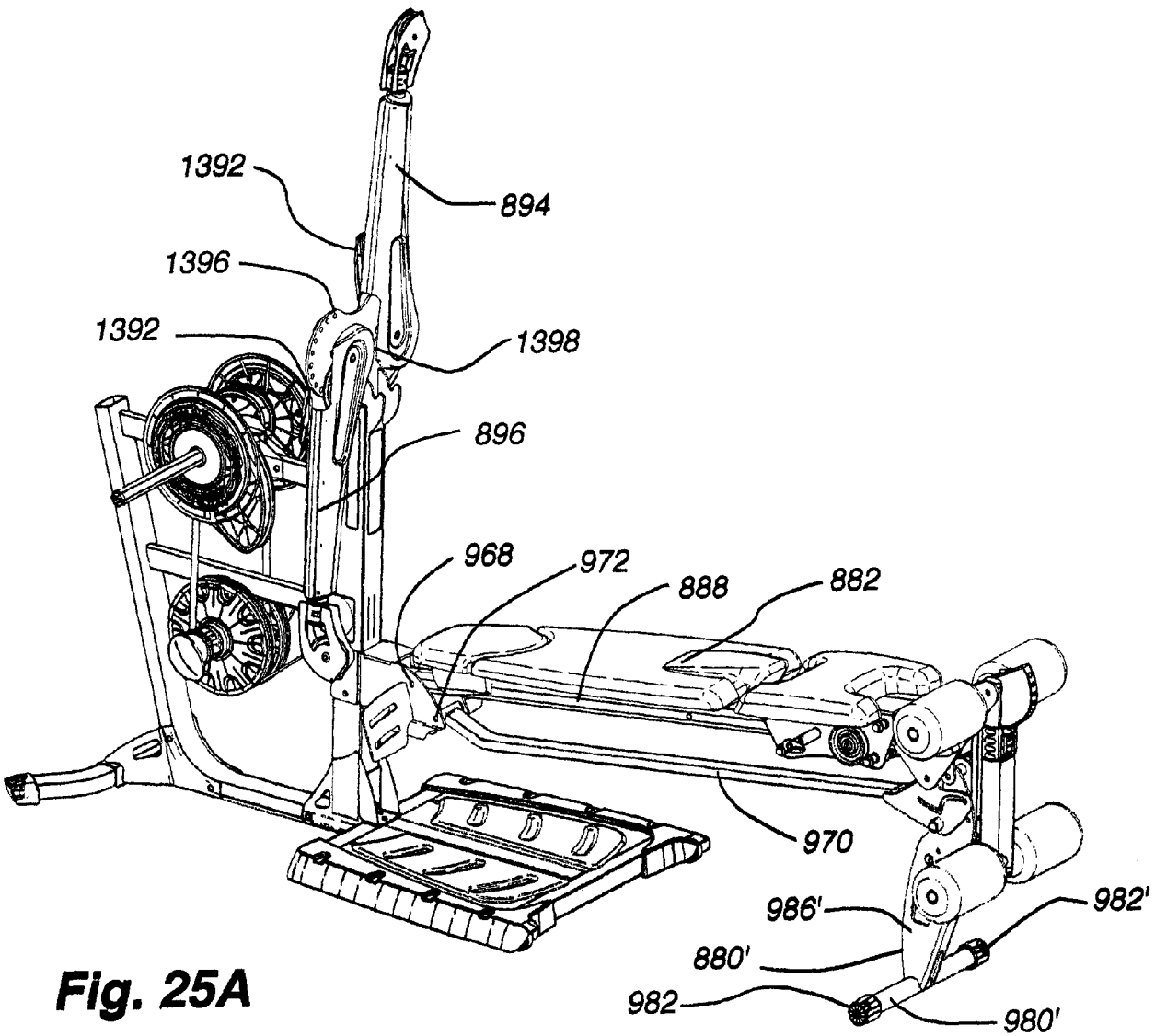
FIG. 25A is an isometric view of the second exercise device with an alternative embodiment of a forward bench support.
Figure 25B:
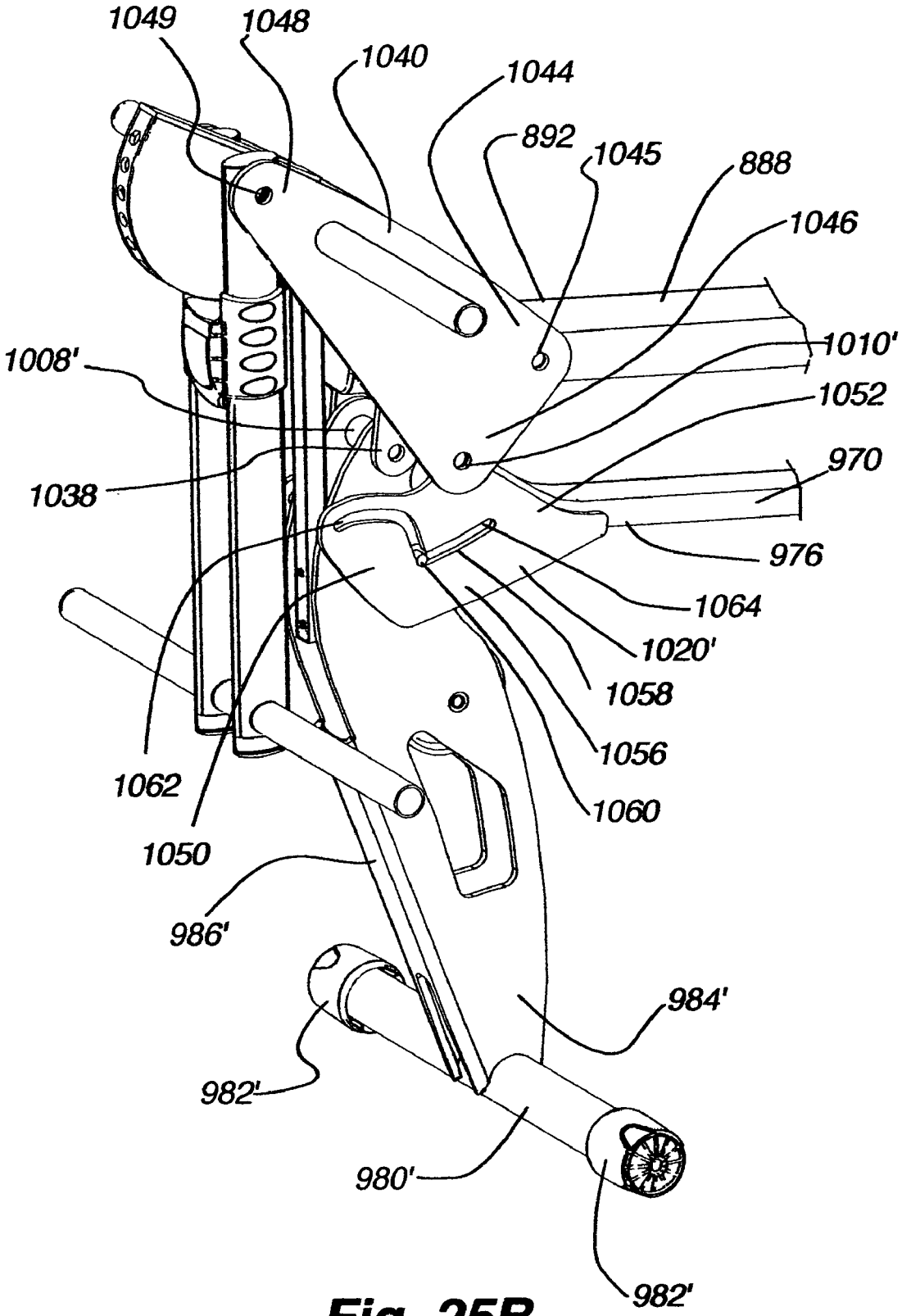
FIG. 25B is a right side detailed view of the alternative forward bench support.
Figure 25C:
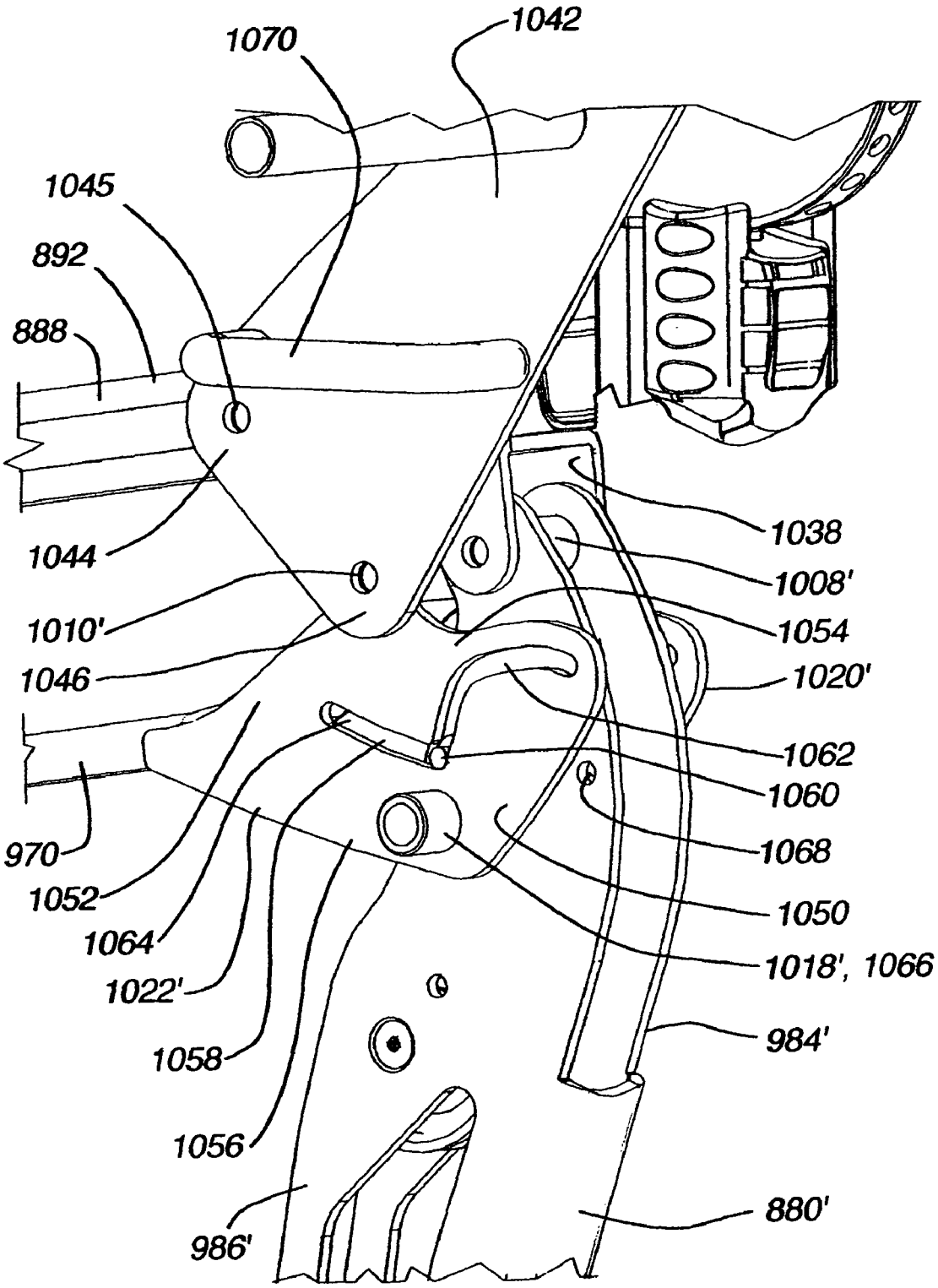
FIG. 25C is a left side detailed view of the alternative forward bench support.
Figure 25D:
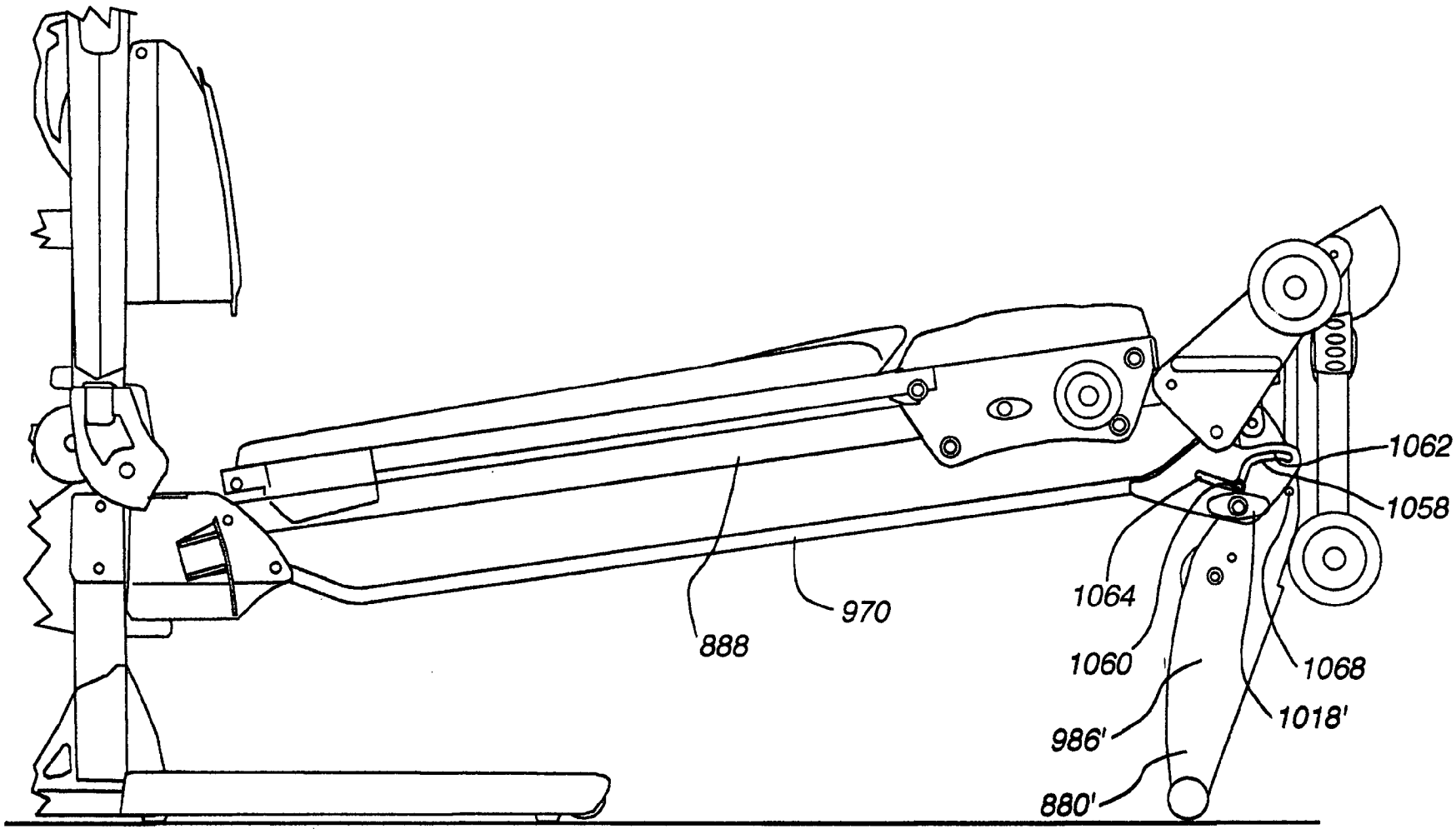
FIG. 25D is a left side view of the second exercise device with the alternative embodiment of the forward bench support.
Figure 25E:
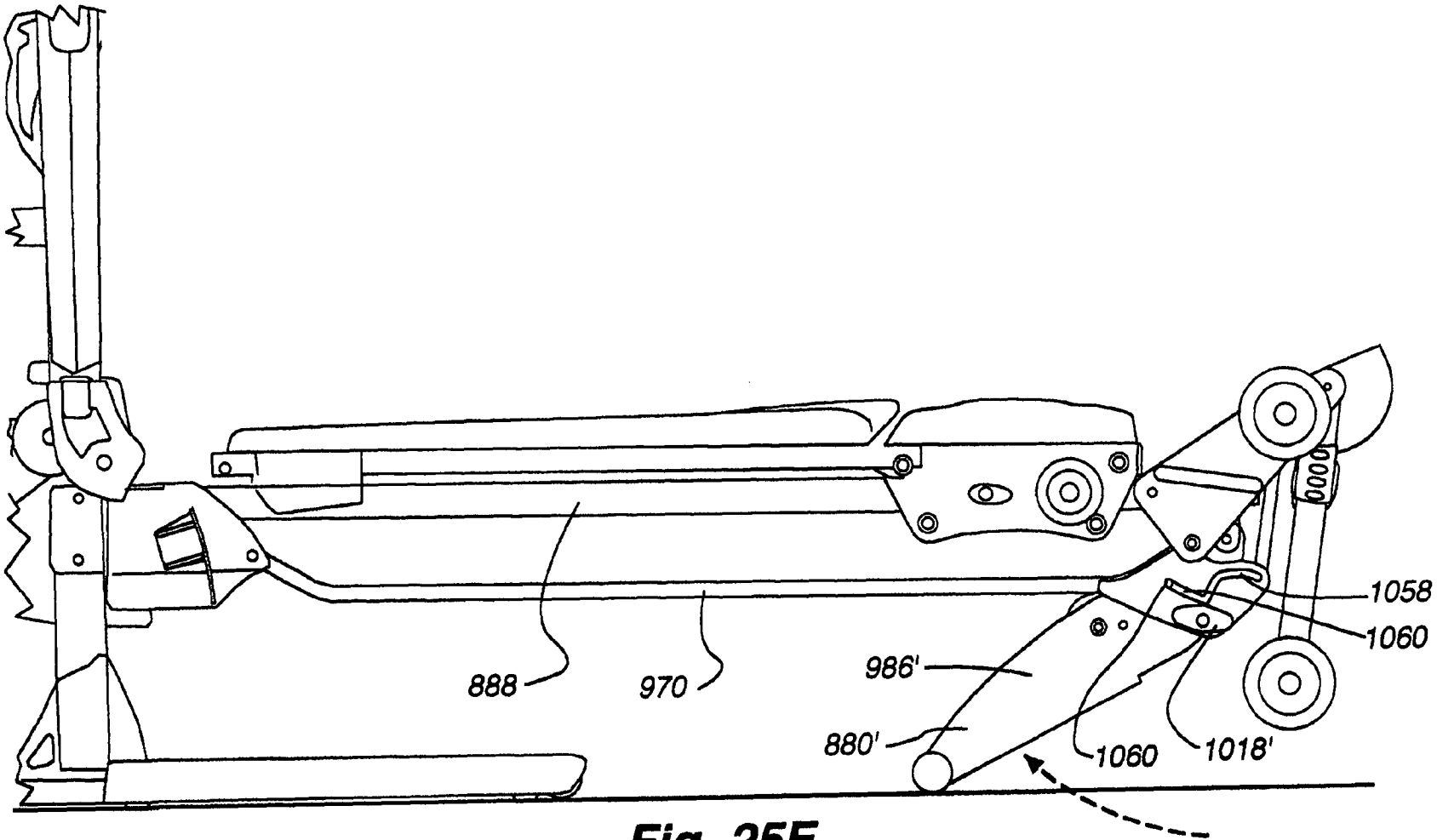
FIG. 25E is a left side view of the second exercise device with the alternative embodiment of the forward bench support pivoted in a rearward direction.
Figure 25F:
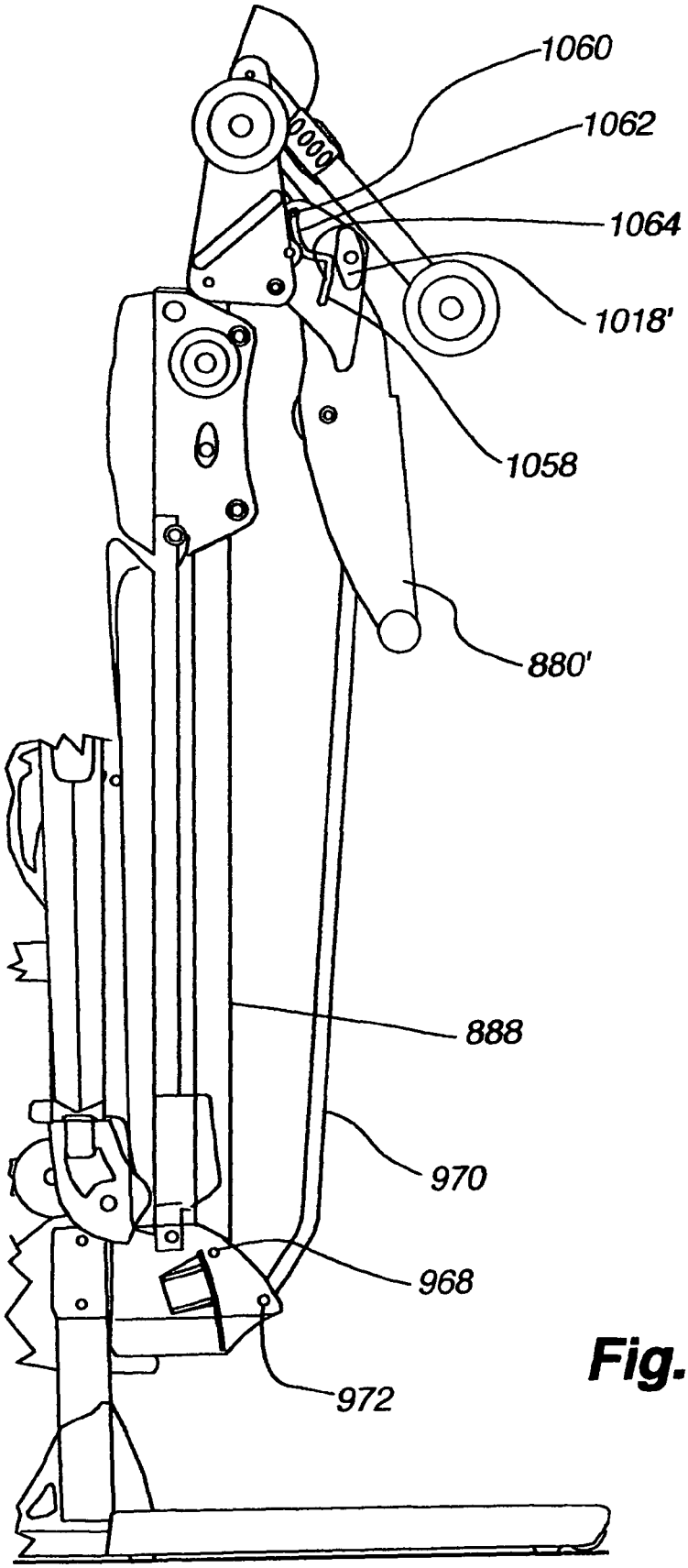
FIG. 25F is a left side view of the second exercise device with the alternative embodiment of the forward bench support pivoted in a storage configuration.

An alternative embodiment of a forward bench support 880' is shown in FIGS. 25A-25C. As with the forward bench support 880 described above, the forward bench support 880' automatically folds inward toward the seat rail 970 and bottom rail 888 when placing the bench frame 882 in the storage configuration. However, the forward bench support 880' shown in FIGS. 25A-25C also provides for selective adjustment of the seat rail incline. The forward bench support is pivotally connected with and adjustably supports the second end portion 892 of the seat rail 888 above the support surface. The forward bench support 880' includes a cross member 980' having a pair of end caps 982' at opposing end portions thereof adapted to engage the support surface. Right and left support members 984', 986' extending upward from the cross member 980' include apertures adapted to receive opposing end portions of a second seat rail axle 1008'. The second seat rail axle 1008', in turn, is supported by an axle support member 1038 extending downward from the second end portion 892 of the seat rail 888.

As shown in FIGS. 25A-25C, the second end portion 892 of the seat rail 888 is connected with the second end portion 976 of the bottom rail 970 through right and left pivot plates 1040, 1042. The pivot plates are generally triangularly-shaped, defining a first corner region 1044, a second corner region 1046, and a third corner region 1048. The first corner regions 1044 of the pivot plates 1040, 1042 are pivotally connected with opposing end portions of a first corner pivot axle 1045. The second corner regions 1046 of the pivot plates are adjacent to right and left extension plates 1020', 1022' connected with the second end portion 976 of the bottom rail 970 and are pivotally connected with opposing end portions of a second bottom rail axle 1010'. As discussed in more detail below, a leg developer assembly can also be pivotally connected with the third corner regions of the pivot plates through a third pivot axle.

As previously mentioned, the right and left extension plates 1020', 1022' connect the second end portion 976 of the bottom rail 970 with the forward bench support 880', and more particularly, with the right and left support members 984', 986', respectively. As shown in FIGS. 25B and 25C the right and left extension plates 1020', 1022' are substantially mirror images of each other, each plate defining a forward side region 1050, a rear side region 1052, a top side region 1054, and a bottom side region 1056. Each plate includes a slot 1058 adapted to receive a pin 1060 extending outward from each support member 984', 986'. The slot 1058 includes an arcuate upper portion 1062 and an arcuate lower portion 1064. The lower portion 1064 of the slot 1058 generally extends from the rear side region 1052 of the extension plate to the forward side region 1050. From a forward end of the lower portion of the slot, the upper portion 1062 of the slot 1058 extends upward toward the top side region 1054 of the extension plate and curves toward the forward side region 1050. A pop-pin 1018' supported on the left extension plate 1022' is adapted to engage a first aperture 1066 and a second aperture 1068 on the left support member 986' of the forward bench support 880'. As discussed in greater detail below, when the forward bench support is pivoted, either for different use configurations or for the storage position, the pop-pin is disengaged and when the bench is pivoted, the pins 1060 move along the slots 1058.

The forward bench support 880' of FIGS. 25A-25C can be pivoted around the second seat rail axle 1008' to adjust the height and level of the seat rail 888. In a configuration where the seat rail 888 inclines from the first end portion 890 to the second end portion 892, the pop-pin 1018' on the left extension plate 1022' is engaged with the first aperture 1066 in the left support member 986'. In addition, the pins 1060 extending from the right and left support members 984', 986' are generally located where the upper and lower portions 1062, 1064 of the slots 1058 intersect. To lower the elevation of the second end portion 892 of the seat rail 888, the pop-pin 1018' is disengaged from the first aperture 1066, and the forward bench support 880' is pivoted rearwardly around the second seat rail axle 1008' until the pop-pin 1018' engages the second aperture 1068. As the forward bench support pivots rearwardly, the pins 1060 extending from the right and left support members 984', 986' move rearward along the lower portions 1064 of the slots 1058 in the extension plates 1020', 1022'.

As previously mentioned, the bench frame 882 having the forward bench support 880' of FIGS. 25A-25C can also be placed in a storage configuration with the seat rail 888 rotated upward toward the frame 862 until the seat rail is substantially vertical with respect to the support surface. The seat rail 888 can also be selectively locked in the storage position. To place the bench frame 882 in the storage configuration, the pop-pin 1018' on the left extension plate 1022' is disengaged from either the first aperture 1066 or second aperture 1068. If the forward bench support 880' is in a rearward pivotal position, the forward bench support is first pivoted around the second seat rail axle 1008' to place the pins 1060 extending from the right and left support members 984', 986' near the intersection of the upper and lower portions 1062, 1064 of the respective slots 1058. The second end portion 892 of the seat rail 888 is then lifted upward so the seat rail and bottom rail 970 pivot clockwise (as viewed from the right side of the exercise device) around the first seat rail axle 968 and the first bottom rail axle 972, respectively. Handles 1070 connected with the right and left pivot plates 1040, 1042 can be used to lift the second end portion of the seat rail.

As the second end portion 892 of the seat rail 888 pivots upward, the bottom rail 970 acts on the pivot plates 1040, 1042 to fold the forward bench support 880' inward and upward toward the bottom rail 970. As discussed above, the second end portions of the seat rail 888 and the bottom rail 970 move along arcs that are not parallel as the bottom rail and seat rail pivot clockwise around the first seat rail axle and the first bottom rail axle. As such, the second end portion 976 of the bottom rail 970 moves rearward and downward relative to the second end portion 892 of the seat rail 888. The relative movement of the second end portions of the bottom rail and seat rail causes the second bottom rail axle 1010' to pull on the second corner regions 1046 of the pivot plates 1040, 1042, which in turn, causes the pivot plates to pivot counterclockwise (as viewed from the right side of the exercise device) around the first corner pivot axle 1045. Rotation of the pivot plates counterclockwise around the first corner pivot axle also moves the third corner regions 1048 of the pivot plates into general alignment with the seat rail. Further, as the pivot plates pivot counterclockwise around the second seat rail axle, the pins 1060 extending from the right and left support members 984', 986' move upward and forward along the upper portions 1062 of the slots in the extension plates 1020', 1022', which guides the forward bench support pivotal motion counterclockwise (as viewed from the right side of the exercise device) around the first corner pivot axle 1045 until the pop-pin 1018' engages the second aperture 1068, which locks the seat rail 888 into the storage configuration.

Figure 26A:
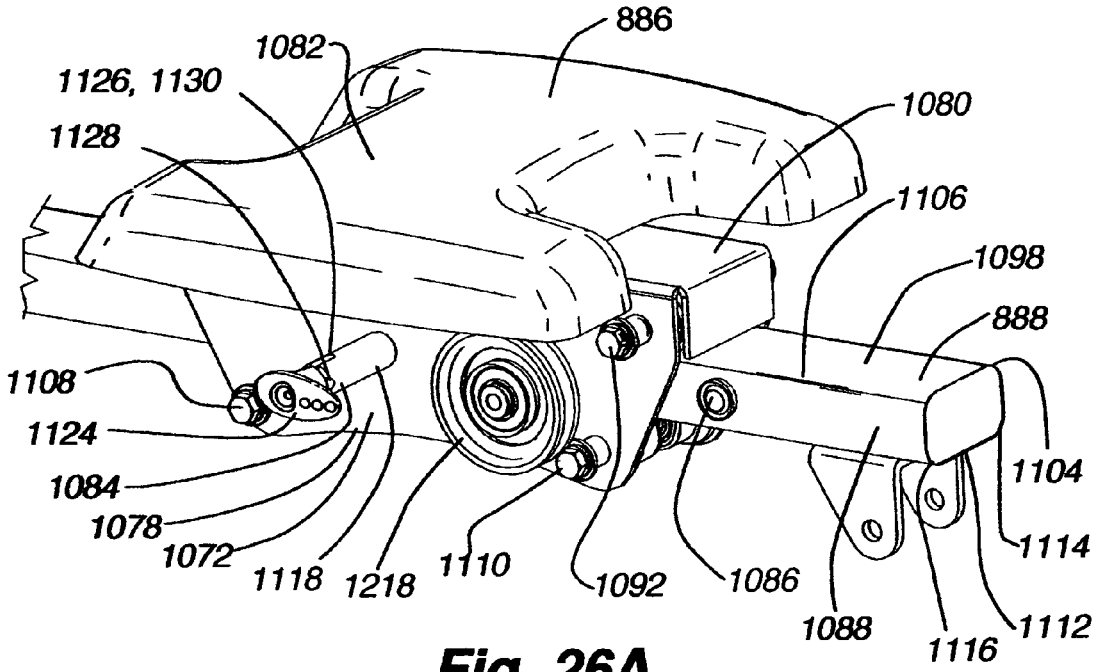
FIG. 26A is a detailed view of a bench seat and seat rail.
Figure 26B:
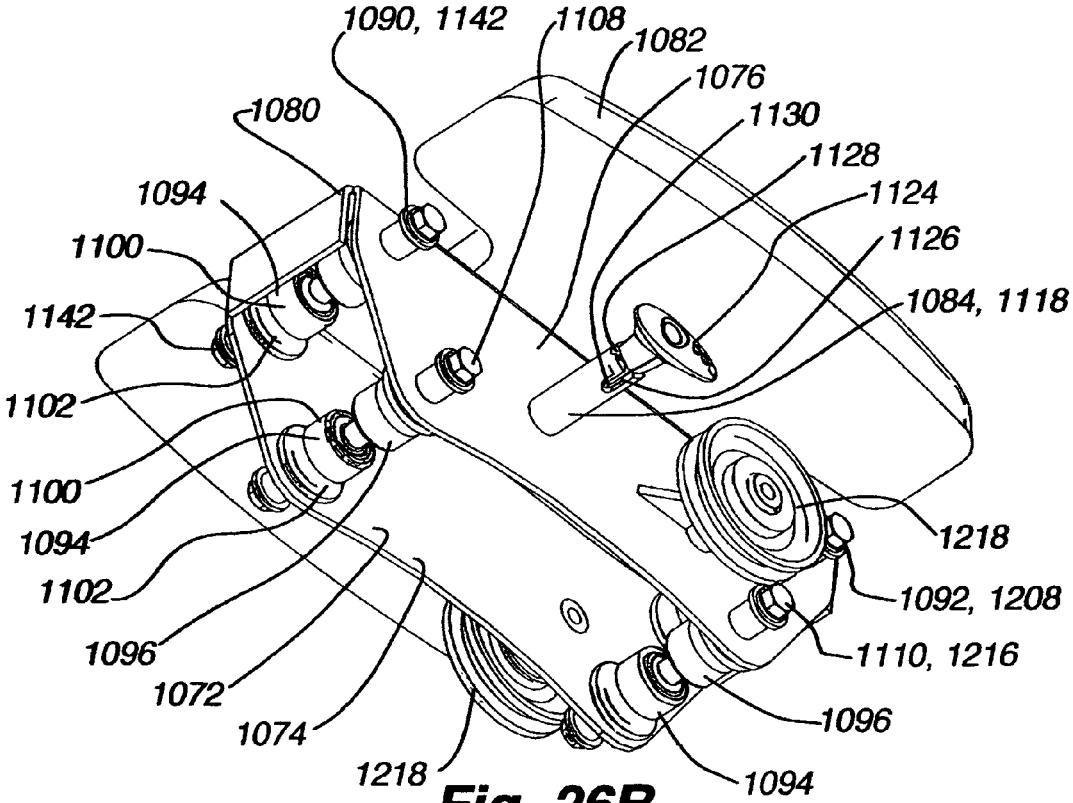
FIG. 26B is a detailed bottom view of the bench seat of FIG. 26A.

As previously mentioned, the bench seat 886 of the exercise device 858 of FIGS. 22A-22G is adjustably connected with the bench frame 882. As shown in FIGS. 26A-26B and others, the bench seat is connected with the seat rail 888 through a wheel car assembly 1072 that allows a user roll the bench seat 886 back and forth along the length of the seat rail 888. The wheel car assembly 1072 of FIGS. 26A-26B is different than the wheel car assembly described above with reference to the first embodiments of the exercise device. The wheel car assembly 1072 includes a main body 1074 defined by right and left sides 1076, 1078 connected with and separated by a top side 1080. The top side 1080 supports a padded portion 1082 of the bench seat 886. A bench seat pop-pin 1084 is supported on the left side 1078 of the wheel car assembly 1072 and is adapted to engage apertures 1086 on a left side 1088 of the seat rail 888. As described in more detail below, a user can selectively fix the bench seat in a desired location along the length of the seat rail and can also configure the bench seat pop-pin, so the bench seat can freely roll back and forth along the length of the seat rail.

As shown in FIGS. 26A and 26B, the wheel car assembly 1072 includes a forward upper axle 1090 and a rear upper axle 1092 are connected with and extend through the right and left sides 1076, 1078 adjacent the top side 1080 of the main body 1074. The upper axles 1090, 1092 each support left and right rollers 1094, 1096 adapted to roll along a top side 1098 of the seat rail 888. Each roller includes a cylindrical portion 1100 and a ledged portion 1102. The cylindrical portion 1100 defines a constant radius flat rolling surface adapted to engage the top side 1098 of the seat rail 888. The ledged portion 1102 defines an increasing radius rolling surface adapted to engage upper right and left corner regions 1104, 1106 of the seat rail 888. The ledged portions 1102 of the rollers act as thrust bearings to absorb forces exerted on the bench seat 886 that have a sideway component perpendicular to the length seat rail 888. As such, the ledged portions of the rollers help to keep the wheel car assembly aligned with the seat rail as it rolls back and forth along the length of the seat rail.

As shown in FIGS. 26A and 26B, the wheel car assembly 1072 also includes a forward lower axle 1108 and rear lower axle 1110 connected with and extending through the right and left sides 1076, 1078 of the main body 1074 below the upper axles 1090, 1092. The lower axles each support left and right rollers 1094', 1096' adapted to roll along a bottom side 1112 of the seat rail 888. Similar to the rollers connected with the upper axles, each roller supported by the lower axles include cylindrical portions 1100' and ledged portions 1102'. The cylindrical portion defines a flat rolling surface adapted to engage the bottom side 1112 of the seat rail 888, and the ledged portion defines an increasing radius (inside to outer edge) rolling surface adapted to engage lower right and left corner regions 1114, 1116 of the seat rail 888. The combination of the rollers engaging the top and bottom sides of the seat rail act prevent the bench seat 886 from tipping forward or backward or otherwise disengaging from the seat rail 888.

As previously mentioned, the bench seat 886 can be configured to either roll freely along the length of the seat rail 888, or can be selectively locked into various positions along the length of the seat rail. More particularly, the bench seat pop-pin 1084 on the left side 1072 of the wheel car assembly 1072 is adapted to selectively engage apertures 1086 in the left side 1088 the seat rail 888 to selectively lock the bench seat 886 into a desired positioned along the length of the seat rail. For example, the bench seat pop-pin can be disengaged from an aperture on the seat rail, which allows the bench seat to roll backward or forward to a desired position along the length of the seat rail. Once the bench seat is rolled to a desired location along the seat rail, the bench seat pop-pin be engaged with another aperture in the seat rail to lock the bench seat into the desired position.

As shown in FIGS. 26A and 26B, the bench seat pop-pin 1084 is spring-loaded and includes a body 118 housing a spring operably connected with a pin. The spring acts to force the pin to engage the pop-pin 1084 with the left side 1088 of the seat rail 888. The pop-pin 1084 can be disengaged from the seat rail 888 by pulling on a handle 1124 connected with the pin in a direction away from the left side 1088 of the seat rail 888. When moving the bench seat 886 from a first location to a second along the seat rail, a user can pull the handle 1124 to disengage the pop-pin 1084 from the seat rail 888. While holding the pop-pin in disengagement from the seat rail, the bench seat 886 can be rolled to the second location. Once the bench seat is in the second location, the handle 1124 can be released, which allows the spring to force the pop-pin 1084 back into engagement with the seat rail 888. If the pop-pin 1084 is aligned with one of the apertures 1086 in the left side 1088 of the seat rail 888, the pin will extend into one of the apertures, locking the bench seat 886 into the second position. If the pop-pin 1084 is not aligned with one of the apertures 1086, the pin will be forced against the left side 1088 of the seat rail 888. The bench seat 886 can then be rolled backward and forward until the pop-pin is aligned with and engages one of the apertures.

As previously mentioned, the bench seat 886 can also be configured to roll freely along the seat rail 888. More particularly, the bench seat pop-pin 1084 can be selectively configured to disable the spring-loaded feature so the pop-pin does not engage the left side 1088 of the seat rail 888. As shown in FIGS. 26A and 26B, the body 1118 of the bench seat pop-pin 1084 includes a first pair of channels 1126 and a second pair of channels 1128 extending inward from a distal end portion of the body 1118. The channels 1126, 1128 are adapted to receive opposing end portions of a shaft 1130 extending through the pop-pin. As such, the channels act to limit the distance that the pin 1122 can extend from the body 1118 toward the seat rail 888. A user can align the shaft 1130 with either pair of channels by pulling the handle 1124 outward from the body 1118 and turning the handle to align the shaft with the desired pair of channels. As shown in FIGS. 26A and 26B, when the shaft 1130 is aligned to be received within the first pair of channels 1126, the pin can extend far enough toward the seat rail 888 to engage one of the apertures, which prevents the bench seat 886 from freely rolling along the seat rail 888. The second pair of channels 1128 are shorter than the first pair of channels 1126. As such, when the shaft is received within the second pair of channels 1128, the pin does not extend far enough from the body to engage the seat rail 888. Therefore, when the shaft is received within the second pair of channels 1128, the bench seat 886 can freely roll back and forth along the seat rail 888 without the spring forcing the pop-pin into engagement with the left side 1088 of the seat rail 888 and into one of the apertures 1086.

Figures 27A, 27B:
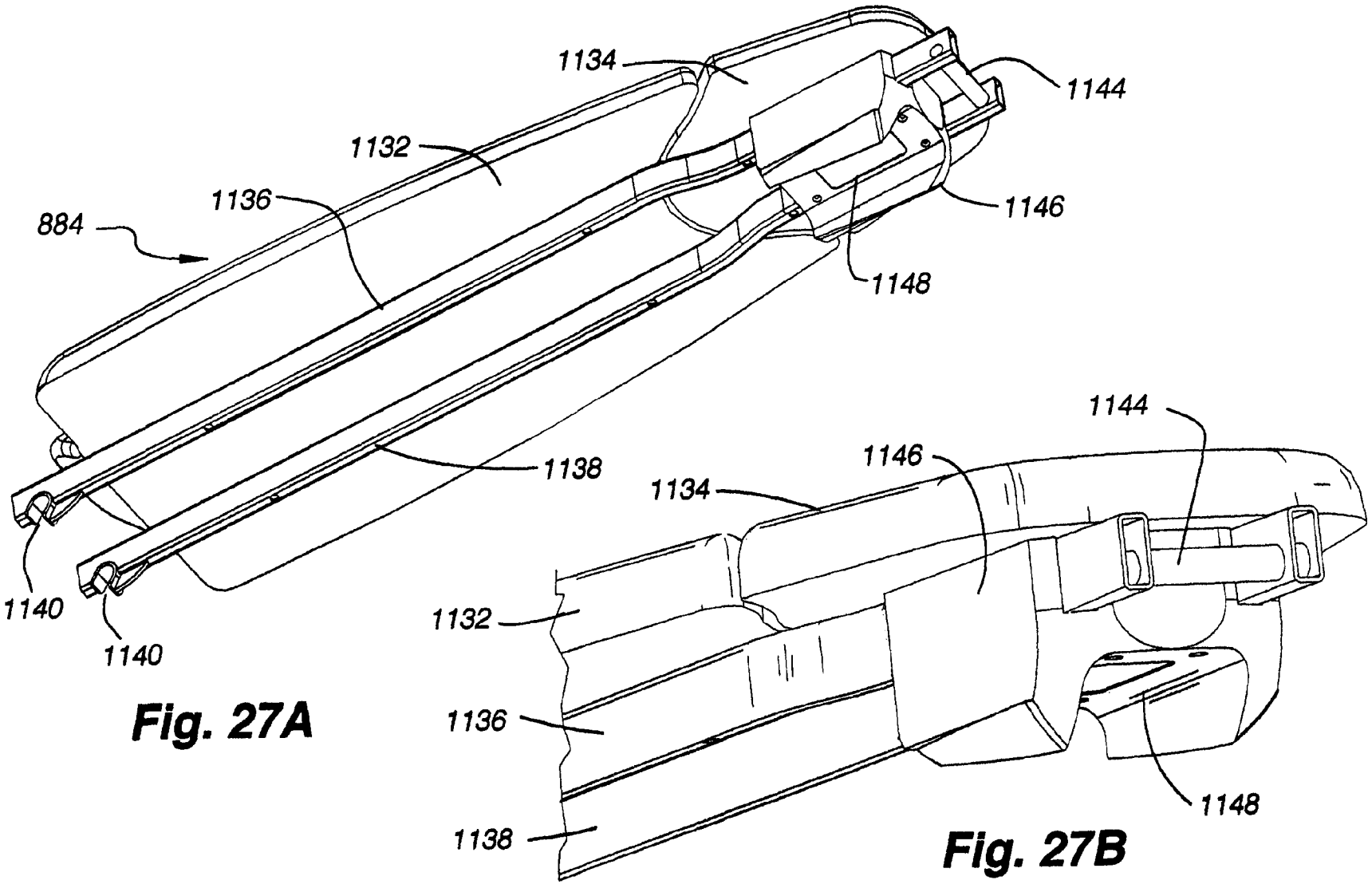
FIG. 27A is detailed view of a back support.
FIG. 27B is a detailed view of a rear end portion of a back support.

As previously mentioned, the back support 884 of the bench assembly 860 is adjustable and removable. More particularly, the back support 884 is adapted to selectively connect with bench seat 886, seat rail 888, and the arm support member 944. As shown in FIGS. 27A, 27B, and others, the back support 884 includes forward and rear padded portions 1132, 1134 mounted on right and left back support rails 1136, 1138. Forward end portions of the back support rails each define bench seat hooks 1140 adapted to receive extended end portions 1142 of the forward upper axle 1090 extending outward from the right and left sides 1076, 1078 of the wheel car assembly 1072 (see FIG. 26B). Rear end portions of the back support rails 1136, 1138 are connected with opposing end portions of a back support handle 1144. As shown in FIGS. 27A and 27B, the rear padded portion 1134 of the back support 884 is further supported by a back support member 1146. The back support member 1146 defines a U-shaped channel 1148 adapted to fit over the seat rail 888.

Referring to FIGS. 22C, 27A, and 27B, the bench seat 886 and the back support 884 can be connected together on top of the seat rail 888 to form a flat bench 1150. To form the flat bench, the bench seat 886 is locked in position near the second end portion 892 of the seat rail 888 and the bench seat hooks 1140 on the back support are connected with the extended portions 1142 of the forward upper axle 1090 on the bench seat 886. The U-shaped channel 1148 in the back support member 1146 is positioned over the seat rail 888. Because the U-shaped channel engages opposing sides of the seat rail 888, the back support member 1146 adds lateral stability to the back support which helps prevent the back support from tipping side-to-side on the seat rail. As shown in FIGS. 22D, 23A, and 23B, the back support 884 can also be connected between the bench seat 886 and hook brackets 1152 on the arm support member 944 such that the back support is inclined relative to the bench seat. The hook brackets 1152 are connected with and extend forward from the front side of the arm support member. Upper portions of the hook brackets are recessed to defined arcuate channels 1154 adapted to receive and support the back support handle 1144. In the inclined position, the bench seat 886 is locked in a position between the second end portion 890 and first end portion 892 of the seat rail 888. The bench seat hooks 1140 on the back support 884 are connected with the extended portions 1142 of the forward upper axle 1090 on the bench seat 886, and the back support handle 1144 is supported by the hook brackets 1152 connected with the arm support member 944.

As shown in FIGS. 22E, 28A-28C, and others, the exercise device 858 can also include a removable foot plate assembly 1156 adapted to connect with the arm support member 944. The removable foot plate assembly may be used to perform various exercises, such as squat exercises. The removable foot plate assembly 1156 includes a foot plate 1158 connected with a frame 1160 having right and left sides 1162, 1164 connected with and separated by a center member 1166. The center member 1166 is generally U-shaped with first and second sides 1168, 1170 connected with and separated by a base side 1172. The right and left sides 1162, 1164 of the frame 1160 are defined by a first portion 1174 angularly offset from a second portion 1176. The first portions 1174 of the right and left sides 1162, 1164 are connected with the first and second sides 1168, 1170 of the center member 1166 such that first portions extend rearward from the base side 1172 of the center member 1166, defining a rear U-shaped channel 1178 adapted to receive the arm support member 944. The foot plate 1158 is connected with forward extending edges of the second portions 1176 of the right and left sides 1162, 1164 as well as forward extending edges of the first and second sides 1168, 1170 of the center member 1166. The foot plate defines a curved shape, and as such, the forward extending edges of the frame correspondingly curve to connect with the foot plate. The removable foot plate assembly also includes right and left foot pads 1180, 1182 connected with the foot plate.

Figure 28A:
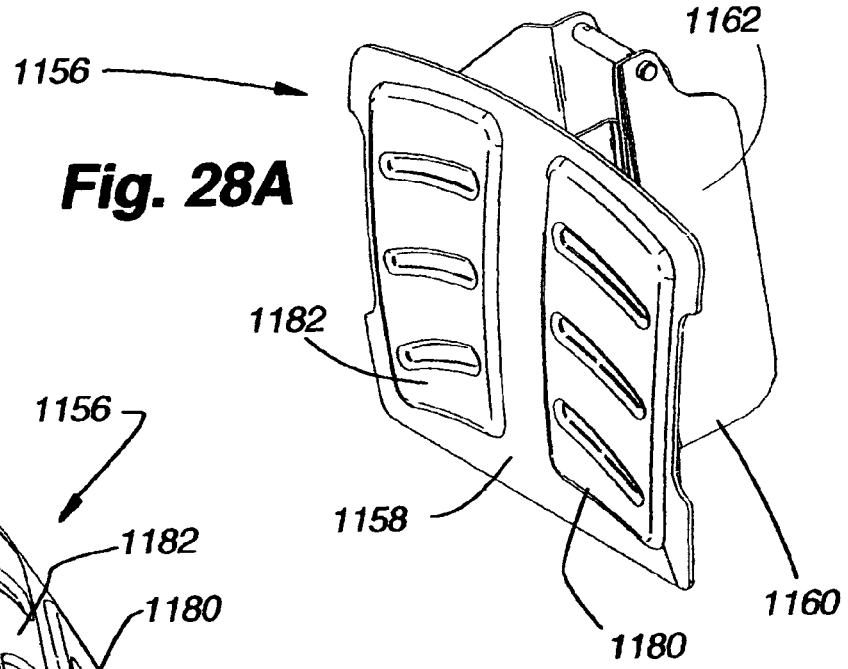
FIG. 28A is a front right isometric view of a removable foot plate assembly.
Figure 28B:
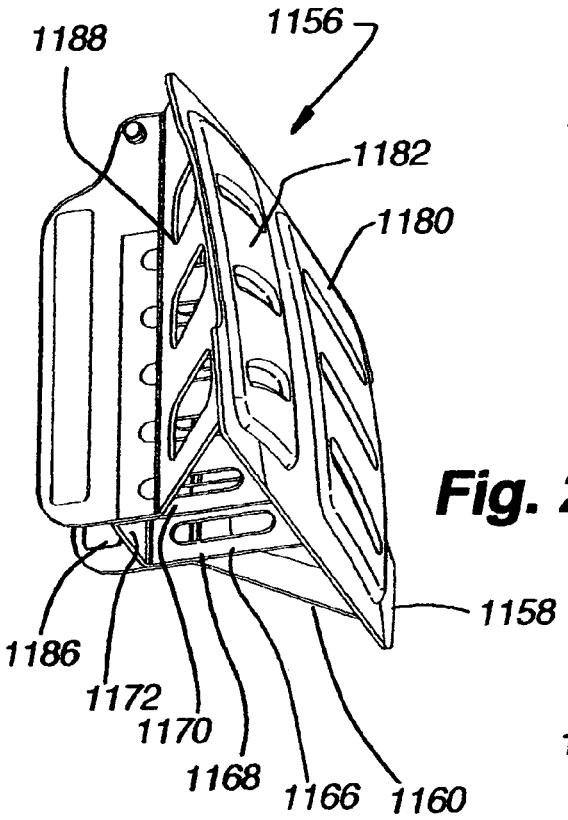
FIG. 28B is a front left isometric view of the removable foot plate assembly.
Figure 28C:
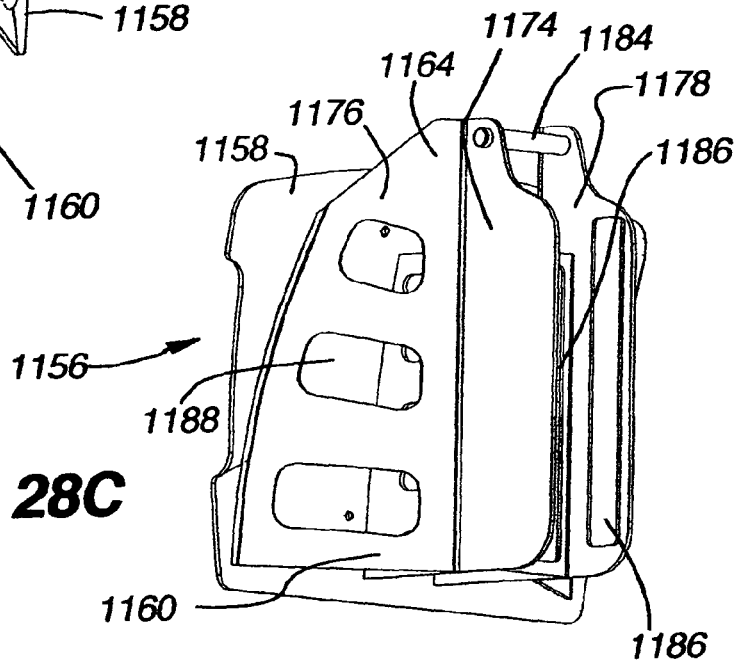
FIG. 28C is a rear right isometric view of the removable foot plate assembly.

As shown in FIGS. 28A-28C, the removable foot plate assembly 1156 also includes a handle bar 1184 extending between the right and left sides 1162, 1164 of the frame 1160 near a top end portion of the U-shaped channel 1178. When connected with the exercise device 858, the removable foot plate assembly 1156 is supported from the handle bar 1184, which is received in the arcuate channels 1154 of the hook brackets 1152 on the arm support member 944. The arm support member 944 is also received within the U-shaped channel 1178 on the rear side of the foot plate assembly 1156. The U-shaped channel engages opposing sides of the arm support member to provide lateral stability to the foot plate assembly, which helps prevent the foot plate assembly from tipping side-to-side on the arm support member. As shown in FIGS. 28B and 28C, padding 1186 can be connected with the U-shaped channel 1178 to help prevent the arm support member 944 being scratched or otherwise damaged from repeated removal and installation of the removable foot plate assembly. To reduce the weight of the foot plate assembly, material sections can be removed out from portions of the frame, forming a webbed structure 1188 in the second portions of the right and left sides.

As shown in FIGS. 22E, 29A, and 29B, the alternative exercise device 858 can include a removable leg press seat back 1190. The removable leg press seat back 1190 provides a surface against which a user can press with his back when sitting on the bench seat 886 while performing leg press exercises. As shown in FIGS. 29A and 29B, right and left rails 1192, 1194 extend downward from a back side 1196 of the removable leg press seat back. The right and left rails include upper hooks 1198 and lower hooks 1200 adapted to connect with the rear upper axle 1092 and the rear lower axle 1110, respectively, on the wheel car assembly 1072. Each upper hook 1198 defines an opening 1202 to an arcuate recess 1204 on a rear edge 1206 of the connection rail adapted to receive the extended end portions 1208 of the upper rear axle 1092. Each lower hook 1200 defines an opening 1210 to an arcuate recess 1212 on a bottom edge 1214 of the connection rail adapted to receive the extended end portions 1216 of the lower rear axle 1110. As such, when forces are applied to the seat back 1190 in a forward direction (direction A in FIG. 29A), the seat back is held in position relative to the bench seat 886 through the engagement of the upper hooks 1198 with the rear upper axle 1092 and the engagement of the lower hooks 1200 with the rear lower axle 1110. Because the hooks are located on bottom and rear edges of the right and left rails 1194, 1196, the seat back is prevented from pivoting about the upper rear axle 1092 in the clockwise direction (as viewed from the right side of the exercise device). As shown in FIGS. 29A and 29B, to disconnect the seat back 1190 from the bench seat 886, the seat back is pivoted counterclockwise (direction B in FIG. 29A) about the upper rear axle 1092, which disengages the upper hooks 1198 from the rear upper axle 1092. Once the upper hooks are disengage from the rear upper axle, the seat back can be lifted upward as shown in FIG. 29B to disengage the lower hooks 1200 from the rear lower axle 1110. It is to be appreciated that the removable seat back can also be connected with the forward axles 1090, 1108 on the bench seat to place a user in a forward facing direction, such as shown in FIG. 22F.

As previously mentioned, the removable seat back 1190 can be used while performing various exercises. However, the removable seat back is particularly useful when performing leg press exercises. Referring to FIG. 22E, when performing leg press exercises, a user sits on the bench seat 886 facing toward the arm support member 944 with his back against the removable seat back 1190. The user places his feet on the either the removable foot plate assembly 1156 or the lower foot plate assembly 954. With the bench seat pop-pin 1084 configured to allow the bench seat to roll freely back and forth along the seat rail 888, the user begins pressing against the foot plate with his legs to move the bench seat back and forth along the seat rail against a selected resistance.

As shown in FIGS. 26A-26B and 29A-29B, the bench seat 886 can include leg press pulleys 1218 rotatably connected with the right and left sides 1076, 1078 of the wheel car assembly 1072 that doubles the resistance exerted on the bench seat 886 from the resistance system. As shown in FIG. 29C, leg press cables 1220 are connected with resistance cables 1222 extending from arm assemblies 864. The leg press cables extend around each leg press pulley 1218 and connect with a cable adjustment mechanism 1224 connected with the bottom rail 970. As discussed below, the cable adjustment mechanism 1224 can be selectively locked into various positions along the length of the bottom rail 970 to adjust the leg press starting position. A portion of resistance cable 1222 extending from the arm assembly 864 to the leg press pulley 1218 defines a first cable length 1226, and a portion of resistance cable extending from the leg press pulley 1218 to the cable adjustment mechanism 1224 defines a second cable length 1228. In the illustrated configuration, the leg press pulleys 1218 act as floating pulleys coupled with the resistance system 868 through the first and second cable lengths 1226, 1228, effectively doubling the force exerted on the bench seat from the resistance system. Although the exercise device is illustrated herein with leg press cables, it is to be appreciated that other embodiments of the exercise device do not utilize leg press cables. For example, in other embodiments, the resistance cable is extended from the arm assembly, around the leg press pulley, and is connected with the cable adjustment mechanism. It should also be appreciated that the exercise device need not include the cable adjustment mechanism, and as such, can extend from the leg press pulley to a connection point on the main frame.

Figure 29C:
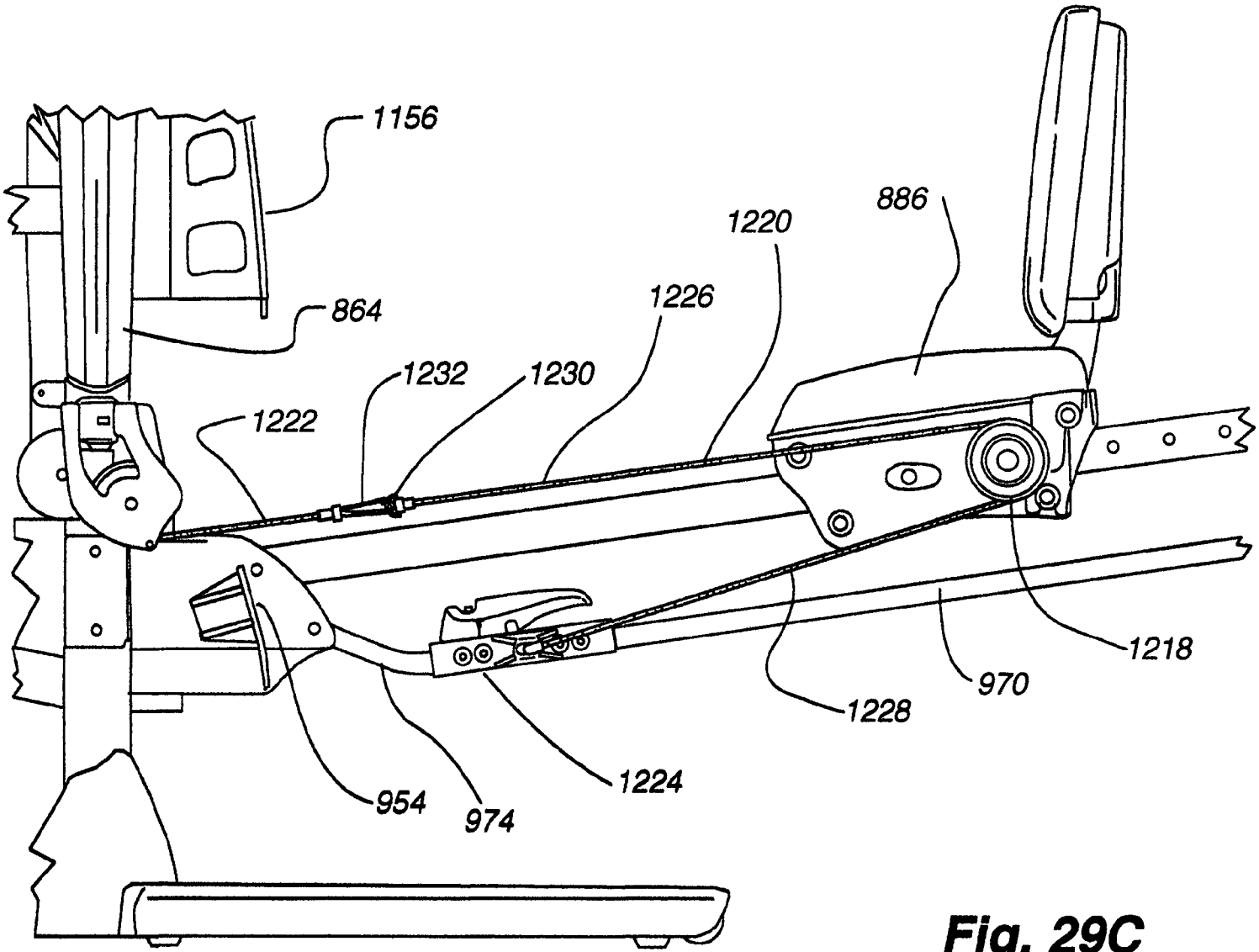
FIG. 29C is left side view of a resistance cable and seat pulley arrangement.
Figure 29D:
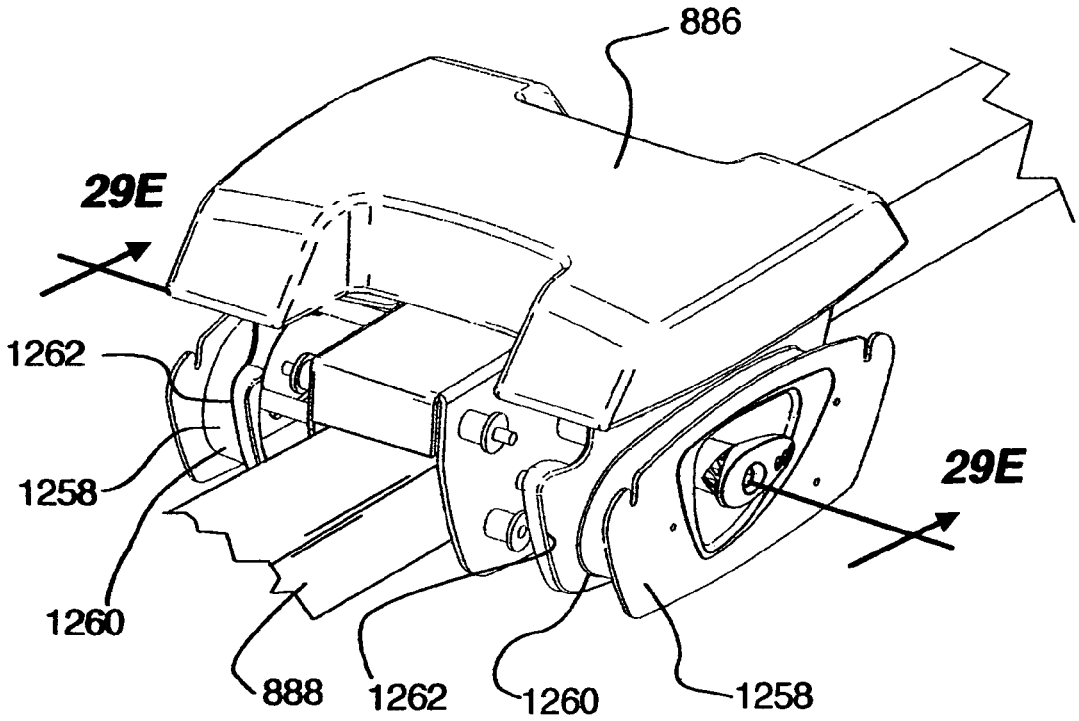
FIG. 29D is a detailed isometric view of a bench seat having cable storage housings.

As shown in FIG. 29C, a first end portion 1230 of the leg press cable 1220 is releasably connected with the resistance cable 1222 extending from the assembly 864 through a snap hook 1232. It is to be appreciated that the leg press cable 1220 can be connected with the resistance cable in various ways and should not be limited to that which is depicted and described herein. From the first end portion 1230, the leg press cable 1220 extends to and is wrapped partially around the leg press pulley 1218. From the leg press pulley, the leg press cable 1220 extends to a second end portion 1234 connected with the cable adjustment mechanism 1224. As shown in FIG. 29G, the cable adjustment mechanism 1224 includes a main body 1236 having a top side 1238 and a bottom side 1239 connected with and separating downwardly extending first and second sides 1240, 1242. Cable connection brackets 1244 extend outward from the first and second sides of the main body. The cable connection brackets 1244 each include an aperture 1246 to which the second end portion 1234 of the leg press cable 1220 can be releasably connected. It is to be appreciated that the second end portion of the leg press cable can be connected with the apertures in the main body in various ways. For example a hook connected with the second end portion of the leg press cable can be used to connect the leg press cable with the main body.

As previously mentioned, the main body 1236 of the cable adjustment mechanism 1224 is connected with the bottom rail 970 such that the main body can move back and forth along the length of the bottom rail 970. It is to be appreciated that, the main body 1236 can be configured to move along the bottom rail in various ways, such as by rolling or sliding. As shown in FIG. 29G, a spring-loaded pop-pin 1248 is supported on the top side 1238 of the main body 1238 of the cable adjustment mechanism 1224. The pop-pin is adapted to selectively engage apertures 1250 along a top side 1252 of the bottom rail 970. As such, cable adjustment mechanism 1224 can be selectively fixed in a desired location along the length of the bottom rail 970. A handle 1254 pivotally connected with the top side 1238 of the main body 1236 is connected with the pop-pin 1248 to allow a user to selective disengage the pop-pin from apertures 1250 in the bottom rail. More particularly, a user can disengage the pop-pin from the bottom rail 970 by pressing downward on an extended portion 1256 of the handle. With the pop-pin 1248 disengaged from the bottom rail, the main body can move in either direction along the length of the bottom rail.

As previously mentioned, the cable adjustment mechanism 1224 allows user to select a desired starting position when performing leg press exercises. With reference to the cable configuration shown in FIG. 29C, the closer the cable adjustment mechanism 1224 is positioned toward the first end portion 974 of the bottom rail 970, the closer the bench seat 886 must be located relative to the foot plate assemblies 954, 1156 without causing the resistance cables 1222 to pull on the resistance system 868. Conversely, the closer the cable adjustment mechanism is positioned toward the second end portion 976 of the bottom rail 970, the farther the bench seat can be moved away from the foot plates without causing the resistance cable to pull on the resistance system.

In one scenario, the cable adjustment mechanism 1224 shown in FIGS. 29C and 29G is positioned relatively close to the first end portion 974 of the bottom rail 970. As such, the first cable length 1226 dictates how far the bench seat 886 can be moved away from the foot plate assemblies 954, 1156 without causing the resistance cables 1222 to pull against and activate the resistance system 868. If a user desires a bench seat starting position located farther from the foot plates than what is shown in FIG. 29C, the user can press down on the extended portion 1256 of the handle 1254 on the cable adjustment mechanism 1224 to disengage the pop-pin 1248 from the bottom rail 970. With the pop-pin disengaged from the bottom rail, the user can move the main body 1236 of the cable adjustment mechanism 1224 along the bottom rail 970 away from the first end portion 974. As the main body is moved away from the first end portion of the bottom rail, the second cable length 1228 becomes shorter and the first cable length 1226 grows longer, allowing the bench seat 886 to move along the seat rail 888 further away from the foot plates without causing the resistance cable to pull against and activate the resistance system. Conversely, moving the cable adjustment mechanism back toward the first end portion 974 of the bottom rail 970 functions to lengthen the second cable length 1228 and shorten the first cable length 1226, which requires the bench seat 886 to be located closer to the foot plates without causing the resistance cables to pull against and activate the resistance system.

Figure 29E:
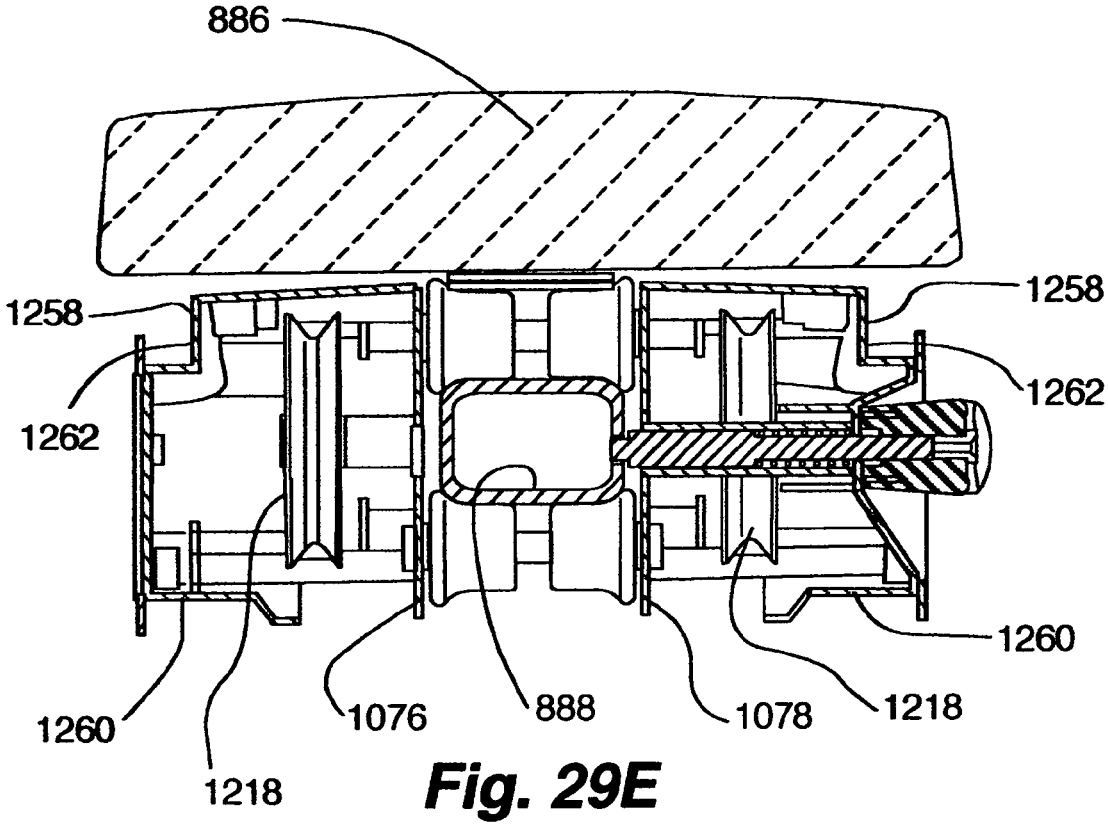
FIG. 29E is a is a cross-sectional view of the bench seat depicted in FIG. 29D, taken along line 29E-29E.
Figure 29F:
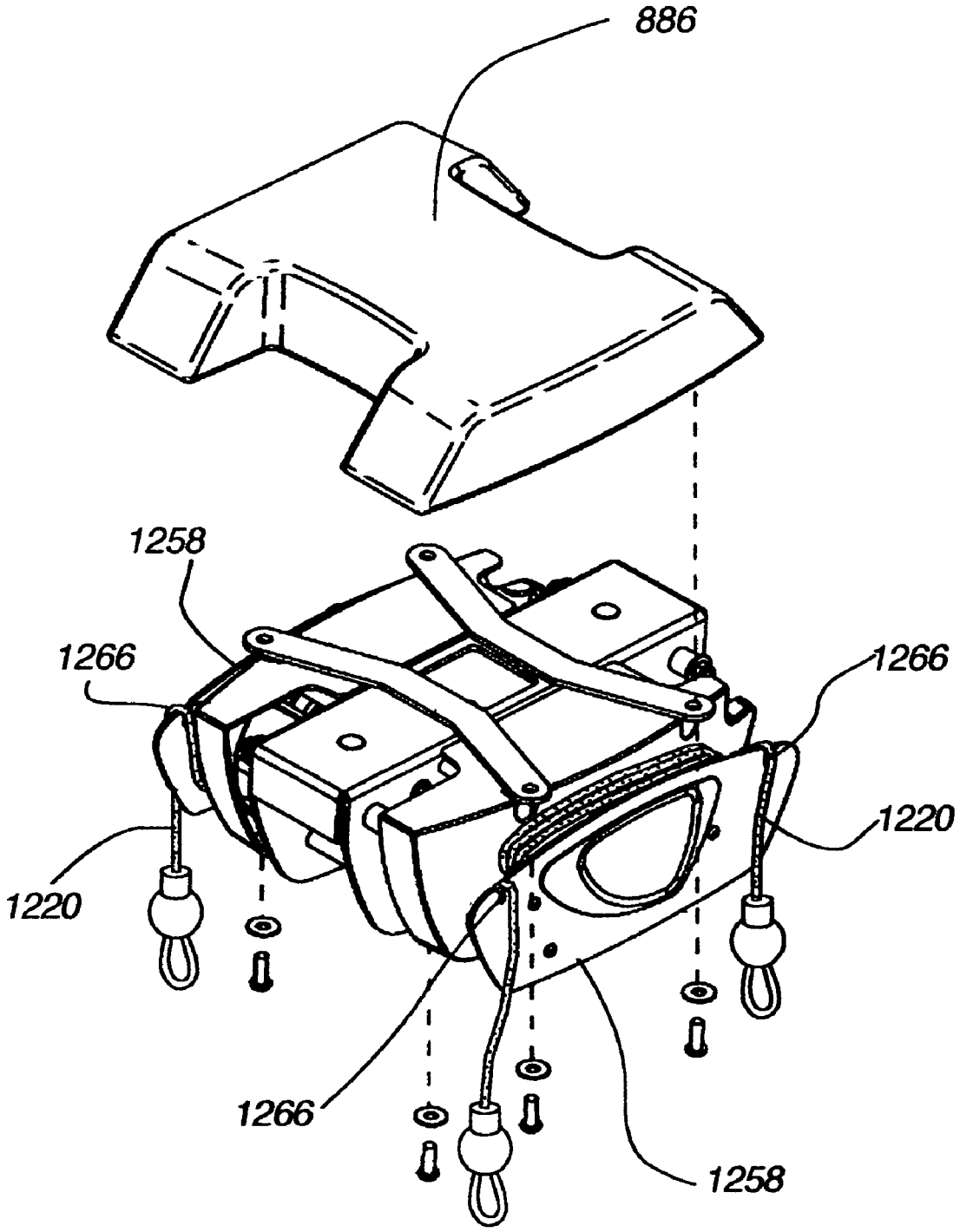
FIG. 29F is a detailed view of leg press cables in a stored configuration wrapped around cable storage housings on a bench seat.
Figure 29G:
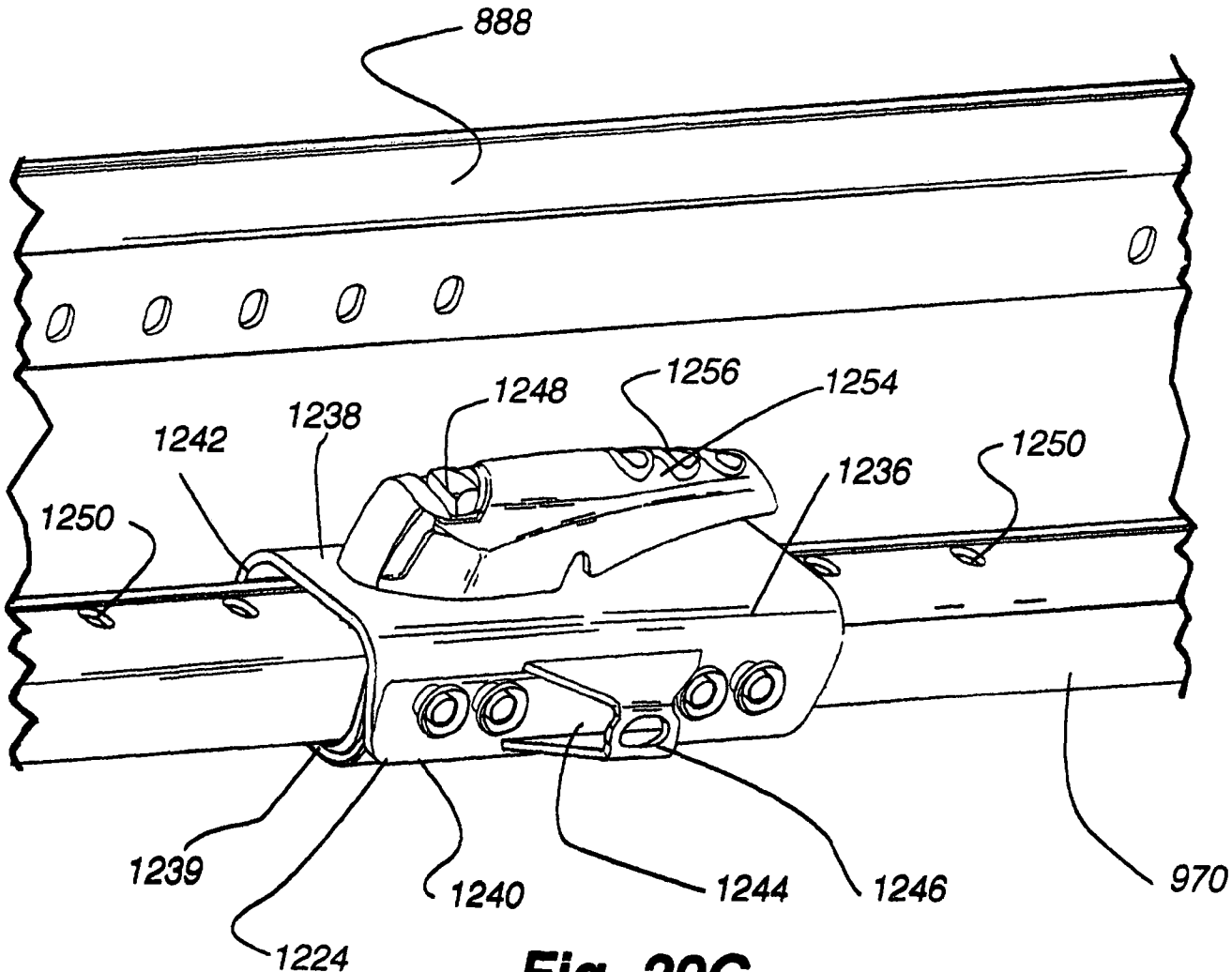
FIG. 29A is a detailed view of a bench seat with a removable leg press seat back.
FIG. 29B is a detailed view of the removable leg press seat back removed from the bench seat.

As shown in FIGS. 29E-29G, cable storage housings 1258 can be connected with the right and left sides 1076, 1078 of the bench seat 886 outside of and adjacent to the leg press pulleys 1218. Each cable storage housing 1258 includes a spool portion 1260 connected with a mounting plate portion 1262. The mounting plate portion 1262 is connected with and extends downward from under the bench seat and supports the spool portion 1260. The mounting plate 1262 also provides shield to help prevent unintended contact with the leg press pulleys 1218, such as by a user's hands when performing leg press exercises. When not in use, the leg press cables 1220 can be stored on the spool portions 1260 of the cable storage housings 1258. To store the leg press cable 1220, the user first disconnects the first end portion 1230 of the leg press cable 1220 from the resistance cable 1222 and the second end portion 1234 of the leg press cable from the cable adjustment mechanism 1224. The user then pulls on either end of the leg press cable until a cable stop 1264 on either end engages with the leg press pulley. The excess length of leg press cable extending from the leg press pulley can then be wound around the spool portion of the cable storage housing. The cable storage housing may also include a slot 1266 to which the free end portion of the leg press cable can secured to prevent the leg press cable from unwinding from the spool portion.

As previously mentioned, the exercise device 858 can also include the leg developer assembly 1006 connected with the bench frame 882 shown in FIGS. 22C and 30A-30F. As described above, the leg developer assembly can be used for leg extension and leg curl exercises. It is to be appreciated that the leg developer assembly 1006 illustrated may be used on earlier described embodiments of the exercise device, and the leg developer assembly of earlier embodiments may be used with the exercise device 858 of FIGS. 22A-22G. Moreover, components may be exchanged to define entirely different leg developer attachments.

As shown in FIGS. 30A-30D, the leg developer assembly 1006 includes right and left actuation members 1268, 1270 and a resistance arm 1272, all pivotally connected with a leg developer axle 1274 supported between the right and left support members 984, 986 of the forward bench support 880. The actuation members 1268, 1270 are selectively connected with the resistance arm 1272 through a leg developer pop-pin 1276. As such, the pivotal position of the actuation members relative to the resistance arm can be selectively adjusted to place the leg developer assembly 1006 in a desired configuration for use. To couple the leg developer assembly 1006 to resistance system 868, resistance cables 1222 extending from one or both of the adjustable arm assemblies are connected with the resistance arm 1272. As such, the resistance cables can extend from the arm assemblies and under the two pulleys 1024 supported by the right and left extension plates 1020, 1022 to connect with the resistance arm 1272. With the resistance cables connected and the leg developer assembly in the desired configuration, the user exercises by applying forces to reciprocatingly pivot the actuation members 1268, 1270. Because the actuation members are connected with the resistance arm through the leg developer pop-pin 1276, the actuation member and the resistance arm pivot together.

Figure 30A:
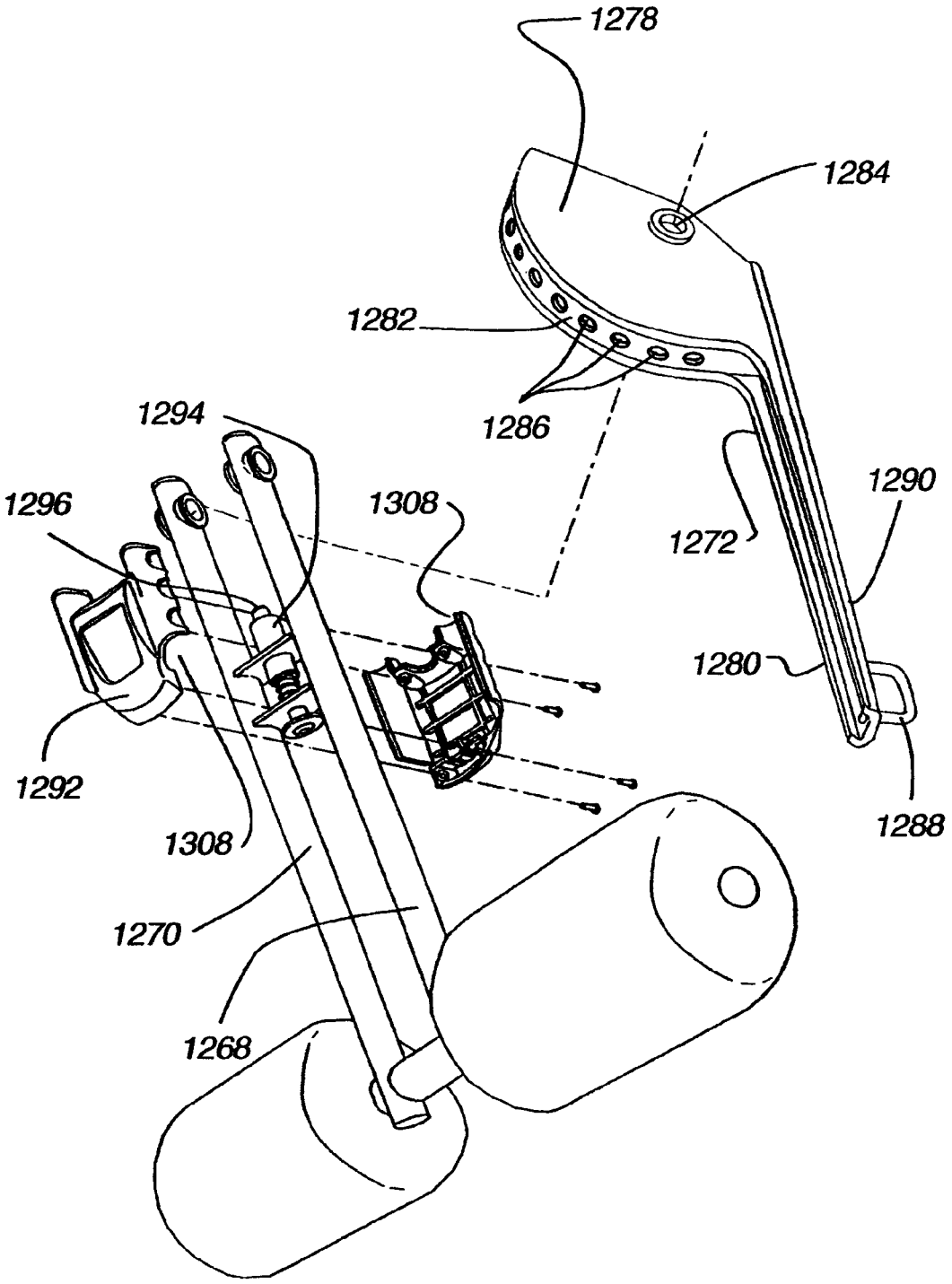
Figure 30B:
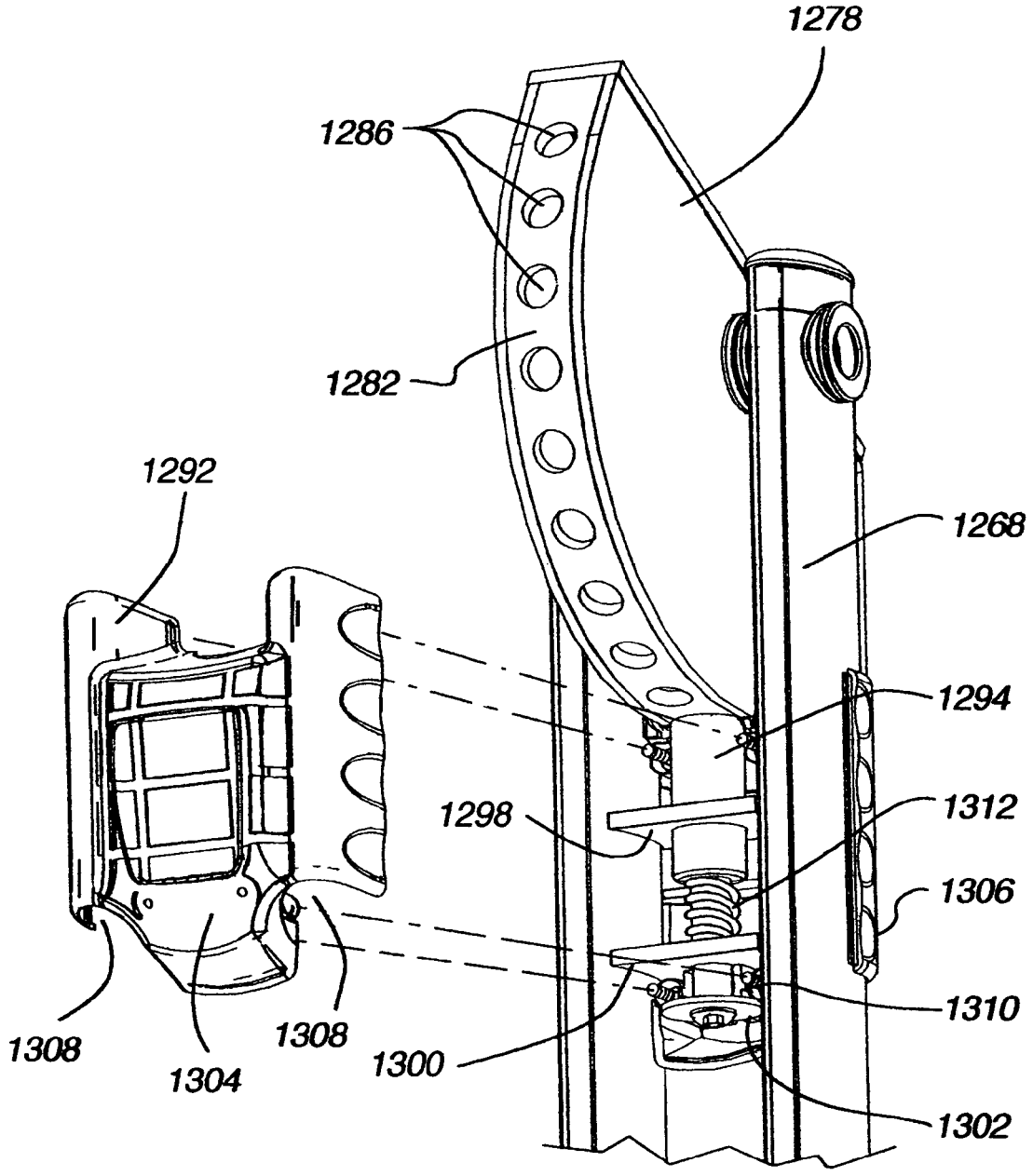
Figure 30D:
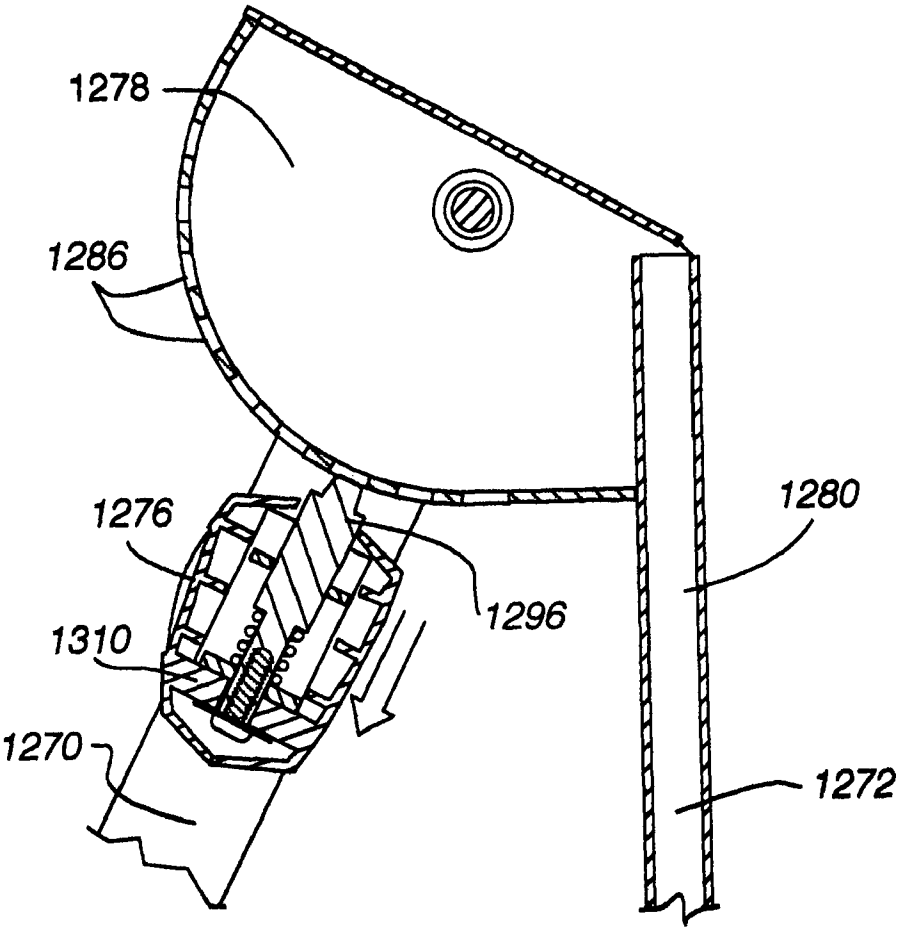

As previously mentioned, the resistance cables 1222 can be connected with the leg developer assembly 1006 through the resistance arm 1272. The resistance arm is also pivotally connected with the leg developer axle 1274 and is selectively connected with the actuation members 1268, 1270 through the leg developer pop-pin 1276. As shown in FIGS. 30-30D, the resistance arm 1272 includes a pivot portion 1278 and an arm portion 1280. The pivot portion includes an arcuate edge 1282 and an axle aperture 1284 adapted to receive the leg developer axle 1274 to pivotally support the resistance arm 1272. The pivot portion 1278 also includes a plurality of circumferentially spaced apertures 1286 extending into the arcuate edge 1282. As discussed in more detail below, the leg developer pop-pin 1276 is adapted to engage the apertures 1286 to provide for selective pivotal positioning of the actuation members relative to the resistance arm. As shown in FIG. 30A, a loop hook 1288 on a rear side 1290 of a lower end portion of the resistance arm provides a connection location for the resistance cables 1272.

As mentioned above, the actuation members 1268, 1270 is pivotally connected with the leg developer axle 1274 and are selectively connected with the resistance arm 1222 through the leg developer pop-pin 1276. As shown in FIGS. 30-30D and others, upper end portions of the actuation members

Figure 30C:
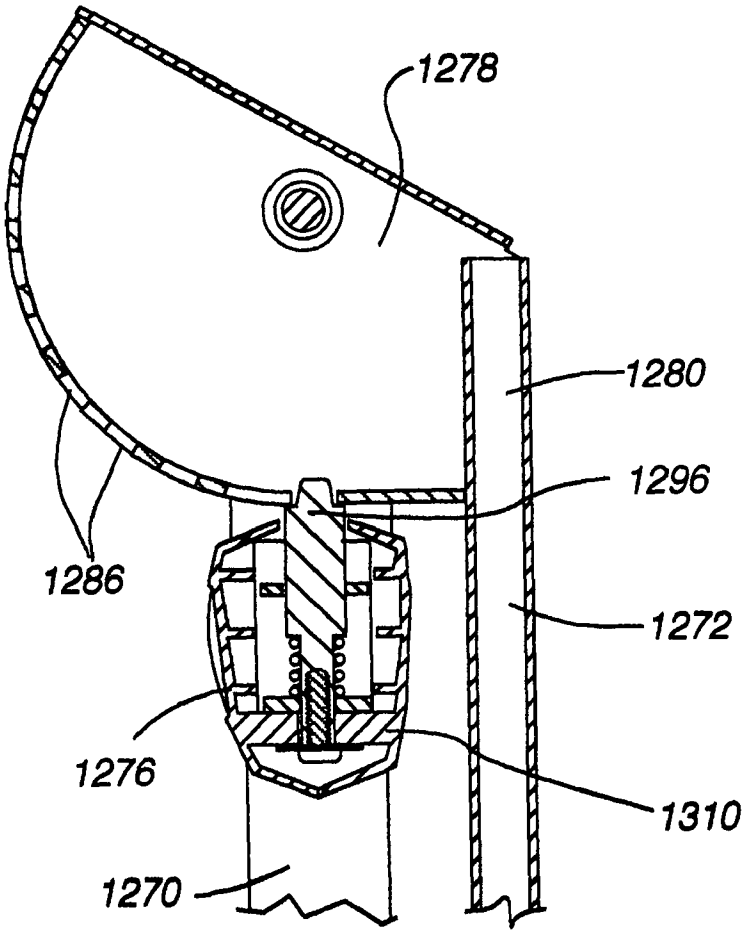

1268, 1270 are connected with the leg developer axle 1274. The actuation members extend downward from the leg developer axle and along opposing sides of the resistance arm 1272. The leg developer pop-pin 1276 is supported between the actuation members. More particularly, the leg developer pop-pin 1276 includes a housing 1292 partially enclosing a body 1294 and a pin 1296 supported by an upper wall member 1298 and a lower wall member 1300, both extending between the right and left actuation members 1268, 1270. The body 1294 of the pop-pin 1276 extends through and is connected with an aperture in the upper wall member 1298. The pin 1296 extends from and is slidingly supported by the body 1294 and an aperture in the lower wall member 1300. A washer 1302 adapted to engage the housing 1292 surrounding the upper and lower wall members is connected with an end portion of the pin 1296. The housing 1292 includes a forward portion 1304 connected with a rear portion 1306 that define channels 1308 adapted to receive the right and left leg actuation members 1268, 1270. As such, the housing can slide up and down along the actuation members. Raised ledges on the inside of the forward and rear portions 1304, 1306 form a collar 1310 adapted to receive the pin 1296 at a location between the lower wall member 1300 and the washer 1302. As shown in FIG. 30C, the leg developer pop-pin also includes a spring 1312 operably connected with the pin 1296 to force the pin 1296 against the arcuate edge 1282 of the resistance arm 1272 and into the apertures 1286 located therein. As shown in FIG. 30D, to disengage the leg developer pop-pin 1276 from the arcuate edge 1282 of the resistance arm 1272, the housing 1292 is slid along the actuation members 1268, 1270 in a direction away from the leg developer axle 1274, forcing the collar 1310 to push against the washer 1302, which in turn, moves the pin away from the apertures in the pivot portion of the resistance arm.

As mentioned above, the pivotal position of the actuation members 1268, 1270 relative to the resistance arm 1272 can be adjusted to configure the leg developer assembly 1006 for various different exercises. For example, when pivoting the actuation members from a first pivotal position to a second pivotal position relative to the resistance arm assembly, a user can move the housing 1292 to disengage the pop-pin 1276 from the resistance arm 1272, as shown in FIG. 30D. While holding the pop-pin in disengagement from the resistance arm, the actuation members 1268, 1270 can be pivoted about the leg developer axle 1274 to the second pivotal position. As shown in FIG. 30C, once the actuation members are in the second position, the housing 1292 can be released, which allows the spring 1312 to force the pin 1296 back into engagement with the resistance arm 1272. If the pin 1296 is aligned with one of the apertures 1286 in the arcuate edge 1282 of the resistance arm 1272, the pin will extend into one of the apertures, locking the actuation members into the second position. If the pin 1296 is not aligned with one of the apertures 1286, the pin will be forced against the arcuate edge 1282 of the resistance arm 1272. The actuation members can then be pivoted up and down until the pin is aligned with and forced into one of the apertures. When the pop-pin 1276 is engaged with the apertures 1286 in the resistance arm 1272, the leg actuation members and the resistance arm rotate together about the leg developer axle 1274.

As shown in FIGS. 22C and 24A, the exercise device 858 also includes roller pads adapted to support a user's legs when performing leg extension and leg curl exercises. In particular, the exercise device 858 includes right and left upper roller pad assemblies 1314, 1316 used in conjunction with the leg developer assembly 1006. As discussed in more detail below, the upper roller pad assemblies 1314, 1316 include upper roller pads 1318 adapted to engage a user's legs when performing leg extension and leg curl exercises. The upper roller pads 1318 have a substantially D-shaped cross section defined by a substantially flat first side 1320 connected with an arcuate second side 1322. It is to be appreciated that the roller pads are not limited to having a substantially flat side and an arcuate side as described and depicted herein and can include other combinations of shapes. For example, the upper roller pads can include two arcuate sides forming an oval or an elliptical cross section. In another scenario, the upper roller pads can include a single curved side that forms a circular cross section. The exercise device 858 also includes a pair of lower roller pads 1324 rotatably supported on a lower roller pad support member 1326 extending outwardly from opposing sides of the actuation members 1268, 1270 of the leg developer assembly 1006.

Figure 30E:
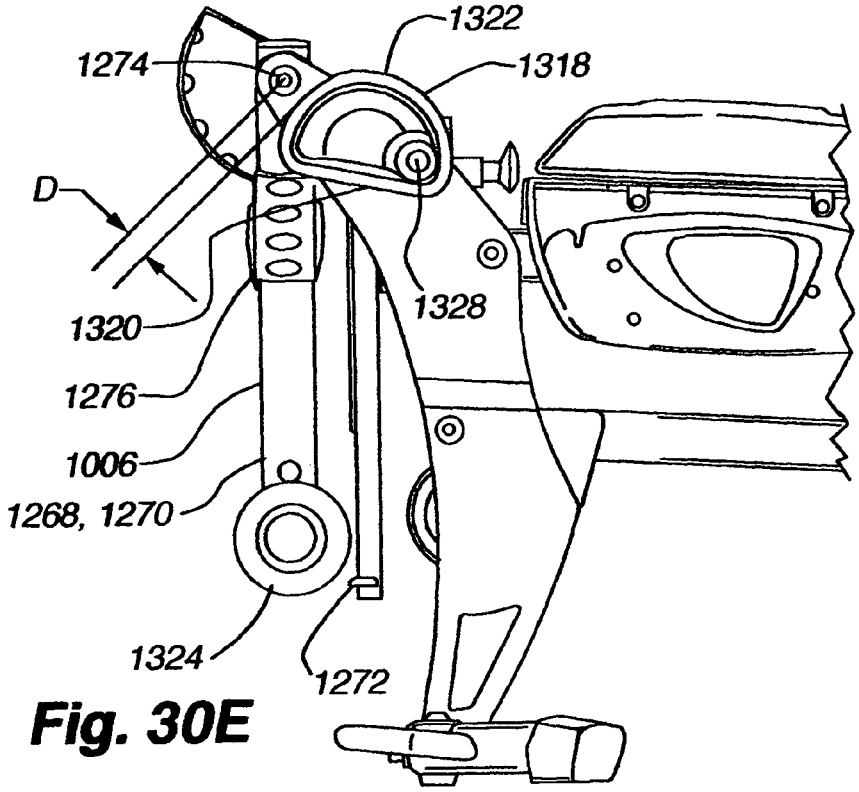
Figure 30F:
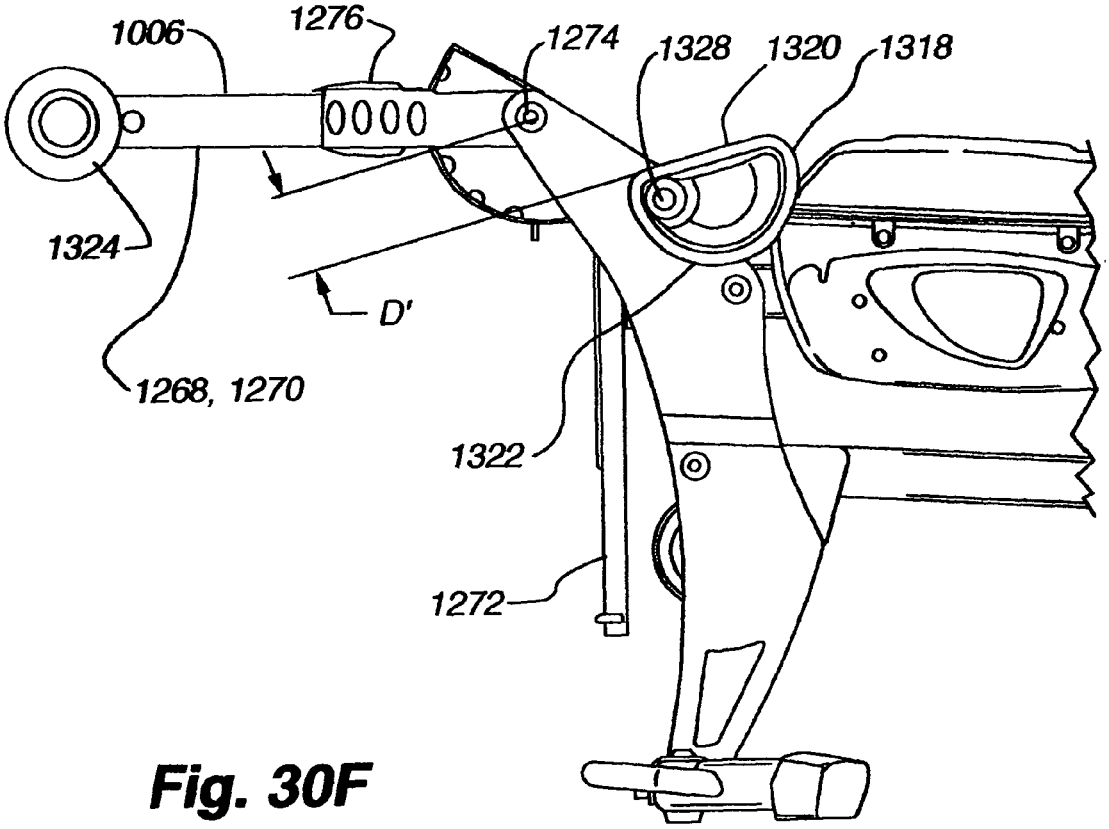

FIG. 30E shows the leg developer assembly 1006 configured for leg extension exercises with the arcuate second sides 1322 of the upper roller pads 1318 upwardly oriented. To position himself on the exercise device 858 to perform a leg extension exercise, a user places the back side of his knees on the second sides 1322 of the upper roller pads and the front side of his ankles behind the lower roller pads 1324. To configure the leg developer for leg curl exercises, the user can disengage the leg developer pop-pin 1276 on the leg developer assembly 1006 to allow the actuation members 1268, 1270 to pivot to an upward position, such as shown in FIG. 30F. The upper roller pads 1318 are then rotated to place the flat first sides 1320 of the upper roller pads 1318 in an upward orientation. To position himself on the exercise device to perform a leg curl exercise, a user lies on the bench assembly 860 with the front side of his legs positioned on first sides 1320 of the upper roller pads 1318 and the rear sides of his ankles positioned under the lower roller pads 1324. As described below, the upper roller pad assemblies 1314, 1316 are configured to position the first and second sides of the upper roller pads relative to the leg developer axle 1274 to provide additional comfort to the user when performing exercises.

As shown in FIG. 24A, the upper roller pad assemblies 1314, 1316 are rotatably supported on upper roller pad support members 1328 extending outwardly from the forward bench support 880. Although the following description refers mainly figures showing mainly the components of the right upper roller pad assembly, it is to be appreciated that the left upper roller pad assembly is substantially a mirror image of the right upper roller pad assembly. As such, the left upper roller pad assembly includes the same components as the right upper roller pad assembly, and operates in relation with the frame and forward bench support as the right upper roller pad assembly. As previously mentioned, the upper roller pad 1318 has a D-shaped cross section defined by the first substantially flat side 1320 and the second arcuate side 1322. The upper roller pad also includes a first end side 1330 and a second end side 1332. A pad support member aperture 1334 and a support rod aperture 1336 extend through the upper roller pad 1318 from the first end side 1330 to the second end side 1332. A first pin aperture 1338 extends into the upper roller pad from the first end side 1330, and a second pin aperture 1340 extends into upper roller pad from the second end side 1332. As discussed in more detail below, an inner end plate 1342 is connected adjacent to the first end side of the roller pad, and an outer end plate 1344 is connected adjacent the second end side of the roller pad.

As shown in FIGS. 24A, 30E, and 30F, the inner end plate 1342 includes a first side 1346 and a second side 1348 and defines a D-shaped perimeter similar to the D-shaped cross section of the upper roller pad 1318. As discussed in more detail below, an aperture 1350 in the inner end plate 1342 is adapted to receive the upper roller pad support members 1328 connected with the forward bench support 880. A stop pin 1352 extends through the inner end plate 1342 such that a first end portion 1354 of the stop pin 1352 extends from the first side 1346 of the inner end plate 1342, and a second end portion 1356 of the stop pin 1352 extends from the second side 1348 of the inner end plate 1342. As discussed in more detail below, the first end portion 1354 of the stop pin 1352 is adapted to engage the support members 984, 986 on the forward bench support 880 to limit the range of pivotal movement of the upper roller pads 1318 about the upper roller pad support members 1328. The second end portion 1356 of the stop pin 1352 is adapted to be received within the first pin aperture 1338 in the first end side 1330 of the upper roller pad 1318. A hollow support rod 1358 having a first end portion 1360 connected with the second side 1348 of the inner end plate 1342 extends outward to a second end portion 1362. As discussed below, the support rod 1358 is adapted to be received within the support rod aperture 1336 in the upper roller pad 1318 and the second end portion 1362 of the support rod is adapted to connect with the outer end plate 1344.

As shown in FIG. 24A, the outer end plate 1344 includes a first side 1364 and a second side 1366 and defines a D-shaped perimeter similar to the D-shaped cross section of the upper roller pad 1318. The outer end plate 1344 includes an aperture 1368 having a side wall 1370 extending inward from the first side 1364. As discussed below, the aperture 1368 is adapted to receive the upper roller pad support members 1328. The outer end plate also includes a first pin 1372 extending from the first side 1364 that is adapted to be received within the second end portion 1362 of the support rod 1358 extending from the second side 1348 of the inner end plate 1342. In addition, a second pin 1374 extends from the first side 1364 of the outer end plate 1344 and is adapted to be received within the second pin aperture 1340 in the second end side 1332 of the upper roller pad 1318.

As previously mentioned, the upper roller pad 1318 is rotatably supported on the upper roller pad support member 1328 extending from the right support member 984 on the forward bench support 880. More particularly, the upper roller pad support member extends through the aperture 1350 in the inner end plate, the pad support member aperture 1334 in the upper roller pad 1318, and the aperture 1368 in the outer end plate 1344. As shown in FIG. 24A, an end cap 1378 is connected with the end of the upper roller pad support member 1328 to help maintain the relative axial positions of the component parts of the right upper roller pad assembly. The second end portion 1356 of the stop pin 1352 on the inner end plate 1342 is received within the first pin aperture 1338 of the first end side 1330 of the upper roller pad 1318, and second pin 1374 on outer end plate 1344 is received within the second pin aperture 1340 on the second end side 1332 of the upper roller pad. As previously mentioned, the support rod 1358 extends from the inner end plate 1342 and through the support rod aperture 1336 in the upper roller pad 1318. As such, the first pin 1372 on the outer end plate 1344 is received within the second end portion 1362 of the hollow support rod 1358. Therefore, the inner end plate, the outer end plate, and the upper roller pad rotate together about the upper roller pad support member. The first end portion 1354 of the stop pin 1352 engages the support members 984, 986 on the forward bench support 880 to limit the range of pivotal movement of the upper roller pad 1318 about the upper roller pad support member.

As previously mentioned, the right and left upper roller pad assemblies 1314, 1316 can be used in conjunction with the leg developer assembly 1006 when performing leg extension and leg curl exercises. As shown in FIG. 30E, when configuring the exercise device 858 to perform leg extension exercises, the upper roller pad assemblies 1314, 1316 are rotated about the upper roller pad support members 1328 so the arcuate second sides 1322 of the upper roller pads 1318 are upwardly oriented. As previously described, the user positions himself on the exercise device with the back side of his knees on the arcuate second sides of the upper roller pads and the front side of his ankles behind the lower roller pads 1324. As shown in particular in FIG. 30E, the distance D between the arcuate second side 1322 of the upper roller pads 1318 and the leg developer axle 1374 is such that the user's knee joints are substantially aligned with the leg developer axle, which provides additional comfort to the user when performing leg extension exercises.

As shown in FIG. 30F, when configuring the exercise device to perform leg curl exercises, the upper roller pad assemblies 1314, 1316 are rotated about the upper roller pad support members 1328 so the flat first sides 1320 of the upper roller pads 1318 are upwardly oriented. As previously described, the user lies on the bench assembly 860 with the front side of his legs positioned on the flat first sides 1320 of the upper roller pads and the rear sides of his ankles positioned under the lower roller pads 1324. As shown in particular in FIG. 30F the distance D' between the flat first sides 1320 of the upper roller pads 1318 and the leg developer axle 1374 is located substantially behind the user's knee joints, which provides additional comfort to the user when performing leg curl exercises.

As described and depicted herein, the various exercise device embodiments include right and left arm assemblies adjustably coupled with the frame. The arm assemblies 894, 896 of the exercise device 858 of FIGS. 22A-22G differs in many respects from earlier described embodiments. As shown in FIGS. 31A-31F, the right and left arm assemblies each include an arm member 1380 having a distal end portion 1382 and a proximal end portion 1384. A distal pulley housing 1386 is rotatably connected with the distal end portion 1382 of the arm member 1380. The distal pulley housing 1386 rotatably supports a first pulley 1388. The distal pulley housing can also rotate relative the arm member 1380 to help align the resistance cable 1222 extending through the arm member. A second pulley 1390 is rotatably connected with and partially enclosed by the proximal end portion 1384 of the arm member 1380. As discussed in more detail below, the proximal end portion 1384 of the arm member 1380 is pivotally connected with the arm support member 944. In addition, each arm assembly includes a spring-loaded arm pop-pin 1392 that allows a user to selectively position the arm assembly, from a substantially downward vertical position, through a plurality of positions in approximately a 180° arc, and in a substantially upward vertical position. More particularly, the arm pop-pin 1392 is operable to allow the arm assembly to pivot about a pivot axis 1394 defined by the pivotal connection of the proximal end portion 1384 of the arm member 1380 with the frame 862.

As previously mentioned, the arm assemblies 894, 896 are pivotally connected with the arm support member 944. As shown in FIGS. 31A-31F, a first plate 1396 and a second plate 1398 are connected with and extend upward from an upper end portion of the arm support member 944. The first and second plates are also connected with and separated by a support member 1400 extending upward from the upper end portion of the arm support member 944. Journals 1402 extending from the inside of the proximal end portions 1384 of the arm members 1380 are pivotally connected with cylindrically-shaped bearing members 1404 on first and second plates 1396, 1398. The bearing members 1404 on the first and second plates are collinear with and define pivot axes 1406 for each arm assembly. The second pulleys 1390 associated with each arm assembly 894, 896 are rotatably connected with second pulley axles 1408 supported by and extending between the first and second plates.

As shown in FIGS. 31A-31F, the first plate includes a plurality of apertures 1410 that are circumferentially spaced along right and left arcuate edges 1412, 1414 of the first plate 1396. As discussed in more detail below, the arm pop-pins 1392 supported on the proximal end portions 1384 of the right and left arm assemblies 894, 896 are adapted to engage the apertures 1410 on the first plate 1396 to selectively lock the arm assemblies in various pivotal positions. Pop-pin levers 1416 on each arm assembly 894, 896 are used to disengage the arm pop-pins 1392 from apertures 1410 on the first plate 1396 to allow the arm assemblies to pivot. More particularly, each pop-pin lever 1416 is pivotally supported by a lever axle 1418 on the arm member and includes a handle portion 1420 angularly offset from a base portion 1422. The base portion 1422 of the pop-pin lever 1416 is adapted engage a T-bar 1424 connected with the arm pop-pin 1392.

The arm pop-pins 1392 are spring-loaded and are biased into engagement with first plate 1396. As such, the spring-loaded feature of the arm pop-pin forces the T-bar 1424 against the base portion 1422 of the pop-pin lever 1416, which in turn holds the base portion against the outer surface of the arm member 1380. Because the base portion 1422 is angularly offset from the handle portion 1420, when the base portion is pressed against the outer surface of the arm member 1380 by the arm pop-pin, the handle portion extends away from the outer surface of the arm member. When the handle portion 1420 is moved toward the outer surface of the arm member 1380, the pop-pin lever 1416 pivots around the lever axle 1418 and the base portion 1422 is lifted away from the outer surface of the arm member. As the base portion moves away from the arm member, the base portion pulls the T-bar 1424 in the same direction, causing the arm pop-pin 1392 to disengage the first plate apertures 1410. When the handle portion 1420 is released, the spring-loaded feature of the arm pop-pin 1392 acts to pull the base portion 1422 through the T-bar 1424 back toward the outer surface of the arm member 1380. Although the arm pop-pins are shown in various figures as located on the front sides of the arm assemblies, it is to be appreciated that the arm pop-pins can be located in other locations on the arm assemblies. For example, the arm pop-pins 1392 are shown in FIG. 25A as located on the rear sides of the arm assemblies 894, 896. Because the arm pop-pins are located on the rear sides of the arm assemblies, the first plate 1396 is located rearward of the second plate 1398.

When the arm pop-pins 1392 are disengaged from the apertures 1410 on the first plate 1396, the arm assemblies 894, 896 are free to pivot around the pivot axes 1406. Depending upon the weight of the arm assemblies, it may be relatively difficult for a user to lift and pivot the arm assemblies upward to a desired position. As shown in FIG. 31C, embodiments of the present invention can include gas springs 1426 with opposing end portions pivotally connected with the arm assemblies 894, 896 and the arm support member 944. The gas springs 1426 act to reduce the effects of the weight of the arm assemblies when the arm pop-pins 1392 are disengaged from the first plate 1396. More particularly, the gas springs 1426 are adapted to exert forces on the arm assemblies to mitigate the gravitational forces exerted arm assemblies. It is to be appreciated that the gas springs can be configured to provide different levels of force on the arm assemblies. For example, the gas springs can be configured to the exert forces on the arm assemblies that will cause the arm assemblies to pivot relatively slowly in a downward direction when the arm pop-pins are disengaged from the first plate. In another example, the gas springs can be configured to the exert forces on the arm assemblies that will cause the arm assemblies to pivot upward when the arm pop-pins are disengaged from the first plate. In yet another example, the gas springs are configured to exert forces on the arm assemblies that will hold the arm assemblies in position when the arm pop-pins are disengaged from the rear plate until such time when the user applies a small amount of force to the arm assemblies causing them to pivot up or down around the pivot axes.

As previously mentioned, the user actuates the resistance system 868 through the cable-pulley system 866. The cable-pulley system 866 on the embodiment of the exercise device 858 shown in FIGS. 32A and 32B includes separate right and left cable-pulley systems 898, 900 that connect the right and left resistance systems 870, 872 with the right and left arm assemblies 894, 896. Although the following description may refer to figures illustrating mainly the components of the right cable-pulley system 898, it is to be appreciated that the left cable-pulley system 900 is substantially a mirror image of the right cable-pulley system, and as such, includes the same components as the right cable-pulley system, which operate in relation with each other and with the frame as the right cable-pulley system. FIGS. 32A and 32B illustrate the cable routing from the right and left arm assemblies 894, 896 to the right and left resistance systems 870, 872. From a first end 1428, the resistance cable 1222 extends through a cable stop 1430 engaged with the first pulley 1388 in the distal pulley housing 1386 and through the inside of the arm member 1380 to the second pulley 1390. The cable stop 1380 is connected with the resistance cable 1222 and prevents the resistance cable from retracting into the arm member. The resistance cable 1222 exits the proximal end portion 1384 of the arm member 1380 and wraps around a portion of the second pulley 1390 and extends downward through the arm support member 944 to a lower directional pulley 1432. From the lower direction pulley 1432, the resistance cable 1222 extends to a second end connected with the transmission assembly 902 of the resistance system 868.

As previously mentioned, the right and left resistance systems 870, 872 each include transmission assemblies 902 and resistance assemblies 904. As shown in FIGS. 23A, 23B, 32A, and 32B, the transmission assembly includes a transmission pulley 1436 and a belt pulley 1438 rotatably connected with a transmission axle 1440. The transmission axle is connected with the transmission support member 950 on the main frame 862. The transmission pulley is connected with the belt pulley, and as such, rotate together. As previously mentioned, the second end of the resistance cable 1222 is connected with the transmission pulley 1436. The transmission assembly is connected with the resistance assembly through a resistance belt 1442. As shown in FIG. 32C, a first end 1444 of the resistance belt 1442 is connected with the belt pulley 1438. A second end 1446 of the resistance belt 1442 is connected with a linearizing cam 1448 on the resistance assembly 904. As discussed in more detail below, forces exerted on the resistance cable 1222, such as during exercise, can cause the transmission pulley 1436 to rotate. As such, when the transmission pulley 1436 rotates in a direction that pulls on the resistance belt 1442, the linearizing cam 1448 imparts torsional forces to the resistance packs 874 on the resistance assembly 904.

It is to be appreciated that although the exercise device 858 of FIGS. 22A-22G of the present invention is depicted and described herein with a belt pulley, other configurations of the exercise device utilize a cam in place of the belt pulley to provide a different force curve, as described above with reference to earlier embodiments. Further, configurations of the exercise device 858 utilize multiple cams and a cam selector mechanism as described above with reference to the earlier embodiments.

The transmission assembly 902 can also include the previously mentioned tensioning mechanism 878 that allows a user to adjust the tension of the resistance belt 1442. More particularly, the tensioning mechanism 878 allows the user to decouple the belt pulley 1438 from the transmission pulley 1436 and rotate the belt pulley relative to the transmission pulley to adjust the tension of the resistance belt between the belt pulley and the linearizing cam 1448. As discussed in more detail below with reference to FIGS. 33A-33E, the tension mechanism 878 includes a spring-loaded locking member 1450 to selectively connect and disconnect the belt pulley 1438 with the transmission pulley 1436. A knob connected with the locking member allows a user to move the locking member 1452 in a first direction to disconnect the belt pulley from the transmission pulley, which allows the belt pulley to rotate independently from the transmission pulley and adjust the tension in the resistance belt. Once the belt tension has been adjusted, a user can move the knob in an opposite second direction to reconnect the belt pulley with the transmission pulley. The tension mechanism also includes a compression spring 1454 to hold the locking member in a position to maintain the connection between the belt pulley and the transmission pulley.

As previously mentioned, the knob 1452 connected with the locking member is used to move the locking member 1452 to selectively connect and disconnect the belt pulley 1438 with the transmission pulley 1436. As shown in FIGS. 33A-33E, the locking member 1450 includes a disc-shaped base portion 1456 having a first side 1458 and an opposing second side 1460. Four posts 1462 are connected with and extend from the first side 1458. As discussed in more detail below, the four posts 1462 are slidingly received within the belt pulley and are connected with the knob. A plurality of studs 1464 extend from the second side 1460 of the base portion of the locking member. As discussed in more detail below, the studs 1464 are adapted to engage a plurality of correspondingly spaced apertures 1466 in an inner radial portion 1468 of the transmission pulley 1436. The base portion 1456 of the locking member 1450 further includes an axle aperture 1470 adapted to receive the transmission axle 1440. When the studs 1464 are engaged with the apertures 1470, the belt pulley and the transmission pulley rotate together. Alternatively, the studs are withdrawn from the apertures, the belt pulley and the transmission pulley can rotate independent of each other. A longitudinally extending wall along the outer circumference of the axle aperture 1470 defines a circular ledge portion 1472 on the second side 1460 of the locking member 1450. As discussed in more detail below, the ledge portion 1472 is adapted to receive a first end 1474 of the compression spring 1454, which acts to hold the studs in engagement with the apertures.

As shown in FIGS. 33A-33E, the belt pulley 1438 has a spool-shaped cross section defined by raised first end portion 1476 and a second end portion 1478 separated by a recessed middle portion 1480. The middle portion 1480 defines a flat outer surface 1482 along its length upon which the resistance belt 1442 is wrapped. A pulley aperture 1484 having a varying diameter extends through the center of the belt pulley 1438. A first diameter of the pulley aperture 1484 defines a first inner cylindrical surface 1486 extending inward from a first end surface 1488 of the belt pulley 1438. Four raised convex surfaces 1490 extend along the length of the first inner cylindrical surface 1486. As discussed in more detail below, four corresponding arcuate recesses 1492 in the outer circumference of the base portion 1456 of the locking member 1450 are adapted to slidingly receive the four raised convex surfaces 1490. A second diameter defines a second inner cylindrical surface 1494 extends from the first inner cylindrical surface 1486. The second diameter is smaller than the first diameter, which defines a first ring surface 1496 located at the transition from the first inner cylindrical surface 1486 to the second inner cylindrical surface 1494. A longitudinally extending wall 1498 on the inner diameter of the first ring surface 1496 defines a circular ledge portion 1500 adapted to be received within a second end 1502 of the compression spring 1454, discussed in more detail below. A third diameter defines a third inner cylindrical surface 1504 extending from the second inner cylindrical surface 1494. The third diameter is larger than the second diameter, defining a second ring surface 1506 at the transition from the second inner cylindrical surface 1494 to the third inner cylindrical surface 1504. A fourth diameter defines a fourth inner cylindrical surface 1508 extending from the third inner cylindrical surface 1504 to a second end surface 1510. The fourth diameter is larger than the third diameter, defining a third ring surface 1512 at the transition from the third inner cylindrical surface 1504 to the fourth inner cylindrical surface 1508.

As shown in FIGS. 33A-33E, the locking member 1450 is connected with the belt pulley 1438 by inserting the four posts 1462 extending from the base portion 1456 through four post apertures 1514 extending from the first ring surface 1496 to the third ring surface 1512. The compression spring 1454 is positioned between the second side 1460 of the base portion 1456 of the locking member 1450 and first ring surface 1496 on the belt pulley 1438. As previously mentioned, the first end 1474 of the compression spring receives the ledge 1472 on the second side 1460 of the locking member 1450, and the second end 1502 of the compression spring receives the ledge 1500 on the first ring surface 1496 in the belt pulley. The four posts 1462 are inserted into the four post apertures 1514 until the base portion 1456 of the locking member 1450 is received within the belt pulley 1438. More particularly, an outer circumferential edge 1516 of the base portion 1456 is adjacent to the first inner cylindrical surface 1486 of the belt pulley 1438 with the four raised convex surfaces 1490 extending through the four arcuate recesses 1492. The engagement between the raised convex surfaces and the arcuate recesses in combination with the posts and post apertures connects the belt pulley with the locking member such that both rotate together while at the same time allowing the locking member to slide longitudinally with respect to the belt pulley. Compression of the compression spring 1454 between the locking member 1450 and the belt pulley 1438 forces the base portion 1456 of the locking member 1450 away from the belt pulley 1438 and toward the transmission pulley 1436.

As shown in FIGS. 33A-33E, the transmission pulley 1436 and the belt pulley 1438 are rotatably mounted on the transmission axle 1440. A first bearing 1517 rotatably supports the transmission pulley on the transmission axle. A bearing second bearing 1518 adapted to be received within the belt pulley 1438 adjacent the third inner cylindrical surface 1504 is connected with an end of the transmission axle through an axle screw 1520 and washer 1522 threaded into the end of the transmission axle. As such, the second bearing 1518 presses against the second ring surface 1506 of the belt pulley 1438 to maintain the axial positions of the belt pulley and the transmission pulley on the transmission axle. The knob 1452 includes four post apertures 1524 adapted to receive end portions of the four posts 1462 extending through the post apertures 1514 and the third ring surface 1512 of the belt pulley 1438. Four knob screws 1526 inserted into the knob post apertures 1524 are screwed into the end portions of the four posts 1462. Radially extending screw heads on the knob screws are adapted to engage internal ledges on the inner walls of the knob post apertures. A cap 1528 is also connected with the knob 1526 with a cap screw 1530.

As shown in FIG. 33D, to disengage the belt pulley 1438 from the transmission pulley 1436, the knob 1452 is moved in a direction away from the transmission pulley, which disengages the studs 1464 on the locking member 1450 from the corresponding apertures 1466 on the transmission pulley 1436. The tension of the resistance belt 1442 can be adjusted by turning the knob 1452 and belt pulley 1438 in a desired direction. Once the resistance belt is adjusted, the knob 1452 is pushed toward the transmission pulley 1436 as shown in FIG. 33E to reengage the studs 1464 on the locking member 1450 with the apertures 1466 on the transmission pulley 1436. The compression spring 1454 presses against the locking member and the belt pulley to maintain the engagement of the studs within the corresponding apertures.

As previously mentioned, the resistance belt 1442 connects the transmission assembly 902 with the resistance assembly 904. As shown in FIG. 32C, the first end 1444 of the resistance belt 1442 is connected with the belt pulley 1438. From the belt pulley, the resistance belt extends upward and is partially wrapped onto the linearizing cam 1448 on the resistance assembly 904. The second end 1446 of the resistance belt 1442 is also connected with the linearizing cam. Unlike earlier embodiments of the exercise device, the resistance assembly 904 on the exercise device 858 does not include a selector mechanism connected to selectively connect various numbers of resistance packs with the linearizing cam. Instead, the level of resistance is adjusted by placing a desired number of resistance packs 874 on the resistance axle 906, as shown in FIG. 22A. As discussed in more detail below with reference to FIGS. 34A-34D, the resistance packs 874 have housings 1532 that can be connected with each other and with the linearizing cam 1448. As such, to set the level of resistance on the exercise device 858, a desired number of resistance packs are placed on the resistance axle and are interconnected with one another and with the linearizing cam. Forces applied to the resistance cable 1222, such as during exercise, are translated to the resistance belt 1442 through the transmission assembly 902. More particularly, the transmission pulley 1436 and the belt pulley 1438 rotate to unwind the resistance belt 1442 from the linearizing cam 1448, causing the linearizing cam and the housings of the interconnected resistance packs to rotate.

The resistance packs 874 on the exercise device 858 are similar to the resistance packs described above with reference to earlier embodiments. However, instead of having a pair of resistance elements, the housing 1532 of the resistance pack 874 in FIGS. 34A-34D encloses a single resistance element 1534 that acts as a torsional spring. It is to be appreciated, however, that other embodiments of the resistance packs 874 can be configured to house more than one resistance element. In turn, the resistance element 1534 is connected with a center hub 1536, which is selectively connected with the resistance axle 906. The housing 1532 includes disc-shaped first and second sides 1538, 1540 with a circular rim extending 1542 along the circular periphery of each side. As shown in FIG. 34C, a plurality of rigid triangular frames 1544 extend outward from an inner surface 1546 of the first side 1538. Although the resistance pack 874 is illustrated with eight triangular frames, it is to be appreciated that the resistance pack can have more or less than eight triangular frames.

As described above with reference to other embodiments, the resistance element 1534 shown in FIGS. 34C and 34D acts as a torsional spring and may be constructed of a suitable elastomeric substance exhibiting resiliency and resistance to stretching. The resistance element 1534 includes a plurality of spokes 1548 connected with and extending radially outward from the center hub 1536. The resistance element 1534 is installed in the housing 1532 with the spokes extending between the adjacent triangular frames 1544. The resistance element also includes a plurality of peripheral portions 1550 extending between outer ends of the spokes 1548. As with previously described resistance packs, the center hub 1536 may be constructed of a rigid material which may be glued or otherwise bonded to the elastomeric inner ends of the spokes. The center hub 1536 shown in FIGS. 34A-34D is provided with a generally hexagonally-shaped inner surface 1546 adapted to receive the resistance axle 906 having a correspondingly shaped cross section. More particularly, the inner surface of the hub defines five flat sides 1554 and one curved side 1556. The cross section of the resistance axle 906 is similarly shaped with five flat sides 1558 and one curved side 1560, as shown in FIG. 35B. The correspondingly shaped sides of the center hub 1536 and resistance axle 906 act as a key that allows the resistance pack to be placed on the resistance axle in a particular angular orientation. As such, the center hub 1536 is configured to receive the resistance axle such that the center hub can slide along the length of the resistance axle, but does not rotate relative to the resistance axle. When the housing 1532 of the resistance pack 874 containing the resistance element 1534 is rotated relative to the center hub 1536, the spokes 1548 and the peripheral portions 1550 of the resistance element are stretched. As describe above with reference to the other embodiments, the resilient construction of the resistance element resists stretching to provide a resistive force that opposes the stretching of the arms and peripheral portions. It is to appreciated that the resistive forces increases the more the resistance elements are stretched. In other words, the more the housing of the resistance pack is rotated relative to the hub, the greater the resistance force. It is also to be appreciated that the resistance packs can be configured with resistance elements having different shapes and sizes, which can produce different levels of resistance for the same amount of housing rotation relative to the resistance axle. For example, FIGS. 34E-34G illustrate three resistance elements 1534', 1534", and 1534'" having three different widths, W', W", and W'", respectively. Provided the three resistance elements of FIGS. 34E-34G are constructed from material having the same elastomeric properties, the resistance elements with the progressively larger widths provide greater levels of resistance.

As previously mentioned, the resistance packs 874 are configured to selectively connect with each other. More particularly, hooks 1562 on an outside surface 1564 of the first side 1538 of one resistance pack is adapted to connect with corresponding hooks 1562 on an outside surface 1566 of the second side 1540 of another resistance pack. As shown in FIGS. 34A-34B, partial rings 1568 on each side of the resistance packs 874 are defined by circumferentially extending raised surfaces 1570 located at various radial distances from the center hub 1536. The intersection of a first end portion 1572 of the each partial ring with the outer surfaces 1564, 1566 of each side 1538, 1540 defines a sloped portion 1574 of the partial ring. Extending from the sloped portion 1574, a middle portion 1576 of the partial ring defines a generally flat raised portion 1578. From the middle portion 1578, the partial ring 1568 extends to a second end portion 1580 defining the hooks 1562. As previously mentioned, the hooks 1562 on the first side 1538 of one resistance pack are adapted to connect with corresponding hooks 1562 on the second side 1540 of another resistance pack. In a particular embodiment, as shown in FIGS. 34A-34B, the first side and second sides of the resistance pack each include a first partial ring 1582 having a first hook 1584 located at a first radial distance from the center hub 1536. A pair of second partial rings 1586 and a pair of second hooks 1588 are located at a second radial distance from the center hub 1536. A third partial ring 1590 and a third hook 1592 is located at a third radial distance from the center hub 1536. A pair of fourth partial rings 1594 and a pair of fourth hooks 1596 are located at a fourth radial distance from the center hub 1536. It is to be appreciated that the resistance packs are not limited to the interconnection configurations depicted and described herein.

As shown in FIGS. 22A, 35A, 35B, and 35C, the resistance axle 906 extends outward from right and left sides of the resistance support member 952 to support the resistance assemblies 904 of the right and left resistance systems 870, 872. As shown in FIGS. 35B and 35C, the resistance axle 906 is connected with the resistance support member 952 through a clam shell clamp 1640. The clam shell clamp 1640 includes a bottom side 1642 connected with the resistance support member 952 between right and left linearizing cam bearings 1644. Eight bolts 1646 connect a top side 1648 of the clam shell clamp 1640 with the bottom side 1642. When installed on the exercise device, the resistance axle 906 extends through linearizing cam bearings 1644 and between the top and bottom sides 1648, 1642 of the clam shell clamp 1640. The eight bolts 1646 are tightened to provide clamping forces between the top and bottom sides on the resistance axle 906. As shown in FIG. 35C, the top and bottom sides 1648, 1642 of the clam shell clamp 1640 are correspondingly formed with the cross sectional shape of the resistance axle 906. The clamping forces exerted on the resistance axle by the clam shell clamp in conjunction with the corresponding shapes of the top and bottom sides of clam shell act to hold the resistance axle in a fixed position and to resist torsional forces exerted on the resistance axle by the resistance packs 874.

As shown in FIGS. 35B and 35C, the exercise device can also include a bolt 1650 retainer that allows the exercise device to be shipped with the top side 1648 of the clam shell clamp 1640 loosely bolted to the bottom side 1642. As such, the resistance axle 906 can be easily installed once the exercise device reaches a shipping destination. For example, in one embodiment, with the top side 1648 of the clam shell clamp 1640 loosely bolted to the bottom side 1642, the resistance axle 906 can be slid with the curved side 1560 facing upward between the two sides of the clam shell clamp. The axial position of the resistance axle 906 can be fixed by sliding the resistance axle through the clam shell clamp until a boss 1652 extending downward from the top side 1648 of the clam shell clamp 1640 engages a divot 1654 in the curved top side 1560 of the resistance axle 906. Once the resistance axle is in position, the bolts 1646 can be tightened. The sequence in which the bolts 1646 are tightened can cause the clam shell clamp 1640 to exert additional compressive forces on opposing sides of the resistance axle 906 to further resist rotational forces exerted thereon by the resistance packs. For example, in one embodiment, a user can extend a wrench through apertures 1656 in the bolt retainer to first tighten the bolts labeled 1646-1 in FIG. 35B. The bolts labeled 1646-2 are tightened next, followed by the bolts labeled 1646-3, and followed by the bolts labeled 1646-4.

As shown in FIGS. 22A, 35A, 35B, the linearizing cam 1448 is rotatably mounted the linearizing cam bearings 1644 around the resistance axle 906 above the transmission assembly 902 such that the resistance belt 1442 extends upward from the belt pulley to wrap around the outer surface of the linearizing cam 1448. A first side 1598 of the linearizing cam 1448 is located adjacent the resistance support member 952. A raised surface 1600 on the first side 1598 of the linearizing cam 1448 defines a stop ledge 1602 adapted to engage the resistance support member 952. A first resistance pack 1606 is bolted to a second side 1608 of the linearizing cam. The first resistance pack includes a housing 1610 partially enclosing a resistance element 1612 connected with a center hub 1614. The housing 1610, resistance element 1612, and center hub 1614 of the first resistance pack 1606 are operably connected to resist rotation of the housing 1610 with respect to the resistance axle 906 in substantially the manner as described above with reference to the resistance pack 874 shown in FIGS. 34A-34D. Before connecting the first resistance pack 1606 with the linearizing cam 1448, the housing 1610 of the first resistance pack 1606 is slightly rotated to stretch the resistance element 1612, which results in a pre-load. As such, pre-load exerted by the first resistance pack forces the stop ledge 1602 on the linearizing cam 1448 to abut the resistance support member 952 to the maintain the linearizing cam in a constant initial starting position when not in use. As discussed in more detail below with reference to FIG. 22A and others, an outer side 1616 of the housing 1610 of the first resistance pack 1606 can be configured with the same hooked connection structure as described above with reference to the second side 1540 of the resistance pack 874. As such, the first sides 1538 of resistance packs 874 can be connected with the outer side 1616 of the first resistance pack 1606 to selectively adjust the resistance of the exercise device.

Referring to FIGS. 22A, 34A-34D, and 35A-35B, when placing a resistance pack 874 on the resistance axle 906, the curved inner side 1556 on the center hub 1536 of the resistance pack 874 is first aligned with the curved side 1560 on the resistance axle 906. The resistance pack 874 can then be slid along the length of the resistance axle until the first side 1538 of the resistance pack 874 abuts the outer side 1616 of the first resistance pack 1606 connected with the linearizing cam 1448. To connect the resistance pack 874 with the first resistance pack 1606, the housing 1532 of the resistance pack 874 is rotated relative to the first resistance pack 1606 to bring the hooks 1562 on the outer side 1616 of the first resistance pack into engagement with corresponding hooks 1562 on the first side 1538 of the resistance pack 874. In one embodiment, when connecting a resistance pack on the resistance axle 906 for the right resistance system 870, the resistance pack is rotated 10-15 degrees counterclockwise (as viewed from the right side of the exercise device) to bring the hooks 1562 on the first side 1538 into engagement with the hooks 1562 on the outer side 1616 of the first resistance pack 1606. The slight rotation in the counterclockwise direction stretches the resistance element in the resistance pack, which results in additional pre-loads that maintain engagement of the hooks between the resistance packs. Additional resistance packs can be placed on the resistance axle connected with adjacent resistance packs in the manner described above.

As previously described, the level of resistance on the exercise device is can be adjusted by varying the number of interconnected resistance packs 874 on the resistance axle 906, which in turn are connected with the linearizing cam 1448. When tension is placed on the resistance belt 1442 that causes the linearizing cam 1448 to rotate around the resistance axle 906, the housings 1532, 1610 of the interconnected resistance packs 874, 1606 on the resistance axle 906 rotate along with the linearizing cam 1448. Due to the resilient construction of the resistance elements inside the resistance packs, the resistance force exerted by each resistance pack progressively increases as the linearizing cam rotates. As such, an outer circumferential surface 1618 of the linearizing cam 1448 can be shaped to offset the progressive increase in forces exerted by the resistance packs 874,1606. More particularly, as the resistance belt 1442 unwinds from linearizing cam 1448, a radial distance R1 from a center longitudinal axis 1620 of the resistance axle 906 to a location where the resistance belt separates from the outer surface of the linearizing cam increases. In other words, a first force exerted on the resistance belt 1442 that causes the linearizing cam 1448 to rotate will result in a progressively increasing torque exerted on the linearizing cam as the linearizing cam rotates around the resistance axle 906. As such, although the resistance packs provide a progressively increasing resistance torque as the housings are rotated relative the resistance axle, the progressively increasing torque exerted by the resistance belt on the linearizing cam results in a substantially linear resistance force exerted on the resistance belt. It is to be appreciated that linearizing cams having different outer shapes can be used with the present invention and as such, should not be limited to the shape of the linearizing cam described and depicted herein.

A description of the operation of the components associated with the cable-pulley system and resistance system located on the right and left sides of the exercise device is provided below. Descriptions of rotational directions (i.e. clockwise and counterclockwise) are from a point of reference as viewed from the right side of the exercise device.

When using right side of the exercise device 858, the user applies a force to the resistance cable 1222, pulling the first end 1428 of the resistance cable from the distal end portion 1382 of the right arm assembly 894. The movement of the resistance cable 1222 is guided by the first pulley 1388, second pulley 1390, and lower direction pulley 1432 of the right cable-pulley assembly 898. Because the second end 1434 of the resistance cable 1222 is terminated in the transmission pulley 1436, pulling the first end 1428 of the first resistance cable 1222 from the right arm assembly causes the transmission pulley 1436 of the right resistance system 870 to rotate counterclockwise. Rotation of the transmission pulley in the counterclockwise direction causes the belt pulley 1438 to rotate in the counterclockwise direction. As such, the resistance belt 1442 winds onto the belt pulley 1438. As the resistance belt winds onto the belt pulley, the resistance belt unwinds from the linearizing cam 1448 of the right resistance system 870, which causes the linearizing cam to rotate counterclockwise around the resistance axle 906. The housing 1610 of first resistance pack 1606 rotates with the linearizing cam 1448 along with the housings 1532 of any additional resistance packs 874 that have been interconnected with first resistance pack. As such, the resistance packs provide a resistance force to the resistance belt as the linearizing cam rotates counterclockwise.

When the user releases the resistance cable 1222, the resistance elements 1534, 1612 of the resistance packs 874,1606 of the right resistance system 870 force the housings 1532, 1610 of the resistance packs to rotate around the resistance axle 906 along with the linearizing cam in the clockwise direction. Rotation of the linearizing cam in the clockwise direction unwinds the resistance belt 1442 from the belt pulley 1438, causing the belt pulley and transmission pulley 1436 to rotate clockwise. Rotation of the transmission pulley 1436 in the clockwise direction winds the resistance cable back onto the transmission pulley, which pulls the resistance cable 1222 to retract back into the right arm assembly 894.

When using left side of the exercise device 858, the user applies a force to the resistance cable 1222, pulling the first end 1428 of the resistance cable from the distal end portion 1382 of the left arm assembly 896. The movement of the resistance cable 1222 is guided by the first pulley 1388, second pulley 1434, and lower direction pulley 1432 of the left cable-pulley assembly 900. Because the second end 1434 of the resistance cable 1222 is terminated in the transmission pulley 1436, pulling the first end 1428 of the first resistance cable 1222 from the left arm assembly causes the transmission pulley 1436 of the left resistance system 870 to rotate clockwise. Rotation of the transmission pulley in the clockwise direction causes the belt pulley 1438 to rotate in the clockwise direction. As such, the resistance belt 1442 winds onto the belt pulley 1438. As the resistance belt winds onto the belt pulley, the resistance belt unwinds from the linearizing cam 1448 of the left resistance system 872, which causes the linearizing cam to rotate clockwise around the resistance axle 906. The housing 1610 of first resistance pack 1606 rotates with the linearizing cam 1448 along with the housings 1532 of any additional resistance packs 874 that have been interconnected with first resistance pack. As such, the resistance packs provide a resistance force to the resistance belt as the linearizing cam rotates clockwise.

When the user releases the resistance cable 1222, the resistance elements 1534, 1612 of the resistance packs 874, 1606 of the left resistance system 872 force the housings 1532, 1610 of the resistance packs to rotate around the resistance axle 906 along with the linearizing cam in the counterclockwise direction. Rotation of the linearizing cam in the counterclockwise direction unwinds the resistance belt 1442 from the belt pulley 1438, causing the belt pulley and transmission pulley 1436 to rotate counterclockwise. Rotation of the transmission pulley 1436 in the counterclockwise direction winds the resistance cable back onto the transmission pulley, which pulls the resistance cable 1222 to retract back into the left arm assembly 896.

FIGS. 36A-36F show a second alternative exercise device 1622 conforming to the aspects of the present invention. The second alternative exercise device 1622 is similar to the first alternative exercise device 858. As such, the exercise device 1622 includes a main frame 862' supporting adjustable right and left arm assemblies 894', 896' and right and left cable-pulley assemblies 898', 900' providing a user interface with right and left resistance systems 870', 872'. The level of resistance of the resistance systems 870', 872' can be adjusted in the same manner as described above with the resistance packs 874 of FIGS. 34A-34D. Also, as described above, resistance cables 1222' extend from the right and left arm assemblies 894', 896' to transmission pulleys 1436' of the right and left resistance systems 870', 872'. Further, the right and left resistance systems 870', 872' include resistance belts 1442' extending from belt pulleys 1438' to linearizing cams 1448'. As shown in FIGS. 36A-36F, the resistance systems 870', 872' of the second alternative exercise device 1622 include separate right and left resistance axles 1624, 1626 that are substantially vertically oriented. As such, the routing of the resistance belts of the second alternative exercise device 1622 is oriented differently from the first alternative exercise device 858. More particularly, the right and left resistance systems include first and second directional belt pulleys 1628, 1630 guide the resistance belts from the belt pulleys 1438' to the linearizing cams 1448'.

FIGS. 36A-36F illustrate the cable routing from the right arm assembly 894' to the right resistance system 870'. Various elements of the exercise device 872' are not shown in FIGS. 36C-36F for clarity. The resistance cable 1222' extends through the right arm assembly 894' to the second pulley 1390'. The resistance cable 1222' wraps around a portion of the second pulley 1390' and extends downward inside the arm support member 944' to the lower directional pulley 1432'. From the lower direction pulley 1432', the resistance cable 1222' extends rearward to wrap counterclockwise (as viewed from the right side of the exercise device) around and is terminated on the transmission pulley 1436'. The resistance belt 1442' extends upward and rearward from the belt pulley 1438' to the first directional belt pulley 1628. From the first directional belt pulley 1628, the resistance belt 1442' extends forward to the second directional belt pulley 1630. The first directional belt pulley has a substantially horizontally oriented axis of rotation and the second directional belt pulley has a substantially vertically oriented axis of rotation. The change in orientation of the axes of rotation between the first and second directional belt pulleys causes the resistance belt 1442' to twist as it extends forward from the first directional belt pulley 1628 and change direction as the resistance belt wraps around the second directional belt pulley 1630. As such, the resistance belt 1442' extends rightward from second directional pulley 1630 to connect with the linearizing cam 1448' of the right resistance system 870'.

FIGS. 36A-36F illustrate the cable routing from the left arm assembly 896' to the left resistance system 872'. As previously mentioned, various elements of the exercise device 872' are not shown in FIGS. 36C-36F for clarity. The resistance cable 1222' extends through the left arm assembly 896' to the second pulley 1390'. The resistance cable 1222' wraps around a portion of the second pulley 1390' and extends downward through the arm support member 944' to the lower directional pulley 1432'. From the lower direction pulley 1432', the resistance cable 1222' extends rearward to wrap counterclockwise (as viewed from the right side of the exercise device) around and is terminated on the transmission pulley 1436'. The resistance belt 1442' extends upward and forward from the belt pulley 1438' to the first directional belt pulley 1628. From the first directional belt pulley 1628, the resistance belt 1442' extends rearward to the second directional belt pulley 1630. The first directional belt pulley has a substantially horizontally oriented axis of rotation and the second directional belt pulley has a substantially vertically oriented axis of rotation. The change in orientation of the axes of rotation between the first and second directional belt pulleys causes the resistance belt 1442' to twist as it extends rearward from the first directional belt pulley 1628 and change direction as the resistance belt wraps around the second directional belt pulley 1630. As such, the resistance belt 1442' extends leftward from second directional pulley 1630 to connect with the linearizing cam 1448' of the left resistance system 872'.

Although the various exercise devices described and depicted herein include resistance systems that utilize resistance packs with torsional springs as the source of resistance, it is to be appreciated that the resistance systems on these exercise devices can utilizes other forms of resistance. For example, some embodiments of the exercise devices are configured resistance systems that utilize conventional weight stacks used as the source of resistance. Still other embodiments utilize linear springs or other types of resiliently flexible elements as the source of resistance.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. An exercise device comprising:

a frame;

an arm bi-directionally coupled with the frame through a first axle and a second axle and configured to be manually moved by a user of the exercise device during exercise;

a first securing mechanism adapted to secure the arm in a first position relative to the first axle;

a second securing mechanism adapted to secure the arm in a second position relative to the second axle; and a release mechanism operably coupled with the first and second securing mechanisms and adapted to simultaneously activate the securing mechanisms to move the arm about the first and second axles.

2. The exercise device of claim 1, wherein the first securing mechanism comprises a pop pin.

3. The exercise device of claim 1, wherein the second securing mechanism comprises a pop pin.

4. The exercise device of claim 1, further comprising:

a resistance system supported on the frame; and a cable operably coupling the arm with the resistance system.

5. The exercise device of claim 4, further comprising:

at least one pulley operably coupled with the cable;

a housing rotatably supporting the at least one pulley; and wherein the housing is pivotally connected with the arm through the first axle and wherein the housing is pivotally connected with the frame through the second axle.

6. The exercise device of claim 1, wherein the release mechanism comprises a lever pivotally connected with the arm to pivot relative to the arm to activate the securing mechanisms.

7. The exercise device of claim 1, wherein the release mechanism comprises a handle slidingly connected with the arm.

8. The exercise device of claim 1, further comprising a third securing mechanism adapted to secure the arm in a third position relative to the frame.

9. The exercise device of claim 8, wherein the third securing mechanism comprises a pop pin.

10. The exercise device of claim 8, further comprising a second release mechanism, different from the first release mechanism, operably coupled with the third securing mechanism and adapted to activate the third securing mechanism independently of the first and second securing mechanisms to move the arm to adjust the third position of the arm relative to the frame without moving the arm about the first and second axles.

11. The exercise device of claim 8, wherein the frame includes a rail and the arm is coupled with the frame to move along the rail.

12. The exercise device of claim 11, further comprising a second release mechanism, different from the first release mechanism, operably coupled with the third securing mechanism and adapted to activate the third securing mechanism independently of the first and second securing mechanisms to move the arm to adjust the third position of the arm relative to the rail without moving the arm about the first and second axles.

13. The exercise device of claim 11, wherein the rail comprises an upright member of the frame.

14. The exercise device of claim 13, further comprising a second release mechanism, different from the first release mechanism, operably coupled with the third securing mechanism and adapted to activate the third securing mechanism independently of the first and second securing mechanisms to move the arm to adjust the third position of the arm relative to the upright member without moving the arm about the first and second axles.

15. The exercise device of claim 1, further comprising:

a first cable connecting the release mechanism with the first securing mechanism; and a second cable connecting the release mechanism with the second securing mechanism.

16. The exercise device of claim 1, wherein:

the first securing mechanism comprises a first means for securing the arm in the first position; and the second securing mechanism comprises a second means for securing the arm in the second position.

17. The exercise device of claim 1, wherein movement of the arm about the first axle comprises movement of the arm in a first plane and movement of the arm about the second axle comprises movement of the arm in a second plane different from the first plane.

18. The exercise device of claim 17, wherein the first plane is a horizontal plane and the second plane is a vertical plane.

19. The exercise device of claim 1, wherein each securing mechanism secures the arm independently relative to the respective axle.

20. The exercise device of claim 1, wherein the first securing mechanism is separate and distinct from the second securing mechanism.

21. An exercise device comprising:

a frame;

a resistance system supported on the frame;

a first arm operably coupled with the resistance system and rotatably supported by the frame, the first arm selectively positionable about a first axis of rotation and selectively positionable about a second axis of rotation;

a first securing mechanism adapted to secure the first arm in a first position about the first axis of rotation;

a second securing mechanism adapted to secure the first arm in a second position about the second axis of rotation;

a first release mechanism operably coupled with the first and second securing mechanisms and adapted to simultaneously activate the first and second securing mechanisms to move the first arm about the first and second axes of rotation;

a second arm operably coupled with the resistance system and rotatably supported by the frame, the second arm selectively positionable about a third axis of rotation and selectively positionable about a fourth axis of rotation;

a third securing mechanism adapted to secure the second arm in a third position about the first third of rotation;

a fourth securing mechanism adapted to secure the second arm in a fourth position about the fourth axis of rotation;

a second release mechanism operably coupled with the third and fourth securing mechanisms and adapted to simultaneously activate the third and fourth securing mechanisms to move the second arm about the third and fourth axes of rotation.

22. The exercise device of claim 21, further comprising:

a first cable operably coupling the first arm assembly with the resistance system; and a second cable operably coupling the second arm assembly with the resistance system.

23. The exercise device of claim 21, wherein the first securing mechanism comprises a first pop pin; the second securing mechanism comprises a second pop pin, the third securing mechanism comprises a third pop pin, and the fourth securing mechanism comprises a fourth pop pin.

24. The exercise device of claim 21, wherein:

the first release mechanism is supported by the first arm; and the second release mechanism is supported by the second arm.

25. The exercise device of claim 24, wherein the first release mechanism comprises a first lever that pivots relative to the first arm to activate the first and second securing mechanisms and the second release mechanism comprises a second lever that pivots relative to the second arm to activate the third and fourth securing mechanisms.

26. The exercise device of claim 21, wherein:

movement of the first arm about the first axis of rotation comprises movement of the first arm in a first plane and movement of the first arm about the second axis of rotation comprises movement of the first in a second plane different from the first plane; and movement of the second arm about the third axis of rotation comprises movement of the second arm in a third plane and movement of the second arm about the fourth axis of rotation comprises movement of the second in a fourth plane different from the third plane.

27. The exercise device of claim 26, wherein the first and third planes are horizontal planes and the second and fourth planes are vertical planes.

28. The exercise device of claim 21, wherein:

the first release mechanism is operable independently from the second release mechanism to activate the first and second securing mechanisms to move the first arm about the first and second axes of rotation without activating the third and fourth securing mechanisms to move the second arm about the third and fourth axes of rotation; and the second release mechanism is operable independently from the first release mechanism to activate the third and fourth securing mechanisms to move the second arm about the third and fourth axes of rotation without activating the first and second securing mechanisms to move the first arm about the first and second axes of rotation.

29. The exercise device of claim 21, further comprising:

a fifth securing mechanism adapted to secure the first arm in a fifth position relative to the frame; and a sixth securing mechanism adapted to secure the second arm in a sixth position relative to the frame.

30. The exercise device of claim 29, further comprising:

a third release mechanism, different from the first release mechanism, operably coupled with the fifth securing mechanism and adapted to activate the fifth securing mechanism independently of the first and second securing mechanisms to move the first arm to adjust the fifth position of the first arm relative to the frame without moving the first arm about the first and second axes of rotation; and a fourth release mechanism, different from the second release mechanism, operably coupled with the sixth securing mechanism and adapted to activate the sixth securing mechanism independently of the third and fourth securing mechanisms to move the second arm to adjust the sixth position of the second arm relative to the frame without moving the second arm about the third and fourth axes of rotation.

31. The exercise device of claim 29, wherein the frame includes a first rail and a second rail, the first arm coupled with the frame to move along the first rail and the second arm coupled with the frame to move along the second rail.

32. The exercise device of claim 31, further comprising:

a third release mechanism, different from the first release mechanism, operably coupled with the fifth securing mechanism and adapted to activate the fifth securing mechanism independently of the first and second securing mechanisms to move the first arm to adjust the fifth position of the first arm relative to the frame without moving the first arm about the first and second axes of rotation; and a fourth release mechanism, different from the second release mechanism, operably coupled with the sixth securing mechanism and adapted to activate the sixth securing mechanism independently of the third and fourth securing mechanisms to move the second arm to adjust the sixth position of the second arm relative to the frame without moving the second arm about the third and fourth axes of rotation.

33. The exercise device of claim 31, wherein the first rail comprises a first upright member of the frame and the second rail comprises a second upright member of the frame.

34. The exercise device of claim 33, further comprising:

a third release mechanism, different from the first release mechanism, operably coupled with the fifth securing mechanism and adapted to activate the fifth securing mechanism independently of the first and second securing mechanisms to move the first arm to adjust the fifth position of the first arm relative to the frame without moving the first arm about the first and second axes of rotation; and a fourth release mechanism, different from the second release mechanism, operably coupled with the sixth securing mechanism and adapted to activate the sixth securing mechanism independently of the third and fourth securing mechanisms to move the second arm to adjust the sixth position of the second arm relative to the frame without moving the second arm about the third and fourth axes of rotation.

* * * * *